US009605524B2

(12) United States Patent
Vinegar et al.

(10) Patent No.: US 9,605,524 B2
(45) Date of Patent: Mar. 28, 2017

(54) HEATER PATTERN FOR IN SITU THERMAL PROCESSING OF A SUBSURFACE HYDROCARBON CONTAINING FORMATION

(71) Applicants: Harold Vinegar, Bellaire, TX (US); Scott Nguyen, Houston, TX (US)

(72) Inventors: Harold Vinegar, Bellaire, TX (US); Scott Nguyen, Houston, TX (US)

(73) Assignee: GENIE IP B.V., Amsterdam (NL)

( * ) Notice: Subject to any disclaimer, the term of this patent is extended or adjusted under 35 U.S.C. 154(b) by 0 days.

(21) Appl. No.: 14/373,884

(22) PCT Filed: Oct. 24, 2012

(86) PCT No.: PCT/IB2012/055860

§ 371 (c)(1),
(2) Date: Jul. 22, 2014

(87) PCT Pub. No.: WO2013/110980

PCT Pub. Date: Aug. 1, 2013

(65) Prior Publication Data

US 2015/0027694 A1 Jan. 29, 2015

Related U.S. Application Data

(63) Continuation-in-part of application No. PCT/US2012/022282, filed on Jan. 23, 2012.
(Continued)

(51) Int. Cl.
*E21B 43/30* (2006.01)
*E21B 36/04* (2006.01)
(Continued)

(52) U.S. Cl.
CPC ..... *E21B 43/243* (2013.01); *E21B 36/04* (2013.01); *E21B 43/2401* (2013.01); *E21B 43/30* (2013.01)

(58) Field of Classification Search
CPC ..... E21B 43/2401; E21B 36/04; E21B 43/30
See application file for complete search history.

(56) References Cited

U.S. PATENT DOCUMENTS 5,226,961 A 7/1993 Nahm et al.
5,229,102 A 7/1993 Minet et al.
(Continued)

FOREIGN PATENT DOCUMENTS

WO WO 02086029 A2 * 10/2002 ..... E21B 43/243

*Primary Examiner* — Zakiya W Bates
(74) *Attorney, Agent, or Firm* — Marc Van Dyke; Fourth Dimension IP

(57) ABSTRACT

Embodiments of the present invention relate to heater patterns and related methods of producing hydrocarbon fluids from a subsurface hydrocarbon-containing formation (for example, an oil shale formation) where a heater cell may be divided into nested inner and outer zones. Production wells may be located within one or both zones. In the smaller inner zone, heaters may be arranged at a relatively high spatial density while in the larger surrounding outer zone, a heater spatial density may be significantly lower. Due to the higher heater density, a rate of temperature increase in the smaller inner zone of the subsurface exceeds that of the larger outer zone, and a rate of hydrocarbon fluid production ramps up faster in the inner zone than in the outer zone. In some embodiments, a ratio between a half-maximum sustained production time and a half-maximum rise time of a hydrocarbon fluid production function is relatively large.

19 Claims, 102 Drawing Sheets

Related U.S. Application Data

(60) Provisional application No. 61/704,544, filed on Sep. 23, 2012, provisional application No. 61/706,149, filed on Sep. 27, 2012.

(51) Int. Cl.
*E21B 43/243* (2006.01)
*E21B 43/24* (2006.01)

(56) References Cited

U.S. PATENT DOCUMENTS 5,229,583 A 7/1993 van Egmond et al.
5,236,039 A 8/1993 Edelstein et al.
5,246,071 A 9/1993 Chu
5,255,742 A 10/1993 Mikus
5,258,755 A 11/1993 Kuckes
5,261,490 A 11/1993 Ebinuma
5,284,878 A 2/1994 Studer et al.
5,285,846 A 2/1994 Mohn
5,289,882 A 3/1994 Moore
5,295,763 A 3/1994 Stenborg et al.
5,297,626 A 3/1994 Vinegar et al.
5,305,212 A 4/1994 Kuckes
5,305,239 A 4/1994 Kinra
5,305,829 A 4/1994 Kumar
5,306,640 A 4/1994 Vinegar et al.
5,316,664 A 5/1994 Gregoli et al.
5,318,116 A 6/1994 Vinegar et al.
5,325,918 A 7/1994 Berryman et al.
5,332,036 A 7/1994 Shirley et al.
5,339,897 A 8/1994 Leaute
5,339,904 A 8/1994 Jennings, Jr. et al.
5,340,467 A 8/1994 Gregoli et al.
5,343,152 A 8/1994 Kuckes
5,349,859 A 9/1994 Kleppe
5,360,067 A 11/1994 Meo, III
5,363,094 A 11/1994 Staron et al.
5,366,012 A 11/1994 Lohbeck
5,377,756 A 1/1995 Northrop et al.
5,388,640 A 2/1995 Puri et al.
5,388,641 A 2/1995 Yee et al.
5,388,642 A 2/1995 Puri et al.
5,388,643 A 2/1995 Yee et al.
5,388,645 A 2/1995 Puri et al.
5,391,291 A 2/1995 Winquist et al.
5,392,854 A 2/1995 Vinegar et al.
5,400,430 A 3/1995 Nenniger
5,402,847 A 4/1995 Wilson et al.
5,404,952 A 4/1995 Vinegar et al.
5,409,071 A 4/1995 Wellington et al.
5,411,086 A 5/1995 Burcham et al.
5,411,089 A 5/1995 Vinegar et al.
5,411,104 A 5/1995 Stanley
5,415,231 A 5/1995 Northrop et al.
5,431,224 A 7/1995 Laali
5,433,271 A 7/1995 Vinegar et al.
5,435,666 A 7/1995 Hassett et al.
5,437,506 A 8/1995 Gray
5,439,054 A 8/1995 Chaback et al.
5,454,666 A 10/1995 Chaback et al.
5,456,315 A 10/1995 Kisman et al.
5,485,089 A 1/1996 Kuckes
5,491,969 A 2/1996 Cohn et al.
5,497,087 A 3/1996 Vinegar et al.
5,498,960 A 3/1996 Vinegar et al.
5,512,732 A 4/1996 Yagnik et al.
5,512,830 A 4/1996 Kuckes
5,513,710 A 5/1996 Kuckes
5,515,931 A 5/1996 Kuckes
5,517,593 A 5/1996 Nenniger et al.
5,525,322 A 6/1996 Willms
5,541,517 A 7/1996 Hartmann et al.
5,545,803 A 8/1996 Heath et al.
5,553,189 A 9/1996 Stegemeier et al.
5,554,453 A 9/1996 Steinfeld et al.
5,566,755 A 10/1996 Seidle et al.
5,566,756 A 10/1996 Chaback et al.
5,571,403 A 11/1996 Scott et al.
5,579,575 A 12/1996 Lamome et al.
5,589,775 A 12/1996 Kuckes
5,621,844 A 4/1997 Bridges
5,621,845 A 4/1997 Bridges et al.
5,624,188 A 4/1997 West
5,626,191 A 5/1997 Greaves et al.
5,632,336 A 5/1997 Notz et al.
5,652,389 A 7/1997 Schaps et al.
5,656,239 A 8/1997 Stegemeier et al.
5,657,826 A 8/1997 Kuckes
5,676,212 A 10/1997 Kuckes
5,713,415 A 2/1998 Bridges
5,725,059 A 3/1998 Kuckes et al.
5,747,750 A 5/1998 Bailey et al.
5,751,895 A 5/1998 Bridges
5,759,022 A 6/1998 Koppang et al.
5,760,307 A 6/1998 Latimer et al.
5,767,584 A 6/1998 Gore et al.
5,769,569 A 6/1998 Hosseini
5,777,229 A 7/1998 Geier et al.
5,782,301 A 7/1998 Neuroth et al.
5,802,870 A 9/1998 Arnold et al.
5,826,655 A 10/1998 Snow et al.
5,828,797 A 10/1998 Minott et al.
5,861,137 A 1/1999 Edlund
5,862,858 A 1/1999 Wellington et al.
5,868,202 A 2/1999 Hsu
5,891,829 A 4/1999 Vallejos et al.
5,899,269 A 5/1999 Wellington et al.
5,899,958 A 5/1999 Dowell et al.
5,911,898 A 6/1999 Jacobs et al.
5,923,170 A 7/1999 Kuckes
5,926,437 A 7/1999 Ortiz
5,935,421 A 8/1999 Brons et al.
5,955,039 A 9/1999 Dowdy
5,968,349 A 10/1999 Duyvesteyn et al.
5,984,010 A 11/1999 Elias et al.
5,984,582 A 11/1999 Schwert
5,985,138 A 11/1999 Humphreys
5,997,214 A 12/1999 de Rouffignac et al.
5,999,489 A 12/1999 Lazaratos
6,015,015 A 1/2000 Luft et al.
6,016,867 A 1/2000 Gregoli et al.
6,016,868 A 1/2000 Gregoli et al.
6,019,172 A 2/2000 Wellington et al.
6,023,554 A 2/2000 Vinegar et al.
6,026,914 A 2/2000 Adams et al.
6,035,701 A 3/2000 Lowry et al.
6,039,121 A 3/2000 Kisman
6,049,508 A 4/2000 Deflandre
6,056,057 A 5/2000 Vinegar et al.
6,065,538 A 5/2000 Reimers et al.
6,078,868 A 6/2000 Dubinsky
6,079,499 A 6/2000 Mikus et al.
6,084,826 A 7/2000 Leggett, III
6,085,512 A 7/2000 Agee et al.
6,088,294 A 7/2000 Leggett, III et al.
6,094,048 A 7/2000 Vinegar et al.
6,099,208 A 8/2000 McAlister
6,102,122 A 8/2000 De Rouffignac
6,102,137 A 8/2000 Ward et al.
6,102,622 A 8/2000 Vinegar et al.
6,109,358 A 8/2000 McPhee et al.
6,112,808 A 9/2000 Isted
6,152,987 A 11/2000 Ma et al.
6,155,117 A 12/2000 Stevens et al.
6,172,124 B1 1/2001 Wolflick et al.
6,173,775 B1 1/2001 Elias et al.
6,187,465 B1 2/2001 Galloway
6,192,748 B1 2/2001 Miller
6,193,010 B1 2/2001 Minto
6,196,350 B1 3/2001 Minto
6,209,640 B1 4/2001 Reimers et al.
6,234,259 B1 5/2001 Kuckes et al.
6,244,338 B1 6/2001 Mones
6,257,334 B1 7/2001 Cyr et al.

(56) References Cited

U.S. PATENT DOCUMENTS

| | | | |
|---|---|---|---|
| 6,269,310 | B1 | 7/2001 | Washbourne |
| 6,288,372 | B1 | 9/2001 | Sandberg et al. |
| 6,328,104 | B1 | 12/2001 | Graue |
| 6,353,706 | B1 | 3/2002 | Bridges |
| 6,354,373 | B1 | 3/2002 | Vercaemer et al. |
| 6,357,526 | B1 | 3/2002 | Abdel-Halim et al. |
| 6,388,947 | B1 | 5/2002 | Washbourne et al. |
| 6,389,814 | B2 | 5/2002 | Viteri et al. |
| 6,412,559 | B1 | 7/2002 | Gunter et al. |
| 6,422,318 | B1 | 7/2002 | Rider |
| 6,427,124 | B1 | 7/2002 | Dubinsky et al. |
| 6,429,784 | B1 | 8/2002 | Beique et al. |
| 6,466,020 | B2 | 10/2002 | Kuckes et al. |
| 6,485,232 | B1 | 11/2002 | Vinegar et al. |
| 6,540,018 | B1 | 4/2003 | Vinegar et al. |
| 6,581,684 | B2 | 6/2003 | Wellington et al. |
| 6,584,406 | B1 | 6/2003 | Harmon et al. |
| 6,585,046 | B2 | 7/2003 | Neuroth et al. |
| 6,588,266 | B2 | 7/2003 | Tubel et al. |
| 6,588,503 | B2 | 7/2003 | Karanikas et al. |
| 6,588,504 | B2 | 7/2003 | Wellington et al. |
| 6,591,906 | B2 | 7/2003 | Wellington et al. |
| 6,591,907 | B2 | 7/2003 | Zhang et al. |
| 6,607,033 | B2 | 8/2003 | Wellington et al. |
| 6,609,570 | B2 | 8/2003 | Wellington et al. |
| 6,609,761 | B1 | 8/2003 | Ramey et al. |
| 6,679,326 | B2 | 1/2004 | Zakiewicz |
| 6,679,332 | B2 | 1/2004 | Vinegar et al. |
| 6,684,948 | B1 | 2/2004 | Savage |
| 6,688,387 | B1 | 2/2004 | Wellington et al. |
| 6,698,515 | B2 | 3/2004 | Karanikas et al. |
| 6,702,016 | B2 | 3/2004 | de Rouffignac et al. |
| 6,708,758 | B2 | 3/2004 | de Rouffignac et al. |
| 6,712,135 | B2 | 3/2004 | Wellington et al. |
| 6,712,136 | B2 | 3/2004 | de Rouffignac et al. |
| 6,712,137 | B2 | 3/2004 | Vinegar et al. |
| 6,715,546 | B2 | 4/2004 | Vinegar et al. |
| 6,715,547 | B2 | 4/2004 | Vinegar et al. |
| 6,715,548 | B2 | 4/2004 | Wellington et al. |
| 6,715,549 | B2 | 4/2004 | Wellington et al. |
| 6,719,047 | B2 | 4/2004 | Fowler et al. |
| 6,722,429 | B2 | 4/2004 | de Rouffignac et al. |
| 6,722,430 | B2 | 4/2004 | Vinegar et al. |
| 6,722,431 | B2 | 4/2004 | Karanikas et al. |
| 6,725,920 | B2 | 4/2004 | Zhang et al. |
| 6,725,921 | B2 | 4/2004 | de Rouffignac et al. |
| 6,725,928 | B2 | 4/2004 | Vinegar et al. |
| 6,729,395 | B2 | 5/2004 | Shahin et al. |
| 6,729,396 | B2 | 5/2004 | Vinegar et al. |
| 6,729,397 | B2 | 5/2004 | Zhang et al. |
| 6,729,401 | B2 | 5/2004 | Vinegar et al. |
| 6,732,794 | B2 | 5/2004 | Wellington et al. |
| 6,732,795 | B2 | 5/2004 | de Rouffignac et al. |
| 6,732,796 | B2 | 5/2004 | Vinegar et al. |
| 6,736,215 | B2 | 5/2004 | Maher et al. |
| 6,739,393 | B2 | 5/2004 | Vinegar et al. |
| 6,739,394 | B2 | 5/2004 | Vinegar et al. |
| 6,742,587 | B2 | 6/2004 | Vinegar et al. |
| 6,742,588 | B2 | 6/2004 | Wellington et al. |
| 6,742,589 | B2 | 6/2004 | Berchenko et al. |
| 6,742,593 | B2 | 6/2004 | Vinegar et al. |
| 6,745,831 | B2 | 6/2004 | de Rouffignac et al. |
| 6,745,832 | B2 | 6/2004 | Wellington et al. |
| 6,745,837 | B2 | 6/2004 | Wellington et al. |
| 6,749,021 | B2 | 6/2004 | Vinegar et al. |
| 6,752,210 | B2 | 6/2004 | de Rouffignac et al. |
| 6,758,268 | B2 | 7/2004 | Vinegar et al. |
| 6,761,216 | B2 | 7/2004 | Vinegar et al. |
| 6,763,886 | B2 | 7/2004 | Schoeling et al. |
| 6,769,483 | B2 | 8/2004 | de Rouffignac et al. |
| 6,769,485 | B2 | 8/2004 | Vinegar et al. |
| 6,782,947 | B2 | 8/2004 | de Rouffignac et al. |
| 6,805,194 | B2 | 10/2004 | Davidson et al. |
| 6,805,195 | B2 | 10/2004 | Vinegar et al. |
| 6,820,688 | B2 | 11/2004 | Vinegar et al. |
| 6,854,534 | B2 | 2/2005 | Livingstone |
| 6,854,929 | B2 | 2/2005 | Vinegar et al. |
| 6,866,097 | B2 | 3/2005 | Vinegar et al. |
| 6,871,707 | B2 | 3/2005 | Karanikas et al. |
| 6,877,554 | B2 | 4/2005 | Stegemeier et al. |
| 6,877,555 | B2 | 4/2005 | Karanikas et al. |
| 6,880,633 | B2 | 4/2005 | Wellington et al. |
| 6,880,635 | B2 | 4/2005 | Vinegar et al. |
| 6,910,537 | B2 | 6/2005 | Brown et al. |
| 6,913,079 | B2 | 7/2005 | Tubel |
| 6,918,443 | B2 | 7/2005 | Wellington et al. |
| 6,918,444 | B2 | 7/2005 | Passey et al. |
| 6,923,257 | B2 | 8/2005 | Wellington et al. |
| 6,923,258 | B2 | 8/2005 | Wellington et al. |
| 6,929,067 | B2 | 8/2005 | Vinegar et al. |
| 6,932,155 | B2 | 8/2005 | Vinegar et al. |
| 6,942,037 | B1 | 9/2005 | Arnold et al. |
| 6,948,562 | B2 | 9/2005 | Wellington et al. |
| 6,948,563 | B2 | 9/2005 | Wellington et al. |
| 6,951,247 | B2 | 10/2005 | de Rouffignac et al. |
| 6,951,250 | B2 | 10/2005 | Reddy et al. |
| 6,953,087 | B2 | 10/2005 | de Rouffignac et al. |
| 6,958,704 | B2 | 10/2005 | Vinegar et al. |
| 6,959,761 | B2 | 11/2005 | Berchenko et al. |
| 6,964,300 | B2 | 11/2005 | Vinegar et al. |
| 6,966,372 | B2 | 11/2005 | Wellington et al. |
| 6,966,374 | B2 | 11/2005 | Vinegar et al. |
| 6,969,123 | B2 | 11/2005 | Vinegar et al. |
| 6,973,967 | B2 | 12/2005 | Wellington et al. |
| 6,981,548 | B2 | 1/2006 | Wellington et al. |
| 6,981,553 | B2 | 1/2006 | Stegemeier et al. |
| 6,991,032 | B2 | 1/2006 | Berchenko et al. |
| 6,991,033 | B2 | 1/2006 | Wellington et al. |
| 6,991,045 | B2 | 1/2006 | Vinegar et al. |
| 6,994,169 | B2 | 2/2006 | Zhang et al. |
| 6,997,518 | B2 | 2/2006 | Vinegar et al. |
| 7,004,247 | B2 | 2/2006 | Cole et al. |
| 7,032,660 | B2 | 4/2006 | Vinegar et al. |
| 7,040,400 | B2 | 5/2006 | de Rouffignac et al. |
| 7,048,051 | B2 | 5/2006 | McQueen |
| 7,055,600 | B2 | 6/2006 | Messier et al. |
| 7,063,145 | B2 | 6/2006 | Veenstra et al. |
| 7,066,254 | B2 | 6/2006 | Vinegar et al. |
| 7,066,257 | B2 | 6/2006 | Wellington et al. |
| 7,073,578 | B2 | 7/2006 | Vinegar et al. |
| 7,086,465 | B2 | 8/2006 | Wellington et al. |
| 7,086,468 | B2 | 8/2006 | de Rouffignac et al. |
| 7,090,013 | B2 | 8/2006 | Wellington |
| 7,096,941 | B2 | 8/2006 | de Rouffignac et al. |
| 7,096,942 | B1 | 8/2006 | de Rouffignac et al. |
| 7,096,953 | B2 | 8/2006 | de Rouffignac et al. |
| 7,100,994 | B2 | 9/2006 | Vinegar et al. |
| 7,104,319 | B2 | 9/2006 | Vinegar et al. |
| 7,114,566 | B2 | 10/2006 | Vinegar et al. |
| 7,121,341 | B2 | 10/2006 | Vinegar et al. |
| 7,121,342 | B2 | 10/2006 | Vinegar et al. |
| 7,128,153 | B2 | 10/2006 | Vinegar et al. |
| 7,147,057 | B2 | 12/2006 | Steele et al. |
| 7,147,059 | B2 | 12/2006 | Hirsch et al. |
| 7,156,176 | B2 | 1/2007 | Vinegar et al. |
| 7,165,615 | B2 | 1/2007 | Vinegar et al. |
| 7,170,424 | B2 | 1/2007 | Vinegar et al. |
| 7,204,327 | B2 | 4/2007 | Livingstone |
| 7,219,734 | B2 | 5/2007 | Bai et al. |
| 7,225,866 | B2 | 6/2007 | Berchenko et al. |
| 7,320,364 | B2 | 1/2008 | Fairbanks et al. |
| 7,353,872 | B2 | 4/2008 | Sandberg et al. |
| 7,357,180 | B2 | 4/2008 | Vinegar et al. |
| 7,360,588 | B2 | 4/2008 | Vinegar et al. |
| 7,370,704 | B2 | 5/2008 | Harris et al. |
| 7,383,877 | B2 | 6/2008 | Vinegar et al. |
| 7,424,915 | B2 | 9/2008 | Vinegar |
| 7,431,076 | B2 | 10/2008 | Sandberg et al. |
| 7,435,037 | B2 | 10/2008 | McKinzie, II et al. |
| 7,461,691 | B2 | 12/2008 | Vinegar et al. |
| 7,481,274 | B2 | 1/2009 | Vinegar et al. |
| 7,490,665 | B2 | 2/2009 | Sandberg et al. |
| 7,500,528 | B2 | 3/2009 | McKinzie et al. |
| 7,510,000 | B2 | 3/2009 | Pastor-Sanz et al. |

(56) References Cited

U.S. PATENT DOCUMENTS

| | | | |
|---|---|---|---|
| 7,527,094 | B2 | 5/2009 | McKinzie et al. |
| 2001/0033164 | A1 | 10/2001 | Vinegar et al. |
| 2002/0003988 | A1 | 1/2002 | Mikus et al. |
| 2002/0018697 | A1 | 2/2002 | Vinegar et al. |
| 2002/0027001 | A1 | 3/2002 | Wellington et al. |
| 2002/0029881 | A1 | 3/2002 | de Rouffignac et al. |
| 2002/0029882 | A1 | 3/2002 | Rouffignac et al. |
| 2002/0029883 | A1 | 3/2002 | Vinegar et al. |
| 2002/0029884 | A1 | 3/2002 | de Rouffignac et al. |
| 2002/0029885 | A1 | 3/2002 | de Rouffignac et al. |
| 2002/0033253 | A1 | 3/2002 | Rouffignac et al. |
| 2002/0033254 | A1 | 3/2002 | Karanikas et al. |
| 2002/0033255 | A1 | 3/2002 | Fowler et al. |
| 2002/0033256 | A1 | 3/2002 | Wellington et al. |
| 2002/0033257 | A1 | 3/2002 | Shahin, Jr. et al. |
| 2002/0033280 | A1 | 3/2002 | Schoeling et al. |
| 2002/0034380 | A1 | 3/2002 | Maher et al. |
| 2002/0035307 | A1 | 3/2002 | Vinegar et al. |
| 2002/0036083 | A1 | 3/2002 | de Rouffignac et al. |
| 2002/0036084 | A1 | 3/2002 | Vinegar et al. |
| 2002/0036085 | A1 | 3/2002 | Bass et al. |
| 2002/0036089 | A1 | 3/2002 | Vinegar et al. |
| 2002/0036103 | A1 | 3/2002 | Rouffignac et al. |
| 2002/0038069 | A1 | 3/2002 | Wellington et al. |
| 2002/0038705 | A1 | 4/2002 | Wellington et al. |
| 2002/0038706 | A1 | 4/2002 | Zhang et al. |
| 2002/0038708 | A1 | 4/2002 | Wellington et al. |
| 2002/0038709 | A1 | 4/2002 | Wellington et al. |
| 2002/0038710 | A1 | 4/2002 | Maher et al. |
| 2002/0038711 | A1 | 4/2002 | Rouffignac et al. |
| 2002/0038712 | A1 | 4/2002 | Vinegar et al. |
| 2002/0039486 | A1 | 4/2002 | Rouffignac et al. |
| 2002/0040173 | A1 | 4/2002 | Rouffignac et al. |
| 2002/0040177 | A1 | 4/2002 | Maher et al. |
| 2002/0040778 | A1 | 4/2002 | Wellington et al. |
| 2002/0040779 | A1 | 4/2002 | Wellington et al. |
| 2002/0040780 | A1 | 4/2002 | Wellington et al. |
| 2002/0040781 | A1 | 4/2002 | Keedy et al. |
| 2002/0043365 | A1 | 4/2002 | Berchenko et al. |
| 2002/0043366 | A1 | 4/2002 | Wellington et al. |
| 2002/0043367 | A1 | 4/2002 | Rouffignac et al. |
| 2002/0043369 | A1 | 4/2002 | Vinegar et al. |
| 2002/0043405 | A1 | 4/2002 | Vinegar et al. |
| 2002/0045553 | A1 | 4/2002 | Vinegar et al. |
| 2002/0046832 | A1 | 4/2002 | Zhang et al. |
| 2002/0046837 | A1 | 4/2002 | Wellington et al. |
| 2002/0046838 | A1 | 4/2002 | Karanikas et al. |
| 2002/0046839 | A1 | 4/2002 | Vinegar et al. |
| 2002/0046883 | A1 | 4/2002 | Wellington et al. |
| 2002/0049358 | A1 | 4/2002 | Vinegar et al. |
| 2002/0049360 | A1 | 4/2002 | Wellington et al. |
| 2002/0050352 | A1 | 5/2002 | Wellington et al. |
| 2002/0050353 | A1 | 5/2002 | Berchenko et al. |
| 2002/0050356 | A1 | 5/2002 | Vinegar et al. |
| 2002/0050357 | A1 | 5/2002 | Wellington et al. |
| 2002/0052297 | A1 | 5/2002 | Rouffignac et al. |
| 2002/0053429 | A1 | 5/2002 | Stegemeier et al. |
| 2002/0053431 | A1 | 5/2002 | Wellington et al. |
| 2002/0053432 | A1 | 5/2002 | Berchenko et al. |
| 2002/0053435 | A1 | 5/2002 | Vinegar et al. |
| 2002/0053436 | A1 | 5/2002 | Vinegar et al. |
| 2002/0056551 | A1 | 5/2002 | Wellington et al. |
| 2002/0056552 | A1 | 5/2002 | Wellington et al. |
| 2002/0057905 | A1 | 5/2002 | Wellington et al. |
| 2002/0062051 | A1 | 5/2002 | Wellington et al. |
| 2002/0062052 | A1 | 5/2002 | Rouffignac et al. |
| 2002/0062959 | A1 | 5/2002 | Wellington et al. |
| 2002/0062961 | A1 | 5/2002 | Vinegar et al. |
| 2002/0066565 | A1 | 6/2002 | Rouffignac et al. |
| 2002/0074117 | A1 | 6/2002 | Shahin, Jr. et al. |
| 2002/0076212 | A1 | 6/2002 | Zhang et al. |
| 2002/0077515 | A1 | 6/2002 | Wellington et al. |
| 2002/0084074 | A1 | 7/2002 | de Rouffignac et al. |
| 2002/0096320 | A1 | 7/2002 | Wellington et al. |
| 2002/0104654 | A1 | 8/2002 | Vinegar et al. |
| 2002/0108753 | A1 | 8/2002 | Vinegar et al. |
| 2002/0117303 | A1 | 8/2002 | Vinegar et al. |
| 2002/0121366 | A1 | 9/2002 | Bass et al. |
| 2002/0126021 | A1 | 9/2002 | Vinegar et al. |
| 2002/0132862 | A1 | 9/2002 | Vinegar et al. |
| 2002/0170708 | A1 | 11/2002 | Vinegar et al. |
| 2002/0191968 | A1 | 12/2002 | Vinegar et al. |
| 2002/0191969 | A1 | 12/2002 | Wellington et al. |
| 2003/0006039 | A1 | 1/2003 | Zhang et al. |
| 2003/0019626 | A1 | 1/2003 | Vinegar et al. |
| 2003/0024699 | A1 | 2/2003 | Vinegar et al. |
| 2003/0024704 | A1 | 2/2003 | Hirsch et al. |
| 2003/0038734 | A1 | 2/2003 | Hirsch et al. |
| 2003/0042016 | A1 | 3/2003 | Vinegar et al. |
| 2003/0042026 | A1 | 3/2003 | Vinegar et al. |
| 2003/0048697 | A1 | 3/2003 | Hirsch et al. |
| 2003/0051872 | A1 | 3/2003 | de Rouffignac et al. |
| 2003/0051881 | A1 | 3/2003 | Vinegar et al. |
| 2003/0056952 | A1 | 3/2003 | Stegemeier et al. |
| 2003/0062154 | A1 | 4/2003 | Vinegar et al. |
| 2003/0062164 | A1 | 4/2003 | Wellington et al. |
| 2003/0066642 | A1 | 4/2003 | Wellington et al. |
| 2003/0066644 | A1 | 4/2003 | Karanikas et al. |
| 2003/0066652 | A1 | 4/2003 | Stegemeier et al. |
| 2003/0066671 | A1 | 4/2003 | Vinegar et al. |
| 2003/0070807 | A1 | 4/2003 | Wellington et al. |
| 2003/0075318 | A1 | 4/2003 | Keedy et al. |
| 2003/0079877 | A1 | 5/2003 | Wellington et al. |
| 2003/0080604 | A1 | 5/2003 | Vinegar et al. |
| 2003/0085034 | A1 | 5/2003 | Wellington et al. |
| 2003/0098149 | A1 | 5/2003 | Wellington et al. |
| 2003/0098605 | A1 | 5/2003 | Vinegar et al. |
| 2003/0100451 | A1 | 5/2003 | Messier et al. |
| 2003/0102124 | A1 | 6/2003 | Vinegar et al. |
| 2003/0102125 | A1 | 6/2003 | Wellington et al. |
| 2003/0102126 | A1 | 6/2003 | Sumnu-Dindoruk et al. |
| 2003/0102130 | A1 | 6/2003 | Vinegar et al. |
| 2003/0110794 | A1 | 6/2003 | Stegemeier et al. |
| 2003/0111223 | A1 | 6/2003 | Rouffignac et al. |
| 2003/0116315 | A1 | 6/2003 | Wellington et al. |
| 2003/0130136 | A1 | 7/2003 | Rouffignac et al. |
| 2003/0131993 | A1 | 7/2003 | Zhang et al. |
| 2003/0131994 | A1 | 7/2003 | Vinegar et al. |
| 2003/0131995 | A1 | 7/2003 | de Rouffignac et al. |
| 2003/0131996 | A1 | 7/2003 | Vinegar et al. |
| 2003/0136558 | A1 | 7/2003 | Wellington et al. |
| 2003/0136559 | A1 | 7/2003 | Wellington et al. |
| 2003/0137181 | A1 | 7/2003 | Wellington et al. |
| 2003/0141065 | A1 | 7/2003 | Karanikas et al. |
| 2003/0141066 | A1 | 7/2003 | Karanikas et al. |
| 2003/0141067 | A1 | 7/2003 | Rouffignac et al. |
| 2003/0141068 | A1 | 7/2003 | de Rouffignac et al. |
| 2003/0142964 | A1 | 7/2003 | Wellington et al. |
| 2003/0146002 | A1 | 8/2003 | Vinegar et al. |
| 2003/0148894 | A1 | 8/2003 | Vinegar et al. |
| 2003/0155111 | A1 | 8/2003 | Vinegar et al. |
| 2003/0164234 | A1 | 9/2003 | de Rouffignac et al. |
| 2003/0164238 | A1 | 9/2003 | Vinegar et al. |
| 2003/0164239 | A1 | 9/2003 | Wellington et al. |
| 2003/0164240 | A1 | 9/2003 | Vinegar et al. |
| 2003/0173072 | A1 | 9/2003 | Vinegar et al. |
| 2003/0173078 | A1 | 9/2003 | Wellington et al. |
| 2003/0173080 | A1 | 9/2003 | Berchenko et al. |
| 2003/0173081 | A1 | 9/2003 | Vinegar et al. |
| 2003/0173082 | A1 | 9/2003 | Vinegar et al. |
| 2003/0173085 | A1 | 9/2003 | Vinegar et al. |
| 2003/0178191 | A1 | 9/2003 | Maher et al. |
| 2003/0183390 | A1 | 10/2003 | Veenstra et al. |
| 2003/0192691 | A1 | 10/2003 | Vinegar et al. |
| 2003/0192693 | A1 | 10/2003 | Wellington |
| 2003/0196788 | A1 | 10/2003 | Vinegar et al. |
| 2003/0196789 | A1 | 10/2003 | Wellington et al. |
| 2003/0196801 | A1 | 10/2003 | Vinegar et al. |
| 2003/0196810 | A1 | 10/2003 | Vinegar et al. |
| 2003/0201098 | A1 | 10/2003 | Karanikas et al. |
| 2003/0205378 | A1 | 11/2003 | Wellington et al. |
| 2003/0209348 | A1 | 11/2003 | Ward et al. |
| 2003/0213594 | A1 | 11/2003 | Wellington et al. |
| 2003/0227393 | A1 | 12/2003 | Vinegar et al. |

(56) References Cited

U.S. PATENT DOCUMENTS

| | | | |
|---|---|---|---|
| 2004/0015023 | A1 | 1/2004 | Wellington et al. |
| 2004/0020642 | A1 | 2/2004 | Vinegar et al. |
| 2004/0040715 | A1 | 3/2004 | Wellington et al. |
| 2004/0060703 | A1 | 4/2004 | Stegemeier et al. |
| 2004/0069486 | A1 | 4/2004 | Vinegar et al. |
| 2004/0079524 | A1 | 4/2004 | Bass et al. |
| 2004/0108111 | A1 | 6/2004 | Vinegar et al. |
| 2004/0120771 | A1 | 6/2004 | Vinegar et al. |
| 2004/0120772 | A1 | 6/2004 | Vinegar et al. |
| 2004/0126190 | A1 | 7/2004 | Stegemeier et al. |
| 2004/0140095 | A1 | 7/2004 | Vinegar et al. |
| 2004/0140096 | A1 | 7/2004 | Sandberg et al. |
| 2004/0144530 | A1 | 7/2004 | Bass et al. |
| 2004/0144540 | A1 | 7/2004 | Sandberg et al. |
| 2004/0144541 | A1 | 7/2004 | Picha et al. |
| 2004/0145969 | A1 | 7/2004 | Bai et al. |
| 2004/0146288 | A1 | 7/2004 | Vinegar et al. |
| 2004/0177966 | A1 | 9/2004 | Vinegar et al. |
| 2004/0211554 | A1 | 10/2004 | Vinegar et al. |
| 2004/0211569 | A1 | 10/2004 | Vinegar et al. |
| 2004/0228688 | A1 | 11/2004 | Stegemeier et al. |
| 2004/0228689 | A1 | 11/2004 | Stegemeier et al. |
| 2004/0228690 | A1 | 11/2004 | Stegemeier et al. |
| 2004/0263350 | A1 | 12/2004 | Vinegar et al. |
| 2005/0006097 | A1 | 1/2005 | Sandberg et al. |
| 2005/0051327 | A1 | 3/2005 | Vinegar et al. |
| 2005/0092483 | A1 | 5/2005 | Vinegar et al. |
| 2005/0111917 | A1 | 5/2005 | Vinegar et al. |
| 2005/0269088 | A1 | 12/2005 | Vinegar et al. |
| 2005/0269089 | A1 | 12/2005 | Sandberg et al. |
| 2005/0269090 | A1 | 12/2005 | Vinegar et al. |
| 2005/0269091 | A1 | 12/2005 | Pastor-Sanz et al. |
| 2005/0269092 | A1 | 12/2005 | Vinegar |
| 2005/0269093 | A1 | 12/2005 | Sandberg et al. |
| 2005/0269095 | A1 | 12/2005 | Fairbanks et al. |
| 2005/0269313 | A1 | 12/2005 | Vinegar et al. |
| 2006/0005968 | A1 | 1/2006 | Vinegar et al. |
| 2006/0213657 | A1 | 9/2006 | Berchenko et al. |
| 2006/0289536 | A1 | 12/2006 | Vinegar |
| 2007/0000662 | A1 | 1/2007 | Symington et al. |
| 2007/0045265 | A1 | 3/2007 | McKinzie et al. |
| 2007/0045266 | A1 | 3/2007 | Sandberg et al. |
| 2007/0045267 | A1 | 3/2007 | Vinegar et al. |
| 2007/0045268 | A1 | 3/2007 | Vinegar et al. |
| 2007/0095536 | A1 | 5/2007 | Vinegar et al. |
| 2007/0095537 | A1 | 5/2007 | Vinegar |
| 2007/0108201 | A1 | 5/2007 | Vinegar et al. |
| 2007/0127897 | A1 | 6/2007 | John et al. |
| 2007/0131411 | A1 | 6/2007 | Vinegar et al. |
| 2007/0131415 | A1 | 6/2007 | Vinegar et al. |
| 2007/0131427 | A1 | 6/2007 | Li et al. |
| 2007/0133959 | A1 | 6/2007 | Vinegar et al. |
| 2007/0133960 | A1 | 6/2007 | Vinegar et al. |
| 2007/0133961 | A1 | 6/2007 | Fairbanks et al. |
| 2007/0137852 | A1 | 6/2007 | Considine et al. |
| 2007/0137856 | A1 | 6/2007 | McKinzie et al. |
| 2007/0137857 | A1 | 6/2007 | Vinegar et al. |
| 2007/0137858 | A1 | 6/2007 | Considine et al. |
| 2007/0144732 | A1 | 6/2007 | Kim et al. |
| 2007/0193743 | A1 | 8/2007 | Harris et al. |
| 2007/0199698 | A1 | 8/2007 | Hocking |
| 2007/0209799 | A1 | 9/2007 | Vinegar et al. |
| 2007/0221377 | A1 | 9/2007 | Vinegar et al. |
| 2007/0289733 | A1 | 12/2007 | Hinson et al. |
| 2008/0017370 | A1 | 1/2008 | Vinegar et al. |
| 2008/0017380 | A1 | 1/2008 | Vinegar et al. |
| 2008/0038144 | A1 | 2/2008 | Maziasz et al. |
| 2008/0073079 | A1 | 3/2008 | Tranquilla et al. |
| 2008/0087420 | A1 | 4/2008 | Kaminsky et al. |
| 2008/0087421 | A1 | 4/2008 | Kaminsky |
| 2008/0087426 | A1 | 4/2008 | Kaminsky |
| 2008/0087427 | A1 | 4/2008 | Kaminsky et al. |
| 2008/0087428 | A1 | 4/2008 | Symington et al. |
| 2008/0107577 | A1 | 5/2008 | Vinegar et al. |
| 2008/0128134 | A1 | 6/2008 | Mudunuri et al. |
| 2008/0135244 | A1 | 6/2008 | Miller |
| 2008/0135253 | A1 | 6/2008 | Vinegar et al. |
| 2008/0135254 | A1 | 6/2008 | Vinegar et al. |
| 2008/0142216 | A1 | 6/2008 | Vinegar et al. |
| 2008/0173442 | A1 | 7/2008 | Vinegar et al. |
| 2008/0173450 | A1 | 7/2008 | Goldberg et al. |
| 2008/0185147 | A1 | 8/2008 | Vinegar et al. |
| 2008/0207970 | A1 | 8/2008 | Meurer et al. |
| 2008/0217003 | A1 | 9/2008 | Kuhlman et al. |
| 2008/0217004 | A1 | 9/2008 | de Rouffignac et al. |
| 2008/0217015 | A1 | 9/2008 | Vinegar et al. |
| 2008/0217016 | A1 | 9/2008 | Stegemeier et al. |
| 2008/0217321 | A1 | 9/2008 | Vinegar et al. |
| 2008/0314593 | A1 | 12/2008 | Vinegar et al. |
| 2009/0014180 | A1 | 1/2009 | Stegemeier et al. |
| 2009/0014181 | A1 | 1/2009 | Vinegar et al. |
| 2009/0071647 | A1 | 3/2009 | Vinegar et al. |
| 2009/0071652 | A1 | 3/2009 | Vinegar |
| 2009/0090509 | A1 | 4/2009 | Vinegar et al. |
| 2009/0095476 | A1 | 4/2009 | Nguyen et al. |
| 2009/0095477 | A1 | 4/2009 | Nguyen et al. |
| 2009/0095478 | A1 | 4/2009 | Karanikas et al. |
| 2009/0095479 | A1 | 4/2009 | Karanikas et al. |
| 2009/0095480 | A1 | 4/2009 | Vinegar et al. |
| 2009/0101346 | A1 | 4/2009 | Vinegar et al. |
| 2009/0101348 | A1 | 4/2009 | Kaminsky |
| 2009/0107679 | A1 | 4/2009 | Kaminsky |
| 2009/0120646 | A1 | 5/2009 | Kim et al. |
| 2009/0126929 | A1 | 5/2009 | Vinegar |
| 2009/0145598 | A1 | 6/2009 | Symington et al. |
| 2009/0159277 | A1 | 6/2009 | Hocking |
| 2009/0194269 | A1 | 8/2009 | Vinegar |
| 2009/0194286 | A1 | 8/2009 | Mason |
| 2009/0194287 | A1 | 8/2009 | Nguyen et al. |
| 2009/0194524 | A1 | 8/2009 | Kim |
| 2009/0200022 | A1 | 8/2009 | Bravo et al. |
| 2009/0200023 | A1 | 8/2009 | Costello et al. |
| 2009/0200025 | A1 | 8/2009 | Bravo |
| 2009/0200031 | A1 | 8/2009 | Miller et al. |
| 2009/0200854 | A1 | 8/2009 | Vinegar |
| 2009/0321075 | A1 | 12/2009 | Harris et al. |
| 2010/0071903 | A1 | 3/2010 | Prince-Wright et al. |
| 2010/0089585 | A1 | 4/2010 | Kaminsky |
| 2010/0096137 | A1 | 4/2010 | Nguyen et al. |
| 2010/0101783 | A1 | 4/2010 | Vinegar et al. |
| 2010/0101784 | A1 | 4/2010 | Vinegar et al. |
| 2010/0101794 | A1 | 4/2010 | Ryan |
| 2010/0108310 | A1 | 5/2010 | Fowler et al. |
| 2010/0108379 | A1 | 5/2010 | Edbury et al. |
| 2010/0126727 | A1 | 5/2010 | Vinegar et al. |
| 2010/0147521 | A1 | 6/2010 | Xie et al. |
| 2010/0147522 | A1 | 6/2010 | Xie et al. |
| 2010/0163227 | A1 | 7/2010 | Tranquilla et al. |
| 2010/0181066 | A1 | 7/2010 | Vinegar et al. |
| 2010/0206570 | A1 | 8/2010 | Ocampos et al. |
| 2010/0258265 | A1 | 10/2010 | Karanikas et al. |
| 2010/0258309 | A1 | 10/2010 | Ayodele et al. |
| 2010/0270015 | A1 | 10/2010 | Vinegar et al. |
| 2010/0272595 | A1 | 10/2010 | Maziasz et al. |
| 2010/0288497 | A1 | 11/2010 | Burnham et al. |
| 2010/0319909 | A1 | 12/2010 | Symington et al. |
| 2011/0042084 | A1 | 2/2011 | Bos et al. |
| 2011/0088904 | A1 | 4/2011 | de Rouffignac et al. |
| 2011/0132600 | A1 | 6/2011 | Kaminsky et al. |
| 2011/0146982 | A1 | 6/2011 | Kaminsky et al. |
| 2011/0168394 | A1 | 7/2011 | Roes et al. |
| 2011/0170843 | A1 | 7/2011 | Vinegar et al. |
| 2011/0174496 | A1 | 7/2011 | Burnham et al. |
| 2011/0186295 | A1 | 8/2011 | Kaminsky et al. |
| 2011/0247802 | A1 | 10/2011 | Deeg et al. |
| 2011/0247819 | A1 | 10/2011 | Nguyen et al. |
| 2011/0259590 | A1 | 10/2011 | Burnham et al. |
| 2011/0259591 | A1 | 10/2011 | Vinegar |
| 2011/0303413 | A1 | 12/2011 | Fairbanks et al. |
| 2012/0048545 | A1 | 3/2012 | Kaminsky |
| 2012/0085535 | A1 | 4/2012 | Mo et al. |
| 2012/0193099 | A1 | 8/2012 | Vinegar et al. |
| 2012/0255730 | A1 | 10/2012 | Daub et al. |
| 2012/0273190 | A1 | 11/2012 | Thomas et al. |

(56) References Cited

U.S. PATENT DOCUMENTS

| | | | |
|---|---|---|---|
| 2012/0325458 | A1 | 12/2012 | El-Rabaa et al. |
| 2013/0008660 | A1 | 1/2013 | de Rouffignac et al. |
| 2013/0043029 | A1 | 2/2013 | Vinegar et al. |
| 2013/0056210 | A1 | 3/2013 | Vinegar et al. |
| 2013/0068462 | A1 | 3/2013 | Pantano |
| 2013/0087327 | A1 | 4/2013 | Nguyen et al. |
| 2013/0087551 | A1 | 4/2013 | De St. Remey et al. |
| 2013/0106117 | A1 | 5/2013 | Sites |
| 2013/0112403 | A1 | 5/2013 | Meurer et al. |
| 2013/0161001 | A1 | 6/2013 | Wigand et al. |
| 2013/0199781 | A1 | 8/2013 | Dale et al. |
| 2013/0199787 | A1 | 8/2013 | Dale et al. |
| 2013/0199789 | A1 | 8/2013 | Liang et al. |
| 2013/0206412 | A1 | 8/2013 | Dale et al. |
| 2013/0206748 | A1 | 8/2013 | Vinegar et al. |
| 2013/0211807 | A1 | 8/2013 | Templeton-Barrett et al. |
| 2013/0264058 | A1 | 10/2013 | Fowler |
| 2013/0269935 | A1 | 10/2013 | Cao et al. |
| 2013/0292114 | A1 | 11/2013 | Lin et al. |
| 2013/0313160 | A1 | 11/2013 | Wigand et al. |
| 2013/0333878 | A1 | 12/2013 | Stone, Jr. et al. |
| 2014/0027119 | A1 | 1/2014 | de Rouffignac et al. |
| 2014/0182843 | A1 | 7/2014 | Vinegar |
| 2014/0190691 | A1 | 7/2014 | Vinegar et al. |
| 2014/0231070 | A1 | 8/2014 | Vinegar et al. |
| 2014/0305640 | A1 | 10/2014 | Wellington et al. |
| 2015/0027694 | A1 | 1/2015 | Vinegar et al. |
| 2015/0101814 | A1 | 4/2015 | Vinegar et al. |
| 2015/0168588 | A1 | 6/2015 | Vinegar et al. |
| 2015/0176380 | A1 | 6/2015 | Vinegar et al. |
| 2015/0184500 | A1 | 7/2015 | Vinegar et al. |
| 2015/0203776 | A1 | 7/2015 | Vinegar et al. |
| 2015/0210917 | A1 | 7/2015 | Vinegar et al. |
| 2015/0260023 | A1 | 9/2015 | Nguyen et al. |
| 2015/0260024 | A1 | 9/2015 | Nguyen et al. |
| 2015/0285032 | A1 | 10/2015 | Vinegar et al. |
| 2015/0292309 | A1 | 10/2015 | Vinegar et al. |
| 2015/0329785 | A1 | 11/2015 | Vinegar et al. |

* cited by examiner

● = heater 220

X = production well 224

• = heater 220

X = production well 224

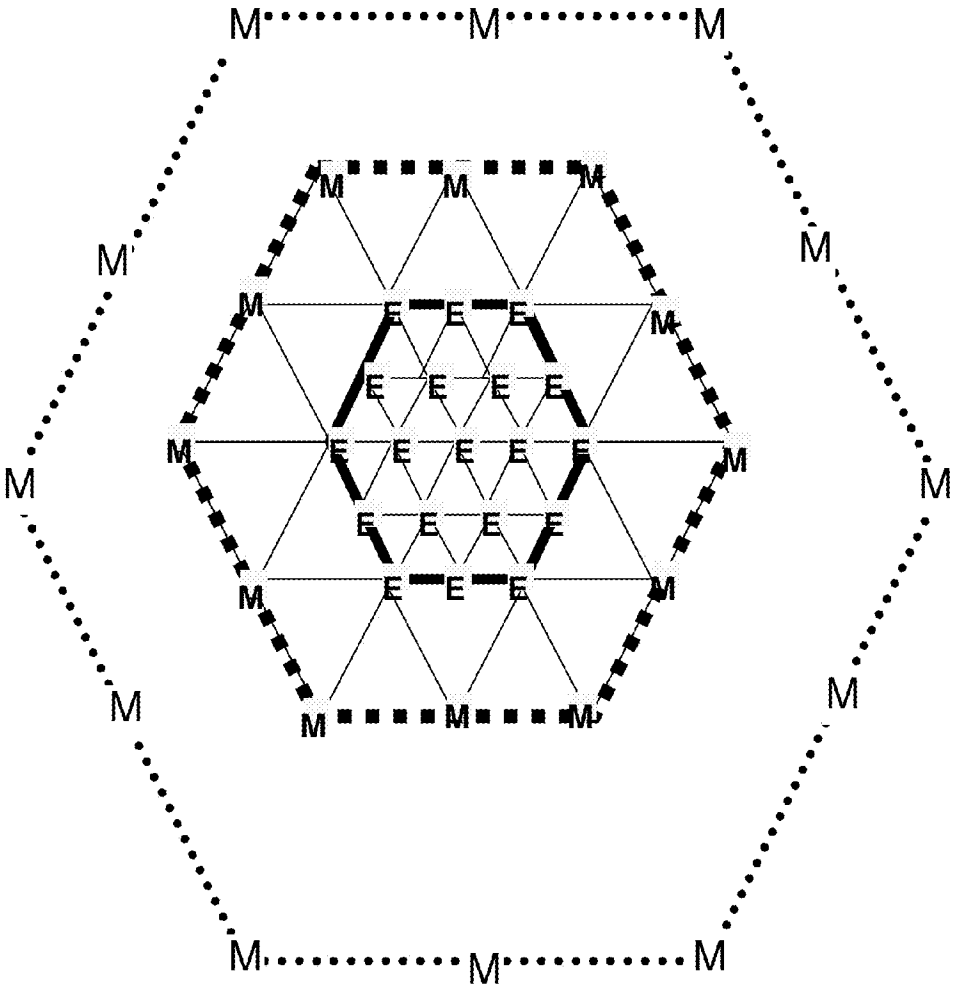
M
M
M

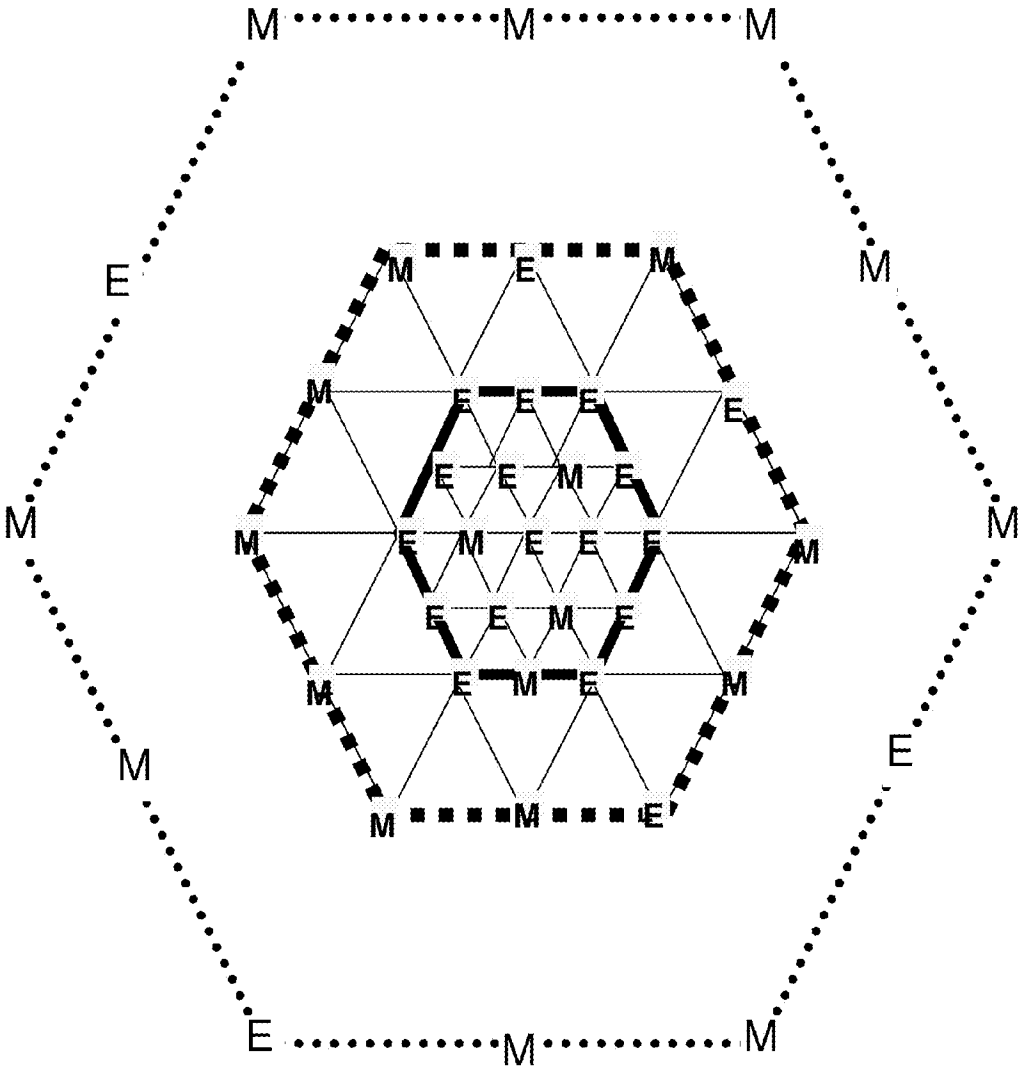
M
M
M
M
E
M
E
M
M
E
M
E
M
M
E
M
E
M
E

HEATER PATTERN FOR IN SITU THERMAL PROCESSING OF A SUBSURFACE HYDROCARBON CONTAINING FORMATION

FIELD OF THE INVENTION

The present invention relates to methods and systems of heating a subsurface formation, for example, in order to produce hydrocarbon fluids therefrom.

DESCRIPTION OF RELATED ART

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Large deposits of heavy hydrocarbons (heavy oil and/or tar) contained in relatively permeable formations (for example in tar sands) are found in North America, South America, Africa, and Asia. Tar can be surface-mined and upgraded to lighter hydrocarbons such as crude oil, naphtha, kerosene, and/or gas oil. Surface milling processes may further separate the bitumen from sand. The separated bitumen may be converted to light hydrocarbons using conventional refinery methods. Mining and upgrading tar sand is usually substantially more expensive than producing lighter hydrocarbons from conventional oil reservoirs.

Retorting processes for oil shale may be generally divided into two major types: aboveground (surface) and underground (in situ). Aboveground retorting of oil shale typically involves mining and construction of metal vessels capable of withstanding high temperatures. The quality of oil produced from such retorting may typically be poor, thereby requiring costly upgrading. Aboveground retorting may also adversely affect environmental and water resources due to mining, transporting, processing, and/or disposing of the retorted material. Many U.S. patents have been issued relating to aboveground retorting of oil shale. Currently available aboveground retorting processes include, for example, direct, indirect, and/or combination heating methods.

In situ retorting typically involves retorting oil shale without removing the oil shale from the ground by mining modified in situ processes typically require some mining to develop underground retort chambers. An example of a "modified" in situ process includes a method developed by Occidental Petroleum that involves mining approximately 20% of the oil shale in a formation, explosively rubblizing the remainder of the oil shale to fill up the mined out area, and combusting the oil shale by gravity stable combustion in which combustion is initiated from the top of the retort. Other examples of "modified" in situ processes include the "Rubble In Situ Extraction" ("RISE") method developed by the Lawrence Livermore Laboratory ("LLL") and radio-frequency methods developed by IIT Research Institute ("IITRI") and LLL, which involve tunneling and mining drifts to install an array of radio-frequency antennas in an oil shale formation.

Obtaining permeability in an oil shale formation between injection and production wells tends to be difficult because oil shale is often substantially impermeable. Drilling such wells may be expensive and time consuming. Many methods have attempted to link injection and production wells.

Many different types of wells or wellbores may be used to treat the hydrocarbon containing formation using an in situ heat treatment process. In some embodiments, vertical and/or substantially vertical wells are used to treat the formation. In some embodiments, horizontal or substantially horizontal wells (such as J-shaped wells and/or L-shaped wells), and/or U-shaped wells are used to treat the formation. In some embodiments, combinations of horizontal wells, vertical wells, and/or other combinations are used to treat the formation. In certain embodiments, wells extend through the overburden of the formation to a hydrocarbon containing layer of the formation. In some situations, heat in the wells is lost to the overburden. In some situations, surface and overburden infrastructures used to support heaters and/or production equipment in horizontal wellbores or U-shaped wellbores are large in size and/or numerous.

Wellbores for heater, injection, and/or production wells may be drilled by rotating a drill bit against the formation. The drill bit may be suspended in a borehole by a drill string that extends to the surface. In some cases, the drill bit may be rotated by rotating the drill string at the surface. Sensors may be attached to drilling systems to assist in determining direction, operating parameters, and/or operating conditions during drilling of a wellbore. Using the sensors may decrease the amount of time taken to determine positioning of the drilling systems. For example, U.S. Pat. No. 7,093,370 to Hansberry and U.S. Patent Application Publication No. 2009-027041 to Zaeper et al., both of which are incorporated herein by reference, describe a borehole navigation systems and/or sensors to drill wellbores in hydrocarbon formations. At present, however, there are still many hydrocarbon containing formations where drilling wellbores is difficult, expensive, and/or time consuming.

Heaters may be placed in wellbores to heat a formation during an in situ process. There are many different types of heaters which may be used to heat the formation. Examples of in situ processes utilizing downhole heaters are illustrated in U.S. Pat. No. 2,634,961 to Ljungstrom; U.S. Pat. No. 2,732,195 to Ljungstrom; U.S. Pat. No. 2,780,450 to Ljungstrom; U.S. Pat. No. 2,789,805 to Ljungstrom; U.S. Pat. No. 2,923,535 to Ljungstrom; U.S. Pat. No. 4,886,118 to Van Meurs et al.; and U.S. Pat. No. 6,688,387 to Wellington et al.; each of which is incorporated by reference as if fully set forth herein.

U.S. Pat. No. 7,575,052 to Sandberg et al. and U.S. Patent Application Publication No. 2008-0135254 to Vinegar et al., each of which are incorporated herein by reference, describe an in situ heat treatment process that utilizes a circulation system to heat one or more treatment areas. The circulation system may use a heated liquid heat transfer fluid that passes through piping in the formation to transfer heat to the formation.

US Patent Application Publication No. 2009-0095476 to Nguyen et al., which is incorporated herein by reference, describes a heating system for a subsurface formation that includes a conduit located in an opening in the subsurface formation. An insulated conductor is located in the conduit. A material is in the conduit between a portion of the insulated conductor and a portion of the conduit. The material may be a salt. The material is a fluid at the operating temperature of the heating system. Heat transfers from the insulated conductor to the fluid, from the fluid to the conduit, and from the conduit to the subsurface formation.

In situ production of hydrocarbons from tar sand may be accomplished by heating and/or injecting fluids into the formation. U.S. Pat. No. 4,084,637 to Todd; U.S. Pat. No. 4,926,941 to Glandt et al.; U.S. Pat. No. 5,046,559 to Glandt, and U.S. Pat. No. 5,060,726 to Glandt, each of which are incorporated herein by reference, describe methods of producing viscous materials from subterranean formations that includes passing electrical current through the subterranean formation. Steam may be injected from the injector well into the formation to produce hydrocarbons.

U.S. Pat. No. 4,930,574 to Jager, which is incorporated herein by reference, describes a method for tertiary oil recovery and gas utilization by the introduction of nuclear-heated steam into an oil field and the removal, separation and preparation of an escaping oil-gas-water mixture.

US Patent Application Publication 20100270015 to Vinegar et al. discloses that an oil shale formation may be treated using an in situ thermal process. A mixture of hydrocarbons, $H_2$, and/or other formation fluids may be produced from the formation. Heat may be applied to the formation to raise a temperature of a portion of the formation to a pyrolysis temperature. Heat sources may be used to heat the formation. The heat sources may be positioned within the formation in a selected pattern.

US Patent Application Publication No. 20090200031 to Miller et al., which is incorporated herein by reference, discloses a method for treating a hydrocarbon containing formation includes providing heat input to a first section of the formation from one or more heat sources located in the first section. Fluids are produced from the first section through a production well located at or near the center of the first section. The heat sources are configured such that the average heat input per volume of formation in the first section increases with distance from the production well.

As discussed above, there has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. Thus, there is a need for improved methods and systems for heating of a hydrocarbon formation and production of fluids from the hydrocarbon formation. There is also a need for improved methods and systems that reduce energy costs for treating the formation, reduce emissions from the treatment process, facilitate heating system installation, and/or reduce heat loss to the overburden as compared to hydrocarbon recovery processes that utilize surface based equipment.

SUMMARY OF EMBODIMENTS

Embodiments of the present invention relate to heater patterns and related methods of producing hydrocarbon fluids from a subsurface hydrocarbon-containing formation (for example, an oil shale formation) where a heater cell may be divided into nested inner and outer zones. Production wells may be located within both zones. In the smaller inner zone, heaters are arranged at a relatively high spatial density while in the larger surrounding outer zone, a heater spatial density is significantly lower. Due to the higher heater density, a rate of temperature increase in the smaller inner zone of the subsurface exceeds that of the larger outer zone, and a rate of hydrocarbon fluid production ramps up significantly faster in the inner zone than in the outer zone.

The overall density of heaters in the heater cell, considered as a whole, is significantly less than that within the inner zone. Thus, the number of heaters required for the heater pattern is substantially less than what would be required if the heater density throughout the heater cell was that within the inner zone.

Thermal energy from the inner zone may migrate outwardly to the outer zone so as to accelerate hydrocarbon fluid production in the outer zone. Despite the significantly lower heater density in the outer zone, a rate of hydrocarbon fluid production in the outer zone may ramp up fast enough so that the overall rate of hydrocarbon fluid production for the heater cell as a whole is substantially sustained, over an extended period of time, once the inner zone production rate has peaked.

As such, the heater patterns disclosed herein provide the minimal, or nearly the minimal, rise time to a substantially sustained production rate that is possible for a given number of heaters. Alternatively, it may be said that the heater patterns disclosed herein minimize, or nearly minimize, the number of heaters required to achieve a relatively fast rise time with a sustained production level.

In some embodiments, a heater spacing within the outer zone is about twice that of the inner zone and/or a heater density within the inner zone is about three times that of the outer zone and/or an average distance, in the inner zone, to a nearest heater is about 2-3 times that within the outer zone. In some embodiments, an area of a region enclosed by a perimeter of the outer zone is between two and seven (e.g. at least two or at least three and/or at most seven or at most six or at most five) times (for example, about four times) that enclosed by a perimeter of the inner zone.

In some embodiments, the inner zone, outer zone or both are shaped as a regular hexagon. This shape may be particularly useful when heater cells are arranged on a two-dimensional lattice so as to fill a two-dimensional portion of the subsurface while eliminating or substantially minimizing the size of the interstitial space between neighboring heater cells. As such, a number of heater cells may entirely, or almost entirely, cover a portion of the sub-surface.

Some embodiments of the present invention relate to 'two-level' heater patterns where an inner zone of heaters at a higher density is nested within an outer zone of heaters at a lower density. This concept may be generalized to N-level heater patterns where one or more 'outer' zones of heaters surround a relatively heater-dense inner zone of heaters. In one example, N=2. In another example, N=3. In yet another example, N=4.

For each pair of heater zones, the more outer heater zone is larger than the more inner heater zone. Although the heater density in the more outer heater zone is significantly less than that in the more inner zone, and although the hydrocarbon fluid production peak in the inner zone occurs at a significantly earlier time than in the more outer zone, sufficient thermal energy is delivered to the more outer zone so once the production rate in the more inner zone ramps up quickly, this rate may be substantially sustained for a relatively extended period of time by hydrocarbon fluid production rate in the more outer zone.

In some embodiments, further performance improvements may be achieved by: (i) concentrating electrical heaters in the denser inner zone while the heaters of the outer zone are primarily molten salt heaters; and/or (ii) significantly reducing a power output of the inner-zone heater after an inner zone hydrocarbon fluid production rate has dropped (e.g. by a first minimal threshold fraction) from a maximum level; and/or (iii) substantially shutting off one or more inner zone production wells after the inner zone hydrocarbon fluid production rate has dropped (e.g. by a second minimal threshold fraction equal to or differing from the first minimal threshold fraction) from a maximum level; and/or (iv) injecting heat-transfer fluid into the inner zone (e.g. via inner zone production well(s) and/or via inner zone injection well(s)) so as to accelerate the outwardly migration of thermal energy from the inner zone to the outer zone—for example, by supplementing outwardly-directed diffusive heater transfer with outwardly-directed convective heat transfer.

In some embodiments, the heater for the zone with the largest well spacing is a molten salt heater due to its operational reliability and energy efficiency.

It is now disclosed a system for in-situ production of hydrocarbon fluids from a subsurface hydrocarbon-containing formation, the system comprising: one or more heater cells, each cell being divided into nested inner and outer zones such that an area ratio between respective areas enclosed by substantially-convex polygon-shaped perimeters of the outer and inner zones is between two and seven (e.g. at least two or at least three and/or at most seven or at most six or at most five), heaters being located at all polygon vertices of the inner and outer zone perimeters, inner zone and outer zone heaters being respectively distributed around inner and outer zone centroids such that an average heater spacing in outer zone significantly exceeds that of inner zone, a significant majority of the inner zone heaters being located away from the outer zone perimeter.

It is now disclosed a system for in-situ production of hydrocarbon fluids from a subsurface hydrocarbon-containing formation, the system comprising: one or more heater cells, each cell being divided into nested inner and outer zones such that an area ratio between respective areas enclosed by substantially-convex polygon-shaped perimeters of the outer and inner zones is between two and seven (e.g. at least two or at least three and/or at most seven or at most six or at most five), heaters being located at all polygon vertices of the inner and outer zone perimeters, inner zone and outer zone heaters being respectively distributed around inner and outer zone centroids such that a heater spatial density in inner zone significantly exceeds that of outer zone, a significant majority of the inner zone heaters being located away from the outer zone perimeter.

It is now disclosed a system for in-situ production of hydrocarbon fluids from a subsurface hydrocarbon-containing formation, the system comprising: one or more heater cells, each cell being divided into nested, inner, outer and outer-zone-surrounding (OZS) additional zones by respective polygon-shaped zone perimeters, heaters being located at all polygon vertices of the inner, outer and OZS additional zone perimeters, inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs: (i) an area ratio between respective areas enclosed by perimeters of the more outer zone and the more inner zone is between two and seven (e.g. at least two or at least three and/or at most seven or at most six or at most five); and (ii) a heater spacing of the more outer zone significantly exceeds that of the more inner zone.

In some embodiments, for each of the zone pairs, a heater spacing of the more outer zone is at least about twice that of the more inner zone.

In some embodiments, for each of the zone pairs, the area ratio between respective perimeters of the more outer and more inner zones is about four, and a heater spacing of the more outer zone is about twice that of the more inner zone.

In some embodiments, for each of the zone pairs, a ratio between a heater spacing of the more outer zone and that of the more inner zone is substantially equal to the square root of the area ratio between the more outer and the more inner zones of the zone pair.

In some embodiments, for each of the zone pairs, the area ratio between respective areas enclosed by perimeters of the more outer zone and the more inner zone is at most six or at most five and/or at least 3.5.

It is now disclosed a system for in-situ production of hydrocarbon fluids from a subsurface hydrocarbon-containing formation, the system comprising: one or more heater cells, each cell being divide into nested, inner, outer and outer-zone-surrounding (OZS) additional zones by respective polygon-shaped zone perimeters, heaters being located at all polygon vertices of the inner, outer and OZS additional zone perimeters, the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs: an area ratio between respective areas enclosed by perimeters of the more outer zone and the more inner zone is between two and seven (e.g. at least two or at least three and/or at most seven or at most six or at most five); and a heater spatial density of the more inner zone significantly exceeds that of the more outer zone.

In some embodiments, a significant majority of the inner zone heaters are located away from the outer zone perimeter.

In some embodiments, a significant majority of the outer zone heaters are located away from a perimeter of the outer-zone-surrounding (OZS) additional zone.

In some embodiments, for each of the zone pairs, a heater spatial density of the more inner zone is equal to at least about twice that of the more outer zone.

In some embodiments, for each of the zone pairs, a heater spatial density of the more inner zone is equal to at most about six times that of the more outer zone.

In some embodiments, for each of the zone pairs, a centroid of the more inner zone is located in a central portion of the region enclosed by a perimeter of the more outer zone.

In some embodiments, a centroid of the inner zone is located in a central portion of the region enclosed by a perimeter of the outer zone.

In some embodiments, each heater cell includes at least one production well located within the inner zone.

In some embodiments, each heater cell includes at least one production well located within the outer zone.

In some embodiments, a production well spatial density in the inner zone at least exceeds that of the outer zone.

In some embodiments, an average heater spacing in outer zone is at least about twice that of inner zone.

In some embodiments, the area ratio between respective areas enclosed by inner zone and outer zone perimeters is about four, and an average heater spacing in the outer zone is about twice that of the inner zone.

In some embodiments, a spacing ratio between an average heater spacing of the outer zone and that of the inner zone is about equal to a square root of the area ratio between respective areas enclosed by the inner zone and outer zone perimeters.

In some embodiments, a spacing ratio between an average heater spacing of the outer zone and that of the inner zone is about equal to a square root of the area ratio between respective areas enclosed by inner zone and outer zone perimeters.

In some embodiments, a heater spatial density in the inner zone is at least about twice that of outer zone.

In some embodiments, a heater spatial density in the inner zone is at least twice that of the outer zone.

In some embodiments, a heater spatial density in the inner zone is at least about three times that of the outer zone.

In some embodiments, a heater density ratio between a heater spatial densities in the inner zone and that of outer zone is substantially equal to an area ratio between an area of the outer zone and that of the inner zone.

In some embodiments, for an area ratio between an area enclosed by a perimeter of outer zone to that enclosed by a perimeter of inner zone is at most six or at most five and/or at least 3.5

In some embodiments, for each of the zone pairs, the area ratio between respective areas enclosed by perimeters of the more outer zone and the more inner zone is at most six or at most five and/or at least 3.5.

In some embodiments, the one or more heater cells include first and second heater cells having substantially the same area and sharing at least one common heater-cell-perimeter heater.

In some embodiments, the one or more heater cells further includes a third heater cell having substantially the same area as the first and second heater cells, the third heater cell sharing at least one common heater-cell-perimeter heater with the first heater cell, the second and third heater cells located substantially on opposite sides of the first heater cell.

In some embodiments, a given heater cell of the heater cells is substantially surrounded by a plurality of neighboring heater cells.

In some embodiments, a given heater cell of the heater cells is substantially surrounded by a plurality of neighboring heater cells and the given heater cell shares a common heater-cell-perimeter heater with each of the neighboring heater cells.

In some embodiments, inner zone heaters are distributed substantially uniformly throughout the inner zone.

In some embodiments, each heater cell being arranged so that within the outer zone, heaters are predominantly located on the outer zone perimeter.

In some embodiments, at least one of the inner and outer perimeters is shaped like a regular hexagon, like a lozenge, or like a rectangle.

In some embodiments, the inner and outer perimeters are similar shaped.

In some embodiments, within the inner and/or outer zones, a majority of heaters are disposed on a triangular, hexagonal or rectangular grid.

In some embodiments, a total number of inner zone heaters exceeds that of the outer zone.

In some embodiments, a total number of inner zone heaters exceeds that of the outer zone by at least 50%.

In some embodiments, at least five inner zone heaters are dispersed throughout the inner zone.

In some embodiments, at least five or at least seven or at least ten outer zone heaters are located around a perimeter of the outer zone.

In some embodiments, at least one-third of at least one-half of inner zone heaters are not located on the inner zone perimeter.

In some embodiments, for each of the inner zone and outer zone perimeters, an aspect ratio is less than 2.5.

In some embodiments, at least five or at least seven or at least ten heaters are distributed about the perimeter of the inner zone.

In some embodiments, a majority of the heaters in the inner zone are electrical heaters and a majority of the heaters in the outer zone are molten salt heaters.

In some embodiments, at least two-thirds or at least three-quarters of inner-zone heaters are electrical heaters and at least two-thirds of outer-zone heaters are molten salt heaters.

In some embodiments, the system further includes control apparatus configured to regulate heater operation times so that, on average, heaters in the outer zone operate above a one-half maximum power level for at least twice as long as the heaters in the inner zone.

In some embodiments, the control apparatus is configured so that on average, the outer zone heaters operate above a one-half maximum power level for at least three times as long as the inner zone heaters.

In some embodiments, an average inner-zone heater spacing is between 1 and 10 meters (for example, between 1 and 5 meters or between 1 and 3 meters).

In some embodiments, the heaters are configured to pyrolize the entirety of both the inner and outer zones.

In some embodiments, the heaters are configured to heat respective substantial entirety of the inner and outer regions to substantially the same uniform temperature.

In some embodiments, among the inner zone heaters and/or outer zone heaters and/or inner perimeter heaters and/or outer perimeter heaters, a ratio between a standard deviation of the spacing and an average spacing is at most 0.2.

In some embodiments, all heaters have substantially the same maximum power level and/or substantially the same diameter.

In some embodiments, a ratio between the area of the inner zone and a square of an average distance to a nearest heater within the inner zone is at least 80.

In some embodiments, a ratio between the area of the inner zone and a square of an average distance to a nearest heater within the inner zone is at least 60 or at least 70 or at least 80 or at least 90 or at least 100.

It is now disclosed a method of in-situ production of hydrocarbon fluids in a subsurface hydrocarbon-containing formation, the method comprising: for a plurality of heaters disposed in substantially convex, nested inner and outer zones of the subsurface formation, an area enclosed by a perimeter of the outer zone being three to seven times that enclosed a perimeter of the inner zone, an average heater spacing in the inner zone being significantly less than that of the outer zone, operating the heaters to produce hydrocarbon fluids in situ such that: i. during an earlier stage of production, hydrocarbon fluids are produced primarily in the inner zone; ii. during a later stage of production which commences after at least a majority of hydrocarbon fluids have been produced from the inner zone, hydrocarbon fluids are produced primarily in the outer zone surrounding the inner zone, wherein at least 5% (or at least 10% or at least 20%) of the thermal energy required for hydrocarbon fluid production in the outer zone is supplied by outward flow of thermal energy from the inner zone to the outer zone.

It is now disclosed a method of in-situ production of hydrocarbon fluids in a subsurface hydrocarbon-containing formation, the method comprising: a. deploying a plurality of subsurface heaters into substantially convex, nested inner and outer zones of the subsurface formation, an area enclosed by a perimeter of the outer zone being three to seven times that enclosed a perimeter of the inner zone, an average heater spacing in the inner zone being significantly less than that of the outer zone; b. operating the heaters to produce hydrocarbon fluids in situ such that a ratio between a half-maximum sustained-production-time and a half-maximum rise-time is at least four thirds, wherein at least a majority of the outer zone heaters commence operation when at most a minority of inner zone hydrocarbon fluids have been produced.

It is now disclosed a method of in-situ production of hydrocarbon fluids in a subsurface hydrocarbon-containing formation, the method comprising: a. deploying a plurality of subsurface heaters into substantially convex, nested inner and outer zones of the subsurface formation, an area enclosed by a perimeter of the outer zone being three to seven times that enclosed a perimeter of the inner zone, an average heater spacing in the inner zone being significantly less than that of the outer zone, b. operating the heaters to produce hydrocarbon fluids in situ, a time dependence of a rate of hydrocarbon fluid production between characterized by earlier inner-zone and subsequent outer-zone production peaks, a time-delay between the peaks being at most about twice the amount of time required to ramp up to the inner-zone production peak.

It is now disclosed a method of in-situ production of hydrocarbon fluids in a subsurface hydrocarbon-containing formation, the method comprising: for a plurality of subsurface heaters arranged in convex, nested inner and outer zones of the subsurface formation, an area enclosed by a perimeter of the outer zone being three to seven times that enclosed by a perimeter of the inner zone, an average heater spacing in the inner zone being significantly less than that of the outer zone, employing both inner-zone and outer-zone heaters to heat the subsurface formation and produce hydrocarbon fluids in-situ such that an average operation time of outer-zone heaters exceeds that of inner-zone heaters by at least a factor of two.

In some embodiments, the method is carried out to produce a substantial majority of both inner-zone and outer-zone hydrocarbon fluids.

In some embodiments, an inner-zone heater spacing is less than one-half of a square root of an area of the inner zone.

In some embodiments, outer zone heaters are distributed around a perimeter the of outer zone.

In some embodiments, outer zone heaters are predominantly outer zone perimeter heaters.

In some embodiments, a majority of inner-zone heaters are electrical heaters and a majority of outer-zone heaters are molten salt heaters.

In some embodiments, a majority of the inner zone heaters are located away from the outer zone perimeter.

In some embodiments, a significant majority of the inner zone heaters are located away from the outer zone perimeter.

In some embodiments, at least five inner zone heaters are dispersed throughout the inner zone.

In some embodiments, at least five outer zone heaters are dispersed throughout the outer zone.

In some embodiments, the inner zone heaters are arranged at a substantially uniform heater spacing.

In some embodiments, an aspect ratio of the inner zone is at most four or at most three or at most 2.5

In some embodiments, for the inner and outer zone, a ratio between a greater aspect ratio and a lesser aspect ratio is at most 1.5.

In some embodiments, a centroid of the inner zone is located in a central portion of the region enclosed by the outer zone perimeter It is now disclosed a system for in-situ production of hydrocarbon fluids from a subsurface hydrocarbon-containing formation, the system comprising: a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters, inner zone and outer zone heaters being respectively distributed around inner and outer zone centroids such that an average heater spacing in outer zone significantly exceeds that of inner zone, each heater cell further comprising inner-zone production well(s) and outer-zone production well(s) respectively located in the inner and outer zones.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters, inner zone and outer zone heaters being respectively distributed around inner and outer zone centroids such that a heater spatial density in inner zone significantly exceeds that of outer zone, each heater cell further comprising inner-zone production well(s) and outer-zone production well(s) respectively located in the inner and outer zones.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, inner zone and outer zone heaters being respectively distributed around inner and outer zone centroids of each heater cell such that, for each heater cell, (i) an average distance to a nearest heater within the outer zone significantly exceeds that of the inner zone; (ii) an average distance to a nearest heater on the inner zone perimeter is at most substantially equal to that within inner zone; and (iii) an average distance to a nearest heater on the outer zone perimeter is equal to at most about twice that on the inner zone perimeter, each heater cell further comprising inner-zone production well(s) and outer-zone production well(s) respectively located in the inner and outer zones.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that an average heater spacing in outer zone significantly exceeds that of inner zone, a significant majority of the inner zone heaters being located away from the outer zone perimeter.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that a heater spatial density in inner zone significantly exceeds that of outer zone, a significant majority of the inner zone heaters being located away from the outer zone perimeter.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, inner zone and outer zone heaters being respectively distributed around inner and outer zone centroids of each heater cell such that, for each heater cell, (i) an average distance to a nearest heater within the outer zone significantly exceeds that of the inner zone; (ii) an average distance to a nearest heater on the inner zone perimeter is at most substantially equal to that within inner zone; and (iii) an average distance to a nearest heater on the outer zone perimeter is equal to at most about twice that on the inner zone perimeter, a significant majority of the inner zone heaters being located away from the outer zone perimeter.

In some embodiments, the area ratio is at least three.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters heaters being located at all polygon vertices of inner, outer and OZS additional zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs:

i. an enclosed area ratio between respective areas enclosed by perimeters of the more outer zone and the more inner zone is between two and seven; and ii. a heater spacing of the more outer zone significantly exceeds that of the more inner zone.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters heaters being located at all polygon vertices of inner, outer and OZS additional zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs:

i. an enclosed area ratio between respective areas enclosed by perimeters of the more outer zone and the more inner zone is between two and seven; and ii. a heater spacing of the more outer zone significantly exceeds that of the more inner zone, wherein the system further comprises a plurality of production wells, at least one of the production wells being located the inner zone, and at least one of the production wells being located in the outer or the outer-zone-surrounding (OZS) additional zones.

In some embodiments, at least one of the production wells is respectively located within each of the inner, outer and outer-zone-surrounding (OZS) additional zones.

In some embodiments, at least one of the production wells is respectively located at least one of, or at least two of the inner, outer and outer-zone-surrounding (OZS) additional zones.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters heaters being located at all polygon vertices of inner, outer and OZS additional zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs:

i. an enclosed area ratio between respective areas enclosed by perimeters of the more outer zone and the more inner zone is between two and seven; and ii. a heater spatial density of the more inner zone significantly exceeds that of the more outer zone.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters heaters being located at all polygon vertices of inner, outer and OZS additional zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs:

i. an enclosed area ratio between respective areas enclosed by perimeters of the more outer zone and the more inner zone is between two and seven; and ii. a heater spatial density of the more inner zone significantly exceeds that of the more outer zone, wherein the system further comprises a plurality of production wells, at least one of the production wells being located the inner zone, and at least one of the production wells being located in the outer or the outer-zone-surrounding (OZS) additional zones.

In some embodiments, at least one of the production wells is respectively located within each of the inner, outer and outer-zone-surrounding (OZS) additional zones.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein an average distance to a nearest heater on the inner zone perimeter is at most substantially equal to that within inner zone, and wherein for each of the zone pairs:

i. an enclosed area ratio between respective areas enclosed by perimeters of the more outer zone and the more inner zone is between two and seven; and ii. an average distance to a nearest heater within the more outer zone significantly exceeds that of the less outer zone;

iii. an average distance to a nearest heater on the perimeter of the more outer zone is equal to at most about twice that of the less outer zone.

It is now disclosed a system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein an average distance to a nearest heater on the inner zone perimeter is at most substantially equal to that within inner zone, and wherein for each of the zone pairs:

i. an enclosed area ratio between respective areas enclosed by perimeters of the more outer zone and the more inner zone is between two and seven; and ii. an average distance to a nearest heater within the more outer zone significantly exceeds that of the less outer zone;

iii. an average distance to a nearest heater on the perimeter of the more outer zone is equal to at most about twice that of the less outer zone, wherein the system further comprises a plurality of production wells, at least one of the production wells being located the inner zone, and at least one of the production wells being located in the outer or the outer-zone-surrounding (OZS) additional zones.

In some embodiments, at least one of the production wells is respectively located within each of the inner, outer and outer-zone-surrounding (OZS) additional zones.

In some embodiments, the area ratio for each of the zone pairs is at least three.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that an average heater spacing in outer zone significantly exceeds that of inner zone, a majority of the heaters in the inner zone being electrical heaters and a majority of the heaters in the outer zone being molten salt heaters.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that a heater spatial density in inner zone significantly exceeds that of outer zone, a majority of the heaters in the inner zone being electrical heaters and a majority of the heaters in the outer zone being molten salt heaters.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, inner zone and outer zone heaters being respectively distributed around inner and outer zone centroids such that (i) an average distance to a nearest heater within the outer zone significantly exceeds that of the inner zone; (ii) an average distance to a nearest heater on the inner zone perimeter is substantially equal to that within inner zone; and (iii) an average distance to a nearest heater on the outer zone perimeter is equal to at most about twice that on the inner zone perimeter, a majority of the heaters in the inner zone being electrical heaters and a majority of the heaters in the outer zone being molten salt heaters.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that an average heater spacing in outer zone significantly exceeds that of inner zone, the system further comprising control apparatus configured to regulate heater operation times so that, on average, heaters in outer zone operate above a one-half maximum power level for at least twice as long as the heaters in inner zone.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, heaters being located at all polygon vertices of inner and outer zone perimeters inner zone and outer zone heaters being respectively distributed around inner and outer zone centroids such that a heater spatial density in inner zone significantly exceeds that of outer zone, the system further comprising control apparatus configured to regulate heater operation times so that, on average, heaters in outer zone operate above a one-half maximum power level for at least twice as long as the heaters in inner zone.

It is now disclosed a system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters, of the outer and inner zones is between two and seven, inner zone and outer zone heaters being respectively distributed around inner and outer zone centroids such that (i) an average distance to a nearest heater within the outer zone significantly exceeds that of the inner zone; (ii) an average distance to a nearest heater on the inner zone perimeter is substantially equal to that within inner zone; and (iii) an average distance to a nearest heater on the outer zone perimeter is equal to at most about twice that on the inner zone perimeter, the system further comprising control apparatus configured to regulate heater operation times so that, on average, heaters in outer zone operate above a one-half maximum power level for at least twice as long as the heaters in inner zone.

In some embodiments, the area ratio is at least three.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective substantially-convex polygon-shaped perimeter such that heaters are located at every vertex thereof, heaters of each zone being respectively distributed around each zone centroid such that, for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. a heater spacing of the more outer zone of the neighboring zone pair NZP significantly exceeds that of the more inner zone of the neighboring zone pair NZP, wherein at least one production well is located within the innermost zone, and at least one production well is located within at least one of the N−1 zones outside of the innermost zone.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective substantially-convex polygon-shaped perimeter such that heaters are located at every vertex thereof, heaters of each zone being respectively distributed around each zone centroid such that, for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. a heater spatial density of the more inner zone of the neighboring zone pair NZP significantly exceeds that of the more outer zone of the zone pair NZP, wherein at least one production well is located within the innermost zone, and at least one production well is located within at least one of the N−1 zones outside of the innermost zone.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective substantially-convex polygon-shaped perimeter such that heaters are located at every vertex thereof, heaters being arranged such that an average distance to a nearest heater on a perimeter of an innermost zone is at most substantially equal to that within innermost zone, heaters of each zone being respectively distributed around each zone centroid such that for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. an average distance to a nearest heater within the more outer zone of the neighboring zone pair NZP significantly exceeds that of the less outer zone;

iii. an average distance to a nearest heater on the perimeter of the more outer zone of the neighboring zone pair NZP is equal to at most about twice that of the less outer zone, wherein at least one production well is located within the innermost zone, and at least one production well is located within at least one of the N−1 zones outside of the innermost zone. In some embodiments, at least one production well is located within each of the N zones.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective polygon-shaped perimeter such that heaters are located at every vertex thereof, heaters of each zone being such that, for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. a heater spacing of the more outer zone of the neighboring zone pair NZP significantly exceeds that of the more inner zone of the neighboring zone pair NZP.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective substantially-convex polygon-shaped perimeter such that heaters are located at every vertex thereof, heaters of each zone being respectively distributed around each zone centroid such that, for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. a heater spatial density of the more inner zone of the neighboring zone pair NZP significantly exceeds that of the more outer zone of the zone pair NZP.

It is now disclosed a system for in-situ production of hydrocarbon fluids from a subsurface hydrocarbon-containing formation, the system comprising:

a heater cell divided into N nested zones (N≥2) where N is an integer having a value of at least two, each zone having a respective centroid and a respective substantially-convex polygon-shaped perimeter such that heaters are located at every vertex thereof, heaters being arranged such that an average distance to a nearest heater on a perimeter of an innermost zone is at most substantially equal to that within innermost zone, heaters of each zone being respectively distributed around each zone centroid such that for each neighboring zone pair NZP of the N−1 neighboring zone pairs defined by the N nested zones:

i. an enclosed area ratio between respective areas enclosed by perimeters of the more outer zone and the more inner zone of the neighboring zone pair NZP is between two and seven; and ii. an average distance to a nearest heater within the more outer zone of the neighboring zone pair NZP significantly exceeds that of the less outer zone;

iii. an average distance to a nearest heater on the perimeter of the more outer zone of the neighboring zone pair NZP is equal to at most about twice that of the less outer zone.

It is now disclosed a system for in-situ production of hydrocarbon fluids from a subsurface hydrocarbon-containing formation, the system comprising:

a heater cell divided into N nested zones (N≥2), N being an integer having a value of at least two, the heater cell being divided such that, for each neighboring zone pair NZP of the N−1 neighboring zone pairs defined by the N nested zones, an enclosed area ratio between respective areas enclosed by perimeters of the more outer zone and the more inner zone is between two and seven, heaters being arranged in the heater cell such that for each neighboring zone pair NZP of the N−1 neighboring zone pairs, a heater spacing ratio between an average heater spacing of the more outer zone of the neighboring zone pair NZP and that of the more inner zone of the neighboring zone pair NZP significantly exceeds unity and is about equal to a square root of the enclosed area ratio.

It is now disclosed a system for in-situ production of hydrocarbon fluids from a subsurface hydrocarbon-containing formation, the system comprising:

a heater cell divided into N nested zones (N≥2), N being an integer having a value of at least two, the heater cell being divided such that, for each neighboring zone pair NZP of the N−1 neighboring zone pairs defined by the N nested zones, a zone area ratio between respective areas of the more outer zone and the more inner zone of the neighboring zone pair NZP is between two and seven, heaters being arranged in the heater cell such that for each neighboring zone pair NZP of the N−1 neighboring zone pairs, a heater spatial density of the more inner zone of the neighboring zone pair NZP is about equal to a product of the zone area ratio and heater spatial density of the more outer zone of the zone pair NZP.

In some embodiments, each of the N zones has a respective substantially-convex polygon-shaped perimeter and heaters are located at every vertex thereof.

In some embodiments, heaters are located in each of the N zones and respectively distributed around a respective centroid thereof.

In some embodiments, wherein least one production well is situated in the innermost zone.

In some embodiments, at least one production well is situated in at least one of the N zones outside of the innermost zone.

In some embodiments, at least one production well is situated in each of the N zones.

In some embodiments, for each zone pair of a majority of the N−1 neighboring zone pairs NZP, the area ratio is at least three.

In some embodiments, for each zone pair the N−1 neighboring zone pairs NZP, the area ratio is at least three.

In some embodiments, heaters are distributed around of the inner zone.

In some embodiments, for each zone of the N−1 zone pairs, the heaters are respectively distributed around a respective centroid thereof.

In some embodiments, for each zone of a majority of zones of the N−1 zone pairs, the heaters are respectively distributed around a respective centroid thereof.

In some embodiments, at least the inner zone is substantially-convex.

In some embodiments, each of the N zones is substantially-convex.

In some embodiments, N has a value of two or three or four.

In some embodiments, for each of the zones, the polygon-shaped perimeter is regular-hexagonal in shape.

In some embodiments, at least one production well is respectively located within each of the N zones.

In some embodiments, for each zone of a majority of the N zones, at least one production well is respectively located therein.

In some embodiments, the system further comprises control apparatus configured to regulate heater operation times so that for each neighboring zone pair NZP, an average production well operation time in the more outer zone of the zone pair operate is at least twice that of the more inner zone of the zone pair.

In some embodiments, for each neighboring zone pair NZP the respective area ratio is at most six.

In some embodiments, for each of the zones, production wells are respectively located on substantially on opposite sides of the zone.

In some embodiments, a centroid of an innermost zone is located in a central portion of the region enclosed by a perimeter of the neighboring zone of the innermost zone.

In some embodiments, for each neighboring zone pair NZP of the N−1, a centroid of the more inner zone is located within a central portion of the region enclosed by a perimeter of the more out zone of the neighboring zone pair NZP It is now disclosed a system for in-situ production of hydrocarbon fluids from a subsurface hydrocarbon-containing formation, the system comprising:

heaters arranged in a target portion of the formation, the target portion being divided into nested inner and outer zones heaters so that inner zone and outer zone heaters are respectively distributed around inner and outer zone centroids, a majority of the heaters in the inner zone being electrical heaters and a majority of the heaters in the outer zone being molten salt heaters.

In some embodiments, at least two-thirds of the heaters in the inner zone are electrical heaters and at least two-thirds of the heaters in the outer zone are molten salt heaters.

In some embodiments, inner and outer zones respective have polygon-shaped perimeters, such that heaters are located at all polygon vertices of inner and outer zone perimeters.

In some embodiments, the inner zone is substantially-convex.

In some embodiments, the outer zone is substantially-convex.

In some embodiments, an average heater spacing in the outer zone significantly exceeds that of the inner zone.

In some embodiments, an average heater spacing in the outer zone is about twice that of the inner zone.

In some embodiments, a spacing ratio between an average heater spacing of the outer zone and that of the inner zone is about equal to a square root of the area ratio between respective areas enclosed by the inner zone and outer zone perimeters.

In some embodiments, a heater spatial density in inner zone significantly exceeds that of the outer zone.

In some embodiments, wherein a heater spatial density in the inner zone is at least twice that of the outer zone.

In some embodiments, a heater spatial density in inner zone is at least about three times that of the outer zone.

In some embodiments, a heater density ratio between a heater spatial densities in inner that of outer zones is substantially equal to a zone area ratio between an area of outer zone and that of inner zone.

In some embodiments, an average distance to a nearest heater within the outer zone significantly exceeds that of the inner zone.

In some embodiments, an average distance to a nearest heater within the outer zone is between two and three times that of the inner zone.

In some embodiments, an average distance to a nearest heater on a perimeter of the inner zone is at most substantially equal to that within inner zone.

In some embodiments, an average distance to a nearest heater on the outer zone perimeter is equal to at most about twice that on the inner zone perimeter.

In some embodiments, the system further comprises at least one inner zone production well within inner zone and at least one outer zone production well within outer zone.

In some embodiments, a production well spatial density in inner zone exceeds that of outer zone.

In some embodiments, a production well spatial density in inner zone is equal to about three times of outer zone.

In some embodiments, a majority of the outer zone heaters are arranged on a perimeter of the outer zone.

In some embodiments, heaters are located at all polygon vertices of inner and outer zone perimeters.

In some embodiments, heaters are located at all vertices of the OZS additional zone perimeter.

In some embodiments, an average distance to a nearest heater within the outer zone is equal to between about two and about three times that of the inner zone.

In some embodiments, an average distance to a nearest heater within the outer zone is equal to between two and three times that of the inner zone.

In some embodiments, for each of the zone pairs, a heater spacing of the more outer zone is at least about twice that of the more inner zone.

In some embodiments, for each of the zone pairs, the area ratio between respective more outer and more inner zones is about four, and a heater spacing of the more outer zone is about twice that of the more inner zone.

In some embodiments, for each of the zone pairs, ratio between a heater spacing of the more outer zone and that of the more inner zone is substantially equal to square root of the area ratio between the more outer and the more inner zones of the zone pair.

In some embodiments, for each of the zone pairs, the area ratio between respective areas enclosed by perimeters of the more outer zone and the more inner zone is at most six.

In some embodiments, for each of the zone pairs, the area ratio between respective areas enclosed by perimeters of the more outer zone and the more inner zone is at most five.

In some embodiments, for each of the zone pairs, the area ratio between respective areas enclosed by perimeters of the more outer zone and the more inner zone is at least 2.5.

In some embodiments, a significant majority of the inner zone heaters are located away from outer zone perimeter.

In some embodiments, a significant majority of the outer zone heaters are located away from a perimeter of outer-zone-surrounding (OZS) additional zone.

In some embodiments, for each of the zone pairs, a heater spatial density of the more inner zone is equal to at least about twice that of the more outer zone.

In some embodiments, for each of the zone pairs, a heater spatial density of the more inner zone is equal to at most about six times that of the more outer zone.

In some embodiments, for each of the zone pairs, a centroid of the more inner zone is located in a central portion of the region enclosed by a perimeter of the more outer zone.

In some embodiments, for each of the zone pairs, an average distance to a nearest heater in the more outer zone is between about two and about three times that of the less outer zone.

In some embodiments, for each of the zone pairs, an average distance to a nearest heater in the more outer zone is between two and three times that of the less outer zone.

In some embodiments, a centroid of inner zone is located in a central portion of the region enclosed by a perimeter of the outer zone.

In some embodiments, the heater cell includes at least one inner zone production well located within the inner zone.

In some embodiments, the heater cell includes at least one outer zone production well located within the outer zone.

In some embodiments, the heater cell includes first and second outer zone production wells located within and on substantially on opposite sides of the outer zone.

In some embodiments, a production well spatial density in the inner zone at least exceeds that of the outer zone.

In some embodiments, an average heater spacing in outer zone is at least about twice that of inner zone.

In some embodiments, the area ratio between respective areas enclosed by inner zone and outer zone perimeters, is about four, and an average heater spacing in outer zone is about twice that of inner zone.

In some embodiments, a spacing ratio between an average heater spacing of the outer zone and that of the inner zone is about equal to a square root of the area ratio between respective areas enclosed by the inner zone and outer zone perimeters.

In some embodiments, a spacing ratio between an average heater spacing of the outer zone and that of the inner zone is about equal to a square root of the area ratio between respective areas enclosed by inner zone and outer zone perimeters.

In some embodiments, a heater spatial density in inner zone is at least about twice that of outer zone.

In some embodiments, a heater spatial density in inner zone is at least twice that of outer zone.

In some embodiments, a heater spatial density in inner zone is at least about three times that of the outer zone.

In some embodiments, a heater density ratio between a heater spatial densities in inner that of outer zones is substantially equal to a zone area ratio between an area of outer zone and that of inner zone.

In some embodiments, an enclosed area ratio between an area enclosed by a perimeter of outer zone to that enclosed by a perimeter of inner zone is at most six or at most five and/or at least 2.5 or at least three or at least three.

In some embodiments, an average distance to a nearest heater in the outer zone is between about two and about three times that of the inner zone.

In some embodiments, an average distance to a nearest heater in the outer zone is between two and three times that of the inner zone.

In some embodiments, an average distance to a nearest heater on the inner zone perimeter is substantially equal to that within inner zone.

In some embodiments, along the perimeter of outer zone, an average distance to a nearest heater is at most four times that along the perimeter of inner zone.

In some embodiments, along the perimeter of outer zone, an average distance to a nearest heater is at most three times that along the perimeter of inner zone.

In some embodiments, along the perimeter of outer zone, an average distance to a nearest heater is at most about twice that along the perimeter of inner zone.

In some embodiments, among outer-perimeter heaters located on the perimeter of outer zone, an average distance to a nearest heater significantly exceeds that among inner-perimeter heaters located on the perimeter of inner zone.

In some embodiments, among outer-perimeter heaters located on the perimeter of outer zone, an average distance to a second nearest heater significantly exceeds that among inner-perimeter heaters located on the perimeter of inner zone.

In some embodiments, the system includes a plurality of the heater cells, first and second of the heater cells having substantially the same area and sharing at least one common heater-cell-perimeter heater.

In some embodiments, wherein a third of the heater cells has substantially the same area as the first and second heater cells, the third heater cell sharing at least one common heater-cell-perimeter heater with the first heater cell, the second and third heater cells located substantially on opposite sides of the first heater cell.

In some embodiments, the system includes a plurality of the heater cells, at least one of which is substantially surrounded by a plurality of neighboring heater cells.

In some embodiments, a given heater cell of the heater cells is substantially surrounded by a plurality of neighboring heater cells and the given heater cell 608 shares a common heater-cell-perimeter heater with each of the neighboring heater cells.

In some embodiments, inner zone heaters are distributed substantially uniformly throughout inner zone.

In some embodiments, the heater cell is arranged so that within the outer zone, heaters are predominantly located on the outer zone perimeter.

In some embodiments, at least one of the inner and outer perimeters is shaped like a regular hexagon, like a lozenge, or like a rectangle.

In some embodiments, the inner and outer perimeters are like-shaped.

In some embodiments, within the inner and/or outer zones, a majority of heaters are disposed on a triangular grid, hexagonal or rectangular grid.

In some embodiments, a total number of inner zone heaters exceeds that of the outer zone.

In some embodiments, a total number of inner zone heaters exceeds that of the outer zone by at least 50%.

In some embodiments, at least five inner zone heaters are dispersed throughout the inner zone.

In some embodiments, at least five or at least seven or at least ten outer zone heaters are located around a perimeter of outer zone.

In some embodiments, at least one-third of at least one-half of inner zone heaters are not located on inner zone perimeter.

In some embodiments, each of the inner zone and outer zone perimeters, has an aspect ratio equal to most 2.5.

In some embodiments, each of the inner zone and outer zone perimeters, has an aspect ratio equal to least 10.

In some embodiments, each of the inner zone and outer zone perimeters, is shaped like a rectangular.

In some embodiments, at least five or seven or nine heaters are distributed about the perimeter of inner zone and/or about the perimeter of the outer zone.

In some embodiments, at least ten heaters are distributed throughout inner zone.

In some embodiments, a majority of the heaters in inner zone are electrical heaters and a majority of the heaters in outer zone are molten salt heaters.

In some embodiments, at least two-thirds or at least three-quarters of inner-zone heaters are electrical heaters and at least two-thirds of outer-zone heaters are molten salt heaters.

In some embodiments, the system further includes control apparatus configured to regulate heater operation times so that, on average, heaters in outer zone operate above a one-half maximum power level for at least twice as long as the heaters in inner zone.

In some embodiments, the system includes control apparatus configured to regulate heater operation times so that, on average, outer zone heaters operate above a one-half maximum power level for at least twice as long as the inner zone heaters.

In some embodiments, the control apparatus is configured so that on average, outer zone heaters operate above a one-half maximum power level for at least three times as long as the inner zone heaters.

In some embodiments, wherein an average inner-zone heater spacing is at most 20 meters or at most 10 meters or at most 5 meters.

In some embodiments, an area of the inner zone is at most one square kilometer.

In some embodiments, an area of the inner zone is at most 500 square meters.

In some embodiments, the heaters are configured to induce pyrolysis throughout substantial entireties of both the inner and outer zones.

In some embodiments, the heaters are configured to heat respective substantial entirety of the inner and outer regions to substantially the same uniform temperature.

In some embodiments, among the inner zone heaters and/or outer zone heaters and/or inner perimeter heaters and/or outer perimeter heaters, a ratio between a standard deviation of the spacing and an average spacing is at most 0.2.

In some embodiments, all heaters have substantially the same maximum power level and/or substantially the same diameter.

In some embodiments, a ratio between the area of the inner zone and a square of an average distance to a nearest heater within the inner zone is at least 80 or at least 70 or at least 60 or at least 90.

In some embodiments, at most 10% or at most 7.6% or at most 5% or at most 4% or at most 3% of a length of the outer zone perimeter.

In some embodiments, an average distance to a nearest heater is at most one-eighth or at most one-tenth or at most one-twelfth of a square root of an area of the inner zone.

In some embodiments, at most 30% or at most 20% or at most 10% of the inner zone is displaced from a nearest heater by length threshold equal to at most one quarter of a square root of the inner zone.

In some embodiments, at most 10% of the inner zone is displaced from a nearest heater by length threshold equal to at most one quarter of a square root of the inner zone.

In some embodiments, the length threshold equals at most one fifth of a square root of the inner zone.

In some embodiments, an aspect ratio of the inner and/or outer zone is at most four or most 3 or at most 2.5.

In some embodiments, among the inner and outer zones, a ratio between a greater aspect ratio and a lesser aspect ratio is at most 1.5.

In some embodiments, an isoperimetric quotient of perimeters, of the inner and/or outer zone is at least 0.4 or at least 0.5 or at least 0.6.

In some embodiments, a perimeter of inner zone has a convex shape tolerance value of at most 1.2 or at most 1.1.

In some embodiments, heaters are arranged within inner zone so that inner zone heaters are present on every 72 degree sector or every 60 degree sector thereof for any reference ray orientation.

It is now disclosed a system for in-situ production of hydrocarbon fluids from a subsurface formation, the system comprising: molten salt heaters and electrical heaters arranged within a target portion of the sub-surface formation.\

In some embodiments, within the target formation, a first heater that is a molten salt heater is located at most 50 or at most 20 or at most 10 or at most 5 meters from a second heater that is an electrical heater.

In some embodiments, within the target formation, the average separation distance between neighboring molten salt heaters significantly exceeds the average separation distance between neighboring electrical heaters.

In some embodiments, within the target formation, the average separation distance between neighboring molten salt heaters is about twice the average separation distance between neighboring electrical heaters.

In some embodiments, within the target portion, the average heater separation distance for electrical:molten-salt neighboring heater pairs significantly exceeds the average separation distance for all-electrical neighboring heater pairs.

In some embodiments, within the target portion, the average heater separation distance for electrical:molten-salt neighboring heater pairs is about twice the average separation distance for all-electrical neighboring heater pairs.

In some embodiments, within the target portion, an average heater separation distance for all-molten-salt neighboring heater pairs is substantially equal to the average separation distance for electrical:molten-salt neighboring heater pairs neighboring heater pairs.

It is now disclosed a system for in-situ production of hydrocarbon fluids from a subsurface hydrocarbon-containing formation, the system comprising:

heaters arranged in a target portion of the formation, the target portion being divided into nested inner and outer zones heaters so that inner zone and outer zone heaters are respectively distributed around inner and outer zone centroids, a majority of the heaters in the inner zone being electrical heaters and a majority of the heaters in the outer zone being molten salt heaters.

In some embodiments, at least two-thirds of the heaters in the inner zone are electrical heaters and at least two-thirds of the heaters in the outer zone are molten salt heaters.

In some embodiments, inner and outer zones respective have polygon-shaped perimeters, such that heaters are located at all polygon vertices of inner and outer zone perimeters.

In some embodiments, at least 25 or at least 50 or at least 100 heaters are arranged within the target region.

In some embodiments, a substantially majority the heaters within the target region are electrical or molten-salt heaters.

In some embodiments, at least 20% of the heaters within the target region are electrical heaters.

In some embodiments, the target region has a length and a width of at most 500 or at most 250 or at most 100 meters.

In some embodiments, the hydrocarbon-containing bearing formation is a coal or an oil shale or a heavy oil or a tar sands formation.

In some embodiments, the heaters are horizontally-oriented and a distance between heaters is measured in a vertical plane.

In some embodiments, the heaters are vertically-oriented and a distance between heaters is measured in a horizontal plane.

In some embodiments, the heaters are slanted and a distance between heaters is measured in a slanted plane.

In some embodiments, an about-tolerance-parameter is at most 0.2 or at most 0.15 or at most 0.1.

It is now disclosed a method of in-situ production of hydrocarbon fluids in a subsurface hydrocarbon-containing formation, the method comprising:

for a plurality of heaters disposed in substantially convex, nested inner and outer zones of the subsurface formation operating the heaters to produce hydrocarbon fluids in situ such that:

i. during an earlier stage of production, hydrocarbon fluids are produced primarily in the inner zone; and ii. during a later stage of production which commences after at least a majority of hydrocarbon fluids have been produced from the inner zone, hydrocarbon fluids are produced primarily in the outer zone surrounding the inner zone, wherein at least some of the thermal energy required for hydrocarbon fluid production in the outer zone is supplied by outward flow of thermal energy from the inner zone to the outer zone.

It is now disclosed a method of in-situ production of hydrocarbon fluids in a subsurface hydrocarbon-containing formation, the method comprising:

for a plurality of subsurface heaters that are arranged within N nested zones of the subsurface formation, N being an integer having a value of at least two, for each neighboring zone pair NZP of the N−1 neighboring zone pairs defined by the N nested zones an area ratio between respective areas enclosed by perimeters of the more outer zone and the more inner zone of the neighboring zone pair NZP is between two and seven, operating the heaters to produce hydrocarbon fluids in situ such that a time ratio between a half-maximum sustained-production-time and a half-maximum rise-time is at least four thirds.

In some embodiments, at least 5% or at least 10% of the thermal energy required for hydrocarbon fluid production in the outer zone is supplied by outward flow of thermal energy from the inner zone to the outer zone.

In some embodiments, for each location of a plurality of locations substantially on opposite sides of the outer zone, at least some of the thermal required for hydrocarbon fluid production at the location is supplied by outward flow of thermal energy from the inner zone to the outer zone.

In some embodiments, for each location of a plurality of locations distributed around the outer zone, at least some of the thermal required for hydrocarbon fluid production at the location is supplied by outward flow of thermal energy from the inner zone to the outer zone.

In some embodiments, method of any preceding method claim wherein at least a majority of the outer zone heaters outside of the most inner zone commence operation when at most a minority of hydrocarbon fluids of the most inner zone have been produced.

In some embodiments, substantially all of the heaters are pre-deployed or pre-drilled heaters.

In some embodiments, wherein the time ratio is at least 1.5 or at least 2.

It is now disclosed method for in-situ production of hydrocarbon fluids from a subsurface hydrocarbon-containing formation, the method comprising: producing hydrocarbon fluids by operating heaters of a heater cell divided into N nested zones (N≥2) where N is an integer having a value of at least two, the heater cell being divided such that for each neighboring zone pair NZP of the N−1 neighboring zone pairs defined by the N nested zones, a respective enclosed area ratio between respective areas enclosed by perimeters of the more outer zone of the neighboring zone pair NZP and the more inner zone of the neighboring zone pair NZP is between two and seven, $Zone_i$ representing the $i^{th}$ most inner zone where i is a positive integer having a value equal to at most N, a rate of production of the hydrocarbon fluids being characterized by a sequence of N zone-specific production peaks $\{Peak_1, \ldots Peak_N\}$, the $i^{th}$ peak $Peak_i$ representing a time of a production peak in the $i^{th}$ zone $Zone_i$, wherein for each i between 1 and N, a time ratio between a time required to ramp up to the $(i+1)^{th}$ peak $Peak_{i+1}$ and $i^{th}$ peak $Peak_i$ is substantially equal to the zone area ratio between the area of the $(i+1)^{th}$ zone $Zone_{i+1}$ and $i^{th}$ zone $Zone_i$.

BRIEF DESCRIPTION OF THE DRAWINGS

FIGS. 2-11, 15-16E, 17-18, 21A-21H, 22-23, 24A-24B, 25-28 and 30-37 illustrate in-situ heater patterns in accordance with various examples.

DETAILED DESCRIPTION OF EMBODIMENTS

Figure 1:
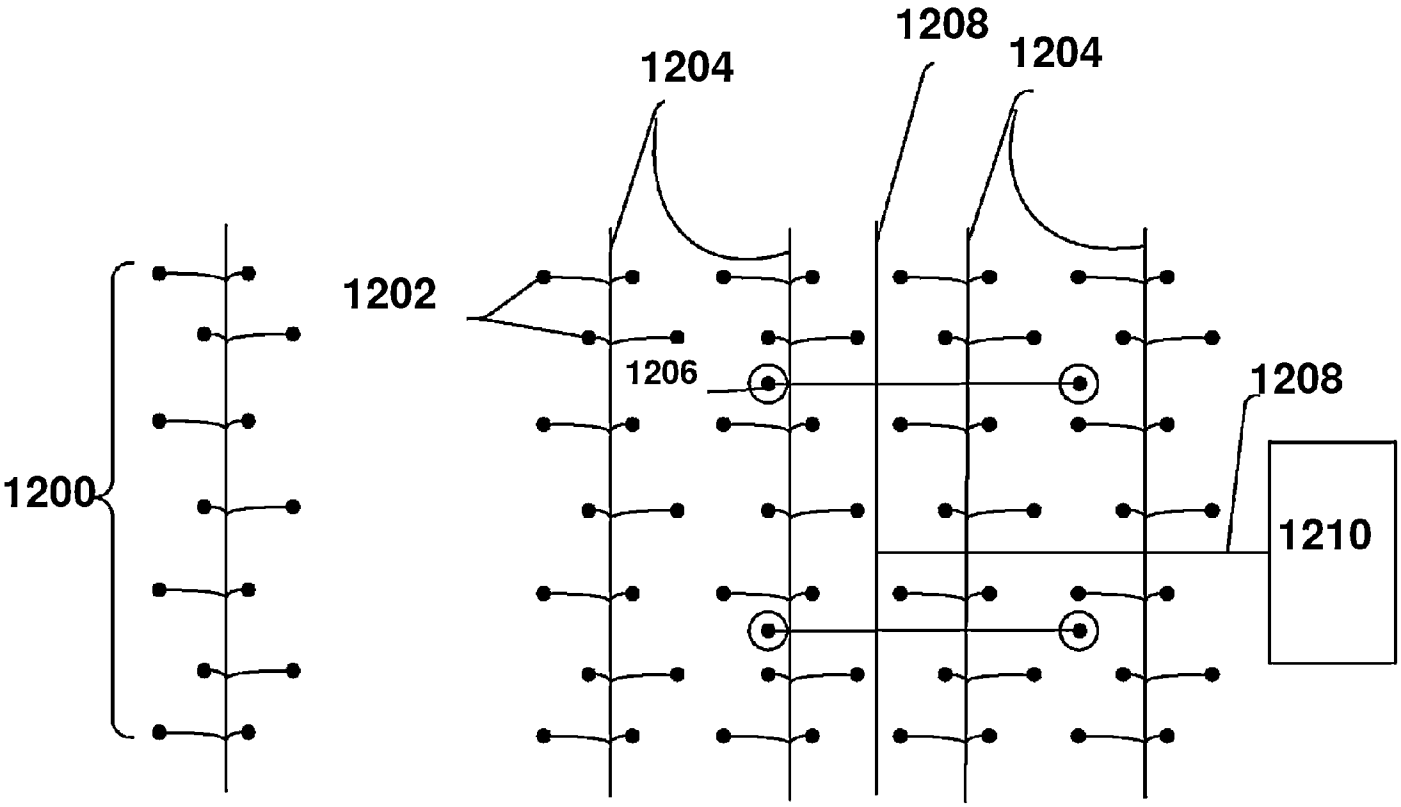
FIG. 1 depicts a schematic view of an embodiment of a portion of the in situ heat treatment system for treating the hydrocarbon containing formation.

For convenience, in the context of the description herein, various terms are presented here. To the extent that definitions are provided, explicitly or implicitly, here or elsewhere in this application, such definitions are understood to be consistent with the usage of the defined terms by those of skill in the pertinent art(s). Furthermore, such definitions are to be construed in the broadest possible sense consistent with such usage.

The following description generally relates to systems and methods for treating hydrocarbons in the formations. Such formations may be treated to yield hydrocarbon products, hydrogen, and other products.

Unless specified otherwise, for the present disclosure, when two quantities $QUANT_1$ and $QUANT_2$, are 'about' equal to each other or 'substantially equal' to each other, the quantities are either exactly equal, or a 'quantity ratio' between (i) the greater of the two quantities MAX ($QUANT_1$, $QUANT_2$) and (ii) the lesser of the two quantities MIN($QUANT_1$, $QUANT_2$) is at most 1.3. In some embodiments, this ratio is at most 1.2 or at most 1.1 or at most 1.05. In the present disclosure, 'about' equal and 'substantially equal' are used interchangeably and have the same meaning.

An 'about-tolerance-parameter' governs an upper bound of the maximum permissible deviation between two quantities that are 'about equal.' The 'about-tolerance-parameter' is defined as the difference between the 'quantity ratio' defined in the previous paragraph and 1. Thus, unless otherwise specified, a value of the 'about-tolerance-parameter' is 0.3—i.e. the 'quantity ratio' of the previous paragraph is at most 1.3. In some embodiments, the 'about-tolerance-parameter' is 0.2 (i.e. the 'quantity ratio' of the previous paragraph is at most 1.2 or 0.1 or 0.05. It is noted that the 'about-tolerance-parameter' is a global parameter—when the about tolerance parameter is X then all quantities that are 'about' or 'substantially' equal to each other have a 'quantity ratio' of about 1+X.

Unless specified otherwise, if heaters (or heater wells) are arranged "around" a centroid of a 'candidate' region (e.g. an inner or outer or outer-zone-surrounding (OZS) additional zone), then for every 'reference ray orientation' (i.e. orientation of a ray from an origin), heaters (i.e. centroids thereof in a cross-section of the subsurface formation in which a heater pattern is defined) are present within all four quadrants (i.e. 90 degree sector) of the candidate region where the 'origin' is defined by the centroid of the 'candidate region.' In some embodiments, heaters are present, for every 'reference ray orientation,' within every 72 degree sector or on every 60 degree sector or on every 45 sector of the 'candidate region.'

If heaters (or heater wells) are arranged 'around' a perimeter of a candidate region, then they are arranged 'around' the centroid of the candidate region and on a perimeter thereof.

An "aspect ratio" of a shape refers to a ratio between its longer dimension and its shorter dimension.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

A "centroid" of an object or region refers to the arithmetic mean of all points within the object or region. Unless specified otherwise, the 'object' or 'region' for which a centroid is specified or computed actually refers to a two-dimensional cross section of an object or region (e.g. a region of the subsurface formation). A 'centroid' of a 'heater' or of a heater well is a 'centroid' of its 'cross section' of the heater or the heater well—i.e. at a specific location. Unless specified otherwise, this cross section is in the plane in which a 'heater pattern' (i.e. for heaters and/or heater wells) is defined.

For the present disclosure, a fluid-advection-based heater or 'advection-based heater' operates by circulating a hot heat transfer fluid within the subsurface or conduits (e.g. pipes) therein where a rate at which thermal energy is transferred from the heater to the subsurface is governed by heat advection (i.e. force convection) from the (i) circulating hot heat transfer fluids to the (ii) conduits (e.g. pipes) through which the hot gas flows. Thermal energy of the heated conduits may be subsequently transferred from the conduits (e.g. pipes) to the subsurface by radiation and/or heat conduction and/or any other combination of heat transfer mechanisms.

For the present disclosure, 'advection' and 'forced convection' are used interchangably.'

Examples of hot heat transfer fluid include but are not limited to hot gases (e.g. flue gas or steam or any other hot gas) and hot liquids (e.g. molten salt, molten metal, or synthetic oil). If the hot heat transfer fluid is other than molten salt then the heater is an example of 'other than a molten salt heater.' Molten salt heaters operate by circulating molten salt within the subsurface or a conduit(s) therein, and 'other than molten salt heaters' do not rely on molten salt circulation.

An object or region is "convex" if for every pair of points within the region or object, every point on the straight line segment that joins them is also within the region or object. A closed curve (e.g. a perimeter of a two-dimensional region) is 'convex' if the area enclosed by the closed curve is convex.

A heater 'cross section' may vary along its central axis. Unless specified otherwise, a heater 'cross section' is the cross section in the plane in which a 'heater pattern' is defined. Unless specified otherwise, for a given heater pattern, the 'cross sections' of each of the heaters are all co-planar.

The term 'displacement' is used interchangeably with 'distance.'

A 'distance' between a location and a heater is the distance between the location and a 'centroid' of the heater (i.e. a 'centroid' of the heater cross section in the plane in which a 'heater pattern' is defined). The 'distance between multiple heaters' is the distance between their centroids.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the subsurface formation.

A "heat source" is any system for providing heat to at least a portion of a formation substantially by conductive and/or radiative heat transfer. For example, a heat source may include electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include a heater that provides heat to a zone proximate and/or surrounding a heating location such as a heater well.

A "heater" is any system or heat source for generating heat in a well or a near wellbore region. Heaters may be, but are not limited to, electric heaters, burners (e.g. gas burners), pipes through which hot heat transfer fluid (e.g. molten salt or molten metal) flows, combustors that react with material in or produced from a formation, and/or combinations thereof. Unless specified otherwise, a 'heater' includes elongate portion having a length that is much greater than cross-section dimensions. One example of a 'heater' is a 'molten salt heater' which heat the subsurface formation primarily by heat convection between molten salt flowing therein and the subsurface formation. As discussed above, and as appreciated by the skilled artisan, the aforementioned 'heat convection' does not need to be directly between the flowing molten salt and the subsurface. Instead, an indirect heat transfer process that relies upon heat convection may be also be considered an example of 'the subsurface formation primarily by heat convection between molten salt flowing therein and the subsurface formation.'

A 'heater pattern' describes relative locations of heaters in a plane of the subsurface formation.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

For the present disclosure, an 'isoperimeteric quotient' of a closed curve (e.g. polygon) is a ratio between: (i) the product of 4n and an area closed by the closed curve; and (ii) the square of the perimeter of the closed curve.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

When an inner zone heater or a point on inner zone perimeter is 'located away' from a perimeter of an outer zone, this means that the 'located away' inner zone heater (or the 'located away inner zone perimeter point') is displaced from the outer zone perimeter by at least a threshold distance. Unless otherwise specified, this 'threshold difference' is at least one half of an inner zone average heater spacing.

"Production" of a hydrocarbon fluid refers to thermally generating the hydrocarbon fluid (e.g. from kerogen or bitumen) and removing the fluid from the sub-surface formation via a production well.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

Unless specified otherwise, when a first quantity $QUANT_1$ 'significantly exceeds' a second quantity $QUANT_2$, a ratio between (i) the greater of the two quantities $MAX(QUANT_1, QUANT_2)$ and (ii) the lesser of the two quantities $MIN(QUANT_1, QUANT_2)$ is at least 1.5. In some embodiments, this ratio is at least 1.7 or at least 1.9.

Unless specified otherwise, a 'significant majority' refers to at least 75%. In some embodiments, the significant majority may be at least 80% or at least 85% or at least 90%.

"Superposition of heat" refers to providing heat from two or more heat sources to a selected section of a formation such that the temperature of the formation at least at one location between the heat sources is influenced by the heat sources.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja a formation in the Orinoco belt in Venezuela.

"Thermally conductive fluid" includes fluid that has a higher thermal conductivity than air at standard temperature and pressure (STP) (0° and 101.325 kPa).

"Thermal conductivity" is a property of a material that describes the rate at which heat flows, in steady state, between two surfaces of the material for a given temperature difference between the two surfaces.

"Thickness" of a layer refers to the thickness of a cross section of the layer, wherein the cross section is normal to a face of the layer.

A "U-shaped wellbore" refers to a wellbore that extends from a first opening in the formation, through at least a portion of the formation, and out through a second opening in the formation. In this context, the wellbore may be only roughly in the shape of a "V" or "U", with the understanding that the "legs" of the "U" do not need to be parallel to each other, or perpendicular to the "bottom" of the "U" for the wellbore to be considered "U-shaped".

"Upgrade" refers to increasing the quality of hydrocarbons. For example, upgrading heavy hydrocarbons may result in an increase in the API gravity of the heavy hydrocarbons.

"Visbreaking" refers to the untangling of molecules in fluid during heat treatment and/or to the breaking of large molecules into smaller molecules during heat treatment, which results in a reduction of the viscosity of the fluid.

"Viscosity" refers to kinematic viscosity at 40° unless otherwise specified. Viscosity is as determined by ASTM Method D445.

"VGO" or "vacuum gas oil" refers to hydrocarbons with a boiling range distribution between 343° and 538° at 0.101 MPa. VGO content is determined by ASTM Method D5307.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° to 250°, from 120° to 240°, or from 150° to 230°).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° to 900°, from 240° to 400° or from 250° to 350°).

Heating the hydrocarbon containing formation with a plurality of heat sources may establish thermal gradients around the heat sources that raise the temperature of hydrocarbons in the formation to desired temperatures at desired heating rates. The rate of temperature increase through mobilization temperature range and/or pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly heating the temperature through a temperature range. In some embodiments, the desired temperature is 300°, 325°, or 350° Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° to about 1200°, about 500° to about 1100°, or about 550° to about 1000° A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 1200. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 1200 are dewatering wells. Dewatering wells may remove liquid water and/or inhibit liquid water from entering a portion of the formation to be heated, or to the formation being heated. In the embodiment depicted in FIG. 1, the barrier wells 1200 are shown extending only along one side of heater sources 1202, but the barrier wells typically encircle all heat sources 1202 used, or to be used, to heat a treatment area of the formation.

Heat sources 1202 are placed in at least a portion of the formation. Heat sources 1202 may include heaters such as insulated conductors, conductor-in-conduit heaters, surface burners, flameless distributed combustors, and/or natural distributed combustors. Heat sources 1202 may also include other types of heaters. Heat sources 1202 provide heat to at least a portion of the formation to heat hydrocarbons in the formation. Energy may be supplied to heat sources 1202 through supply lines 1204. Supply lines 1204 may be structurally different depending on the type of heat source or heat sources used to heat the formation. Supply lines 1204 for heat sources may transmit electricity for electric heaters, may transport fuel for combustors, or may transport heat exchange fluid that is circulated in the formation. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 1206 to be spaced relatively far apart in the formation.

Production wells 1206 are used to remove formation fluid from the formation. In some embodiments, production well 1206 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 1206 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 1206. During initial heating, fluid pressure in the formation may increase proximate heat sources 1202. The increased fluid pressure may be released, monitored, altered, and/or controlled through one or more heat sources 1202. For example, selected heat sources 1202 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase although an open path to production wells 1206 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 1202 to production wells 1206 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 1206 may be transported through collection piping 1208 to treatment facilities 1210. Formation fluids may also be produced from heat sources 1202. For example, fluid may be produced from heat sources 1202 to control pressure in the formation adjacent to the heat sources. Fluid produced from heat sources 1202 may be transported through tubing or piping to collection piping 1208 or the produced fluid may be transported through tubing or piping directly to treatment facilities 1210. Treatment facilities 1210 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

Formation fluid may be hot when produced from the formation through the production wells. Hot formation fluid may be produced during solution mining processes and/or during in situ heat treatment processes. In some embodiments, electricity may be generated using the heat of the fluid produced from the formation. Also, heat recovered from the formation after the in situ process may be used to generate electricity. The generated electricity may be used to supply power to the in situ heat treatment process. For example, the electricity may be used to power heaters, or to power a refrigeration system for forming or maintaining a low temperature barrier. Electricity may be generated using a Kalina cycle, Rankine cycle or other thermodynamic cycle. In some embodiments, the working fluid for the cycle used to generate electricity is aqua ammonia.

FIGS. 2A-2E illustrate a pattern of heaters 220 within a cross section (e.g. a horizontal or vertical or slanted cross section) of a hydrocarbon-bearing subsurface formation such as oil shale, tar sands, coals, bitumen-containing carbonates, gibsonite, or heavy oil—containing diatomite). In some embodiments, each of the heaters (e.g. within heater wells) includes an elongate section having an elongate/central axis locally perpendicular to the cross section of the subsurface formation. Each dot 220 in FIGS. 2A-2D represents a location of a cross section of the respective elongate heater in the plane defined by the subsurface cross section. The heater spatial pattern of FIGS. 2A-2D, or the heater pattern of any other embodiment, may occur at any depth within the subsurface formation, for example, at least 50 meters or at least 100 meters or at least 150 meters or at least 250 meters beneath the surface, or more.

In the example of FIGS. 2A-2E, heaters 220 are respectively disposed at relatively high and low spatial densities (and relatively short and long heater spacings) within nested inner 210 and outer 214 zones of the cross section of the hydrocarbon-bearing formation. In the particular example of FIGS. 2A-2D, (i) nineteen inner zone heaters 226 are disposed at a relatively high density (and relatively short spacings between neighboring heaters) both within an inner zone 210 and around a perimeter 204 of the inner zone 210 (i.e. referred to as an 'inner perimeter'), and (ii) twelve outer zone 228 heaters are arranged a relatively low density (and relatively long spacings between neighboring heaters) in outer zone 214 so as to be distributed around a perimeter 208 of outer zone 214. In the non-limiting example of FIG. 2A-2E, within outer zone 214, (i) all outer zone heaters are distributed around the perimeter 208 of outer zone 214, and (ii) the region between the inner 204 and outer 208 perimeters is relatively free of heaters.

Because heater patterns are defined within a two-dimensional cross-section of the subsurface formation, the terms 'inner zone' 210 and 'outer zone' 214 refer to portions of the two-dimensional cross section of the subsurface formation. Because heater patterns are defined within a two-dimensional cross-section of the subsurface formation, various spatial properties related to heater location such as heater spacing, density, and 'distance to heater' are also defined within a two-dimensional planar cross-section of the formation.

For the present disclosure, the 'inner zone' 210 refers to the entire area enclosed by a perimeter 204 thereof. The 'outer zone' 214 refers to the entire area, (i) outside of inner zone 210 that is (ii) enclosed by a perimeter 208 outer zone 214.

As will be discussed below, in some embodiments, the heater patterns illustrated in the non-limiting example of FIGS. 2A-2E, and in other embodiments disclosed herein, are useful for minimizing and/or substantially minimizing a number of heaters 220 required to rapidly reach a relatively-sustained substantially steady-state production rate of hydrocarbon fluids in the subsurface formation.

In some embodiments, during an initial phase of heater operation, the subsurface formation within the smaller inner zone 210 heats up relatively quickly, due to the high spatial density and short spacing of heaters therein. This high heater spatial density may expedite production of hydrocarbons within inner zone 210 during an earlier phase of production when the average temperature in the inner zone 210 exceeds (e.g. significantly exceeds) that of the outer zone 214. During a later phase of operation, the combination of (i) heat provided by outer zone heaters; and (ii) outward flow of thermal energy from inner zone 210 to outer zone 214 may heat the outer zone 214.

As will be discussed below (see, for example, FIGS. 12A-12D), in some embodiments two distinct 'production peaks' may be observed—an earlier inner zone production peak 310 and a later outer zone production peak 330. In some embodiments, these production peaks collectively contribute to an 'overall' hydrocarbon production rate within the 'combined' region (i.e. the combination of inner 210 and outer 214 regions) that (i) ramps up relatively quickly due to the inner zone peak (i.e. has a 'fast rise time') and (ii) is sustained at a near-steady rate for an extended period of time.

For the present disclosure, 'inner zone perimeter 204' or 'inner perimeter 204' which forms a boundary between inner 210 and outer 214 zones, is considered part of inner zone 210. In the example of FIGS. 2A-2E the twelve heaters located on the 'inner hexagon' 204 are inner zone heaters 226. The 'outer zone perimeter 208' or 'outer perimeter 208' which forms a boundary between the outer zone 214 and 'external locations' outside of the outer zone is considered part of outer zone 214. The terms 'inner zone perimeter 204' and 'inner perimeter 204' are used interchangeably and have the same meaning; the terms 'outer zone perimeter 208' and 'outer perimeter 208' are used interchangeably and have the same meaning.

Figure 2A:
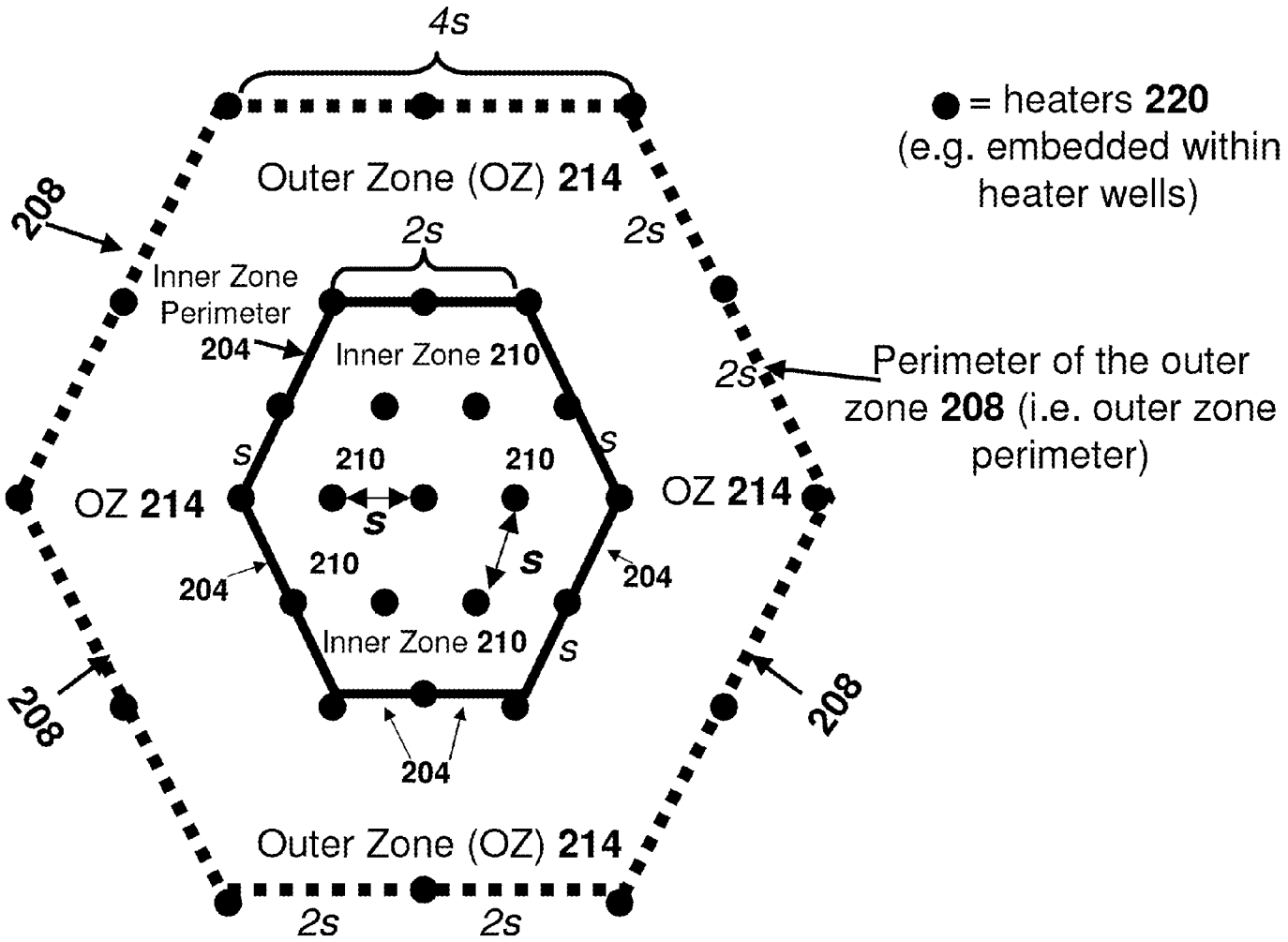
Figure 2B:
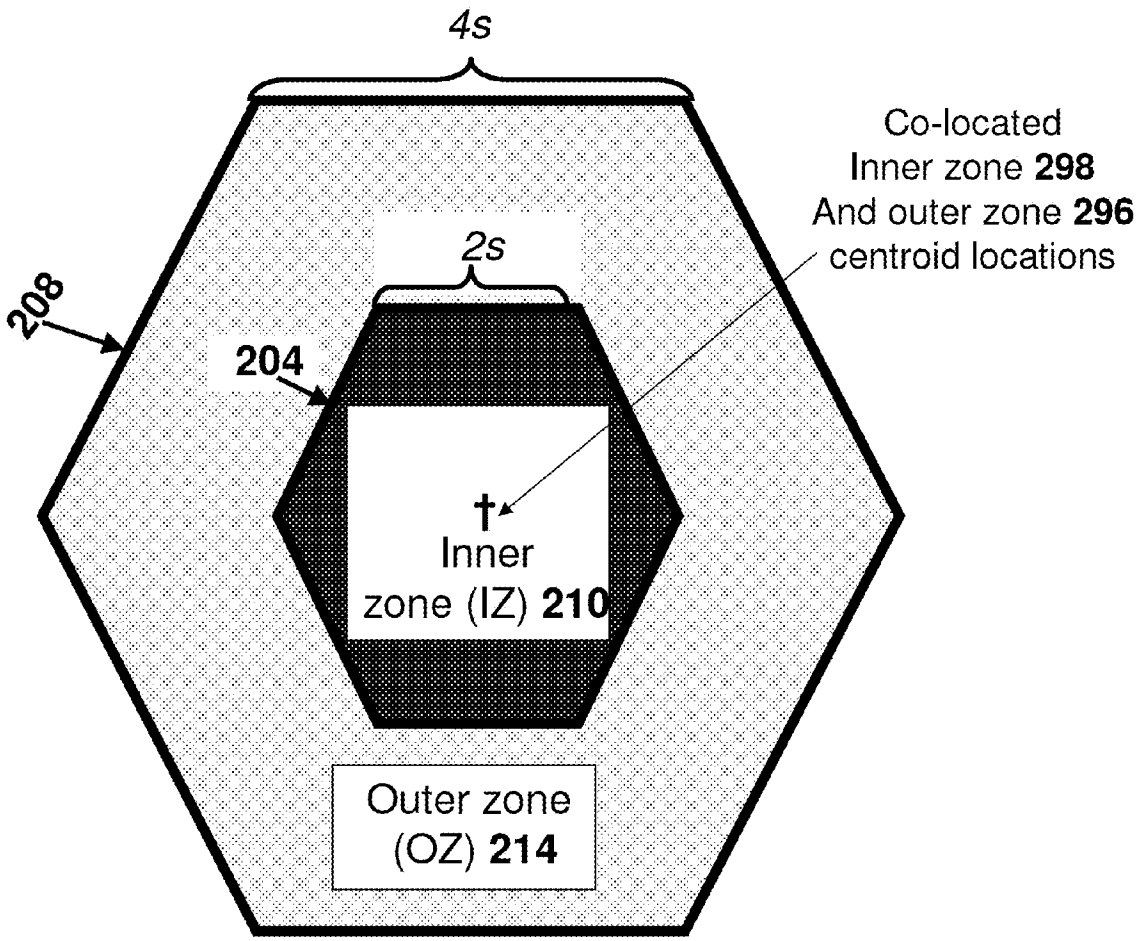

As illustrated in FIG. 2B, inner 210 and outer 214 zones are (i) nested so that outer zone 214 surrounds inner zone 210, (ii) share a common centroid location 298, and (iii) have like-shaped perimeters 204, 208. In the example of FIGS. 2A-2E, inner 204 and outer 208 zone perimeters are both regular hexagons. In the non-limiting example of FIGS. 2A-2E, inner zone heaters are 226 dispersed throughout the inner zone at exactly a uniform spacing s. In the example if FIGS. 2A-2E, inner zone heaters 226 are uniformly arranged on an equilateral triangular grid throughout the inner zone 210—a length of each triangle side is s.

Within outer zone 214, an 'average heater spacing' is approximately double that of the inner zone. Along outer perimeter 208, heaters are distanced from each other by 2s. For every pair of adjacent heaters situated on outer perimeter 208, a third heater on inner perimeter 206 is distanced from both heaters of the pair of adjacent heaters by 2s.

In the example of FIGS. 2A-2E, twelve outer zone heaters are uniformly distributed around regular hexagonally-shaped outer perimeter 208 so that adjacent heaters on outer perimeter 208 (i) are separated by a separation distance 2s; and (ii) subtend an angle equal to 30 degrees relative to the center 298 of outer zone.

An area enclosed by inner perimeter 204 (i.e. an area of inner zone 210) is equal to $6\sqrt{3}s^2$ while an area enclosed by outer perimeter 208 (i.e. an area of the 'combined area' that is the sum of inner 210 and outer 214 zones) is equal to 24 $\sqrt{3}s^2$ or four times the area enclosed by the inner perimeter 204. An area ratio between areas of the outer 210 and inner 214 zones is three.

The heater spatial density in inner zone 210 significantly exceeds that within outer zone 214. As will be discussed below with reference to FIG. 30, according to a 'reservoir engineering' definition of heater spatial density, the density within inner zone 210 of FIGS. 2A-2E is three times that of outer zone 214.

For the example of FIG. 2A-2E, the heater pattern includes a total of 31 heaters. If the heaters were all drilled at the average inner zone 210 spacing, a total of 61 heaters would be required. Compared to drilling all of the heaters at an average spacing within inner zone 210, the pattern of FIGS. 2A-2E requires only about half as many heaters.

In the example of FIGS. 2A-2E the inner zone and outer zone perimeters 204, 208 are both regularly-hexagonally shaped. In some embodiments, the shapes of the inner and/or outer zone perimeters 204, 208 (and consequently the shape of the inner 210 and/or outer 214 zones) are defined by the locations of the heaters themselves—for example, the heater locations may define vertex locations for a polygon-shaped perimeter.

For example, in some embodiments, inner zone 210 may be defined by a 'cluster' of heaters in a relatively high-spatial-density region surrounded by a region where the density of heaters is significantly lower. In these embodiments, the edge of this cluster of heaters where an observable 'density drop' may define the border (i.e. inner zone perimeter 204) between (i) the inner zone 210 where heaters are arranged in a 'cluster' at a relatively high density and (ii) the outer zone 214.

In some embodiments, the perimeter of outer zone 208 may be defined by a 'ring' (i.e. not necessarily circularly-shaped) of heaters outside of inner zone 210 distributed around a centroid of outer zone 214. This ring may be relatively 'thin' compared to the cluster of heaters that form the inner zone 210. Overall, a local density within this 'ring' of heaters defining outer zone perimeter 208 is relatively high compared to locations adjacent to the ring—i.e. locations within outer zone 214 (i.e. 'internal locations' within outer zone 214 away from inner-zone 204 and outer-zone 208 perimeters) and outside of outer zone 214.

Alternatively or additionally, the inner and/or outer zone perimeters 204, 208 are polygon shaped and are defined such that heaters (i.e. a centroid thereof in a cross-section of the subsurface where the heater pattern is defined) are located at all polygon vertices of perimeters 204, 208. As noted elsewhere, any heater pattern disclosed herein may also be a heater well pattern. As such, the perimeters 204, 208 may be defined such that heater well centroids i.e. in a cross-section of the subsurface where the heater pattern is defined) are located at all polygon vertices of perimeters 204, 208.

Figure 2C:
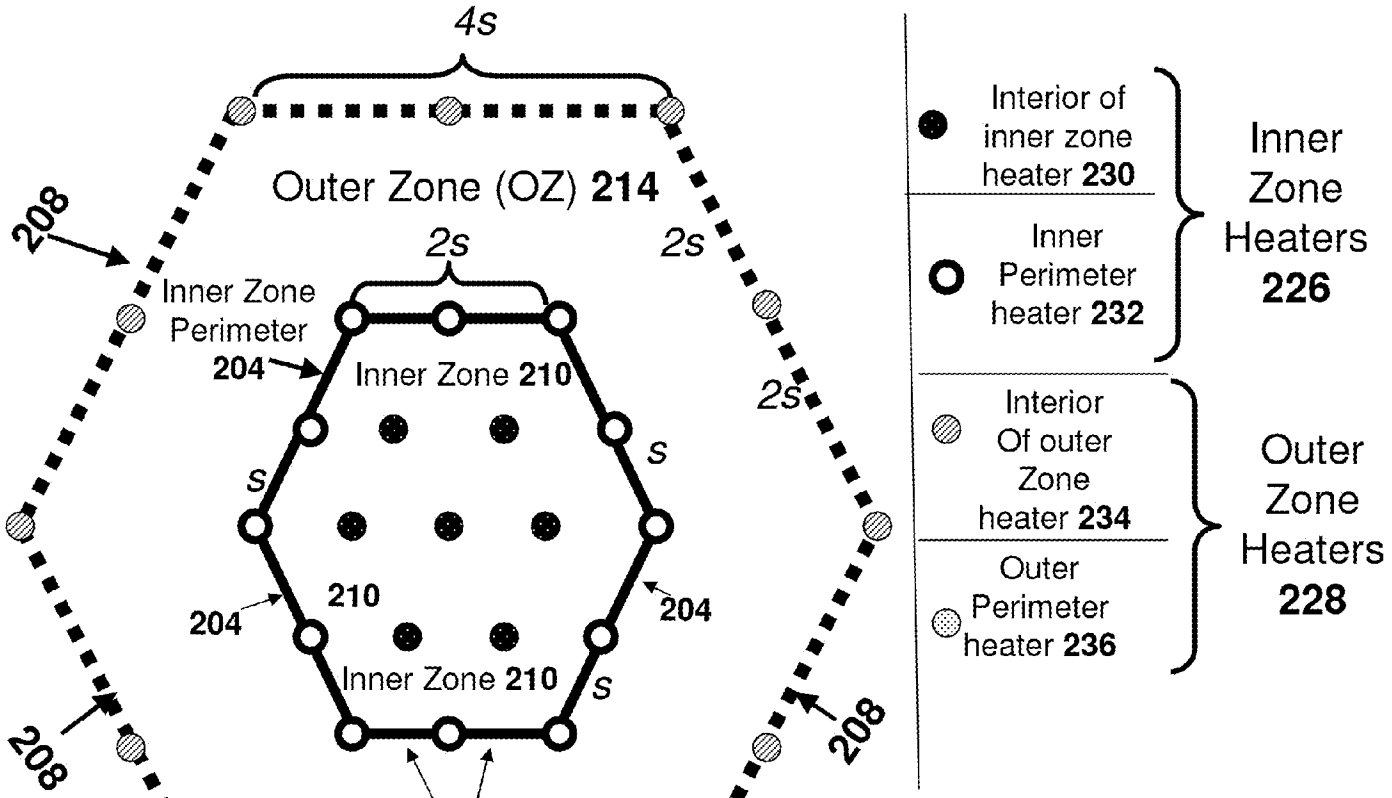

Reference is now made to FIG. 2C. As illustrated in FIG. 2C, heaters are labeled (i.e. for the non-limiting example of FIGS. 2A-2E) as inner zone heaters 226 or outer zone heaters 228. In the example of FIGS. 2A-2E, 19 heaters are inner zone heaters 226 and 12 heaters are outer zone heaters 228. As illustrated in FIG. 2C, heaters may be labeled (i.e. for the non-limiting example of FIGS. 2A-2D) as (i) 'interior of inner zone heaters' 230 located in an 'interior region' of the inner zone 210 away from the inner zone perimeter; (ii) inner perimeter heaters 232; (iii) interior of outer zone heaters' 234 located in an 'interior region' of the inner zone 210 away from the inner zone perimeter; and (iv) outer perimeter heaters 236. In the example of FIG. 2C, there are seven 'interior of inner zone heaters' 230, twelve inner perimeter heaters 232, zero interior of outer zone heaters' 234, and twelve outer perimeter heaters 236.

In the example of FIGS. 2A-2E and FIG. 3, inner 210 and outer 214 zones are like-shaped and shaped as regular hexagons.

Figure 3:
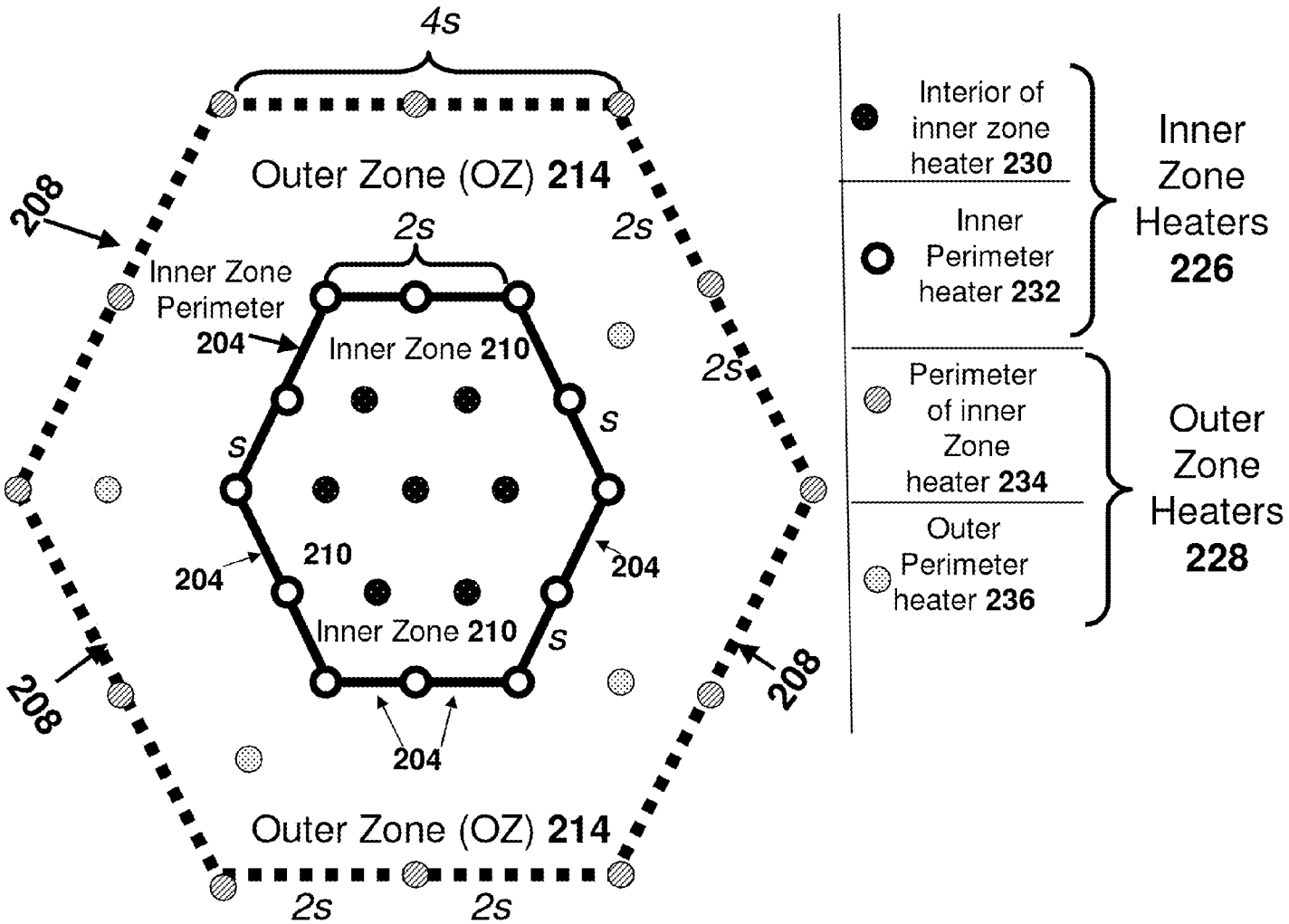
Figure 4A:
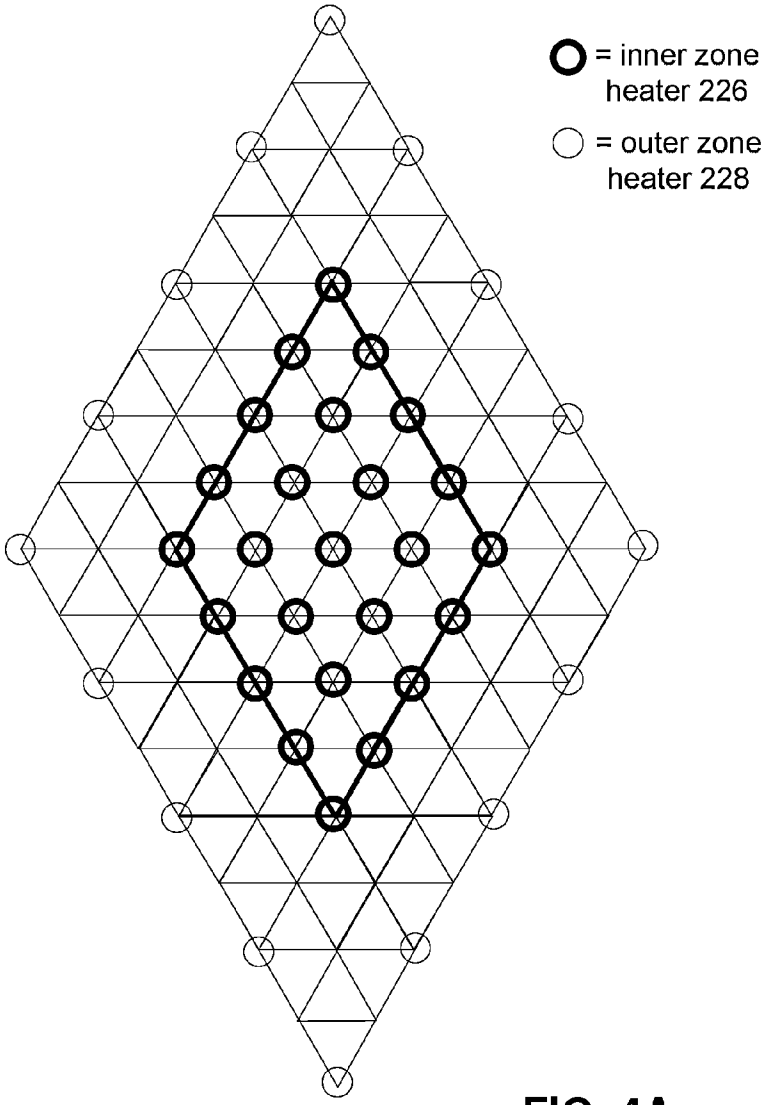
Figure 4B:
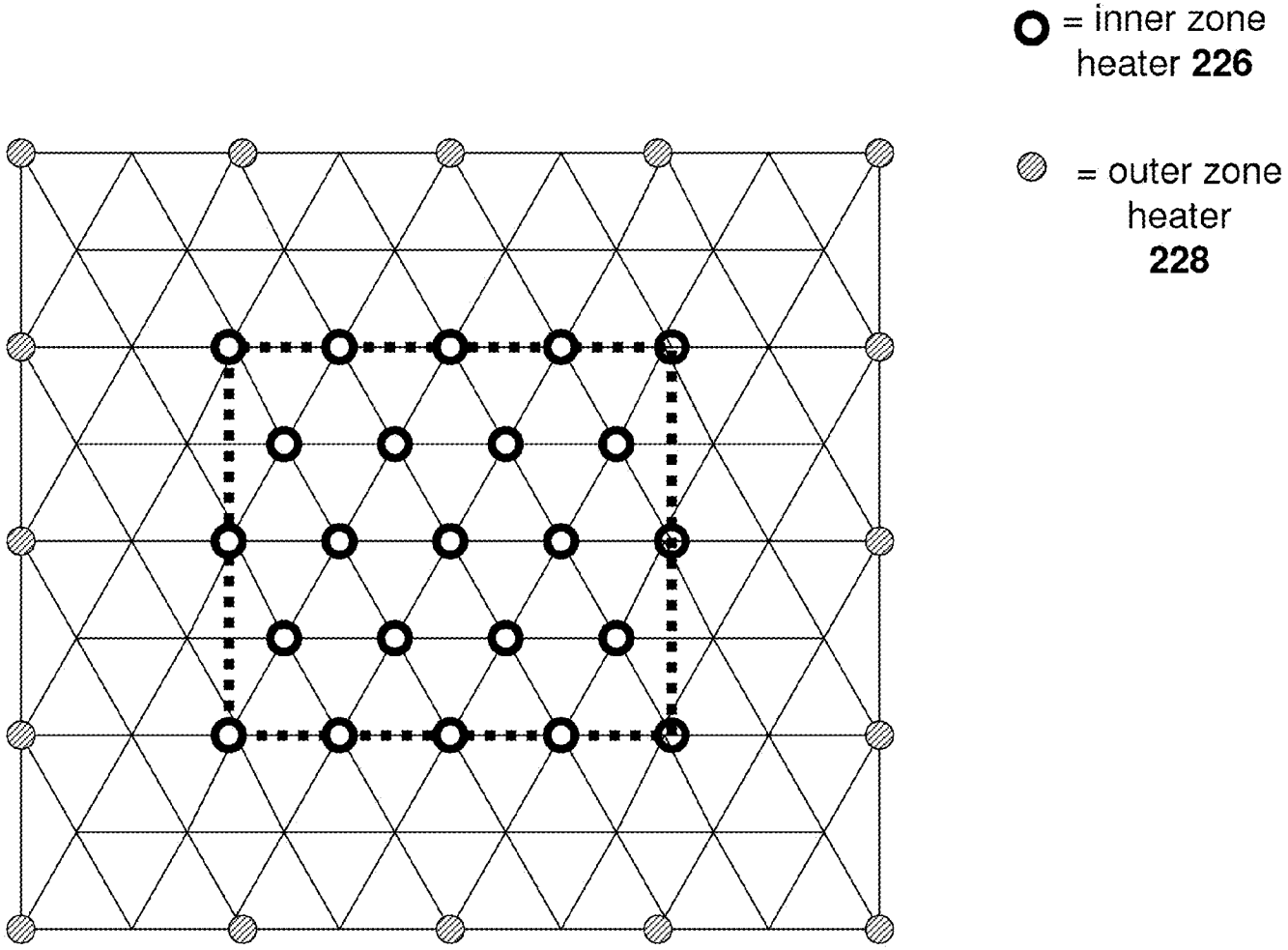
Figure 7A:
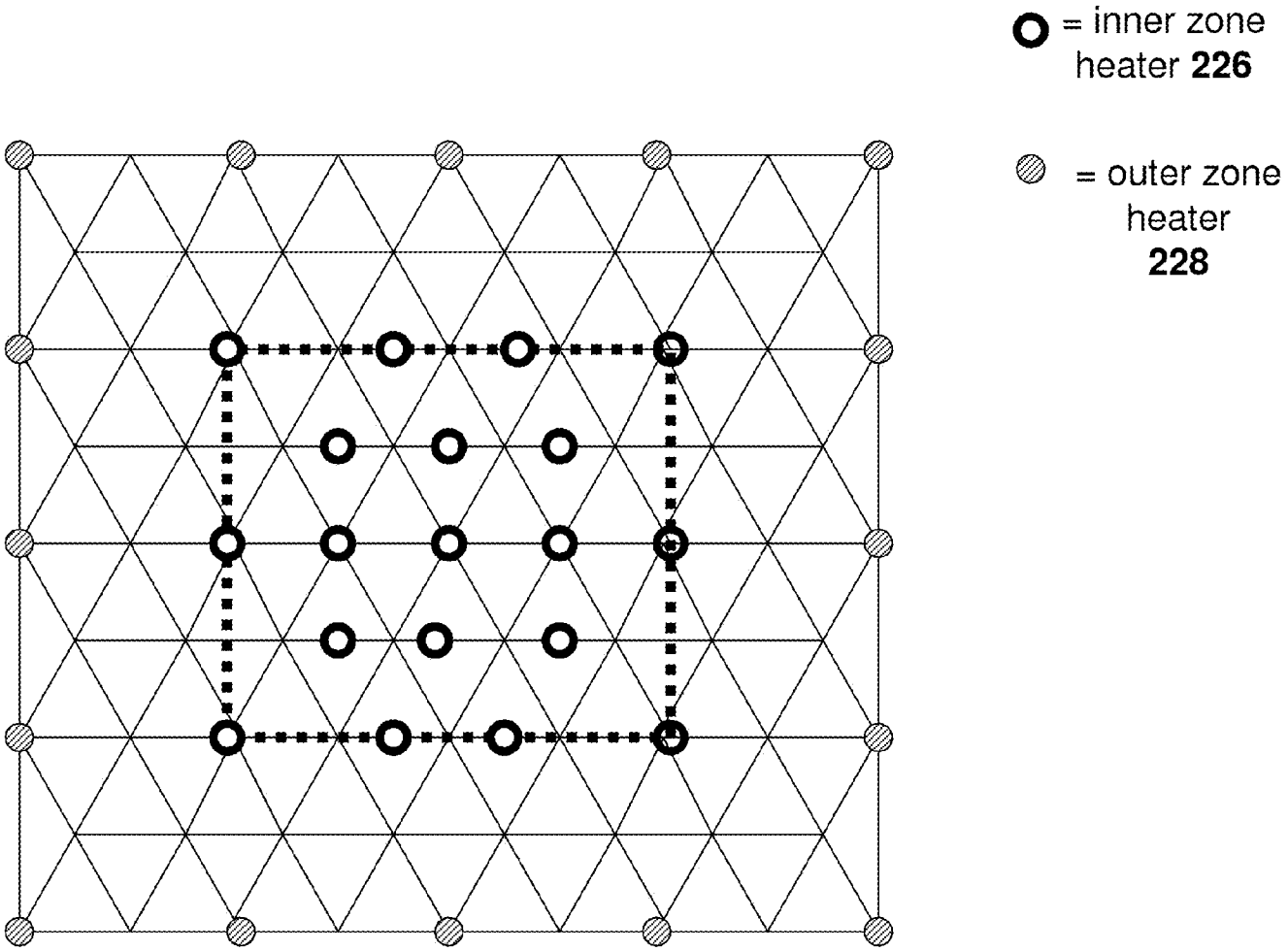
Figure 7B:
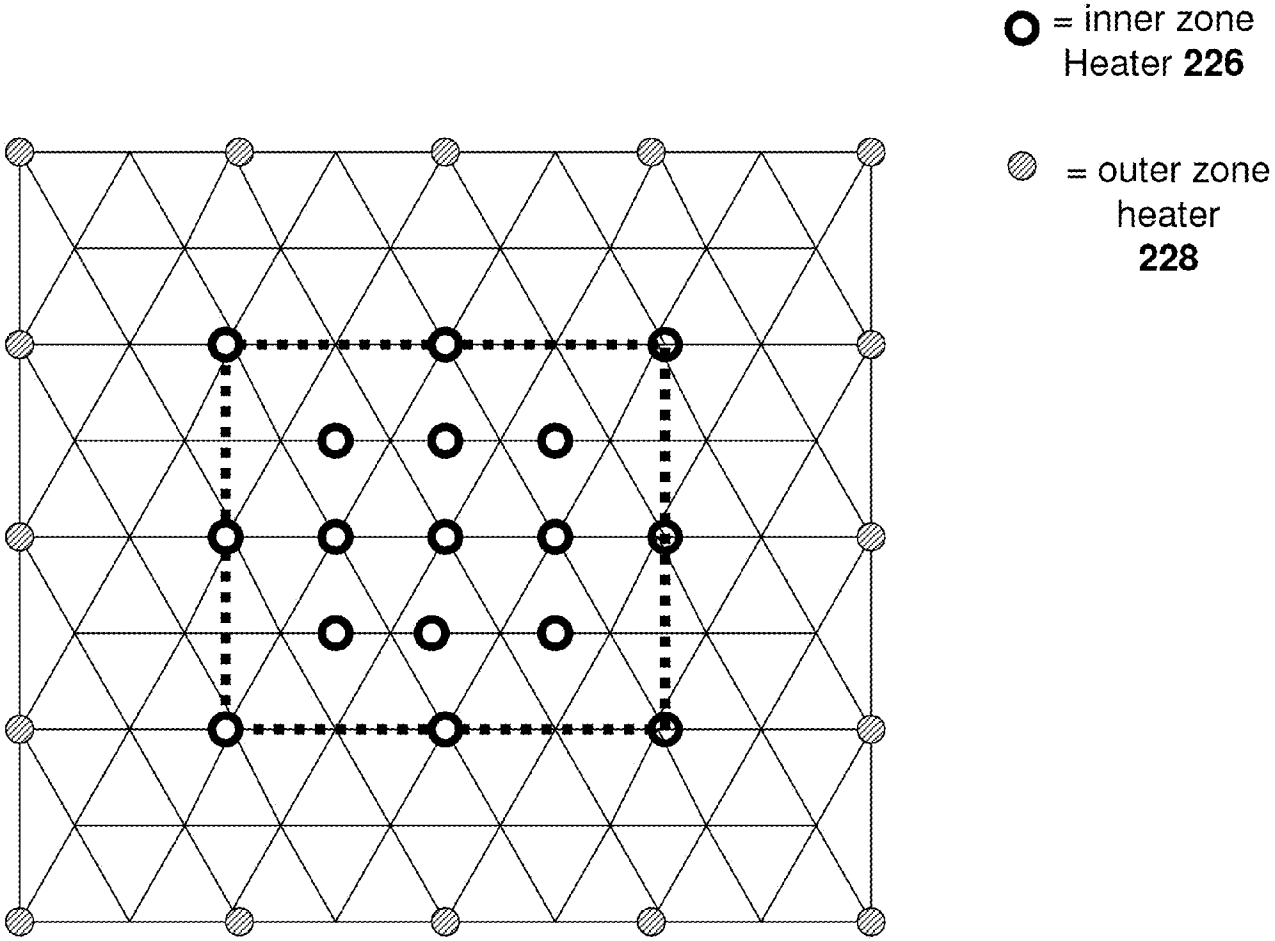

In the example of FIG. 4A, inner 210 and outer 214 zones are each shaped as a lozenge (i.e. a 'diamond-shaped' rhombus having opposing 45-degree angles). In the example of FIG. 4B and FIGS. 7A-7B, inner 210 and outer 214 zones are each rectangular in shape. In the examples of FIGS. 2-3, and FIGS. 8-9, inner 210 and outer 214 zones are each shaped like a regular hexagon. The regular hexagon and the lozenge are examples of 'equi-sided polygons'—i.e. polygons having sides of equal length. In some embodiments, a perimeter of inner and/or outer zone is shaped like an equi-sided polygon.

In one non-limiting example related to FIG. 4B (or to any other embodiment), an aspect ratio of inner 210 and/or outer 214 zones is relatively large—for example, at least 5 or at least 10 or at least 50 or at least 100.

One salient feature of the heater location schemes of FIGS. 2-11 is that outer zone heaters 228 are predominantly located on or near the outer zone perimeter. In some embodiments, this is consistent with the feature of a 'ring of heaters' forming the perimeter 208 of outer zone 210 such that the density within the 'ring of heaters' exceeds that of adjacent locations.

Figure 2D:
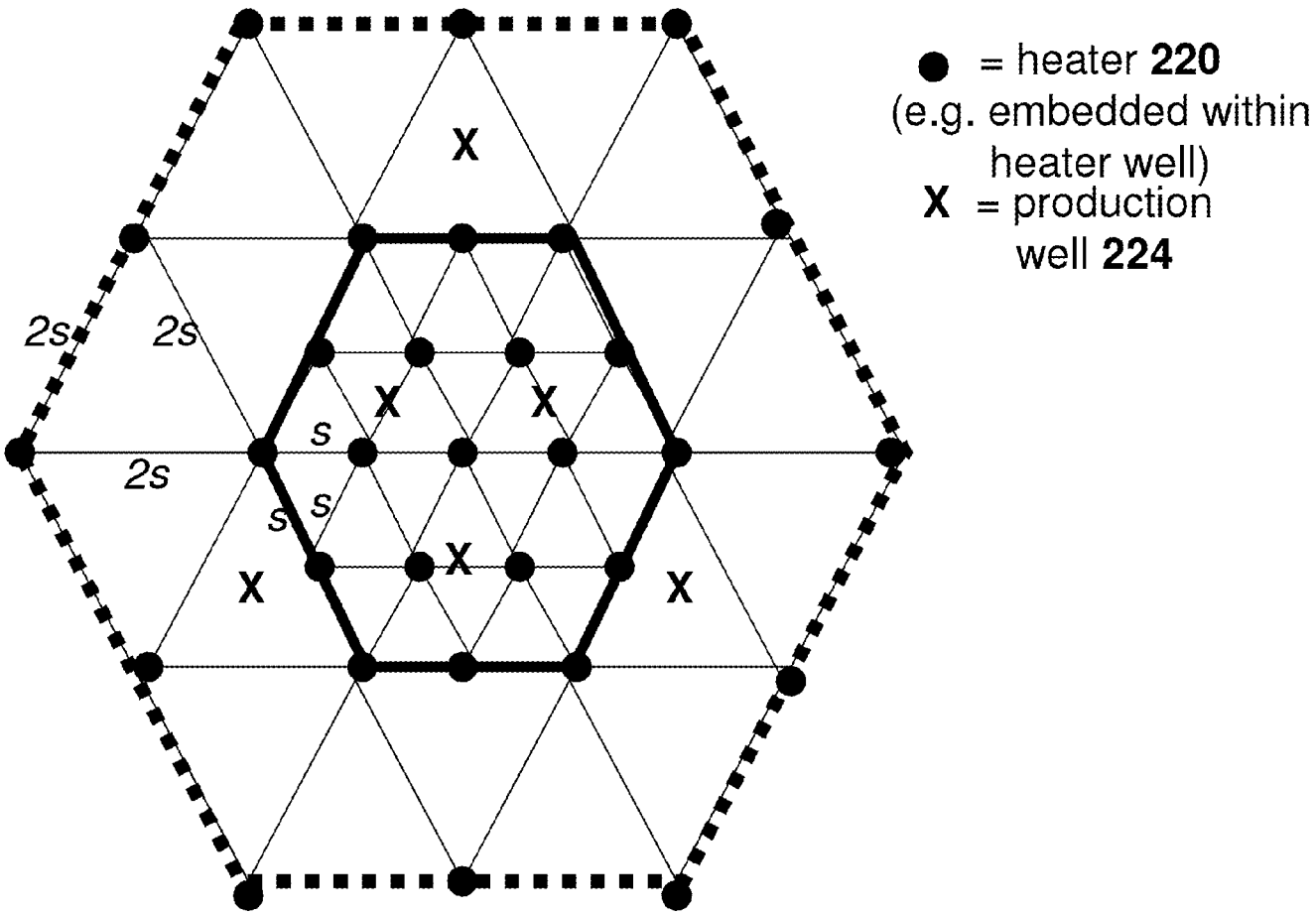

In one example, is possible to compare the heater 'location' or 'layout' scheme illustrated in FIG. 3 to that illustrated in FIGS. 2A-2D. Referring to FIG. 2C, there are seven 'interior of inner zone heaters' 230, twelve inner perimeter heaters 232, four interior of outer zone heaters' 234, and twelve outer perimeter heaters 236. In the example of FIGS. 2A-2D, a ratio between (i) a number of outer perimeter heaters 236; and (ii) a number of interior of outer zone heaters' 234 is infinite. In the example of FIG. 3 this ratio is 3. In different embodiments, this ratio may be at least 1.5 or at least 2 or at least 2.5 or at least 3.

Figure 2E:
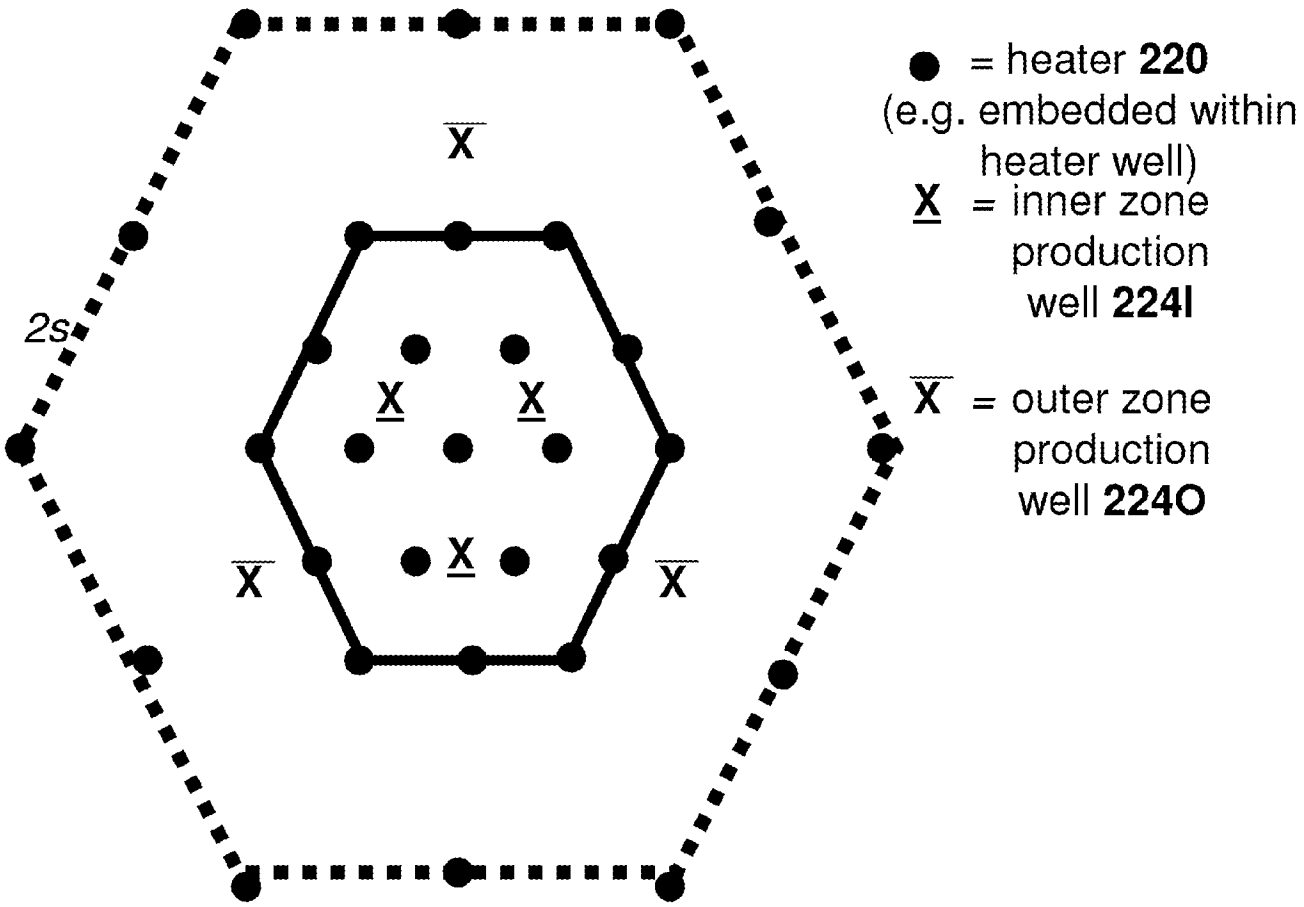

In the examples of FIGS. 2A-2C and FIGS. 3-5 production wells are not explicitly illustrated. FIG. 2D illustrates one non-limiting layout scheme for production wells in a region of a subsurface formation where heaters are arranged according to the schemes of FIGS. 2A-2C. FIG. 2E illustrates an identical layout of heaters and production wells as in FIG. 2E—however, in FIG. 2E inner zone production wells are labeled as 224I while outer zone production wells are labeled as 224O.

In some embodiments, a density of production wells in inner zone significantly exceeds that of outer zone. In the example of FIGS. 2D-2E, the same number of production wells are in each zone—however, the area of the outer zone is three times that of the inner zone. Using a reservoir engineering definition of 'density,' for the example of FIGS. 2D-2E, it is possible to associate 12 heaters with inner zone 210 and 12 heaters with outer zone 214. In addition, three production wells 224I are within inner zone 210 and associated therein, while three production wells 224I are within outer zone 214 and associated therein. Thus, in both inner 210 and outer 214 zones there is a 4:1 ratio between heaters and production wells. In some embodiments, for every zone the ratio between heaters and production wells is between two and six.

The heaters and/or production wells may also be drilled horizontally, or they may be slant drilled, or a combination of vertical, horizontal and slant drilling. Horizontal drilling may be preferable for a commercial development because of the smaller surface footprint and hence reduced infrastructure expenditures.

Figure 5A:
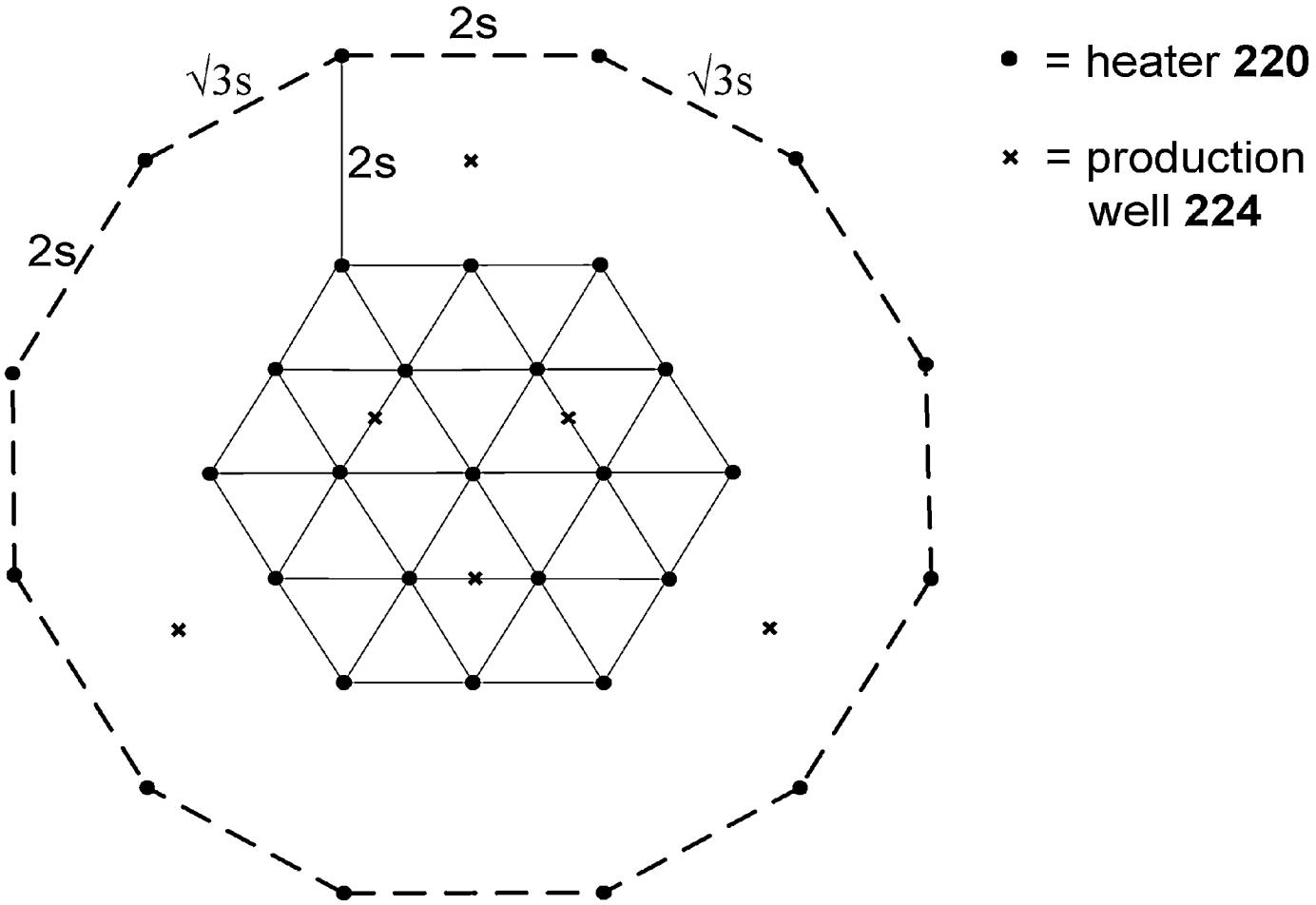
Figure 5B:
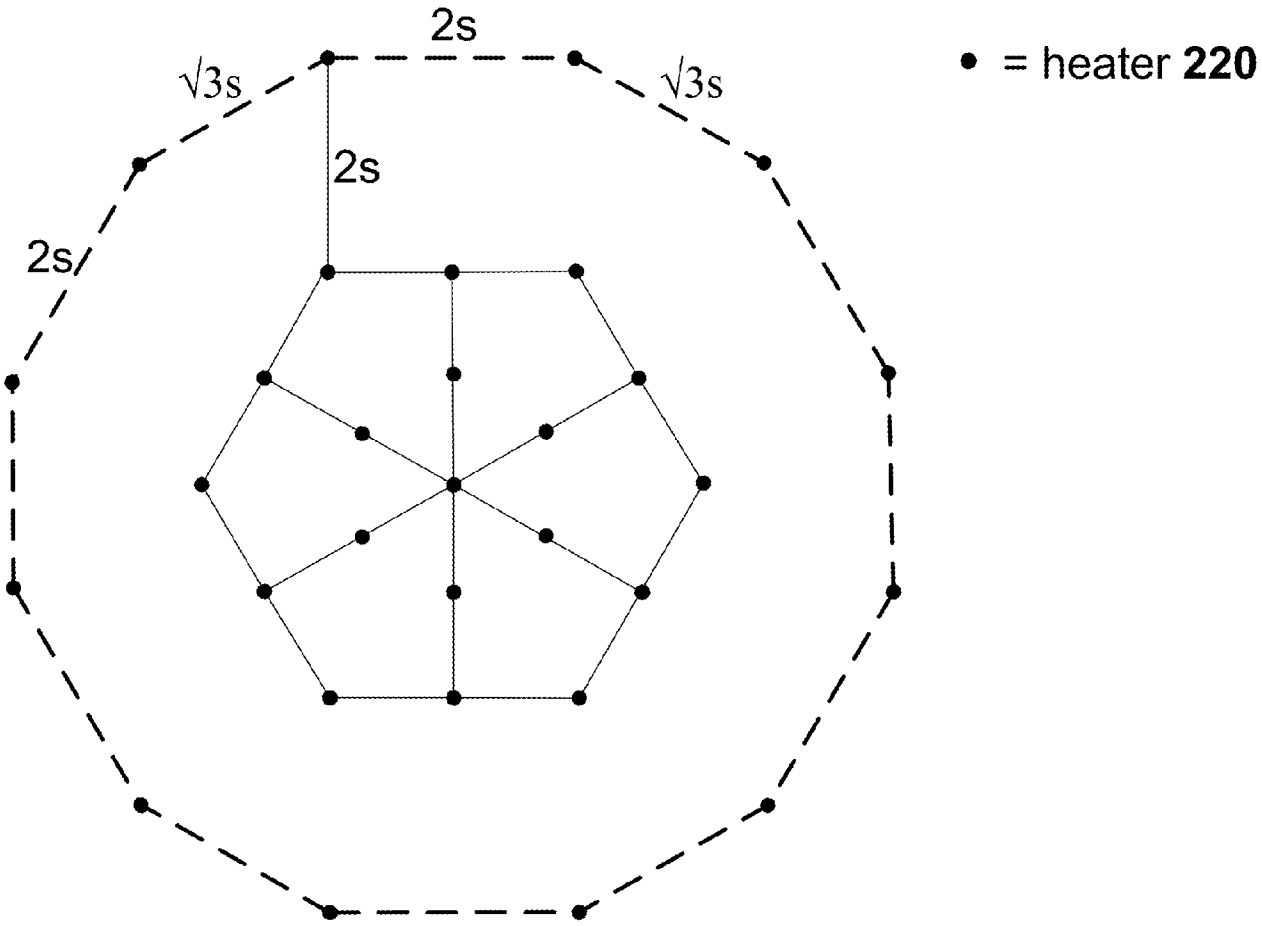
Figure 6A:
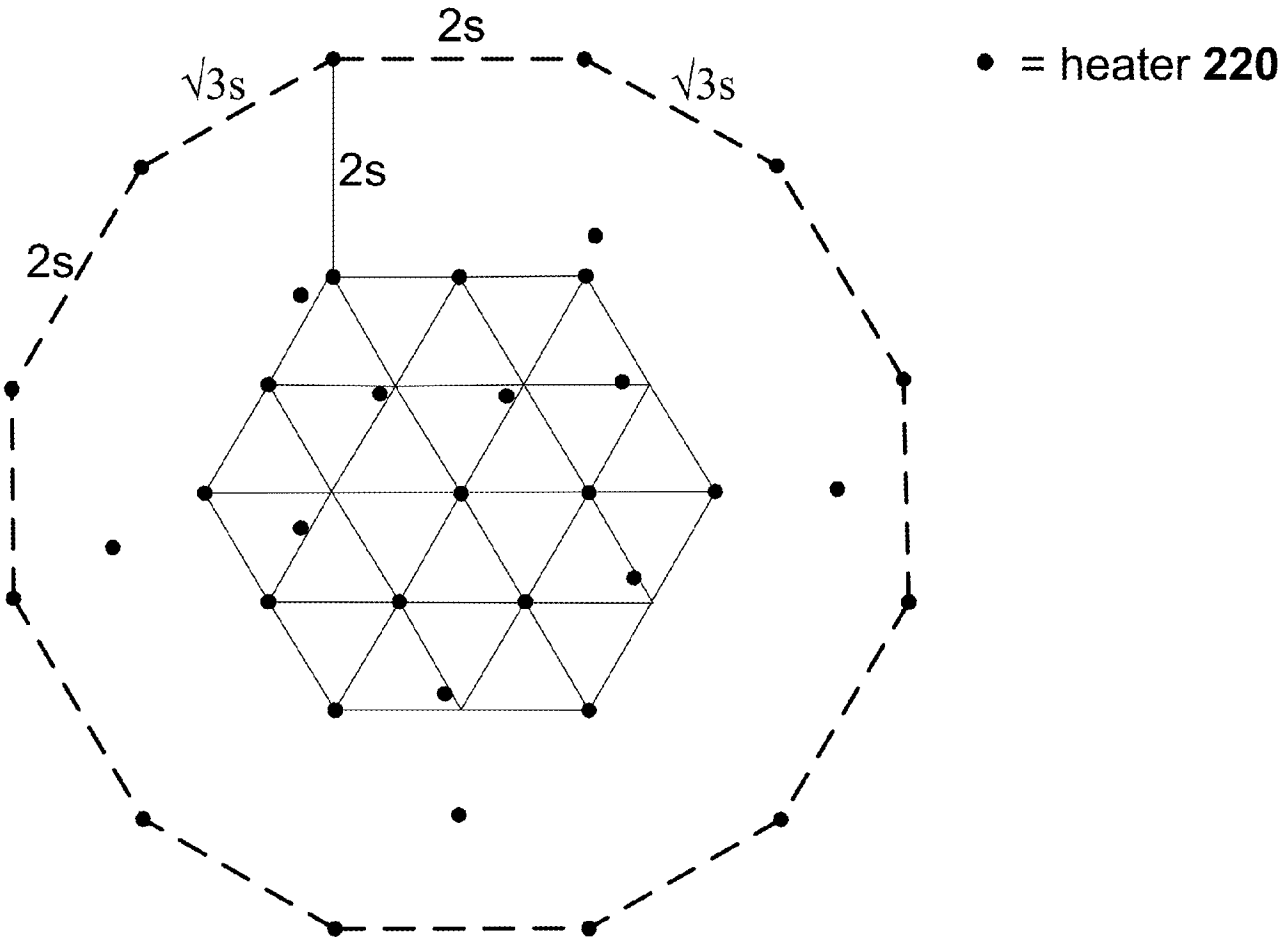
Figure 6B:
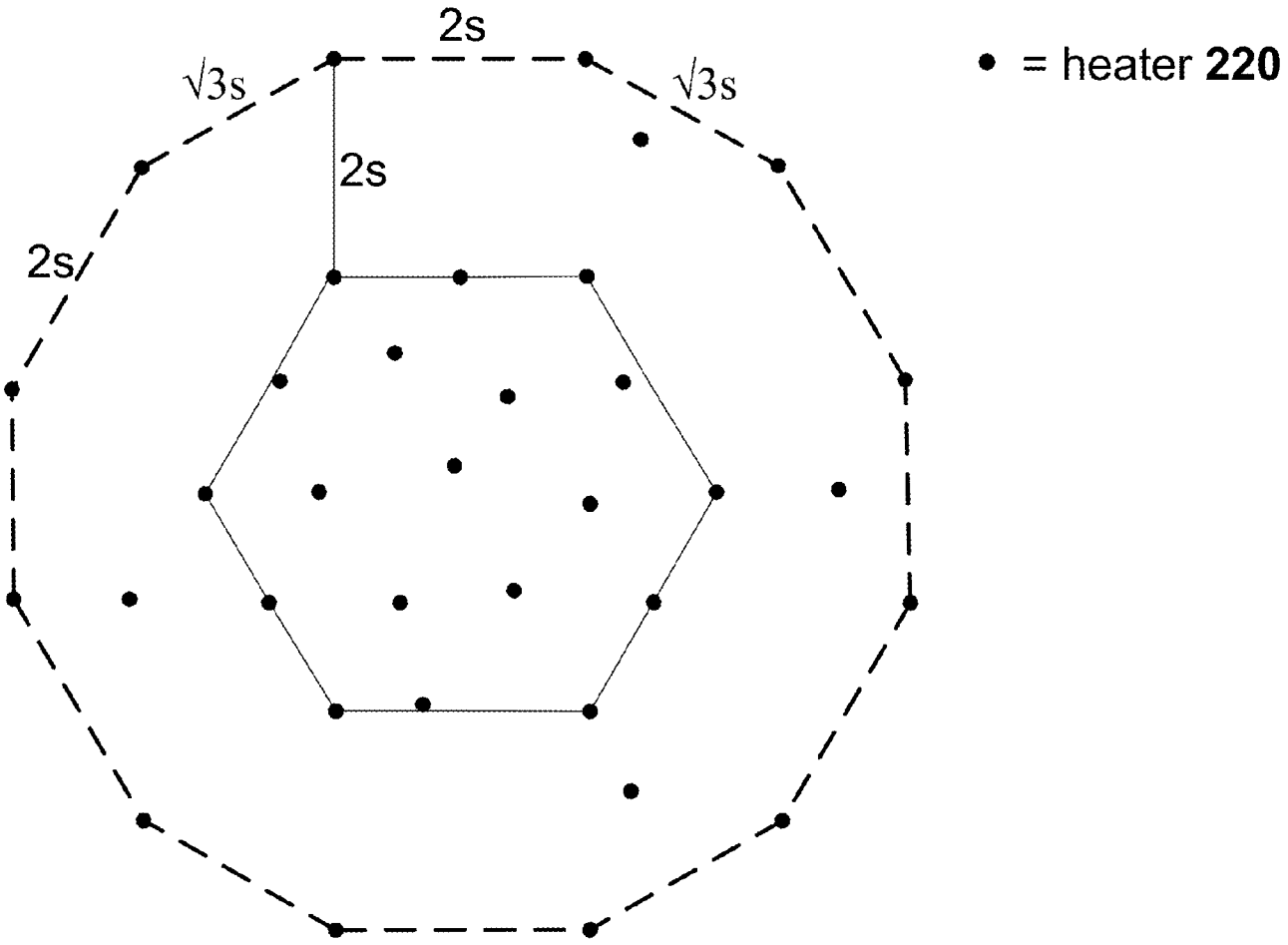

FIGS. 5-6 illustrate additional heater patterns. In the example of FIG. 5B, respective heaters of ring of six 'mid-region' heaters are each located within inner zone 210 (i) approximately midway between a center of inner zone 210 and the inner zone perimeter 204; and (ii) substantially collinear with both the inner zone center 298 and a mid-point between adjacent hexagon vertices. Because heaters are located both in the inner zone center 298 and at the mid-point locations of hexagon sides, a 'spoke' pattern of six spokes may be observed in the example of FIG. 5B.

Figure 8:
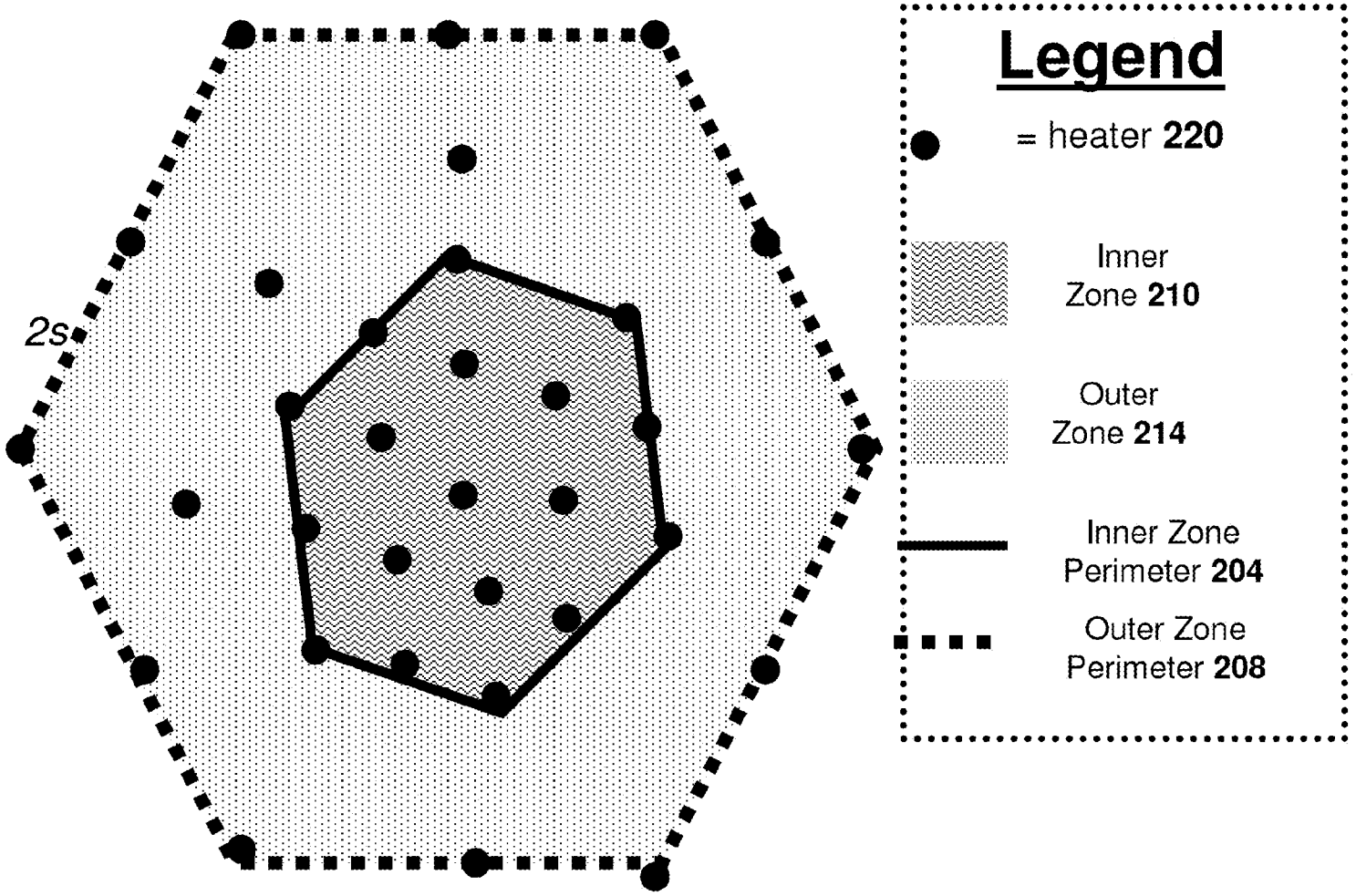
Figure 9:
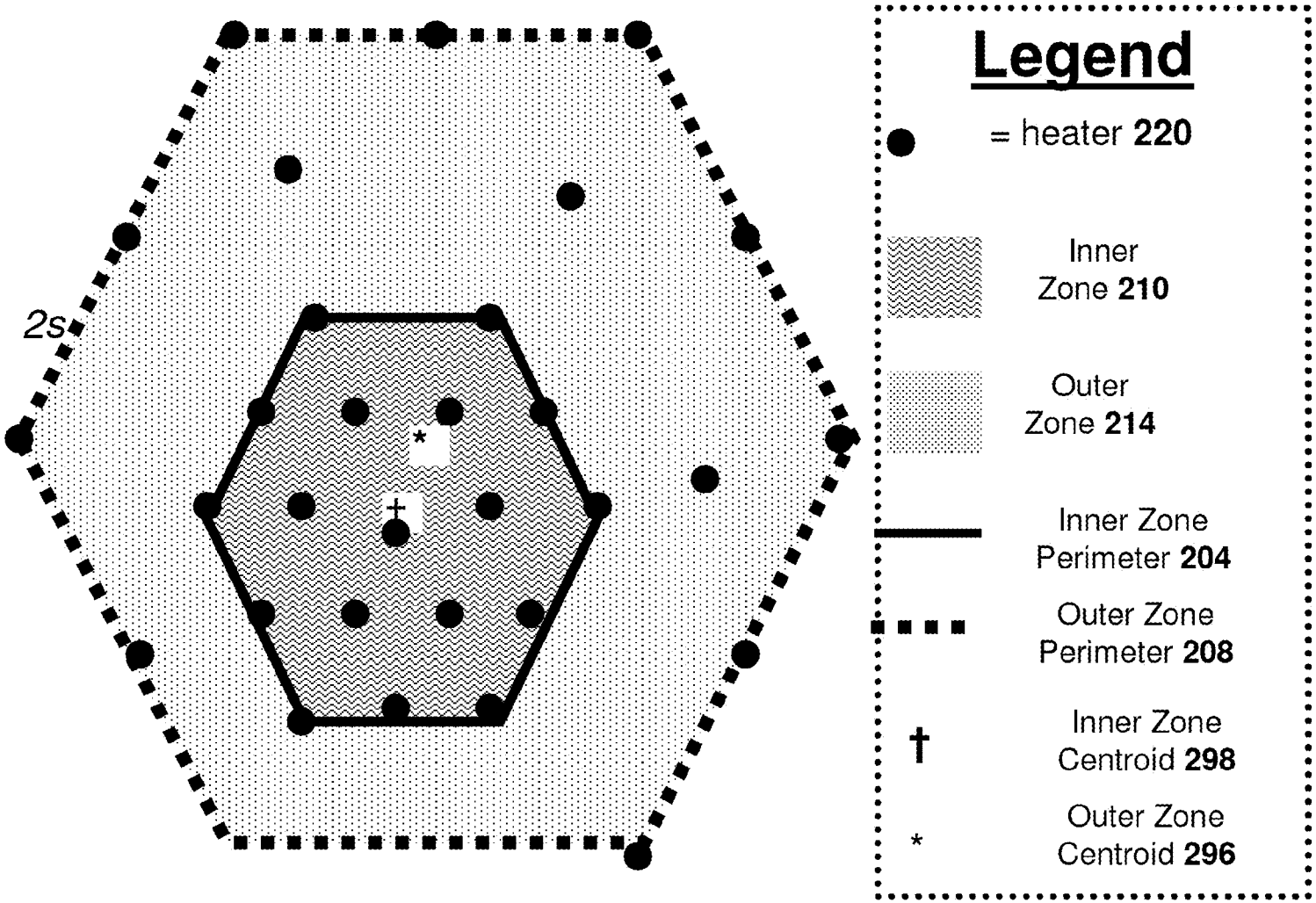
Figure 10A:
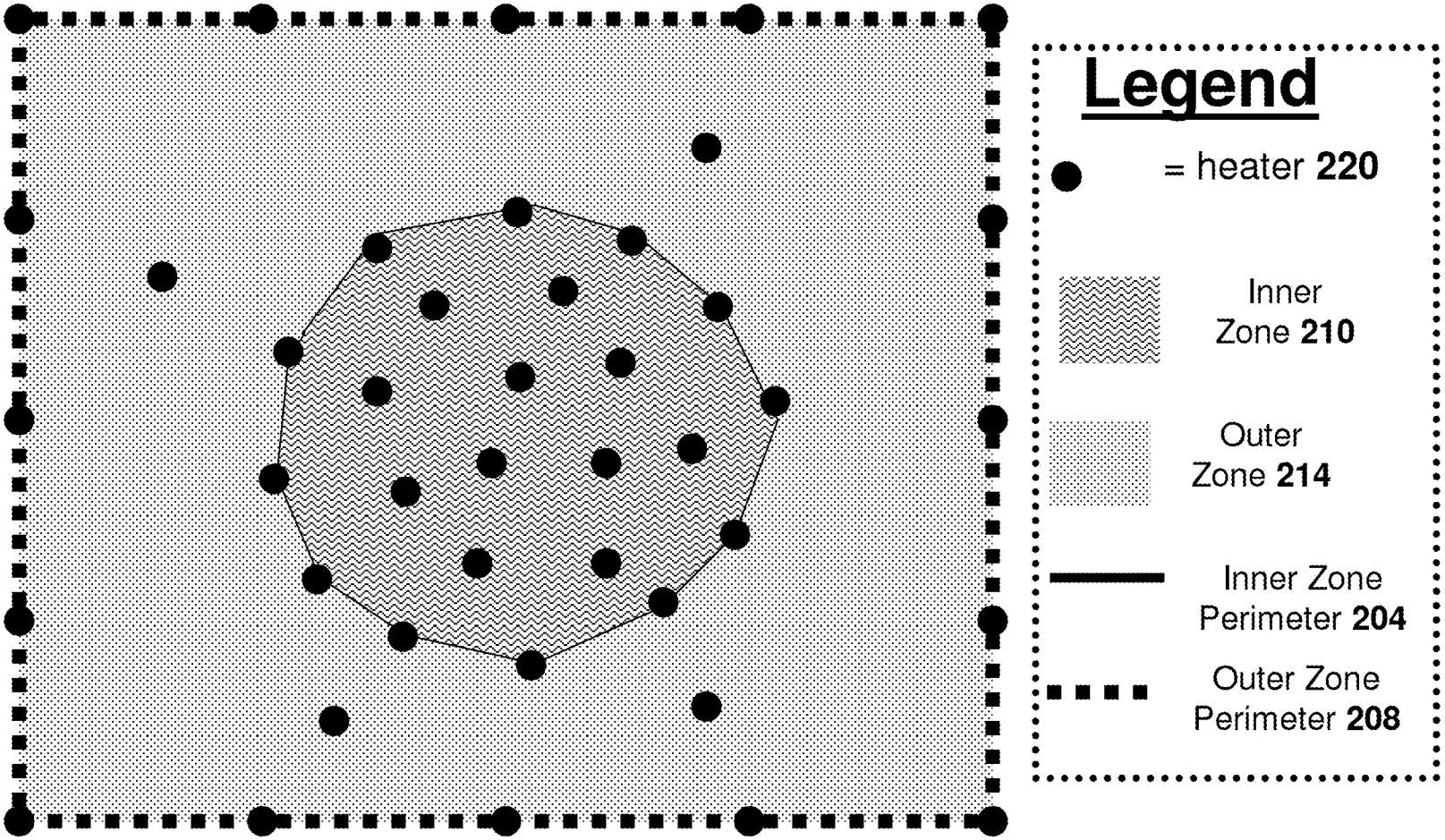
Figure 10B:
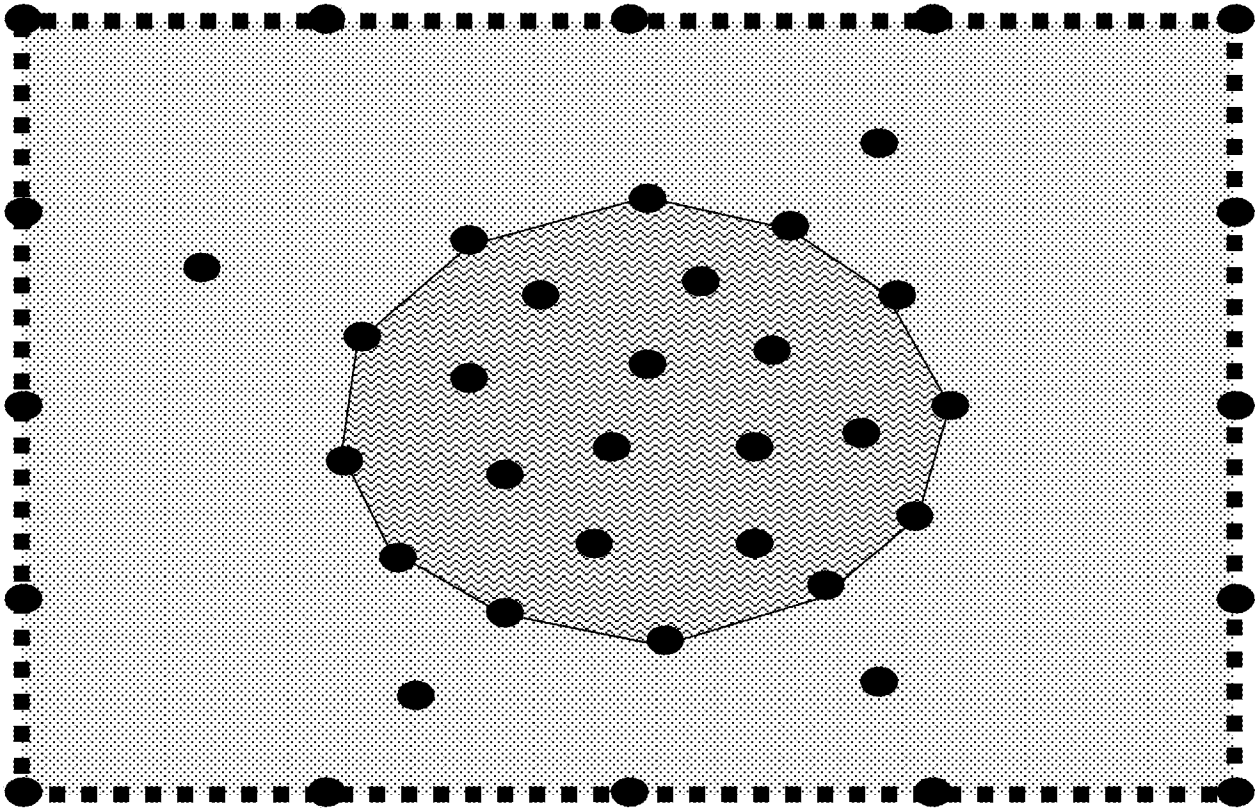
Figure 11:
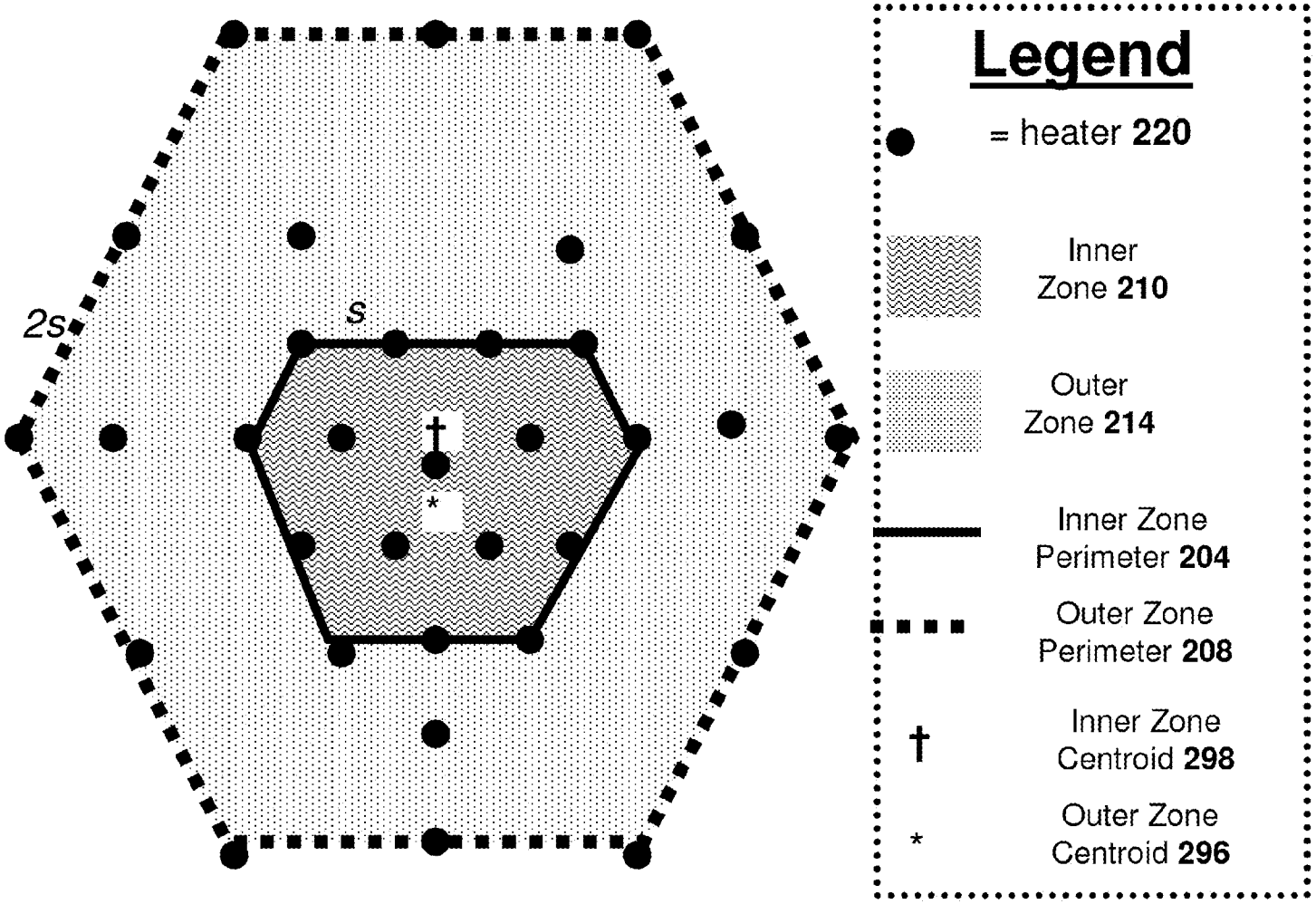

In the examples of FIGS. 2-4 and 7-9, inner 210 and outer 214 zones have like-shaped perimeters 204, 208, share a common centroid location, and share a common orientation. In FIG. 8, inner 210 and outer 214 zones (and their perimeters 204, 208) have different orientations. In the example of FIG. 9, inner zone centroid 298 is offset from outer zone centroid 296. Nevertheless, even in the case of FIG. 9, the centroid 298 of inner zone 210 is located in a 'central portion of the region enclosed by outer zone perimeter 208.

In the examples of FIGS. 2-4 and 7-9, inner 210 and outer 214 zones have like-shaped perimeters 204, 208. In contrast, in the examples of FIGS. 5-6 and 10-11, the shapes of inner 204 and outer 208 zone perimeters are different.

Some features disclosed herein may be defined relative to a 'characteristic length' within inner 210 or outer 214 zones. For the present disclosure, a 'characteristic length' within a region of a cross-section of the subsurface formation is a square root of an area of the region. Thus, a 'characteristic inner zone length' is a square root of an area of inner zone 210, and a 'characteristic inner zone length' is a square root of an area of outer zone 214. For the 'regular hexagon' example of FIGS. 2-3, and 8-9, (i) the area of inner zone 210 is $6\sqrt{3}s^2$ so that the 'characteristic inner zone length' is approximately 3.2s; (ii) an area of outer zone 214 is three times that of inner zone 210 so that the 'characteristic outer zone length' is approximately 5.6s. For the 'lozenge' example of FIG. 4A, (i) the area of inner zone 210 is $8\sqrt{3}s^2$ so that the 'characteristic inner zone length' is approximately 3.7s; (ii) an area of outer zone 214 is three times that of inner zone 210 so that the 'characteristic outer zone length' is approximately 6.4s.

It is appreciated that heaters are typically within heater wells (e.g. having elongate sections), any heater spatial pattern (and any feature or combination of feature(s)) disclosed herein may also be a heater well pattern.

One salient feature of the pattern/arrangement of FIG. 2D is the presence of production wells both within inner 210 and outer 214 zones.

In these patterns, one or more production wells may be located within the inner, and one or more production wells may be located within the outer zone. The number of production wells and the placement of the production wells within the zone may depend on a number of physical and economic considerations including but limited to: the permeability of the resource, reservoir pressures, density of heater wells, heat injection rate, fluid flow paths, and well costs. For example, there may be a tradeoff between the incremental cost of an increased number of production wells and the resulting lower average reservoir pressure and higher oil recovery efficiency. In another example, production well locations may define the fluid flow paths, and flow of hydrocarbon fluids nearby heater wells may cause more cracking or coking, leading to lower oil recovery efficiency. A reservoir simulation program such as STARS made by Computer Modeling Group, LTD may be used to determine the economically optimized number and location of production wells in the inner and outer zones.

One or more production wells are needed within the inner zone in order to enable the earlier production from the closer heater spacing in the inner zone. Higher pressures may develop in the inner zone unless one or more production wells are located in the inner zone.

In addition, one or more production wells are needed in the outer zone because once the inner zone has been substantially pyrolyzed, hydrocarbons generated in the outer zone may experience more cracking and coking from flow paths directed towards the one or more inner zone production wells.

Having patterns with both one or more inner and outer zone production wells allows convection of heat from fluid flow from the inner zone into the outer zone. This also provides additional operational flexibility so that after the inner zone has been substantially pyrolyzed, one or more inner zone production wells may be shut in to encourage convection of heat from the inner zone into the outer zone.

In various embodiments, some or all (i.e. any combination of) the following features related to 'heater patterns' may be observed:

(A) A heater spatial density, within the inner zone 210 significantly exceeds that of the outer zone 214 and/or an 'average spacing between neighboring heaters' within the outer zone 214 significantly exceeds that of the inner zone 210 and/or within outer zone 214, an average distance to a nearest heater significantly exceeds that of inner zone 210. As will be discussed below with reference to FIGS. 12A-12D, in some embodiments, heater patterns providing this feature may be useful for expediting a rate of conversion of kerogen and/or bitumen of the hydrocarbon-bearing formation into hydrocarbon fluids within inner zone 210 so that an inner zone production peak 310 occurs in an earlier stage of production, and an outer zone production peak 330 only occurs after a delay.

(B) Inner zone heaters 226 and outer zone heaters 228 are distributed 'around' respective centroids 298, 296 of inner 210 and outer 214 zones. As will be discussed below (see FIGS. 26A-26B), when heaters are distributed 'around' a centroid then for every orientation of a 'reference ray' starting at an 'origin' at the location of the centroid (296 or 298), at least one heater is located (i.e. the heater cross section centroid is located) in every quadrant (i.e. every 90 degree sector) defined by the origin/centroid (296 or 298). In different embodiments, heaters are arranged within inner 210 and/or outer 214 zones so that inner zone heaters 226 or outer zone heaters 228 are present on every 72 degree sector or on every 60 degree sector or on every 45 degree sector of inner or outer zones for every reference ray orientation.

(C) Outer zone heaters 228 are predominantly located on or near the outer zone perimeter 208. In some embodiments, the relatively high density of heaters in inner zone 210 causes an outward flow of thermal energy from inner zone 210 into outer zone 214. Arrangement of outer zone heaters 228 so that they are predominantly located on or near the outer zone perimeter 208 may facilitate the 'inward flow' of thermal energy so as to at least partly 'balance' the outward flow of thermal energy into outer zone 214 from inner zone 210.

In some embodiments where heaters are deployed at most sparsely in the interior portion of outer zone 210 away from inner and outer zone perimeters 204, 208. This may be useful for reducing a number of heaters required to produce hydrocarbon fluids in a required manner. Furthermore, the relative lack of heaters within the 'middle portion' of outer zone 210 (i.e. distanced from both perimeters 204, 208) may delay production of fluids from this middle portion of outer zone 210 and within outer zone 210 as a whole. As will be discussed below, with reference to FIGS. 12A-12E, this delay may be useful for producing hydrocarbon fluids in a manner where a significant production rate (e.g. at least half of a maximum production rate) is sustained for a relatively extended period of time.

(D) A ratio between areas enclosed by the outer 208 and inner 204 perimeters is at least 3 or at least 3.5 and/or at most 10 or at most 9 or at most 8 or at most 7 or at most 6 or at most 5 or at most 4.5 and/or about 4. In the examples of FIGS. 2-4 and 7-9, this ratio is exactly four. In some embodiments, arranging heaters according to any of these ratios may be useful for producing hydrocarbons so that an overall rate of production ramps up relatively rapidly (i.e. short rise time) while is sustained for a relatively extended period of time. In some embodiment, if this ratio is too small, then the amount of time that the rate of production is sustained may be too short and/or the thermal efficiency of the heater pattern may be reduced due to a reduction in the re-use of thermal energy from inner zone heaters within outer zone 210. If this ratio is too large, this may, for example, cause a dip in production after hydrocarbon fluids are rapidly produced within inner zone 210.

(E) The centroid 296 of inner zone 210 is located in a central portion of the region enclosed by outer zone perimeter 208—upon visual inspection of the heater patterns of FIGS. 2-11, it is clear that this is true for all of these heater patterns. In some embodiments, substantially centering the inner zone within outer zone is useful for ensuring that a higher fraction of thermal energy from heaters 226 within inner zone 210 is re-used within outer zone 214, thus increasing the overall thermal efficiency of the heater pattern. Unless specified otherwise, when centroid 296 of inner zone 210 is located in a central portion of the region enclosed by outer zone perimeter 208, centroid 296 of inner zone 210 is in the inner third of a region enclosed by outer zone perimeter 208. In some embodiments, centroid 296 of inner zone 210 is in the inner quarter or inner fifth or inner sixth or inner tenth.

(F) In the example of FIGS. 2-11, there is no contact between perimeters 204, 208 of inner 210 and outer zones 214. In some embodiments, at least 30% or at least a majority of inner zone perimeter 204 is located away from outer zone perimeter 214. In some embodiments, at least a majority or at least a significant majority (i.e. at least 75%) of the inner zone heaters are located away from the outer zone perimeter 208.

When an inner zone heater or a point on inner zone perimeter 204 is located away from a perimeter 208 of outer zone 214, this means that the located away inner zone heater (or the located away point on inner zone perimeter 204) is displaced from the outer zone perimeter 208 by at least a threshold distance. Unless otherwise specified, this threshold distance is at least one half of an inner zone average heater spacing.

Alternatively or additionally, in some embodiments, this threshold distance is at least: (i) at least two-thirds of the inner zone average heater spacing and/or (ii) at least the inner zone average heater spacing or (iii) at least an average distance within inner zone (i.e. averaged over all locations within inner zone 210) to a nearest heater; and/or (ii) at least three times (or at least four times or at least five times) the square root of the area of the inner zone divided the number of inner zone heaters. In the example of FIGS. 2-3, the square root of the area of the inner zone is 3.2s and the number of inner zone heaters is 19, so four times the square root of the area of the inner zone is about 0.51s. In the example of FIG. 4, the square root of the area of the inner zone is 3.8s and the number of inner zone heaters is 25, so four times the square root of the area of the inner zone is about 0.44s.

(G) Perimeters 204, 208 of inner 210 and/or outer 214 zones are convex or substantially convex—the skilled artisan is directed to the definition of 'substantially convex' described below with reference to FIG. 29. In some embodiments, this may be useful for facilitating outward flow of heat generated by inner zone heaters located at or near the perimeter 204 of inner zone 210—e.g. so that heat from inner zone heaters located at or near inner zone perimeter 204 flows outwards into outer zone 214 and toward outer zone perimeter 208 rather than flowing inwards towards a centroid 296 of inner zone 210. In some embodiments, this increases the thermal efficiency of the heater pattern. In some embodiments, a candidate shape is 'substantially convex' if an area enclosed by a minimally enclosed convex shape exceeds the area of the candidate shape by at most 20% or at most 10% or at most 5%.

For the present disclosure, whenever something (i.e. an area or a closed curve such as a perimeter of an area) is described as convex it may, in some embodiments be 'substantially convex.' Whenever something is described as 'substantially convex' it may, in alternative embodiments be convex.

(H) An isoperimetric quotient of perimeters 204, 208 of the inner 210 and/or outer 214 zone is at least 0.4 or at least about 0.5 or at least 0.6. In the present disclosure, an 'isoperimetric quotient' of a closed curve is defined as the isoperimetric coefficient of the area enclosed by the closed curve, i.e.

$$\frac{4\pi A}{P^2}$$

where P is the length of the perimeter of the closed curve, and A is the area enclosed by the closed curve (e.g. an area of inner zone 210 for the 'closed curve' defined by perimeter 204 or the sum of the areas of inner 210 and outer 214 zones for the 'closed curve' defined by perimeter 208).

(I) An 'aspect ratio' of perimeter 204 of inner 210 and/or of perimeter 208 of outer 214 zone is at most 5 or at most 4.5 or at most 4 or at most 3.5 or at most 3 or at most 2.5 or at most 2.0 or at most 1.5. An "aspect ratio" of a shape (i.e. either the shape or an enclosing perimeter thereof) refers to a ratio between its longer dimension and its shorter dimension. In some embodiments, the inner and outer zones have a similar and/or relatively low aspect ratio that may be useful for efficient re-use of inner-zone-generated thermal energy within outer zone' 214 and/or for obtaining a production curve exhibiting a relatively fast rise-time with sustained substantial production rate.

(J) Perimeters 204, 208 of inner 210 and/or outer 214 zones have common shape characteristics. In the example of FIGS. 2-4 and 7-9, inner and outer zone perimeters 204, 208 are like-shaped. This is not the case in FIGS. 5-6 or in FIGS. 10A-10B. Nevertheless, in the example FIGS. 10A-10B, the perimeters 204, 208 of inner and outer zone substantially share a common aspect ratio (i.e. ratio between a longer dimension and a shorter dimensions) and/or substantially share a common isoperimeteric quotient. In some embodiments, $IPQ_{INNER}$ is the isoperimeter quotient of inner zone 210, $IPQ_{OUTER}$ is the isoperimeter quotient of outer zone 214, $MAX(IPQ_{INNER}, IPQ_{OUTER})$ is the greater of $IPQ_{INNER}$ and $IPQ_{OUTER}$, $MIN(IPQ_{INNER}, IPQ_{OUTER})$ is the lesser of $IPQ_{INNER}$ and $IPQ_{OUTER}$, and a ratio $$\frac{MAX(IPQ_{INNER}, IPQ_{OUTER})}{MIN(IPQ_{INNER}, IPQ_{OUTER})}$$

is at most 3 or at most 2.5 or at most 2 or at most 1.75 or at most 1.5 or at most 1.3 or at most 1.2 or at most 1.15 or at most 1.1 or at most 1.05 or exactly 1.

(K) In some embodiments, heaters are 'distributed substantially uniformly' in inner 210 and/or outer 214 outer zone. This may allow for more efficient heating of inner zone 210. In some embodiments, visual inspection of a 'heater layout' diagram describing positions of heater cross sections is sufficient to indicate when heaters are 'distributed substantially uniformly' throughout one or more of the zone(s).

Alternatively or additionally, heaters may be distributed so as to provide a relatively low 'heater standard deviation spacing' relative to a 'heater average spacing in one or more of the zone(s).

Figure 22A:
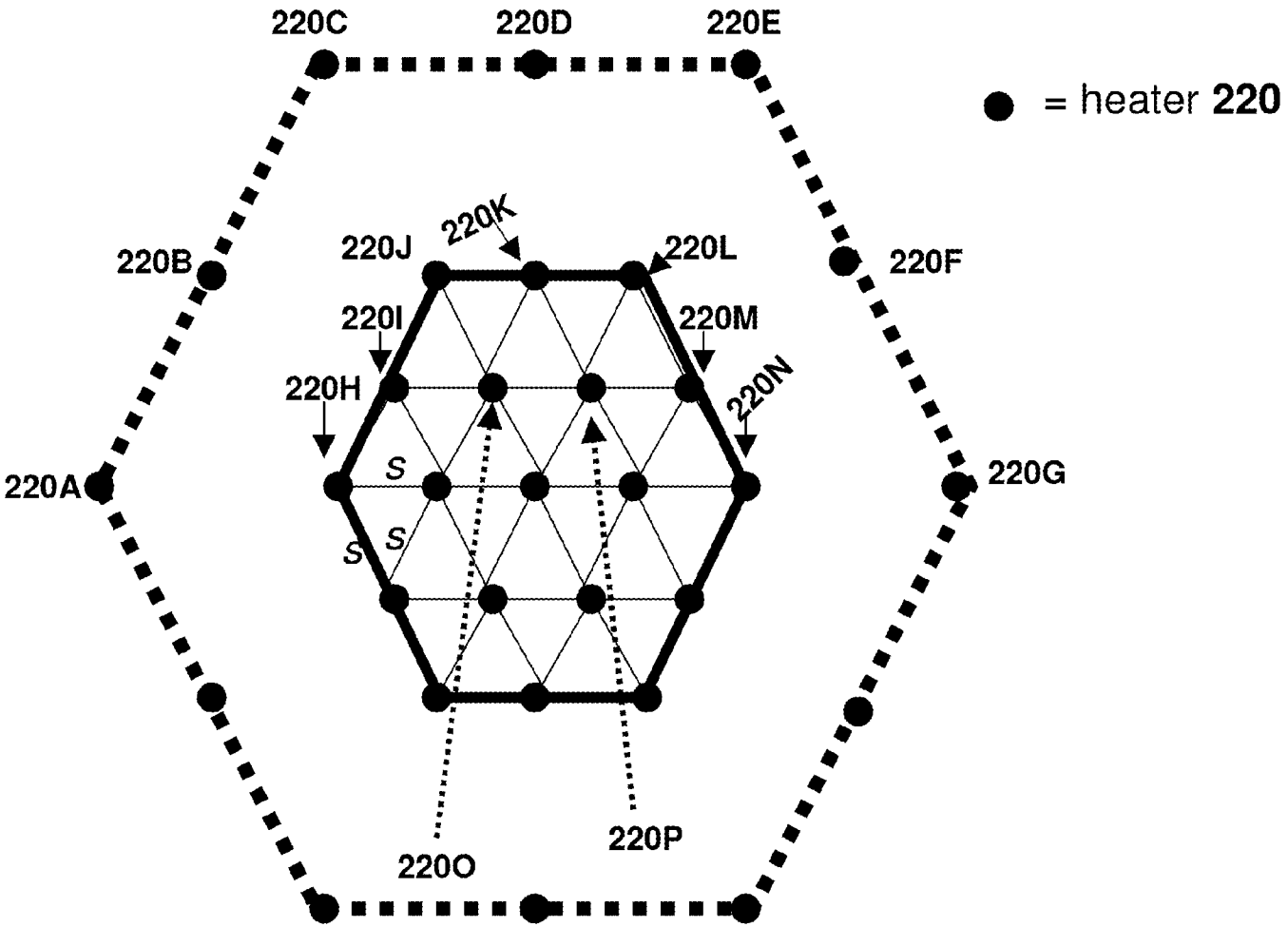
Figure 22B:
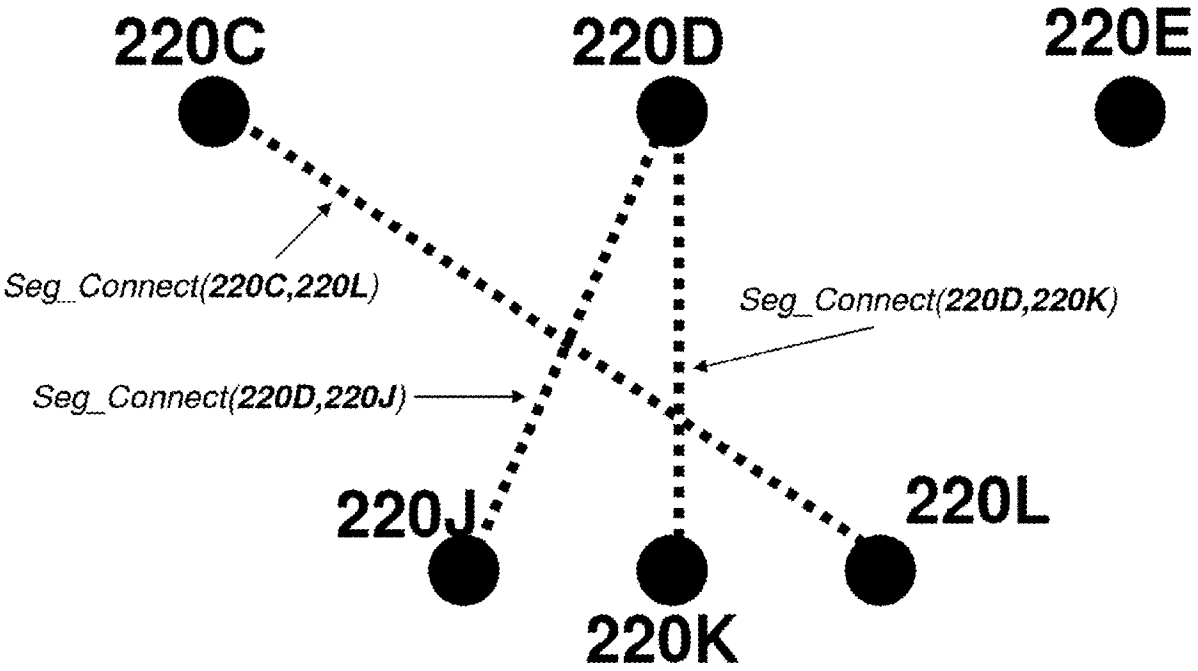
Figure 22C:
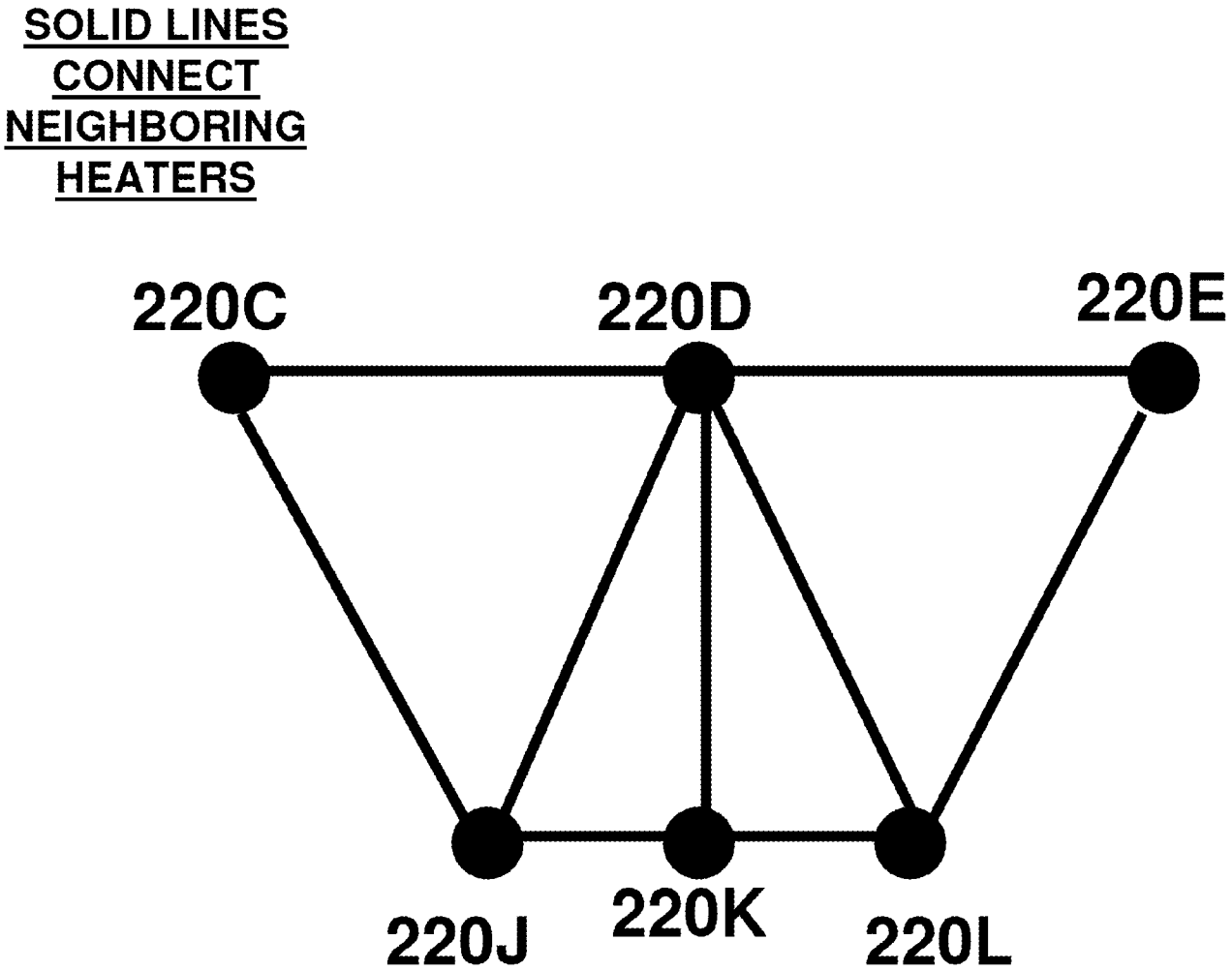

Within any area of the subsurface formation (e.g. within inner zone 210 or outer zone 214), there are a number of 'neighboring heater spacings' within the area of the formation—for example, in FIG. 22C (i.e., there are 36 spacings in outer zone 214 (i.e. 30 of the spacings have values of 2a and 6 of the spacings have values of $\sqrt{3}$ a) and there are 32 spacings in inner zone 210 (i.e. all 36 of the spacings have a value of a). In this example, the average spacing in inner zone 210 is exactly a while the average spacing in outer zone 214 is $$\frac{6\sqrt{3}\,a + 30(2a)}{36} \cong 1.95a.$$

It is also possible to compute a 'standard deviation heater spacing'—in the inner zone 214 this is exactly zero and in the outer zone the 'standard deviation heater spacing' is $$\sqrt{\frac{6(\sqrt{3}\,a - 1.95a)^2 + 30(2a - 1.95a)^2}{36}} \cong \sqrt{\frac{6(0.048a^2) + 30(0.0025a^2)}{36}} \cong \sqrt{\frac{0.36a^2}{36}} = 0.1a.$$

In the example of FIG. 22C, a quotient of the standard deviation spacing and the average spacing is about 0.05.

Figure 24A:
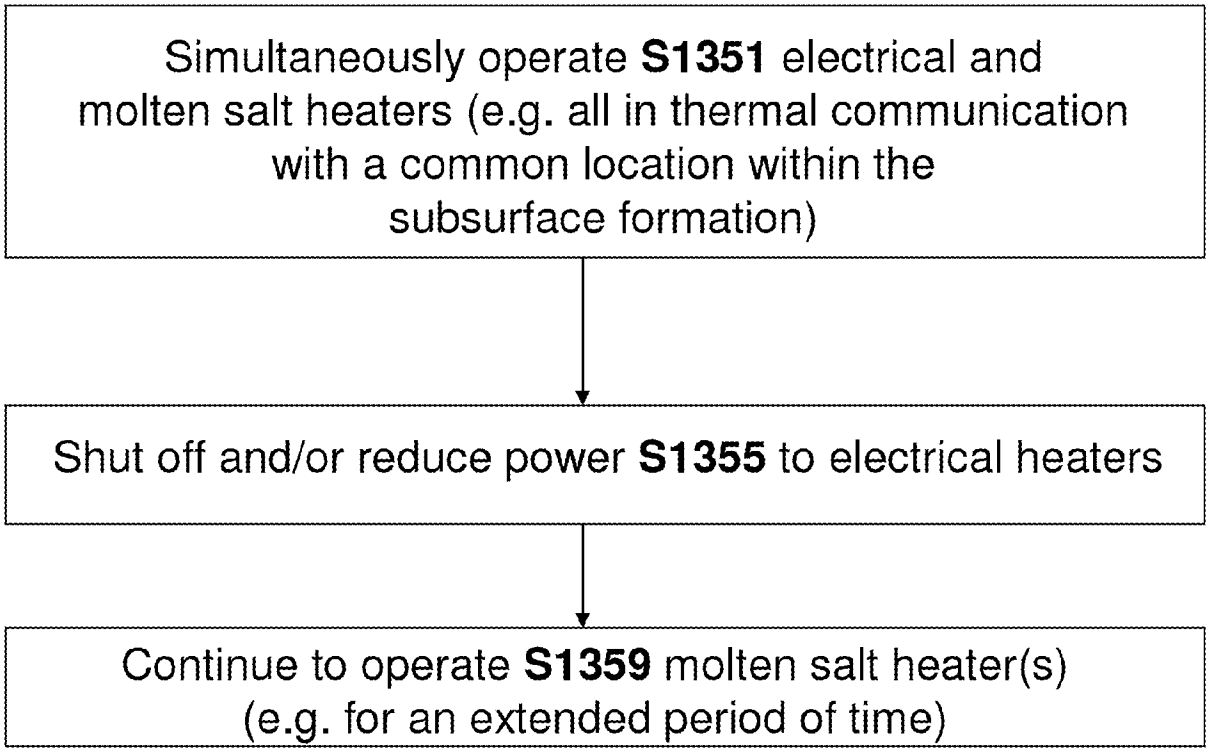

In the example of FIGS. 5A and 24A, the average spacing is $$\frac{17\sqrt{3}\,a + 18a}{35} \cong 1.87a.$$

Figure 25A:
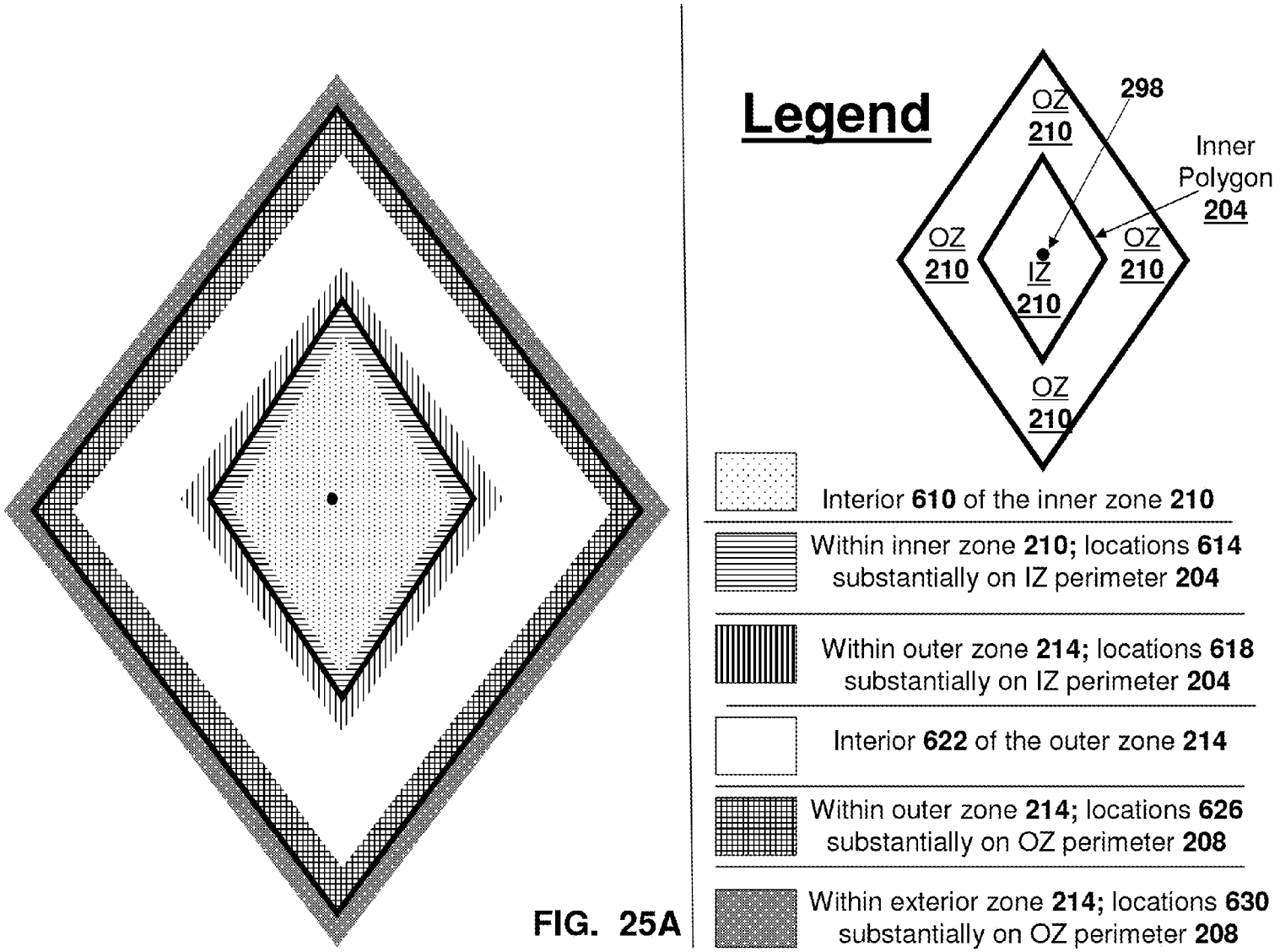

In the example of FIGS. 5A and 25A, the 'standard deviation heater spacing' is $$\sqrt{\frac{17(\sqrt{3}\,a - 1.87a)^2 + 18(2a - 1.87a)^2}{35}} \cong$$

-continued $$\sqrt{\frac{17(0.0196a^2)+18(0.0169a^2)}{36}} \cong \sqrt{\frac{0.36a^2}{36}} = 0.135a,$$

and a quotient of the standard deviation spacing and the average spacing is about 0.072.

In different embodiments, a quotient between a standard deviation spacing and an average spacing is at most 0.5 or at most 0.4 or at most 0.3 or at most 0.2 or at most 0.1.

(L) In some embodiments, heaters are dispersed throughout inner zone 214 rather than being limited to specific locations within inner zone (e.g. perimeter 204)—upon visual inspection of the heater patterns of FIGS. 2-11, it is clear that this feature is true for all of these heater patterns. In some embodiments, the heaters are distributed according to an average heater spacing that is 'small' compared to some 'characteristic length' of inner zone 210—for example, an average heater spacing within inner zone 210 may be at most one-half or at most two-fifths or at most one-third or at most one-quarter of the square root of an area of inner zone 210. This 'close heater' spacing relative to a characteristic length of inner zone 210 may be useful for outwardly directing thermal energy from inner zone heaters so as to facilitate heat flow into outer zone 214.

In some embodiments, a ratio between (i) a product of a number of inner zone heaters 226 and a square of the average spacing in the inner zone and (ii) an area of inner zone 210 is at least 0.75 or at least 1 or at least 1.25 or at least 1.5.

In some embodiments, at least 10% or at least 20% or at least 30% or at least 40% or at least 50% of inner zone heaters are 'interior of inner zone heaters 230' located within inner zone 210 away from inner zone perimeter 204;

(M) One or more production wells located in inner 210 and/or outer 214 zones. In some embodiments, one or more production wells (e.g. multiple production wells) are arranged within inner and/or outer zones to efficiently recovering hydrocarbon fluids from the subsurface. In some embodiments, locating production well(s) in inner zone 210 is useful for quickly removing hydrocarbon fluids located therein. In some embodiments, it is useful to locate production wells on different sides of the inner zone so as to facilitate the fast and/or efficient removal of hydrocarbon fluids from the subsurface formation.

When two inner zone production wells having respective locations $LOC_{PROD_WELL}^{IZ1}$ and $LOC_{PROD_WELL}^{IZ2}$ are 'are on different sides' of inner zone 210 having centroid $CENT_{IZ}$ 298, the angle $\angle LOC_{PROD_WELL}^{1}CENT_{IZ}LOC_{PROD_WELL}^{2}$ subtended by the locations of the two production wells through inner zone centroid $CENT_{IZ}$ 298 is at least 90 degrees (or at least 100 degrees or at least 110 degrees or at least 120 degrees). When outer inner zone production wells having respective locations $LOC_{PROD_WELL}^{OZ1}$ and $LOC_{PROD_WELL}^{OZ2}$ are 'are on different sides' of outer zone 214 having outer zone centroid $CENT_{OZ}$ 296, the angle $\angle LOC_{PROD_WELL}CENT_{OZ}LOC_{PROD_WELL}$ subtended by the locations of the two production wells through outer zone centroid $CENT_{IZ}$ 298 is at least 90 degrees.

When two production wells having respective locations $LOC_{PROD_WELL}^{1}$ and $LOC_{PROD_WELL}^{2}$ are 'are on different sides' of inner zone 210 having centroid $CENT_{IZ}$ 298, the angle $\angle LOC_{PROD_WELL}^{1}CENT_{IZ}LOC_{PROD_WELL}^{2}$ subtended by the locations of the two production wells through inner zone centroid $CENT_{OZ}$ 296 is at least 90 degrees.

(N) A majority or a substantial majority of heaters within inner zone 214 are distributed on a triangular or rectangular (e.g. square) or hexagonal pattern. In some embodiments, this allows for more efficient heating of inner zone 210;

For identical heaters spaced on a triangular heater well pattern, all operating at constant power, the time $t_{pyr}$ to heat the formation to pyrolysis temperature by thermal conduction is approximately:

$$t_{pyr} \sim cD^2_{spacing}/D_{well} \quad \text{(EQN. 1)}$$

where $D_{spacing}$ is the spacing between adjacent heater wells, $D_{well}$ is the diameter of the heater wells, and c is a proportionality constant that depends on the thermal conductivity and thermal diffusivity of the formation.

As noted above, heaters are deployed at a relatively high density within inner zone 210 and at a relatively low density within inner zone 214. Similarly, an 'average spacing between neighboring heaters' within the outer zone 214 significantly exceeds that of the inner zone 210.

In some embodiments, the amount of time required to pyrolyze kerogen (and/or to carry out any other in-situ hydrocarbon production process—for example, producing hydrocarbon fluids from tar sands) is substantially less in the inner zone 210 than in the outer zone due to the relatively high heater density and/or relatively short heater spacing in the inner zone 210.

FIGS. 12A-12D present illustrative production functions describing a time dependence of the hydrocarbon production rate in a subsurface hydrocarbon formation according to one illustrative example. It is expected that a production function sharing one or more feature(s) with that illustrated in FIGS. 12A-12D may be observed when producing hydrocarbons using a two-level heater cell—for example, a two-level heater cell having feature(s) similar that of FIG. 2D.

A number of illustrative hydrocarbon production functions related to two-level heater cells are presented in FIGS. 12A-12D. In particular, the time dependence of hydrocarbon fluid production rate in (i) the inner zone 210 (see inner zone production rate curve 354); (ii) outer zone 214 (see outer zone production rate curve 358); (iii) the 'combined' region defined as the combination of inner 210 and outer 214 zones—this is equivalent to the area enclosed by a perimeter 208 of the outer zone (see combined region production rate curve 350), are all presented in accordance with this illustrative example.

Because of the relatively 'close' heater spacing in the inner zone 210 (i.e. in the example of FIG. 2D, the heater spacing in inner zone 210 is exactly one-half that of outer zone 214), temperatures in the inner zone 210 rise more rapidly than in the outer zone 214, so as to expedite the production of hydrocarbons in the inner zone 210. In contrast, in most locations in the outer zone 214, a 'hydrocarbon production temperature' (e.g. a pyrolysis temperature) is reached only after a significant time delay.

Figure 12A:
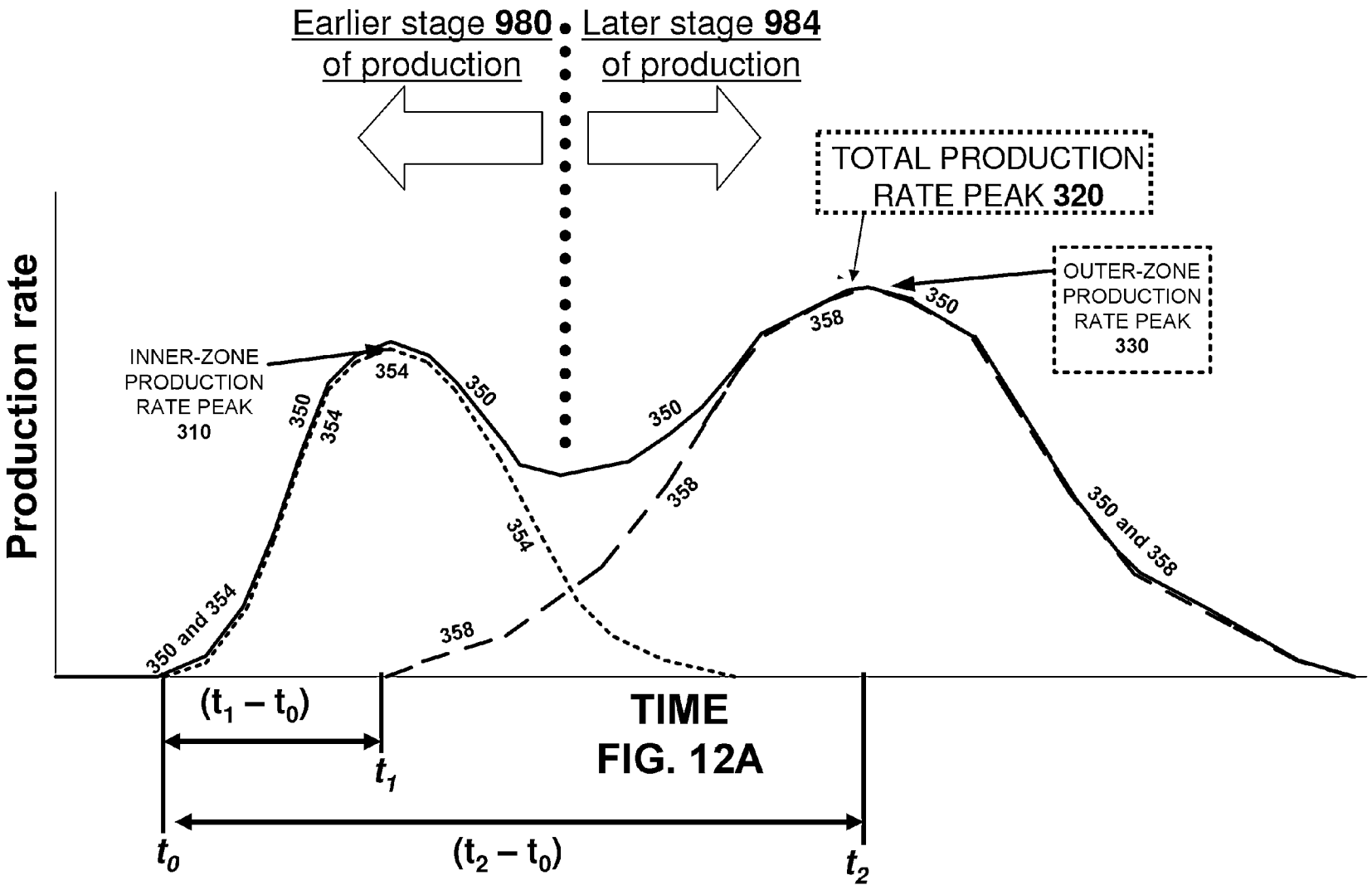
FIGS. 12A-12D describe illustrative production functions for a two-level heater cell.

In the example of FIG. 12A, an inner zone production rate peak 310 occurs before an outer zone production rate peak 330. During the intervening time period, a production dip may be observed. In other examples, it may be possible to minimize and/or eliminate the production dip—for example, by controlling (e.g. reducing) the power level of inner zone heaters 226 relative to those 228 in outer zone 214.

Roughly speaking, the production rate peak occurs when a particular zone or region reaches 'hydrocarbon production temperature'—e.g. a pyrolysis temperature and/or a temperature where fluids are mobilized in a heavy oil formation and/or bitumen-rich formation and/or tar-sands formation.

As illustrated in FIG. 12A, a production peak 330 of function 358 describing production in outer zone 214 occurs after a production peak 310 of function 354 describing production in inner zone 210. Thus, it may be said that for a two-level heater cell having zones 210, 214 (which may be written as $\{Zone_1, Zone_2\}$ where $Zone_1$ is the innermost zone (or inner zone 210) and $Zone_2$ is the first zone outside of the innermost zone (or zone 214) that sequential production peaks $\{Peak_1, Peak_2\}$ (labeled respectively as 310 and 330 in FIG. 12A) are observed respectively at times $\{t_1, t_2\}$. An amount of time required to ramp up to the $i^{th}$ peak $Peak_i$ is $t_i$.

For the example of FIG. 12A, (i) the amount of time required to ramp up to the production peak $Peak_1$ (labeled as 310 in FIG. 12) for the innermost zone $Zone_1$ (i.e. inner zone 210) is $(t_1-t_0)$; and (ii) the amount of time required to ramp up to the production peak $Peak_2$ (labeled as 330 in FIG. 12A) for the zone $Zone_2$ (i.e. outer zone 214) immediately outside of the innermost zone 210 is $(t_2-t_0)$.

A peak time ramp-up time ratio between these two quantities is $$\frac{(t_2 - t_0)}{(t_1 - t_0)}.$$

Inspection of FIG. 12A indicates that for the example FIG. 12A, this ramp-up time ratio is about three. In some embodiments, this peak time ramp-up ratio is about equal to a zone area ratio between areas of the more outer zone $Zone_2$ (i.e. outer zone 214) and the more inner zone $Zone_1$ (i.e. inner zone 210). For the example of FIG. 2D, a 'zone area ratio' between (i) an area of the more outer zone $Zone_2$ (i.e. outer zone 214); and (ii) an area of the more inner zone $Zone_1$ (i.e. inner zone 210) is three. Thus, in some embodiments, for a more inner zone $Zone_1$ (e.g. inner zone 210) and a more outer zone $Zone_2$ (i.e. outer zone 214), a 'zone area ratio' thereof is substantially equal to a 'ramp-up time' ratio for times of their production $Peak_1$ peaks and $Peak_2$. In some embodiments, this is true at least in part because a reciprocal of a 'density ratio' between heater densities in the more outer (i.e. outer zone 214) and the more inner zone (i.e. outer zone 214) is also equal to the ramp-up is also equal to about three.

Figure 12B:
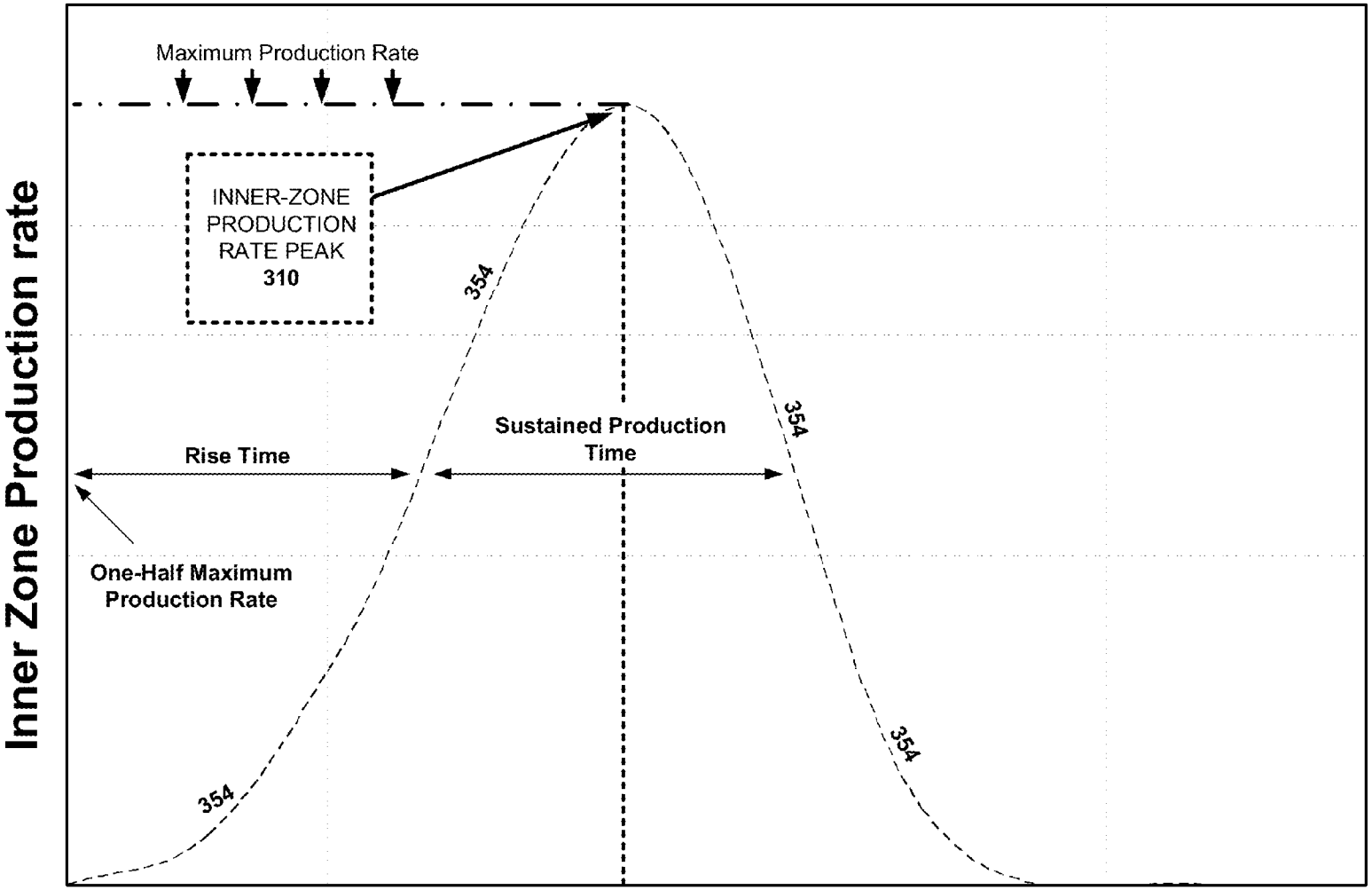
Figure 12C:
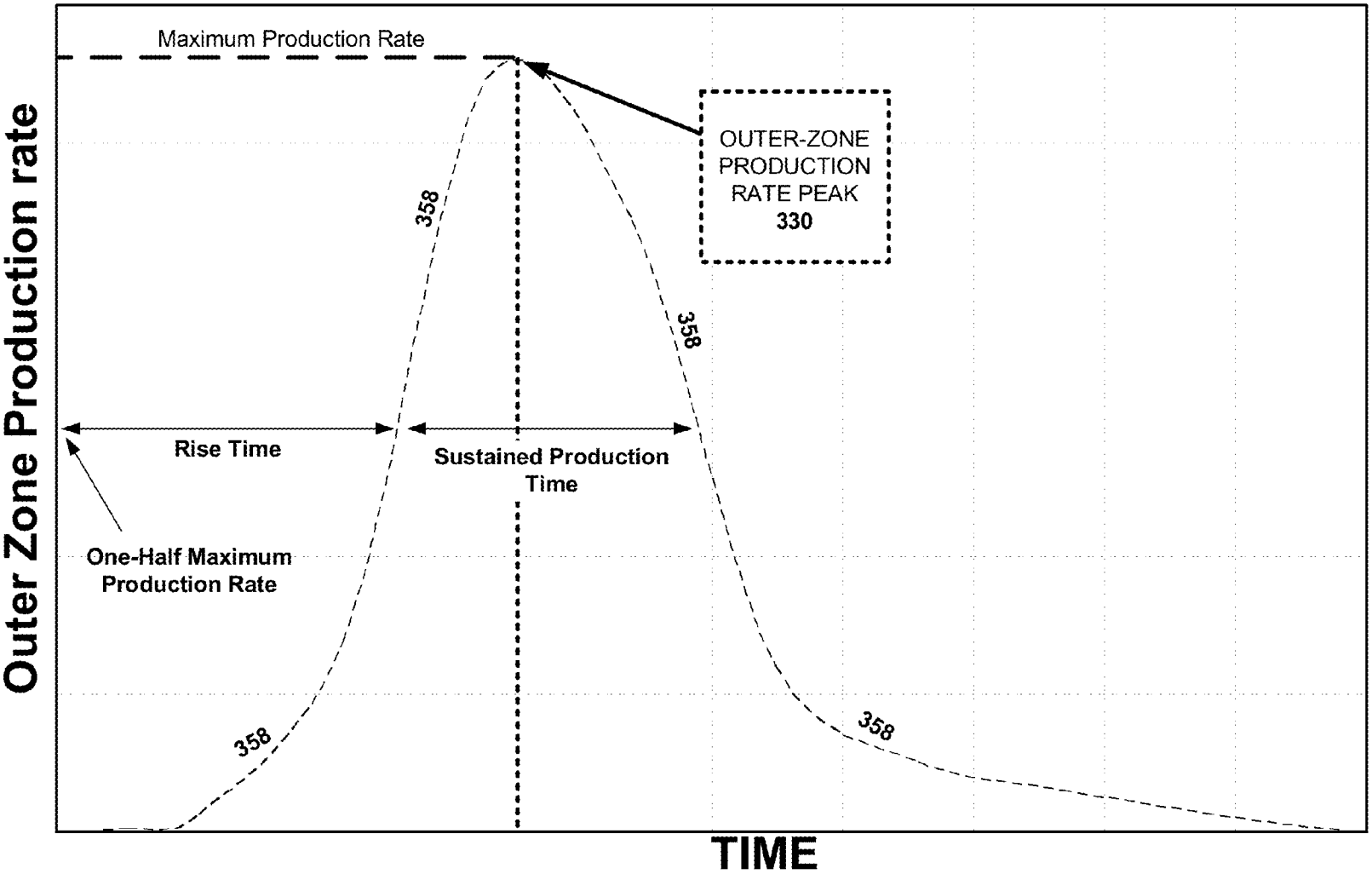
Figure 12D:
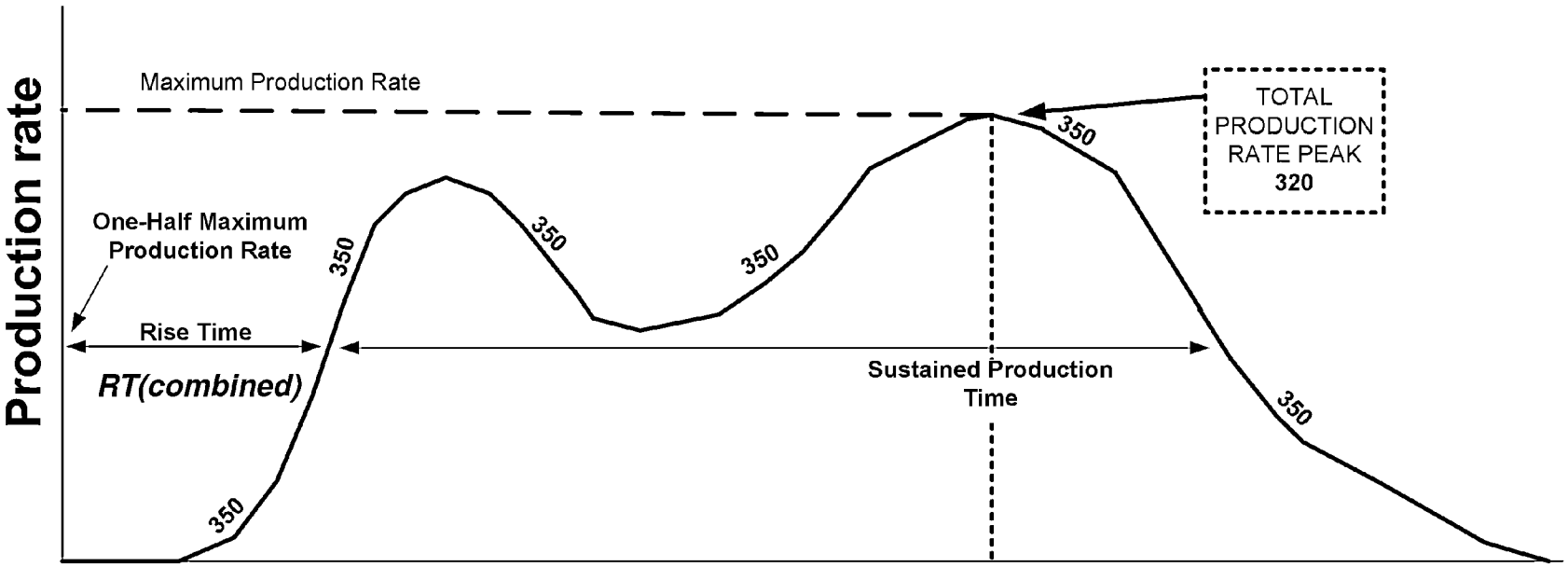

Also illustrated in FIGS. 12A and 12D is the overall or total rate of hydrocarbon fluid in the 'combined region' (i.e. the area enclosed within outer zone perimeter 208—this is the combination of inner 210 and outer 214 zones), described by curve 350 having a production rate peak 320 which occurs immediately before that 330 of outer zone 2140.

Inspection of combined region hydrocarbon fluid production rate curve 350 indicates that: (i) similar to inner zone production curve 354, combined region production curve 350 ramps up relatively quickly indicating a fast rise time; (ii) a 'significant' hydrocarbon production rate (e.g. at least one-half of the maximum production rate) is sustained for a relatively long period of time. In the example of FIGS. 12A and 12D, a ratio SPT/RT between a (i) a sustained production time SPT (i.e. the amount of time that the production rate is contiuously sustained above one-half of a maximum production rate level for the combined region) and (ii) a rise time RT for the combined region is relatively 'large'—e.g. at least four-thirds or at least three-halves or at least two.

For the present disclosure, a 'half-maximum hydrocarbon fluid production rate rise time' or 'half-maximum rise time' is the amount of time required for hydrocarbon fluid production to reach one-half of its maximum, while the 'half-maximum hydrocarbon fluid production rate sustained production time' or the 'half-maximum sustained production time' is the amount of time where the hydrocarbon fluid production rate is sustained at least one-half of its maximum. FIGS. 12B, 12C and 12D respectively show production rate curves 354, 358 and 350 for the inner 210, outer 214 and 'total' zones (i.e. the combination of inner and outer zones).

In FIGS. 12A-12D, a production dip (e.g. occurring after peak 310 and before peak 330) is illustrated.—In some embodiments, such a production dip (or any other production dip) may be observed even within a time period of a 'half-maximum hydrocarbon fluid production rate sustained production time' as long as the production rate remains above one-half of a maximum rate throughout the time period of the 'half-maximum hydrocarbon fluid production rate sustained production time'.

A relatively large SPT/RT ratio may describe situations where, (i) hydrocarbon fluids are produced (e.g. from kerogen or from bitumen) and removed from the subsurface after only a minimal delay, allowing a relatively rapid 'return' on investment in the projection while using substantially only a minimal number of heaters; and (ii) hydrocarbon fluids are produced for a relatively extended period of time at a relatively constant rate. Because hydrocarbon fluids are produced at a relatively constant rate, a ratio between a peak hydrocarbon production rate and an average hydrocarbon production rate for the combined region, is relatively small. In some embodiments, the amount of infrastructure required for hydrocarbon fluid production and/or processing is determined at least in part by the maximum production rate. In some embodiments, a relatively low ratio between a peak hydrocarbon production rate and an average hydrocarbon production rate for the combined region may reduce the amount of infrastructure required for fluid production and/or processing with a minimal number, or near minimal number, of pre-drilled heater wells.

It is appreciated that none of the examples relating to illustrative production functions are limiting. It may be possible to change the shape of this function, for example, by operating heaters at different power levels.

Figure 14A:
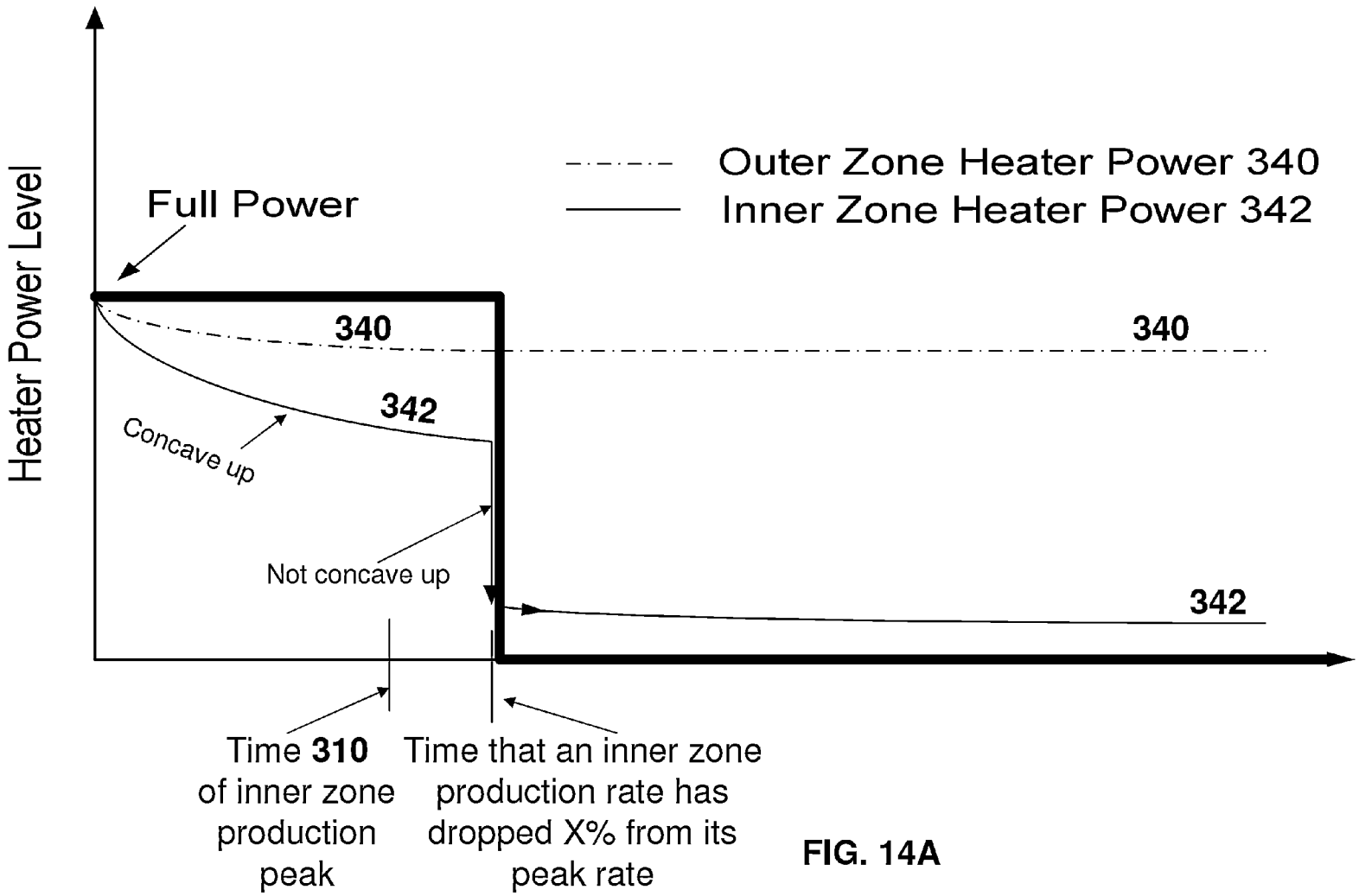

Also illustrated in FIG. 14A are the earlier 980 and later 984 stages of production. During the earlier 980 stage of production, hydrocarbon fluids are produced primarily in inner 210 zone; during the later 984 stage of production, hydrocarbon fluids are produced primarily in outer 214 zone.

Figure 12E:
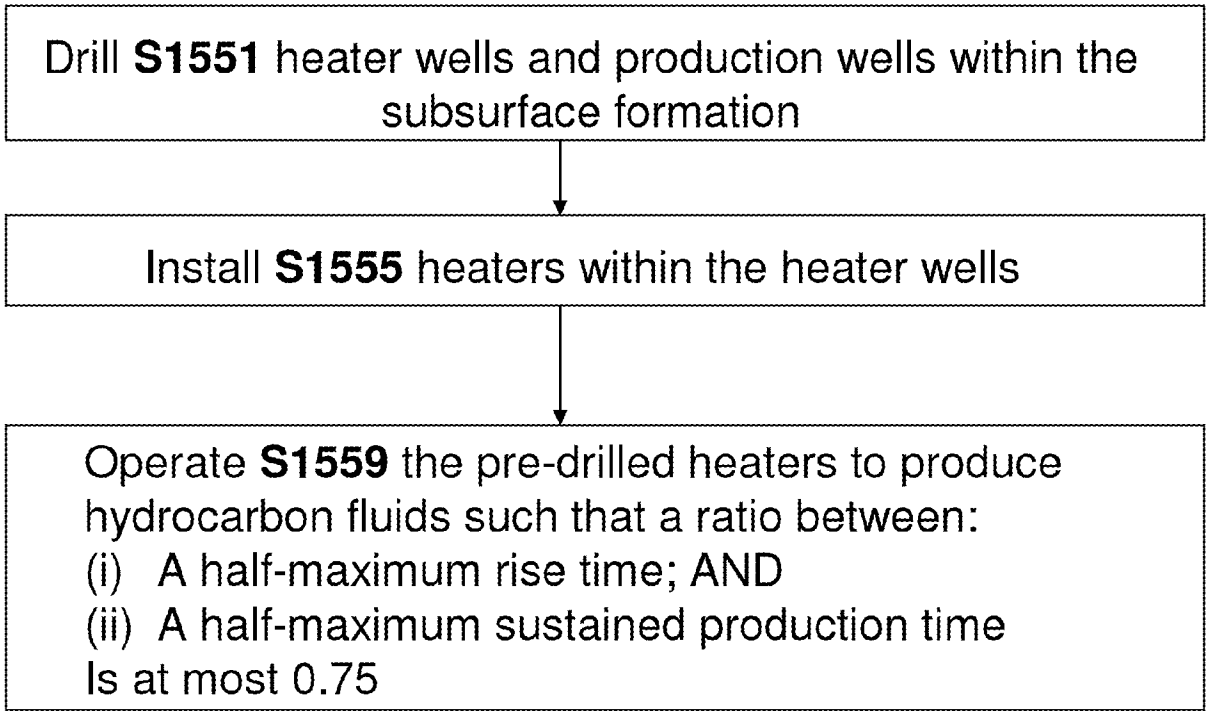
FIG. 12E, 13A-13G, 14A-14H, illustrate methods of operating heater(s) and/or production well(s).

FIG. 12E is a flowchart of a method for producing hydrocarbon fluids. In step S1551, wells are drilled into the subsurface formation. In step S1555, heaters are installed in the heater wells—it is appreciated that some heaters may be installed before all heater wells or production wells are drilled.

In step S1559, the pre-drilled heaters are operated to produce hydrocarbon fluids such that a ratio between a half-maximum sustained production time and a rise time is at least four-thirds, or at least three-halves, or at least seven quarters or at least two. In some embodiments, this is accomplished using any inner zone and outer zone heater pattern disclosed herein. In some embodiments, at least a majority of the outer zone heaters commence operation when at most a minority of inner zone hydrocarbon fluids have been produced.

In some embodiments, any heater pattern disclosed herein (e.g. relating to two-level heater cells) may be thermally efficient. In particular, in some embodiments, at least 5% or at least 10% or at least 20% of the thermal energy used for outer zone hydrocarbon fluid production is supplied by outward migration (e.g. by heat conduction and/or convection) of thermal energy from the inner zone 210 to the outer zone 214.

FIGS. 13A-13F are a series of frame (frame 1 is at an earlier time, frame 2 is at a later time, etc) describing the average temperatures respectively in inner zone 210 and outer zone 214 at various points in time during production in one non-limiting illustrative example. Initially both zones are at a low temperature below a near-production temperature. The 'near-production temperature' is defined as within 30 degrees Celsius of a hydrocarbon production temperature—for example, a pyrolysis temperature or a mobility temperature for mobilizing hydrocarbon fluids.

In frames 2-5, the average temperature in the inner zone exceeds that of the outer zone, and thermal energy migrates outwards—e.g. by heat conduction and optionally by heat convection. In some embodiments, outward migration of thermal energy contributes to the thermal energy required to produce in the outer zone 214. In some embodiments, this statement is true for a plurality of locations 1098 within the outer zone—for example, locations on substantially opposite sites of the outer zone 214 or distributed 'around' outer zone 214.

Figure 13A:
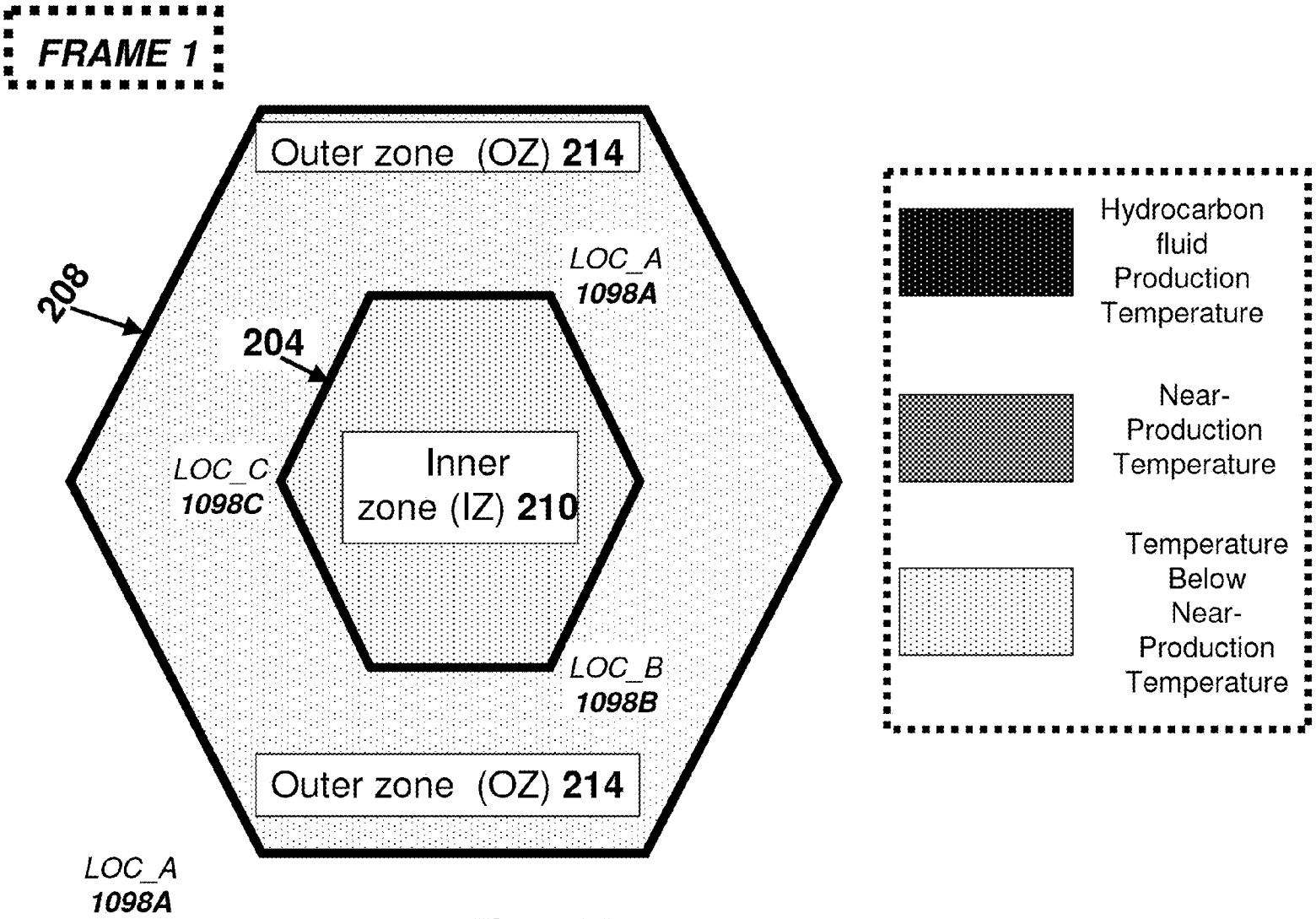
Figure 13B:
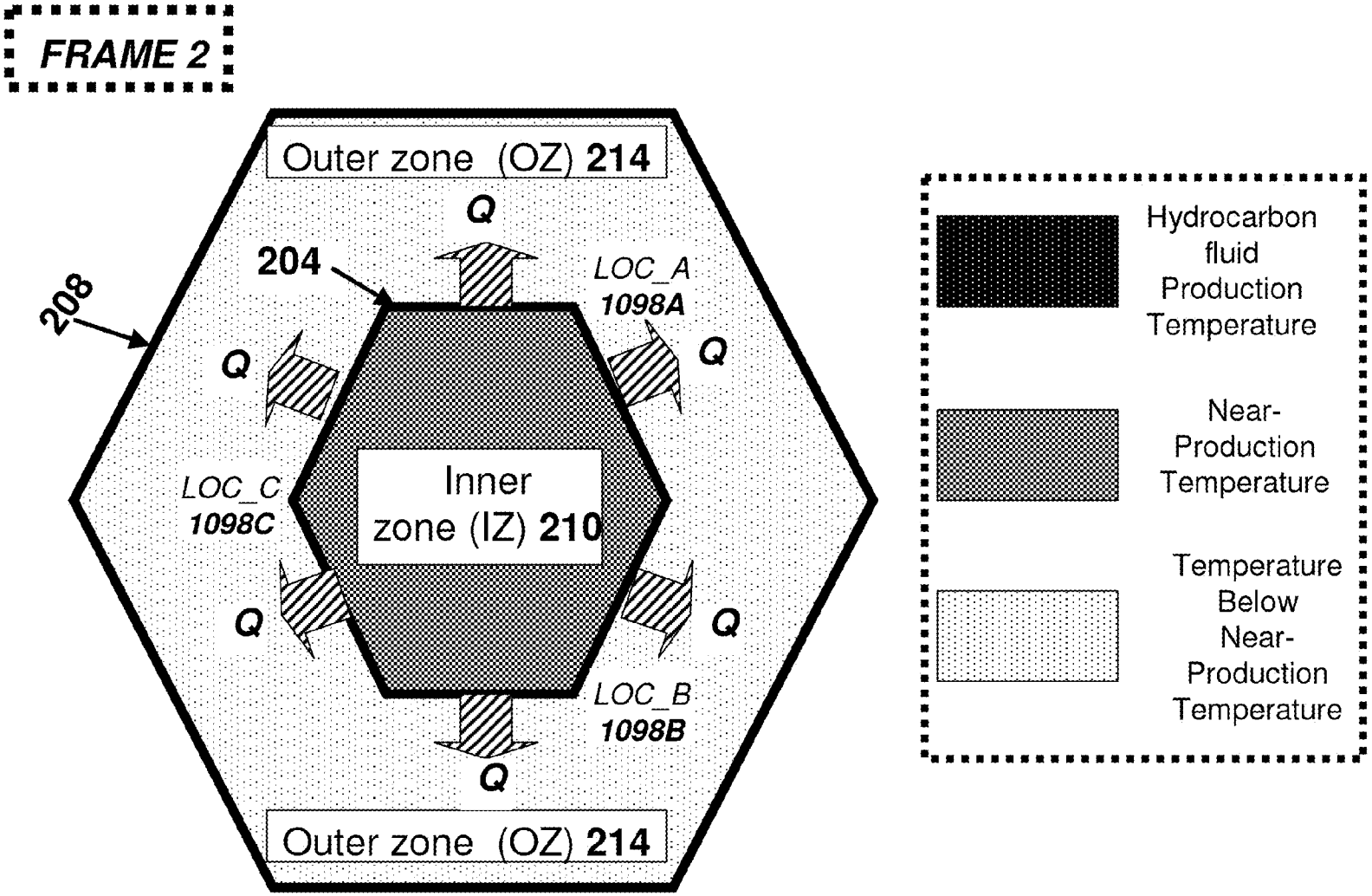
Figure 13C:
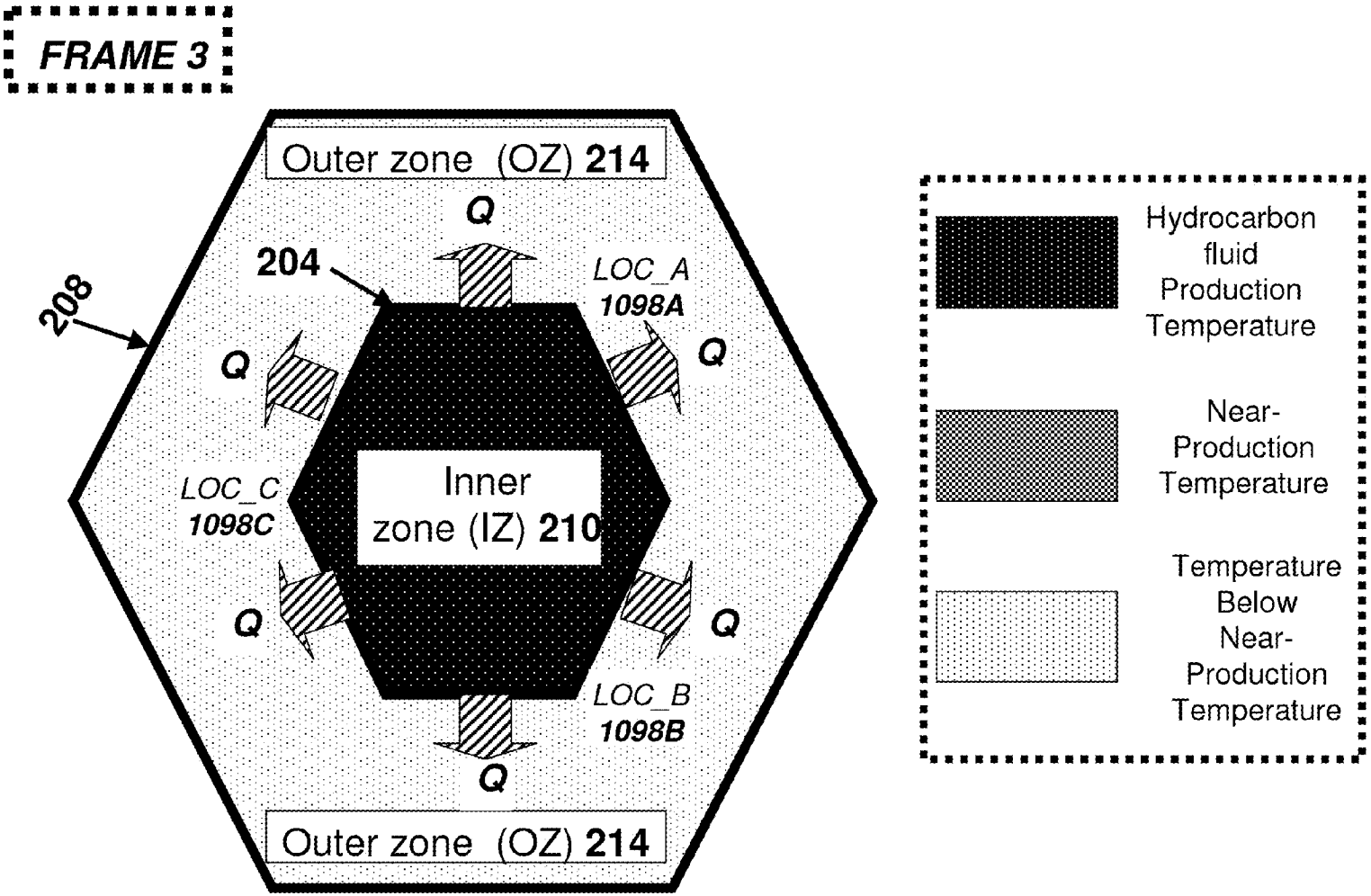
Figure 13D:
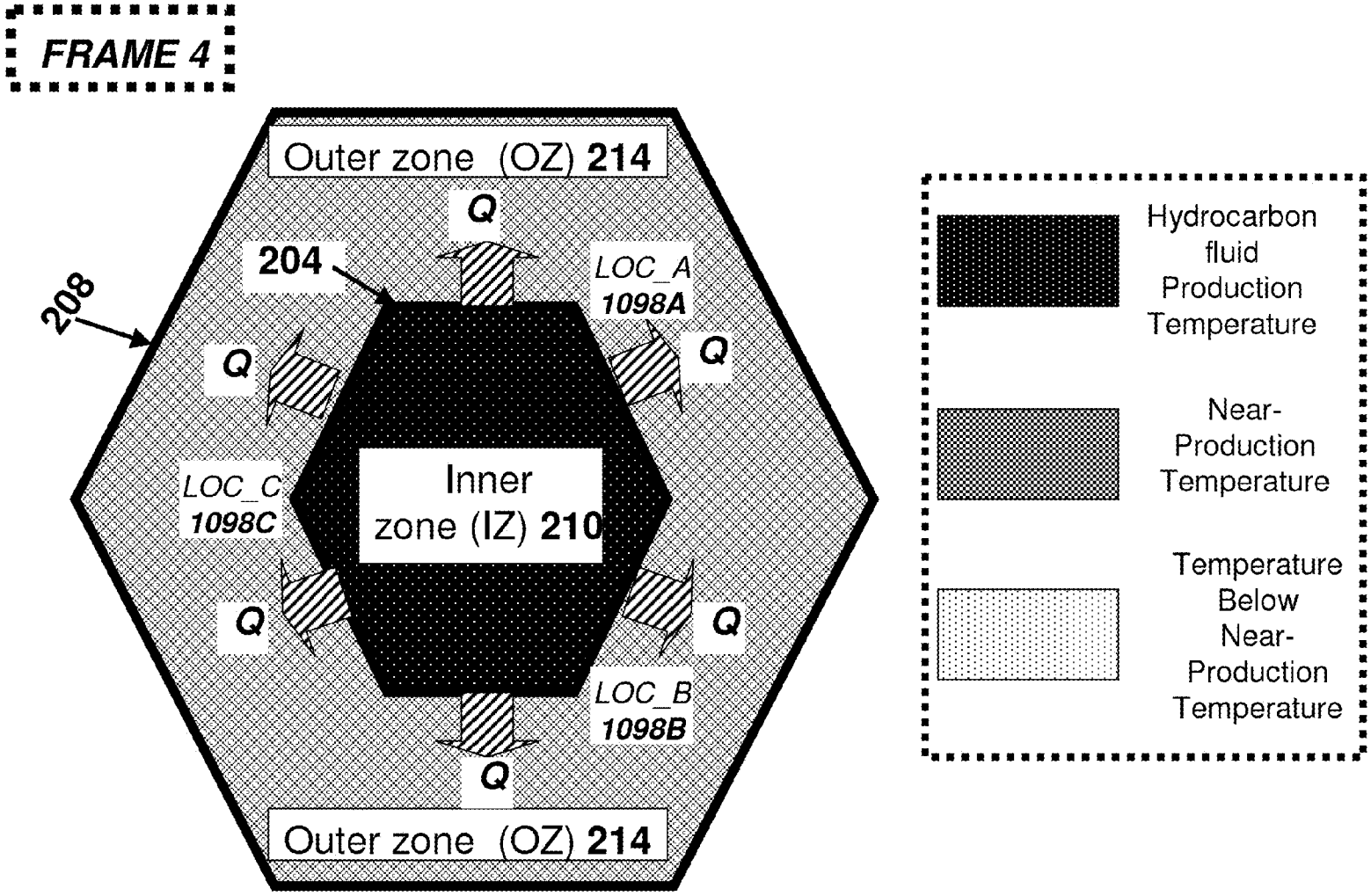
Figure 13E:
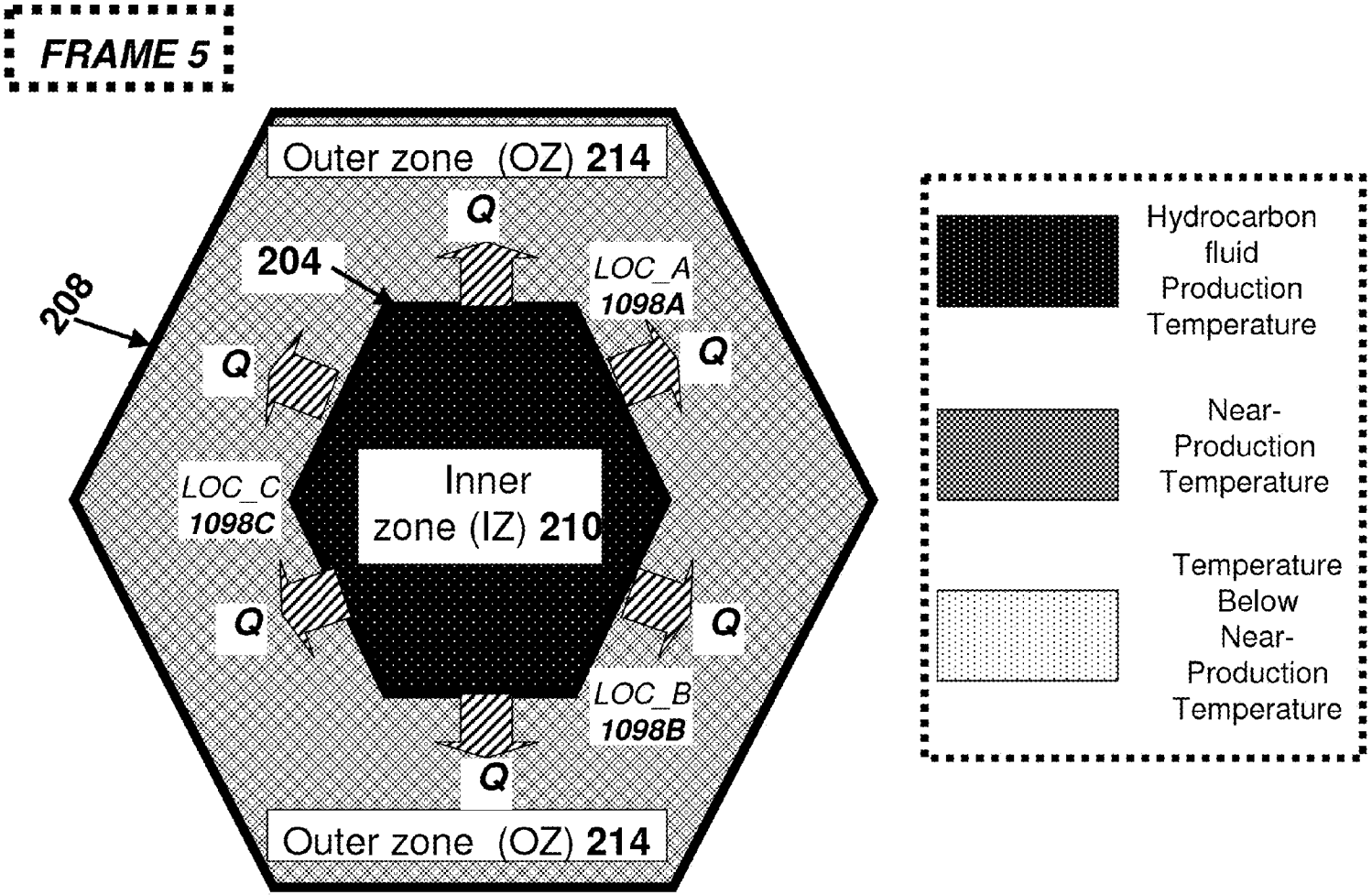
Figure 13F:
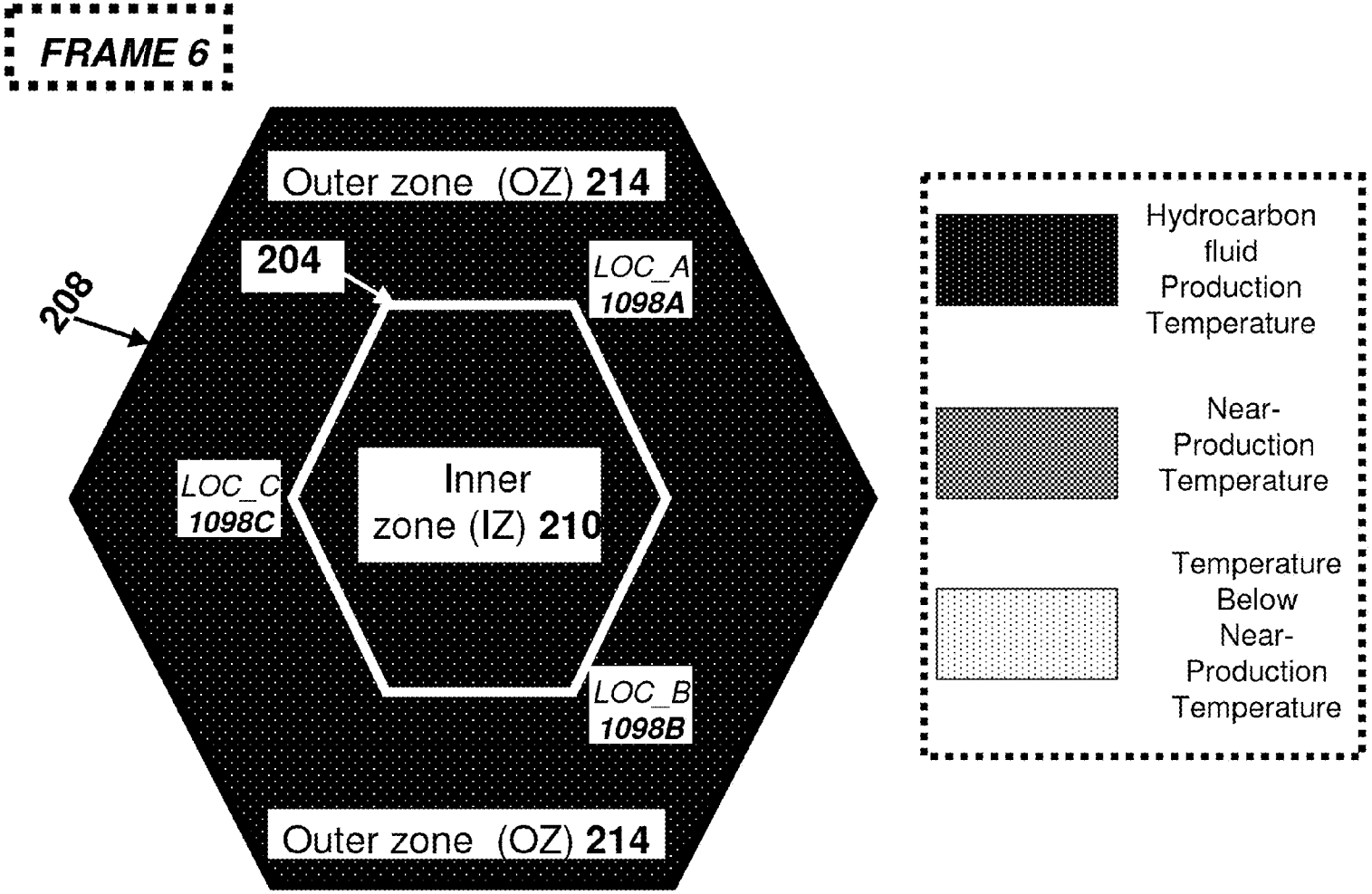
Figure 13G:
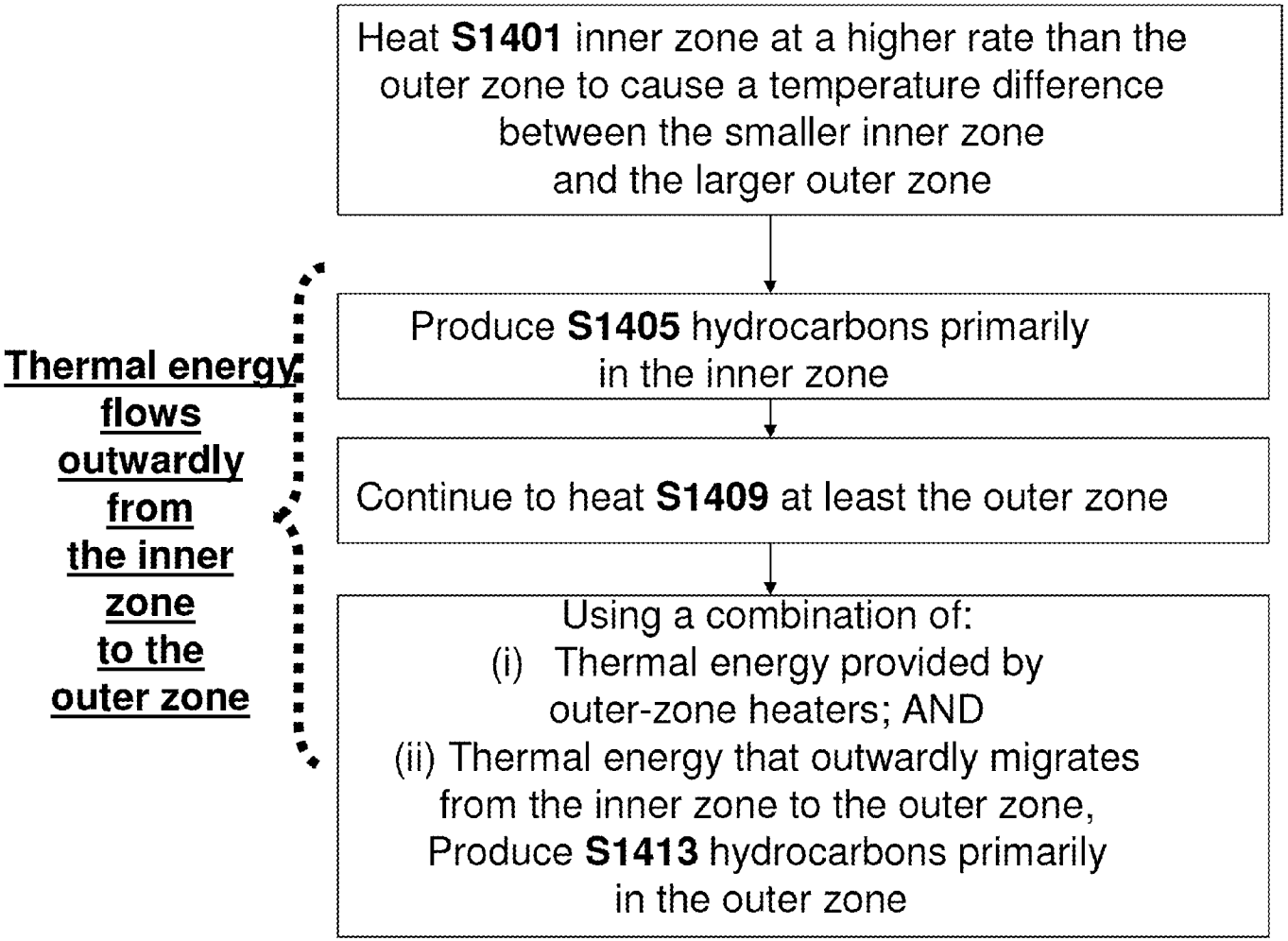

FIG. 13G illustrates a related method.

As will be discussed below (see, for example, FIG. 14G), in some embodiments it is advantageous to increase the rate of outward migration of heat by injecting a heat transfer fluid (e.g. carbon-dioxide or steam) into inner zone at a time when the production in a more inner zone is decreasing. In steps S1401, S1405, and S1409 the inner zone is heated, hydrocarbonds are produced first in the inner zone, the outer zone is further heated. In step S1413 the combination of (i) thermal energy which has outwardly migrated from inner 210 to outer zone 214 and (ii) thermal energy from outer zone heaters 228 sufficiently heats outer zone 214 to produce hydrocarbon fluids therein.

Reference is now made to FIG. 14A, which describes a time dependence of a power level of inner zone heaters 226 (see solid line 342) and outer zone heaters 228 (see broken line 340) as a function of time in some embodiments. According to FIG. 14A, in some embodiments, a power level of inner zone and outer zone heaters, during a time period when the inner zone production rate ramps up and peaks, remains about a half-maximum level and only 'slightly' drops off as a function of time. During this time period, the rate at which the heater power level drops in the inner zone is greater than in the outer zone.

After inner zone production rate peak 310, during a phase when inner zone production rate declines, (i) at least some of the inner zone heaters 226 are shut off (e.g. at least one quarter or at least one third or a majority of the heaters), as indicated by the drop of solid line 340, and (ii) outer zone heaters 228 continue to operate at this constant power level, while inner zone heaters 226 are shut off. Thus, at this time, a difference between an average power of the outer zone heaters and inner zone heaters increases.

Once the production rate in the inner zone has dropped by a certain threshold (for example, by at least 30% or at least 50% and/or at most 90% or at most 70% of a maximum production rate), this may indicate that a hydrocarbon fluid production temperature (e.g. a temperature which results in mobilized fluids, visbreaking, and/or pyrolysis of hydrocarbon containing material so that mobilized fluids, visbroken fluids, and/or pyrolyzation fluids are produced in the formation) has been reached throughout most of the inner 210 zone—e.g. a pyrolysis temperature or a temperature for mobilizing hydrocarbon fluids), even when significant portions of the outer 214 zone (e.g. at least 30% of or a majority of) are at a significantly cooler temperature. Studies conducted by the present inventors indicated that once this inner-zone production drop has occurred, the ability of the inner-zone heaters to expedite fluid production is significantly reduced, and thus further full-power operation of the inner-zone heaters may be of only marginal utility, and may not justify the energy 'cost.'

As indicated in FIG. 14A, in some embodiments, it is useful to shut off and/or reduce power to the inner zone heaters even while the outer zone heaters continue to operate at about the same power level.

In some embodiments, a power level or one or more inner zone heaters 226 is reduced in response to a predicted or detected drop in a rate of production in inner zone 210 (e.g. at a time when only a minority of hydrocarbon fluids have been produced in outer zone 214). In some embodiments, the inner zone heater 226 is substantially shut-off or deactivated—i.e. a power level is reduced by at least 50% in a relatively 'short' amount of time. This 'short amount of time' is at most 30% or 20% or 10% of the time delay between an inner-zone production peak 310 and that 330 of outer zone 214.

In some embodiments, in response to the predicted or detected drop in a rate of production in inner zone 210, one or more inner zone heater(s) are operated so as to cause power level of the one or more inner zone heaters to decrease at a faster rate. This is shown in FIG. 14A—at a time that an inner zone production rate has dropped X % from a peak rate, a curve 342 describing a heater power level of an inner zone heater 226 exhibits an inflection point—there is an increase in the rate at which the power level of the inner zone heater 226 decreases.

In some embodiments, on average, the total amount of time that outer zone 228 heaters operate at a power level that is at least one-half of a maximum heater power level significantly exceeds that of the inner zone 226 heaters—for example, by at least a factor of 1.5 or at least a factor of 2 or at last factor of 2.5 or at least a factor of 3 or at least a factor of 4 or at least a factor of 5 or at least a factor of 6 or at least a factor of 8.

Figure 14B:
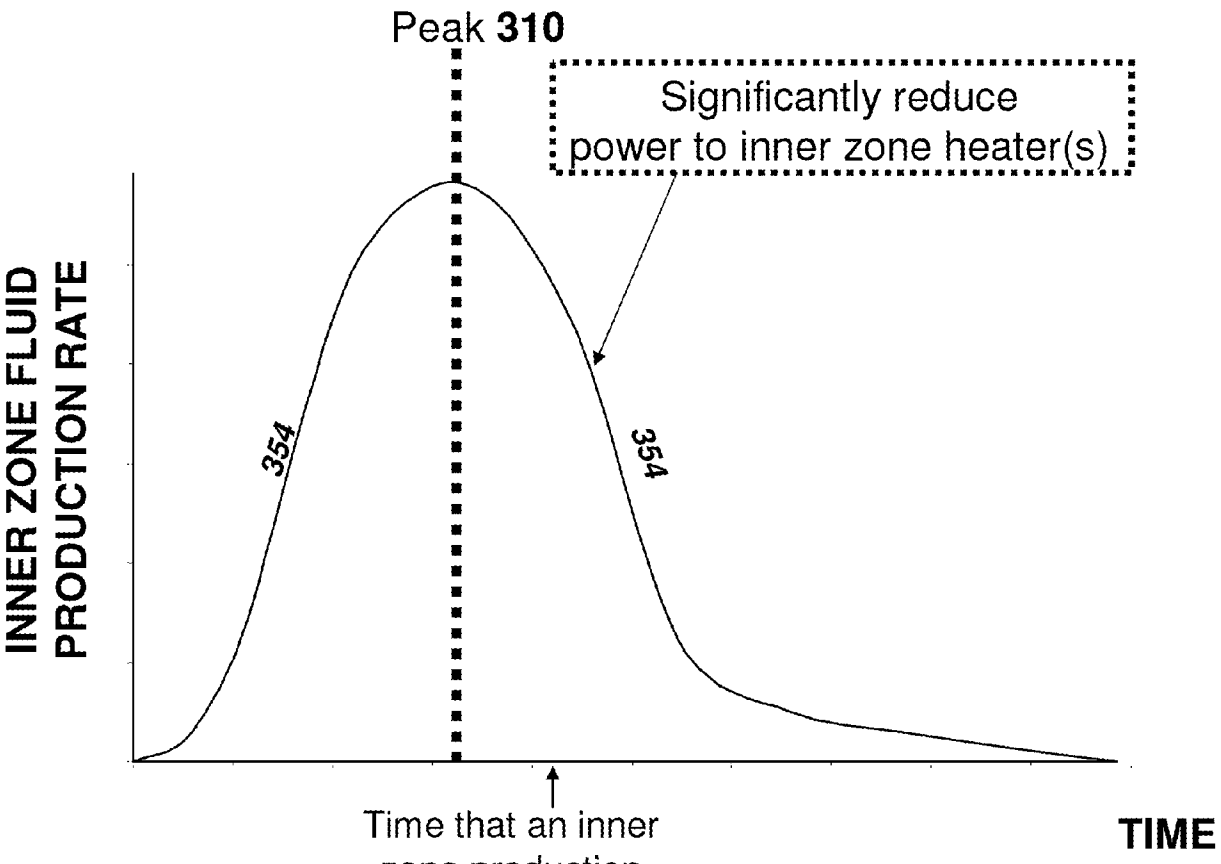
Figure 14C:
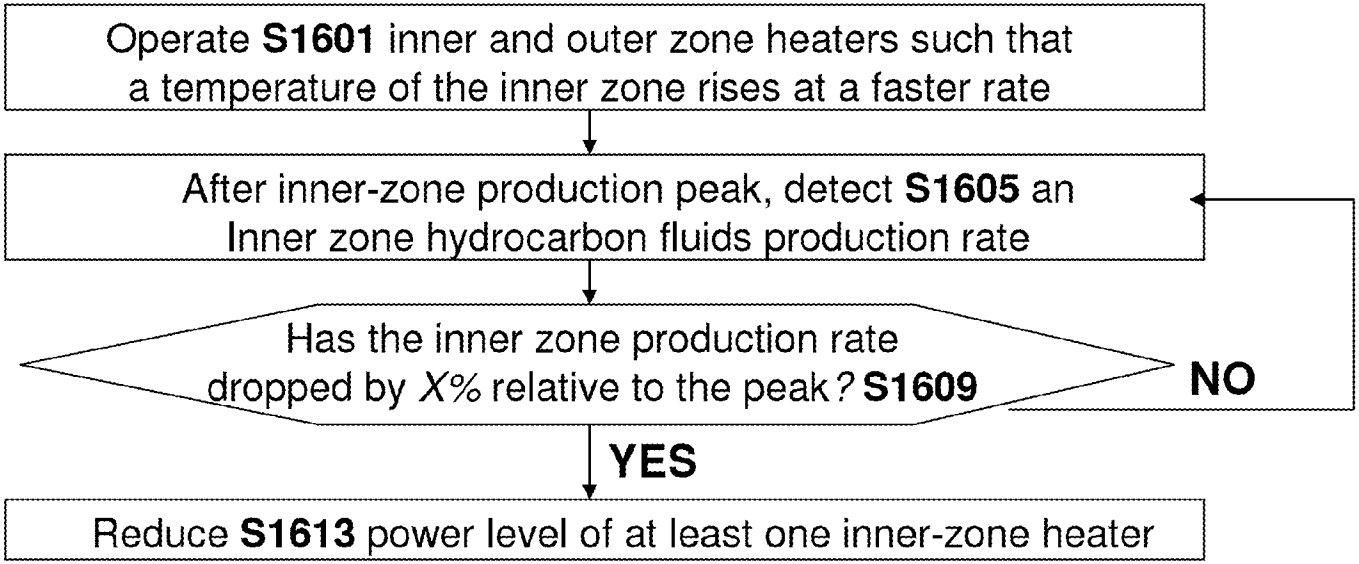

One time when power to inner zone heater(s) may be decreased FIG. 14B is shown in FIG. 14B, and a related method is illustrated in FIG. 14C. In some embodiments, a value of X is at least 5 and at most 95—for example, at least 5 or at least 10 or at least 20 or at least 35 or at least 50 and/or at most 75 or at most 50 or at most 35 or at most 25 or at most 20.

Figure 14D:
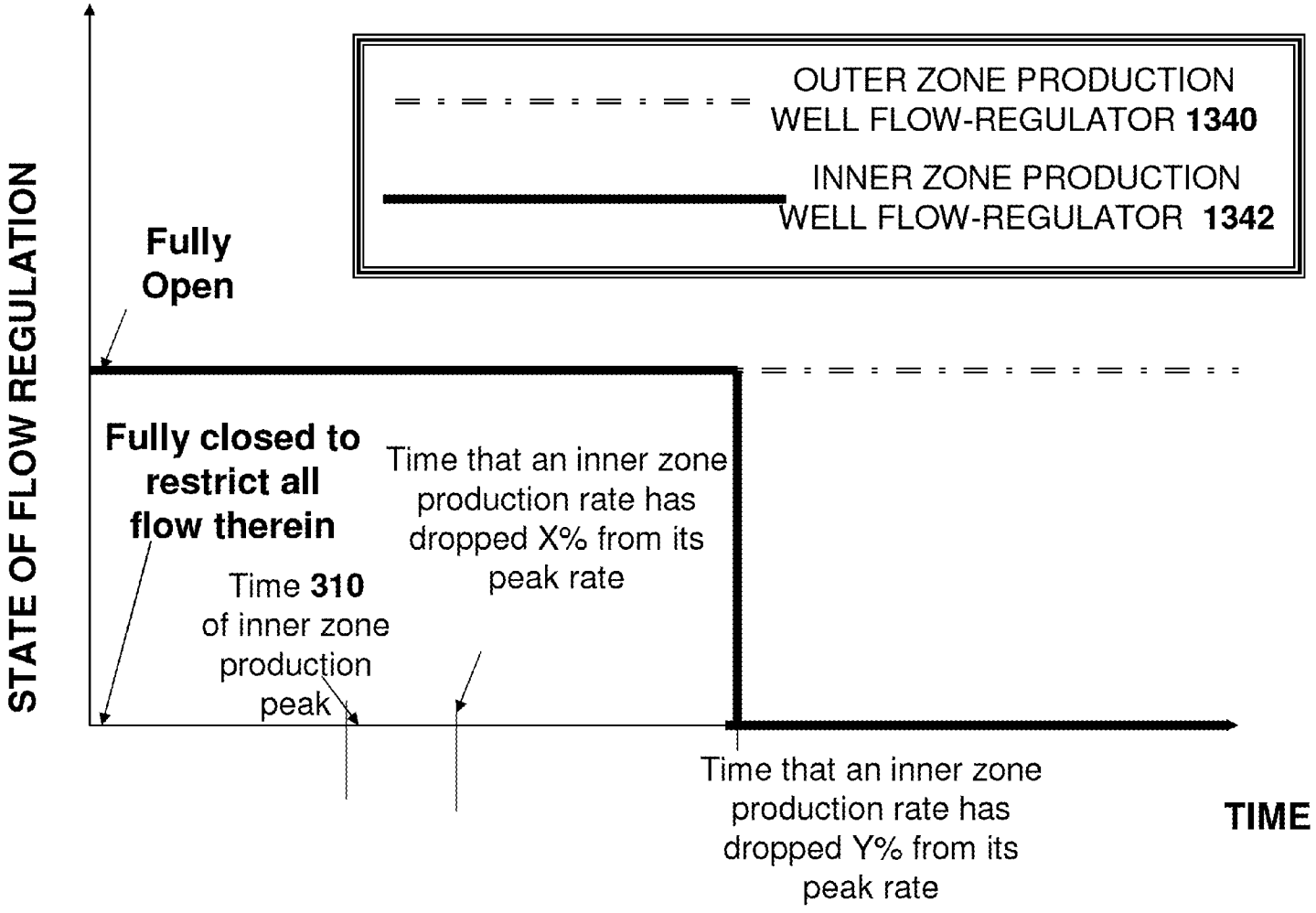
Figure 14E:
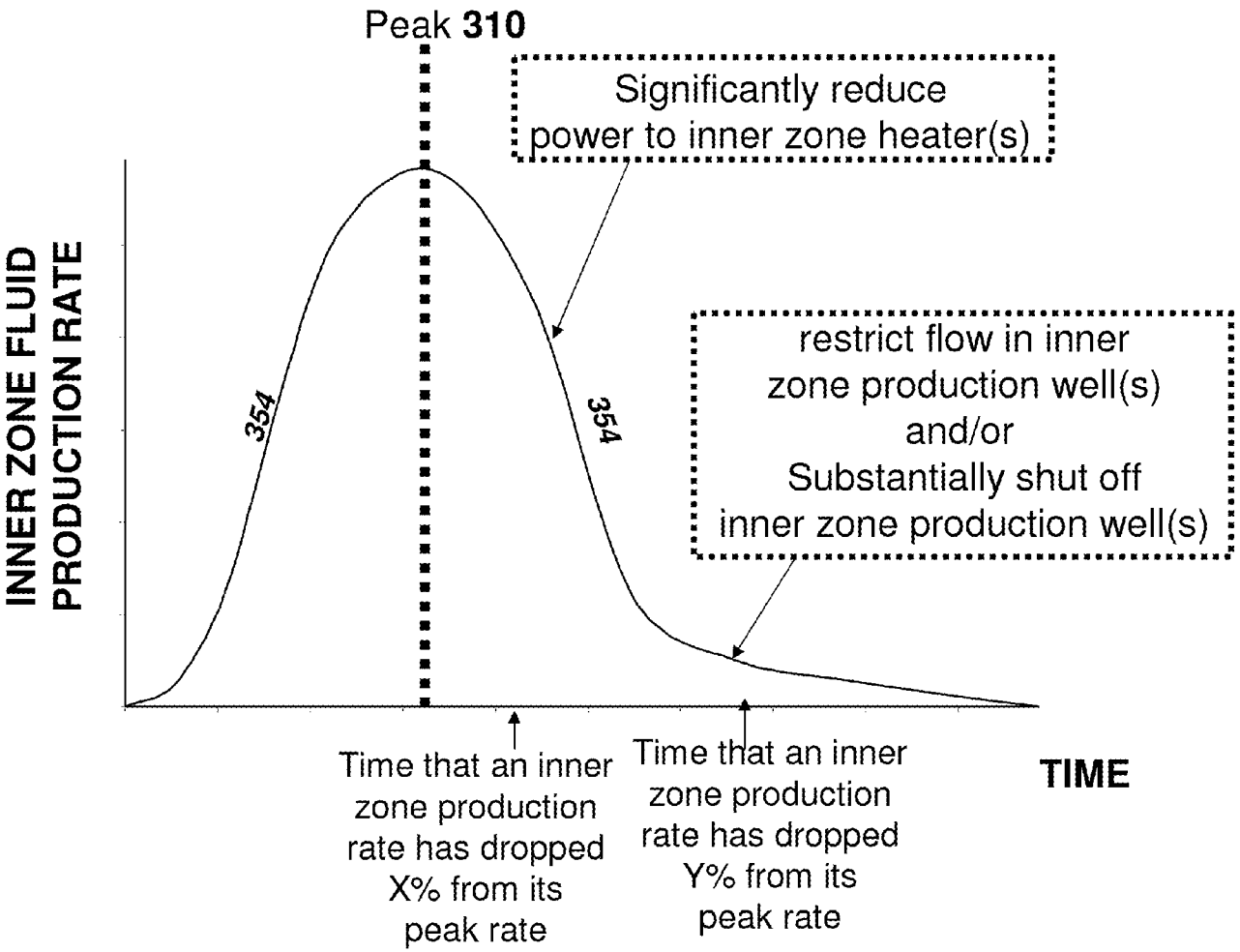

As illustrated in FIGS. 14D-14E, it is possible at least partially restrict flow within production well(s) and/or to shut off inner zone production wells (or to restrict a flow of formation fluids therein) as well. In the example of FIG. 14E, (i) inner zone heater(s) may be shut off (or subjected to a sudden decrease in output power) and (ii) inner zone production wells may also be shut off and/or operated to restrict flow therein so as to reduce a rate of production below what would be observed without the restriction of flow of formation fluids.

In the example of FIG. 14D, the production well is completely shut-off. It is appreciated that this is not a limitation, and that in some embodiments, flow may be restricted within the production well 226 without entirely shutting the well off—i.e. the flow is at least partially restricted.

In some embodiments, a value of Y is at least 5 and at most 95—for example, at least 10 or at least at least 25 or at least 35 or at least 50 or at least 65 or at least 75 and/or at most 95 or at most 75 or at most 65 or at most 50 or at most 35. In some embodiments, a ratio between Y and X is at least 1 or at least 1.25 or at least 1.5 or at least 2 and/or at most 3 or at most 2 or at most 1.5.

Figure 14F:
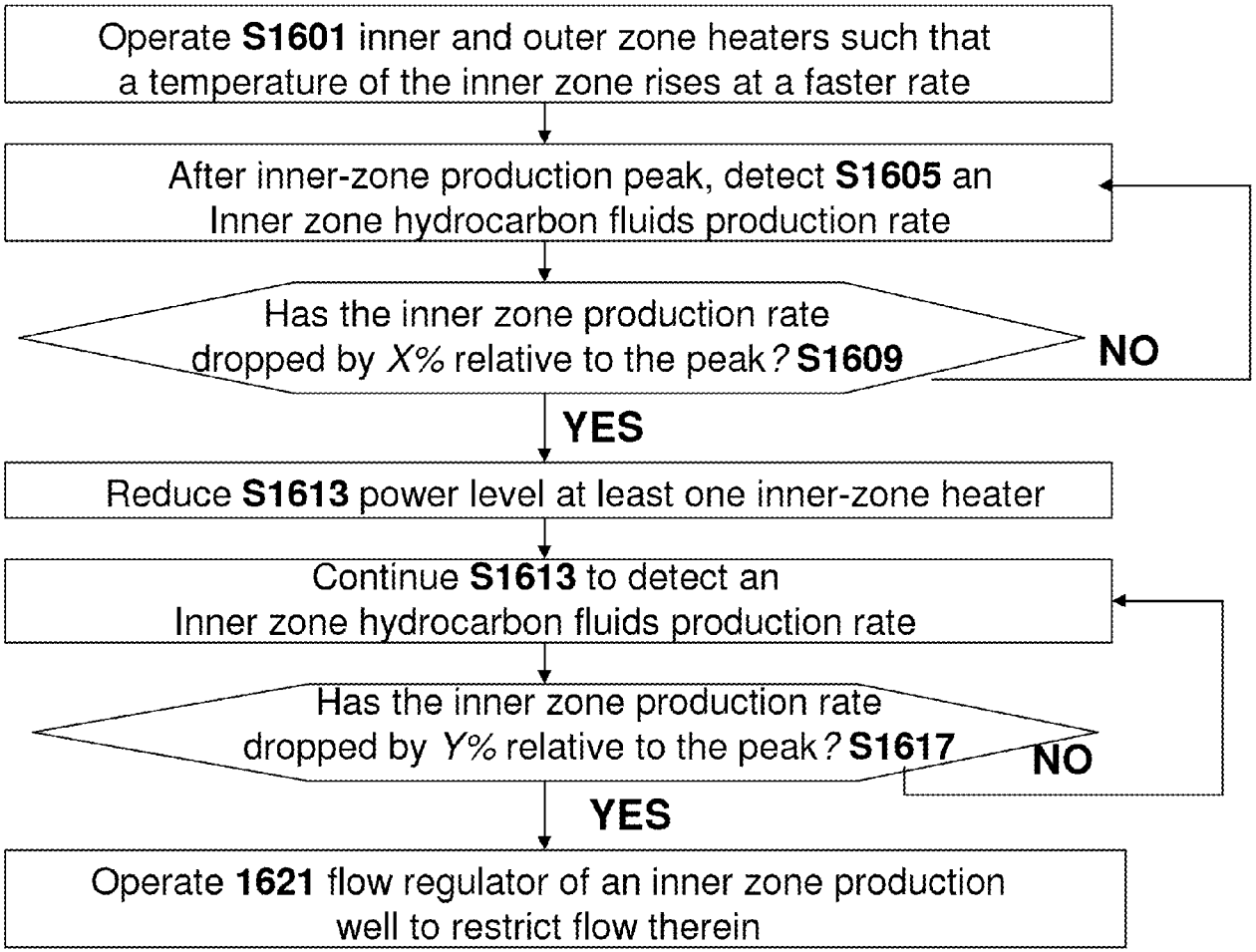
Figure 14G:
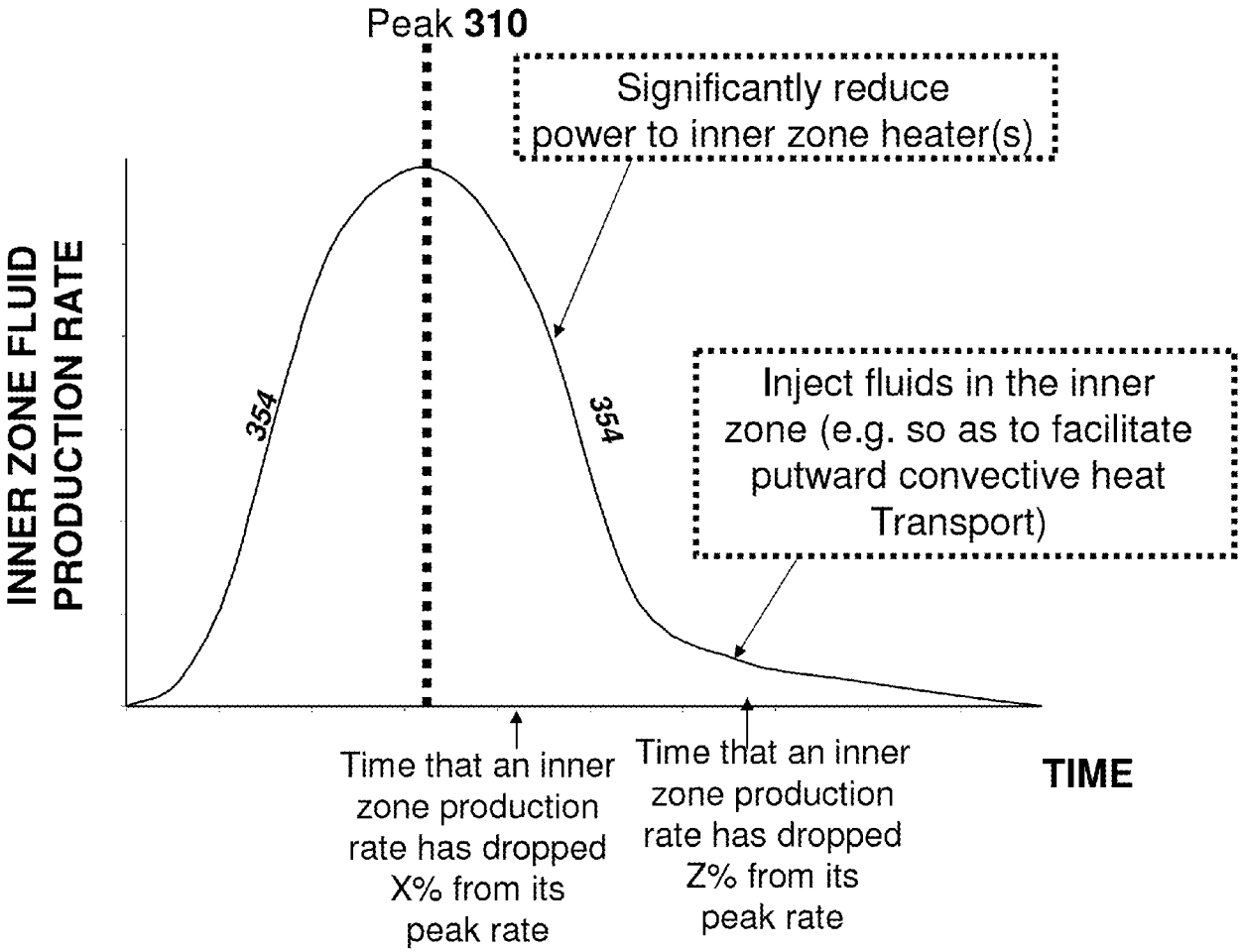
Figure 14H:
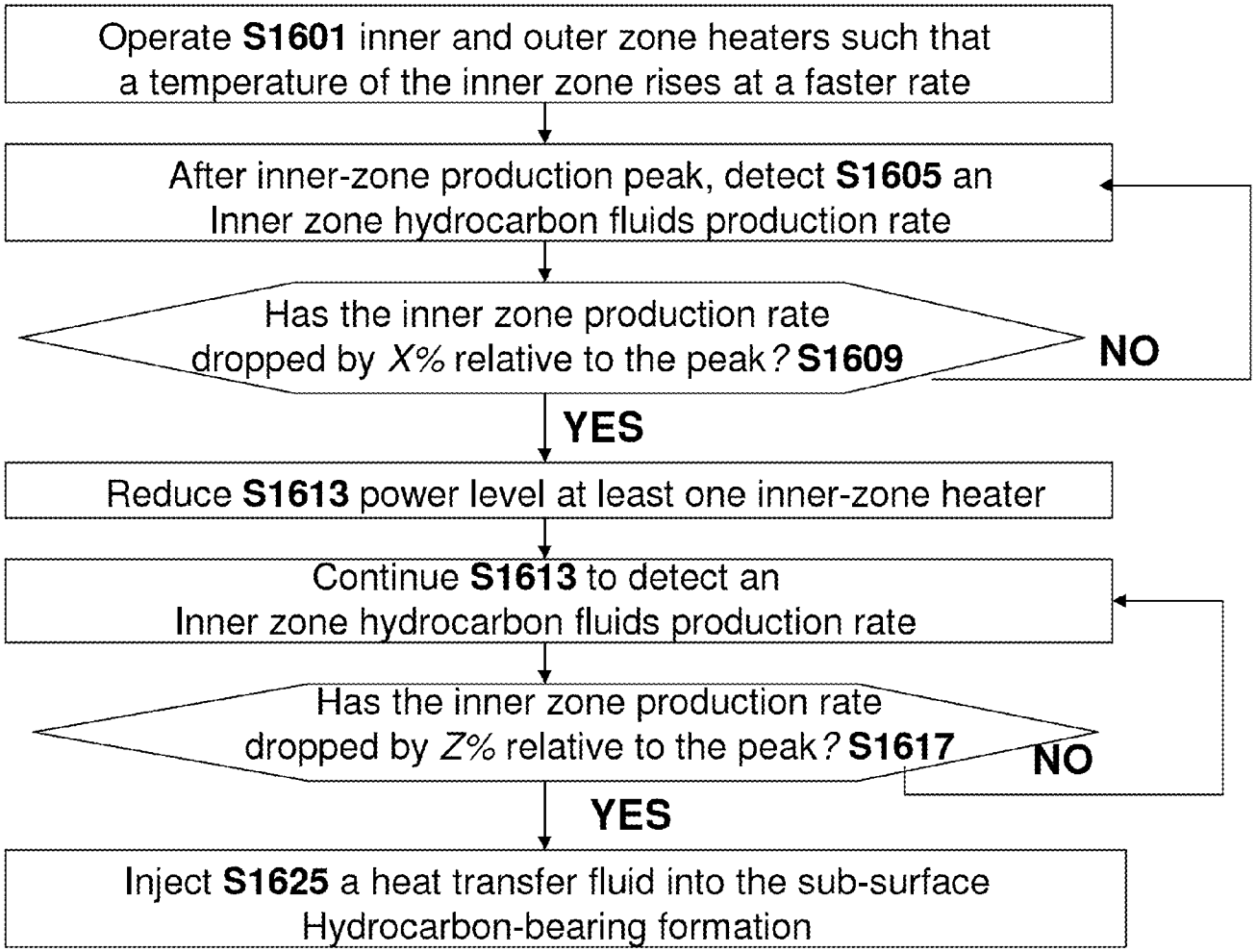

Alternatively or additionally, is illustrated in FIG. 14H, it is possible to inject a heat transfer fluid (e.g. carbon dioxide or steam or any other heat transfer fluid) into the inner zone. This technique may be provided in together with that of FIG. 14F-14G or instead of this technique.

In some embodiments, a value of Z is at least 5 and at most 95—for example, at least 10 or at least at least 25 or at least 35 or at least 50 or at least 65 or at least 75 and/or at most 95 or at most 75 or at most 65 or at most 50 or at most 35. In some embodiments, a ratio between Z and Z is at least 1 or at least 1.25 or at least 1.5 or at least 2 and/or at most 3 or at most 2 or at most 1.5.

As will be discussed below with reference to FIGS. 20-21, in some embodiments, it is advantageous to deploy mostly electrical heaters (i.e. which have a relatively low capital cost but a lower operating efficiency) in the inner 210 zone, and mostly molten salt heaters (which have a higher capital cost but are more efficient to operate) in the outer 214 zone. Because the outer zone heaters 226 operate, on average, for a significantly longer period of time, in some embodiments, the total amount of thermal energy supplied to the subsurface formation by operation of outer zone heaters 228 is greater (or significantly greater—for example, as least 1.5 times as much or at least twice as much) than the total amount of thermal energy supplied by operation of inner zone heaters 226.

As discussed elsewhere in the present disclosure, molten salt heaters are one example of 'advection-based heaters.' In some embodiments, it is advantageous to deploy mostly electrical heaters (i.e. which have a relatively low capital cost but a lower operating efficiency) in the inner 210 zone, and mostly advection-based heaters (which have a higher capital cost but are more efficient to operate) in the outer 214 zone. Similarly, combustion-based heaters may have a higher capital cost but may be more efficient to operate.

Figure 15A:
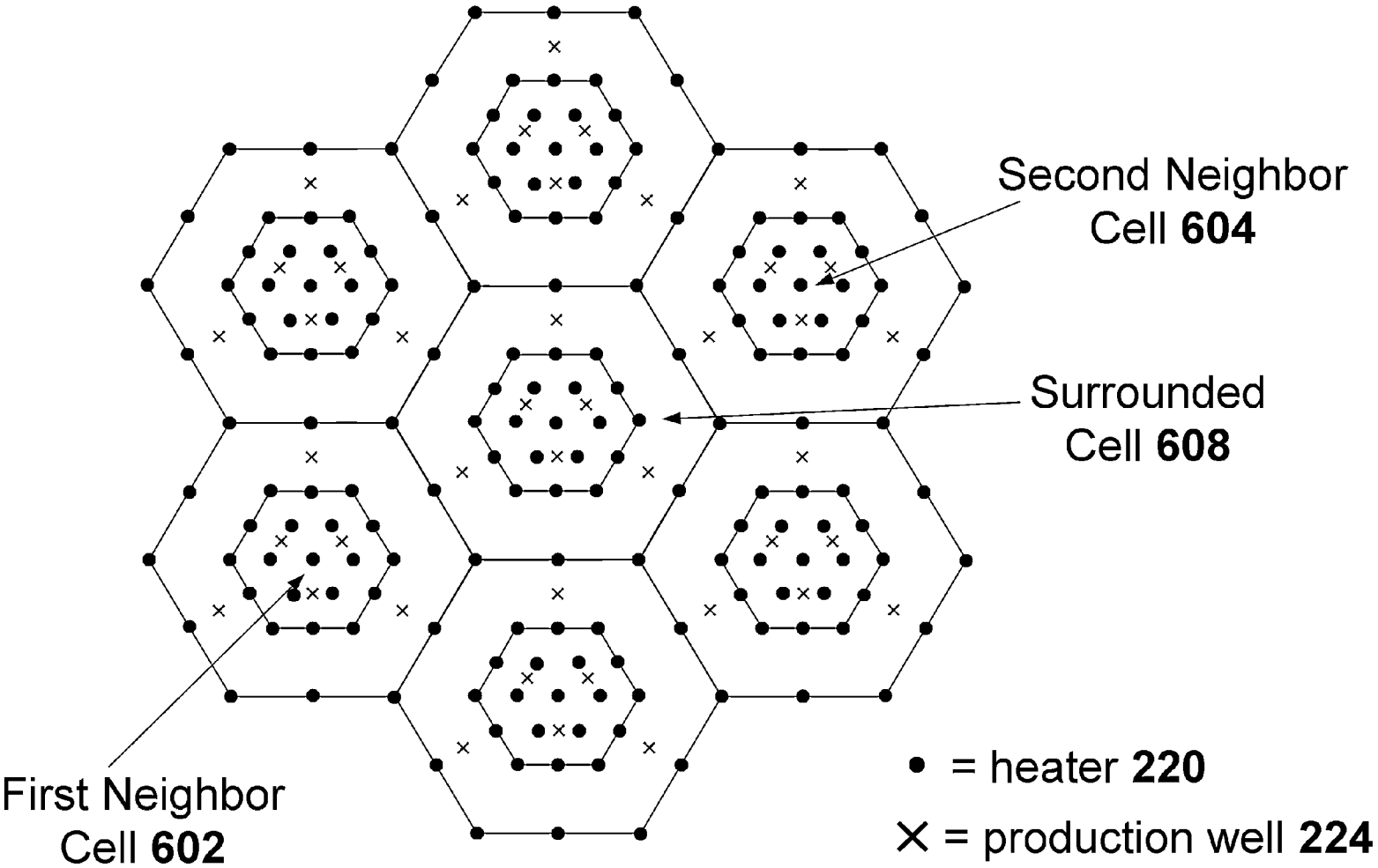

As illustrated in FIG. 15A, in some embodiments, the heater pattern of FIG. 2A, or of any other embodiment disclosed herein (for example, see any of FIGS. 2-11) may repeat itself. Thus, in some embodiments, any inner zone-outer zone heater pattern disclosed herein may be a 'unit cell' heater pattern which repeats itself. Since any heater pattern disclosed herein (and any feature(s) thereof or combination thereof) may also be a 'heater well pattern,' the heater well pattern of FIG. 2A, or of any other embodiment disclosed herein, may repeat itself.

In the example of FIG. 15A, the heater pattern of FIG. 2A exactly repeats itself in each cell so as to fill space of a subsurface formation—i.e. the unit heater cells are identical. As illustrated in the example of FIGS. 15D-15F, the 'identical cell' feature is not a limitation and heater cells are not required to be exactly repeating unit cells. In some embodiments, each heater cell may individually provide common features (i.e. any combination of features disclosed herein including but not limited to features related to heater spacing features, heater spatial density feature(s), features related to size(s) and/or shape of inner and/or outer zones (or relationships between them), production well features, features relating to operation of heaters or any other feature).

In the example of FIGS. 15A-15F, for each heater cell, an area enclosed by outer zone perimeter 208 is about four times that of inner zone perimeter 204, a heater density within inner zone 210 significantly exceeds that of outer zone 214, at least a substantial majority of the inner zone heaters 226 are located away from outer zone perimeter 208, production well(s) are located in each of inner 210 and outer 214 zones.

In the example of FIGS. 15A-15F, for a plurality of the heater cells, (i) the area of all cells are substantially equal to a single common value; (ii) for each heater cell of the plurality of cells, a significant portion (i.e. at least one third or at least one half or at least two-thirds or at least three-quarters) of each cell perimeter (e.g. outer zone perimeter 208) is located 'close' to a neighboring cell perimeter.

A 'candidate location' of a first heater cell (i.e. within the cell or on a perimeter thereof—e.g. cell A 610) is located 'close to' a second heater cell (e.g. cell B 614 or C 618) if a distance between (i) the 'candidate location' of the first heater cell and (ii) a location of the second heater cell that is closest to the 'candidate location' of the first heater cell is less than a 'threshold distance.' Unless otherwise specified, this 'threshold distance' is at most two-fifths of a square root of an area of the first heater cell. In some embodiments, this 'threshold distance' is at most one third or at most one quarter or at most one sixth or at most one tenth of a square root of an area of the first heater cell.

In some embodiments, for each of first and second neighboring heater cells (e.g. having substantially equal areas), at least a portion (e.g. at least 5% or at least 10% or at least 20% or at least 30% or at least 40% or at least a majority of) of each cell perimeter selected from one of the first and second heater cells) is 'close' to the other heater cell.

In the example of FIG. 15A, one of the cells is a 'surrounded cell' whereby an entirety of its perimeter is 'close to' neighboring heater cells. For the present disclosure, a heater cell is 'substantially surrounded' when a substantial majority (i.e. at least 75%) of its perimeter is 'close to' a neighboring heater cell. In the example of FIG. 15A, different portions of a perimeter of surrounded cell 608 are 'close to' six different neighboring heater cells. In some embodiments, different portions of a perimeter of surrounded cell 608 are 'close to' at least 3 or at least 4 or at least 5 different neighboring cells—e.g. a majority of which or at least 3 or at least 4 or at least 5 of which have an area that is 'substantially equal' to that of surrounded cell 608.

Also labeled in FIG. 15A are first 602 and second 604 neighboring cells, which are located on opposite sides of surrounded cell 608. In the present disclosure, two neighboring cells $CELL^1_{NEIGHBOR}$ and $CELL^2_{NEIGHBOR}$ having respective centroids $CENT(CELL^1_{NEIGHBOR})$ and $CENT(CELL^2_{NEIGHBOR})$ are said to be 'substantially on opposite sites' of a candidate heater cell $CELL_{CANDIDATE}$ having a centroid $CENT(CELL_{CANDIDATE})$ if an angle $\angle CENT(CELL^1_{NEIGHBOR})CENT(CELL_{CANDIDATE})CENT(CELL^2_{NEIGHBOR})$ is at least 120 degrees. In some embodiments, this angle is at least 130 degrees or at least 140 degrees or at least 150 degrees.

One salient feature of the multi-cell embodiment of FIG. 15A-15F is that neighboring cells may 'share' one or more (e.g. at least two) common outer perimeter heaters 236. In this situation, each of the shared heater serves as an outer perimeter heater for two or more neighboring cells. In the example of FIG. 15A, neighboring heater cells may share up to three common outer perimeter heaters.

Without limitation, in some embodiments, the multi-cell pattern based upon nested hexagons (e.g. having two levels as illustrated in FIG. 15A or having three or levels as discussed below) may provide one or more of the following benefits: (i) a significantly lower heater well density (e.g. at most three-thirds or at most three-fifths or at most one-half)

compared to what would be observed for the hypothetical case where all heaters were arranged at a uniform density equal to that of the inner zones 210; (ii) a relatively short time to first production (e.g. see FIG. 12A-12D); (iii) a lower energy use due to heat exchange between zones and/or between neighboring cells; and/or (iv) due to the presence of production wells in inner zones as well as outer zones, more oil and less gas is produced because fluids pass near fewer heater wells en route to a production well—hence, less cracking. In some embodiments, inner zone heaters 226 are primarily less efficient electric heaters while outer zone heaters 228 are primarily more efficient molten salt heaters (see, for example, FIGS. 21A-21H). As such, in some embodiments, the use of molten salt heaters in outer zones increases the overall energy efficiency of hydrocarbon production.

In some embodiments, inner zone heaters 226 are primarily less efficient electric heaters while outer zone heaters 228 are primarily advection-based heaters—e.g. molten salt heaters that employ molten salt as a heat-transfer fluid or advection-based heaters that employ a heat transfer fluid other than molten salt (e.g. a gas or a liquid other than molten salt).

It appreciated that other embodiments other than that of FIG. 15A may provide some or all of the aforementioned benefits.

Figure 15B:
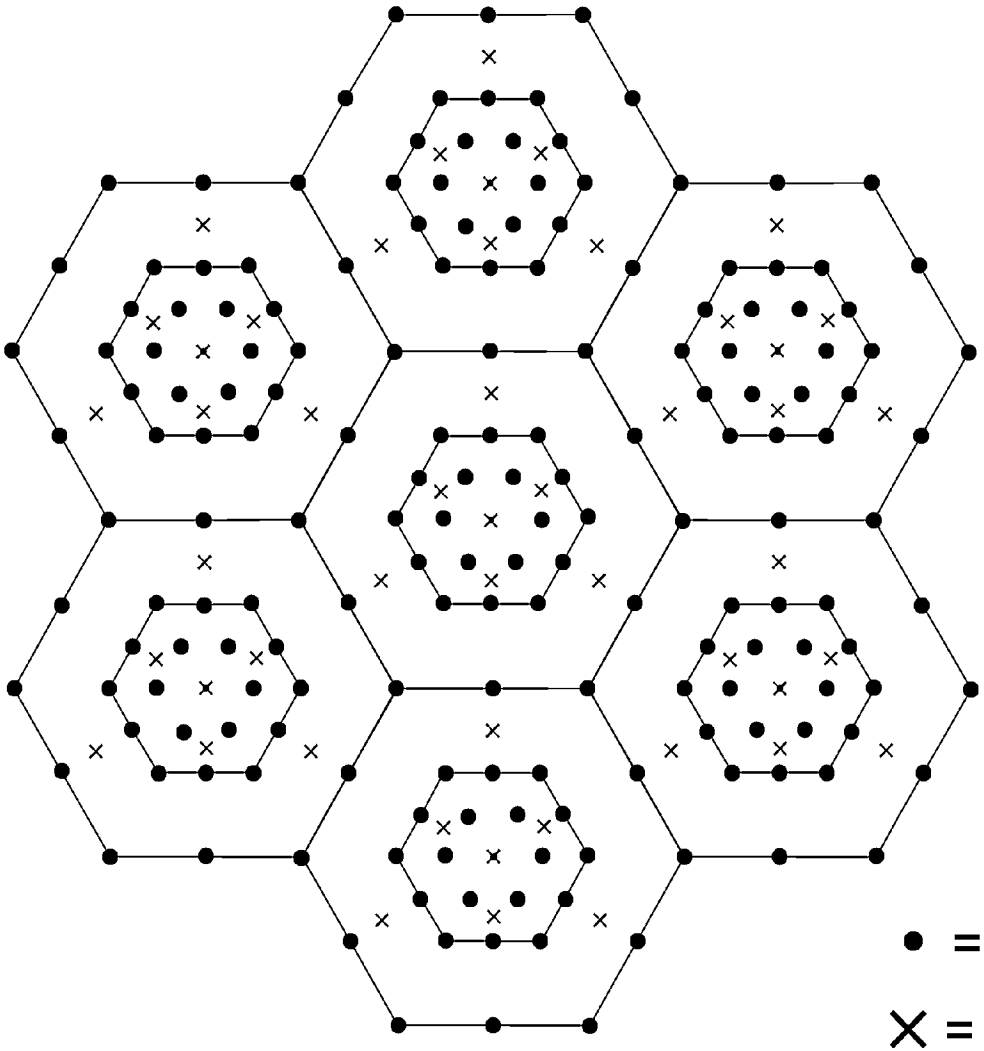

The pattern of FIG. 15B is similar to that of FIG. 15A—however, in the example of FIG. 15B production wells are arranged at the centroid 296, 298 of each heater cell, while in the example of FIG. 15A heaters are arranged at the centroid 296, 298 of each heater cell.

Figure 15C:
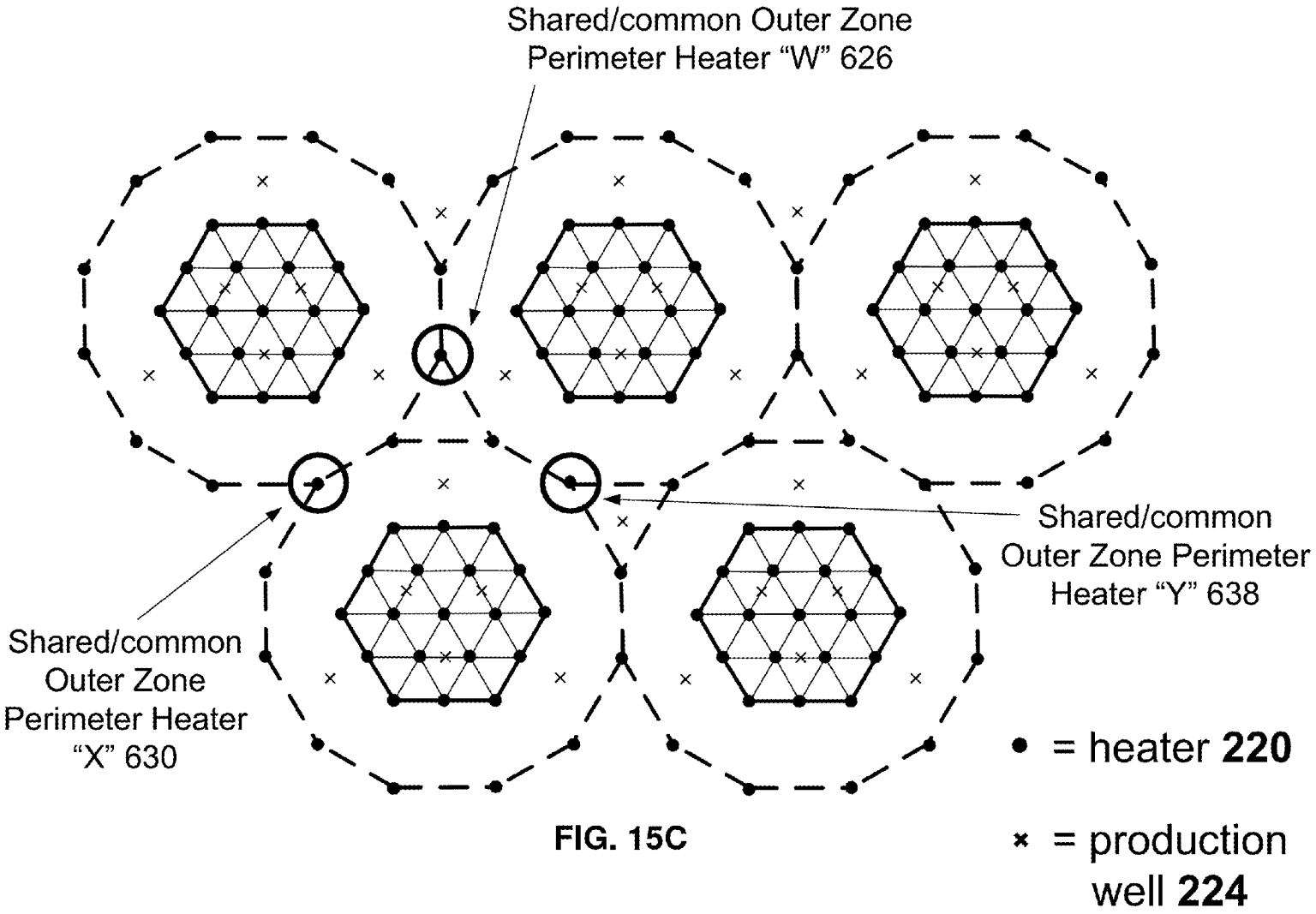
Figure 15D:
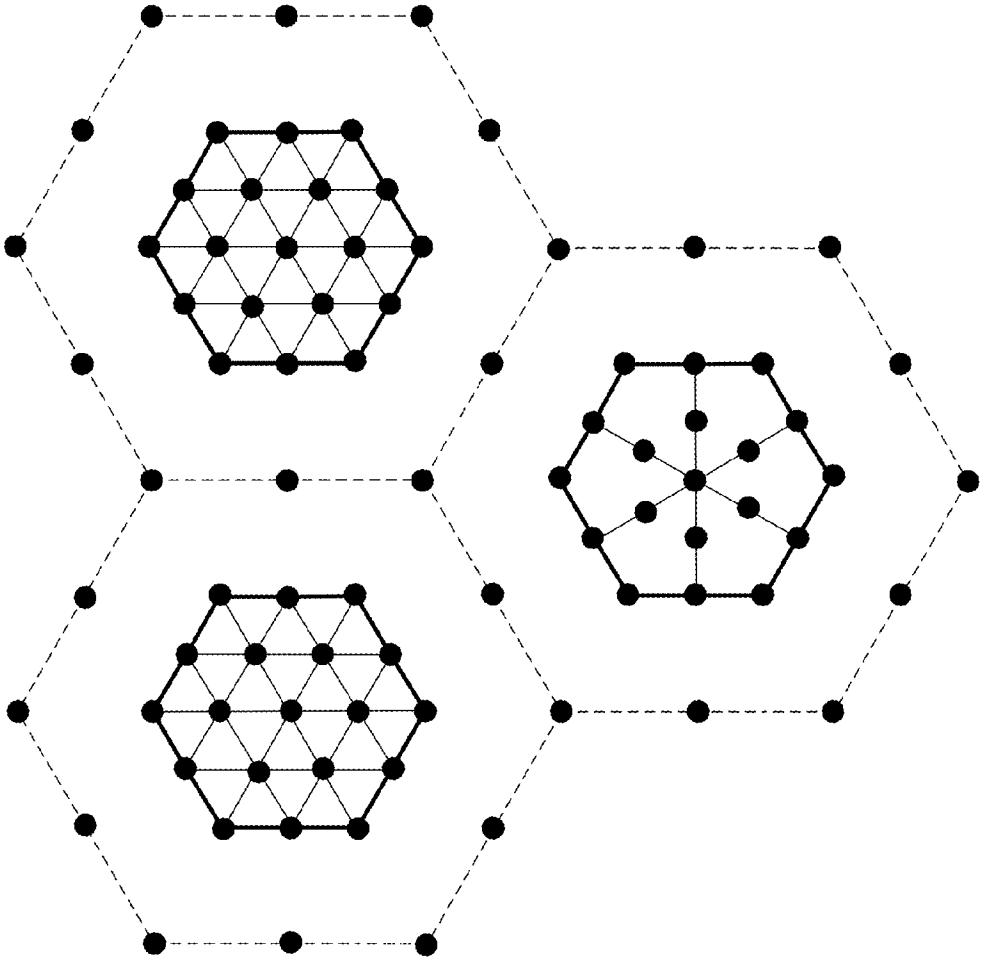
Figure 15E:
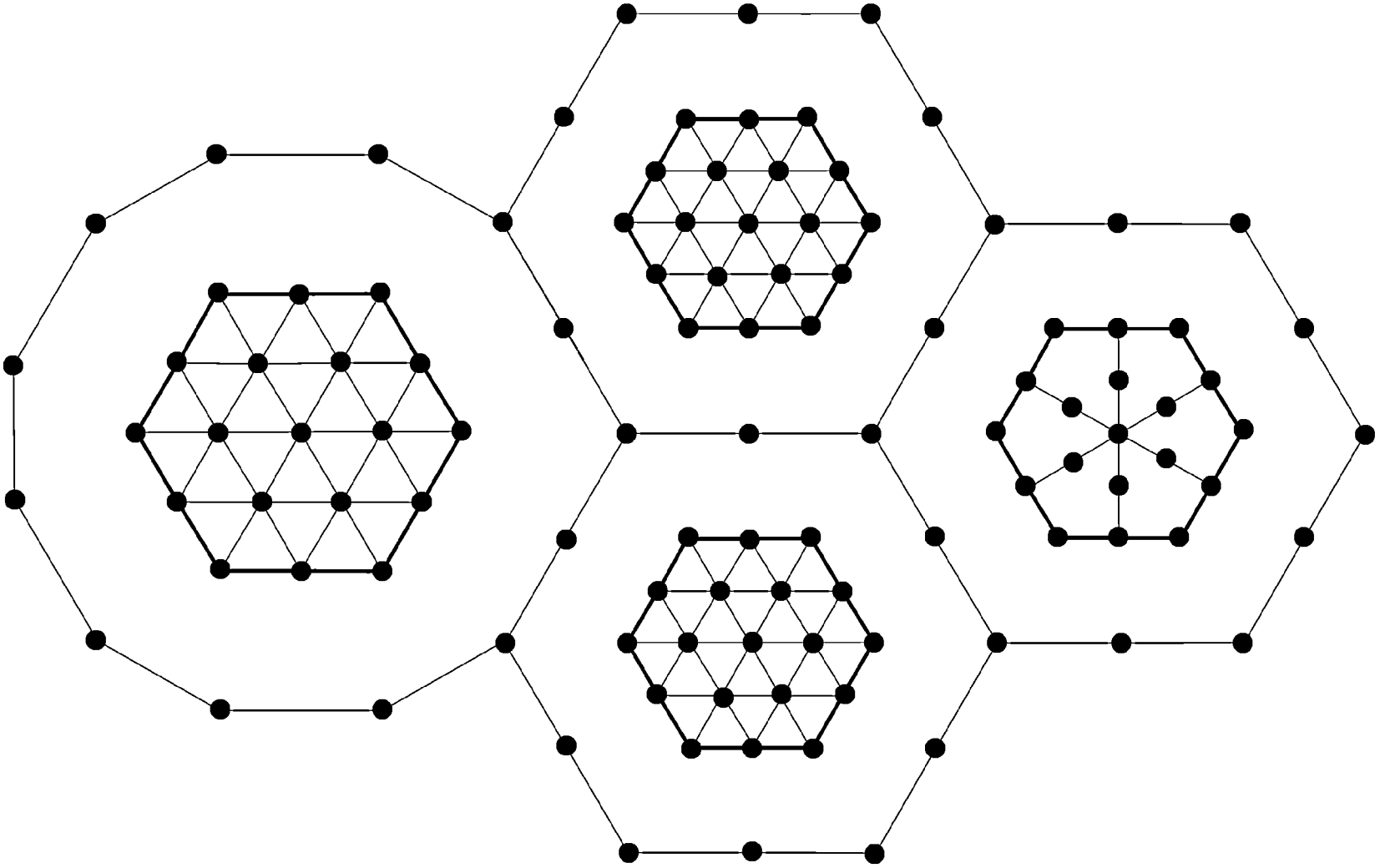
Figure 15F:
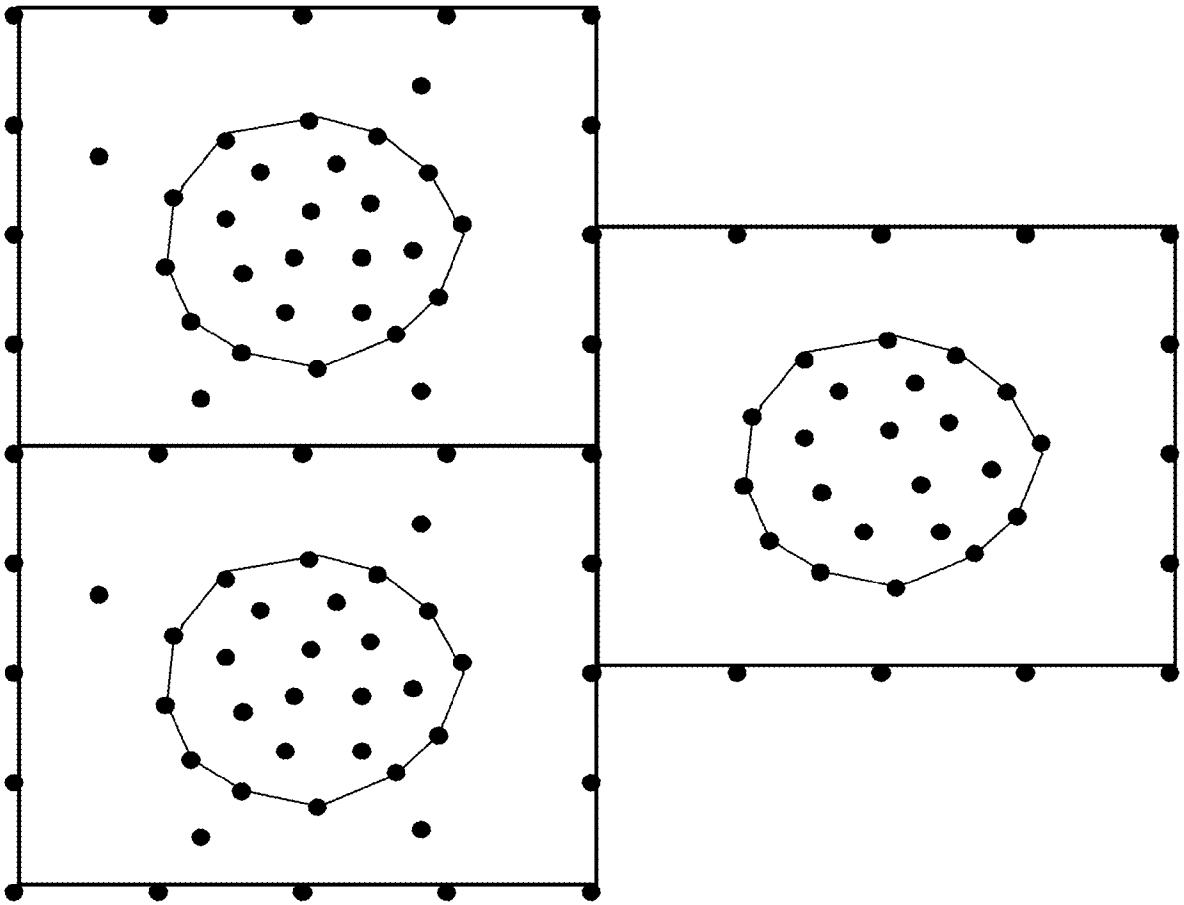

In FIG. 15C, a region of subsurface formation is filled with multiple heater cells including cell "A" 610, cell "B" 614 and cell "C" 618. As illustrated in FIG. 15C, cells "A" 610 and "C" 618 share common outer zone perimeter heater "W" 626; cells "A" 610 and "B" 614 share common outer zone perimeter heater "X" 639; cells "B" 614 and "C" 618 share common outer perimeter heater "Y" 638.

As illustrated in FIGS. 15D-15F, in some embodiments, the heater cells do not have identical patterns, and the heater cells may be thought of as 'quasi-unit cells' rather than 'unit cells.' In the example of FIGS. 15D-15F, even though heater cells are not identical, each heater cell individually may contain any combination of feature(s) relating to inner 210 and outer 214 zones described in any embodiment herein. The features include but are not limited to features related to heater spacing (e.g. shorter average spacing between neighboring heaters in inner zone 214 than in outer zone 210), heater density (e.g. higher density in inner zone 214 than in outer zone 210), dimensions of inner and/or outer zone perimeters 204, 208 (e.g. related to aspect ratio, or related to a ratio between respective areas of outer and inner zones or of areas enclosed by perimeters 204, 208 thereof), average distance to a nearest heater, dispersion and/or distribution of heaters within inner and/or outer zone, heater distribution along inner and/or outer zone perimeter(s) 204, 208, or any other feature (e.g. including but not limited to feature(s) related to heater location).

In the example of FIGS. 15D-15F, neighboring cells all have like-shaped and like-sized inner zone and outer zone perimeters 204, 208. This is not a limitation. In some embodiments, areas or aspect ratios of inner zone and/or outer zone perimeters 204, 208 of neighboring cells (i.e. which optionally share at least one common outer zone heater) may be similar but not identical. In some embodiments, for any 'cell' pair $\{CELL_1, CELL_2\}$ of neighboring heater cells $CELL_1$, $CELL_2$ an area enclosed by inner zone and/or outer zone perimeters 204, 208 of $CELL_1$ is (i) equal to at least 0.5 times and at most 2.0 times that of $CELL_2$ or (ii) equal to at least 0.666 times and at most 1.5 times that of $CELL_2$; or (iii) equal to at least 0.8 and at most 1.2 times that of $CELL_2$. In some embodiments, for any pair of neighboring heater cells $CELL_1$, $CELL_2$ an aspect ratio of inner zone and/or outer zone perimeters 204, 208 of $CELL_1$ is (i) equal to at least 0.5 times and at most 2.0 times that of $CELL_2$ or (ii) equal to at least 0.666 times and at most 1.5 times that of $CELL_2$; or (iii) equal to at least 0.8 and at most 1.2 times that of $CELL_2$.

In some embodiments, any feature(s) in the previous paragraph relating any pair of neighboring heater cells $CELL_1$, $CELL_2$ may be true for at least one pair of neighboring heater cells $CELL_1$, $CELL_2$. In some embodiments, any feature(s) may be true for various pair sets of cells. For example, if a cell $CELL_{GIVEN}$ surrounded by a plurality of neighbors $CELL_{NEIGHBOR_1}$, $CELL_{NEIGHBOR_2}$, . . . $CELL_{NEIGHBOR_N}$, any feature(s) of the previous paragraph previous paragraph may be true for at least a majority, or for all of the following cell pairs: $\{CELL_{GIVEN}, CELL_{NEIGHBOR_1}\}$, $\{CELL_{GIVEN}, CELL_{NEIGHBOR_2}\}$, . . . , $\{CELL_{GIVEN}, CELL_{NEIGHBOR_N}\}$.

In some embodiments, a region of the subsurface formation (i.e. a two-dimensional portion of a cross-section of the subsurface formation) may be 'substantially filled' by a plurality of heater cells if at least 75% or at least 80% or at least 90% of the area of the region is occupied by one of the heater cells. In some embodiments, the 'cell-filled-region' includes at least 3 or at least 5 or at least 10 or at least 15 or at least 20 or at least 50 or at least 100 heater cells and/or is rectangular in shape and/or circular in shape or having any other shape and/or has an aspect ratio of at most 3 or at most 2.5 or at most 2 or at most 1.5. In some embodiments, any feature(s) relating pairs of neighboring cells (i.e. relating to the sharing of outer perimeter heaters 236 or related to neighboring pairs of heaters $\{CELL_1, CELL_2\}$) may be true for a majority of heater cells (or at least 75% of the heater cells or at least 90% of the heater cells) within the cell-filled region. In some embodiments, both a 'length' and a 'width' of the cell-filled region (i.e. measured in heater cells) may be at least 3 or at least 5 or at least 10 or at least 20 heater cells.

Figure 16A:
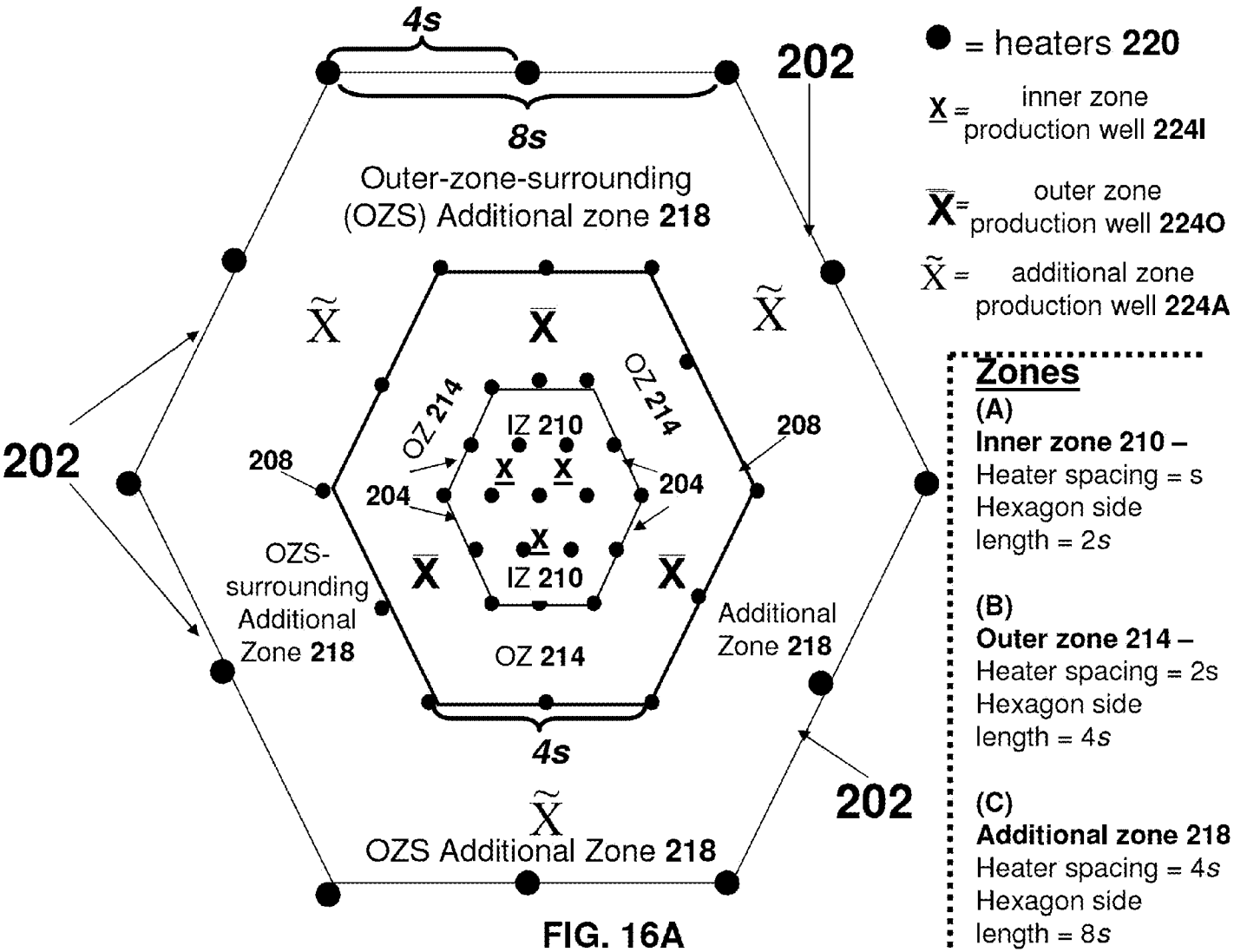
Figure 16B:
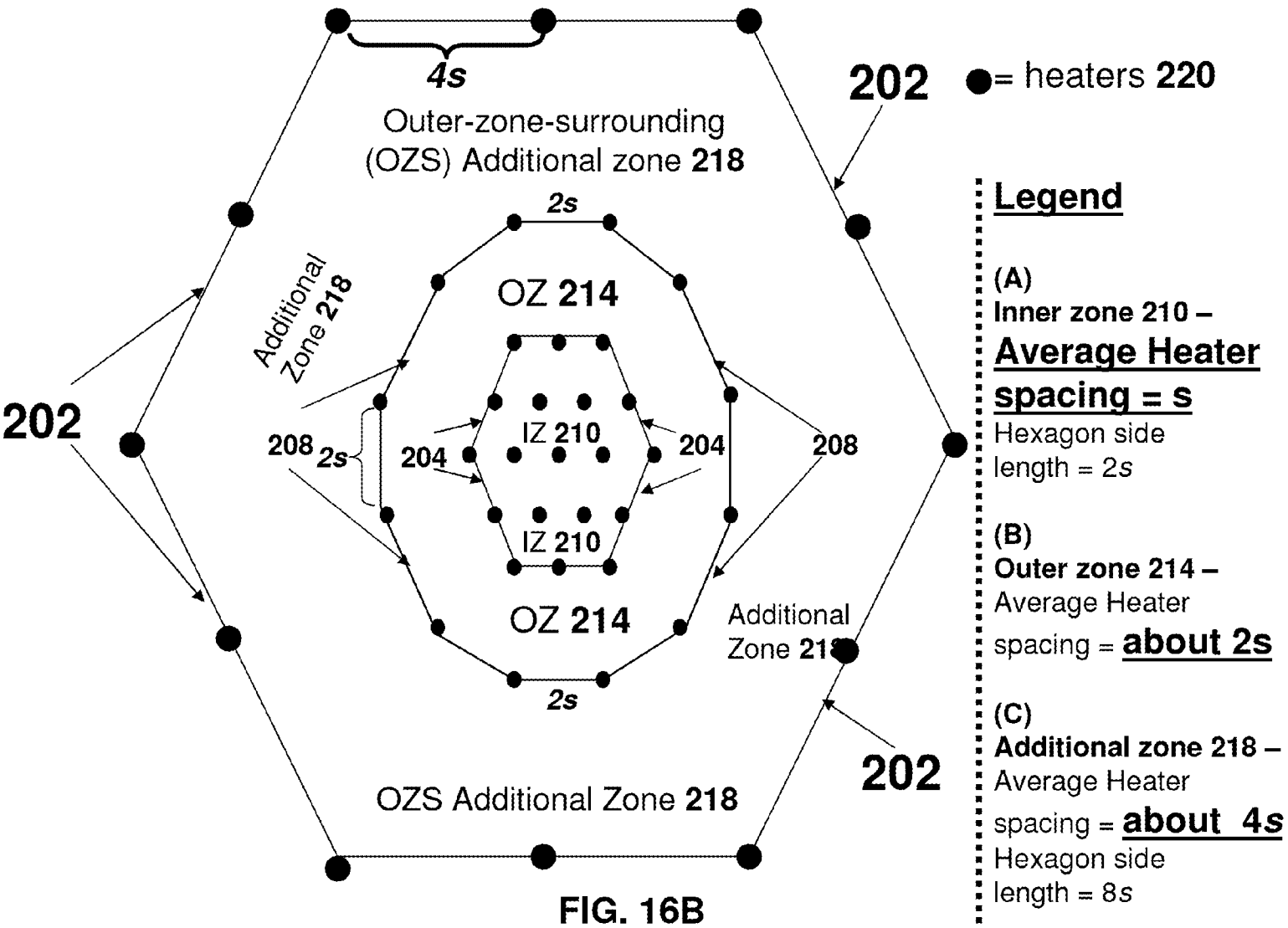
Figure 16C:
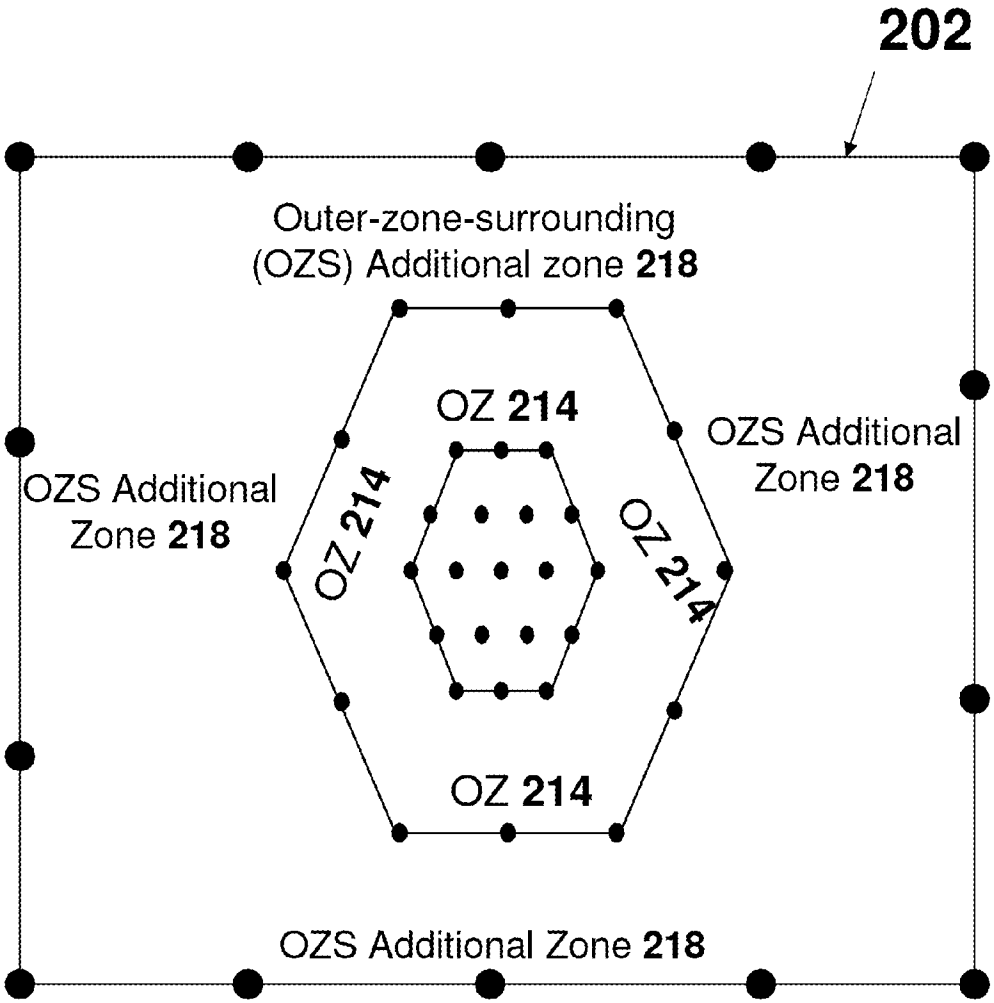

FIGS. 2-15 relate to heater patterns having at least two 'levels'—i.e. an inner zone 210 having relatively high heater density and an outer zone 214 having relatively low heater density. In the examples of FIGS. 16A-16C, one or more heater cells have at least 'three' levels. In the examples of FIGS. 16A-16C, heaters are located within an outer-zone-surrounding (OZS) additional zone 218 at a significantly larger heating spacing and significantly lower density than in outer zone 214.

OZS additional zone heaters (i.e. heaters located OZS additional zone perimeter 202 or in an interior of OZS additional zone 218) include OZS additional zone perimeter heaters each located on or near OZS additional zone perimeter 202 and distributed around OZS additional zone perimeter 202. In some embodiments, OZS additional zone heaters are predominantly OZS additional zone perimeter heaters—this is analogous to the feature provided by some embodiments and described above whereby outer zone heaters 228 are predominantly outer zone perimeter heaters 236.

For the present disclosure, the OZS 210 refers to the entire area enclosed by a perimeter 202 thereof. that is also outside of outer zone 214.

In the example of FIG. 16A, an area enclosed by a perimeter 202 of OZS additional zone 218 and four times that of outer zone perimeter 202, and an average heater spacing within OZS additional zone 218 is about twice that of outer zone 214. In the example of FIG. 16A, perimeters 204, 208, 202 of inner, outer and OZS-additional zones 210, 214, 218, are regular-hexagonal in shape and have respective side lengths equal to 2s, 4s, and 8s. In the example of FIG. 16A, respective average heater spacings of inner 210, outer 214, and OZS additional 218 zones are equal to s, approximately equal to 2s, and approximately equal to 4s. In different embodiments, a perimeter 202 of OZS additional zone 218 is convex or substantially convex.

In different embodiments, a relation between OCS additional zone 218 and outer zone 214 is analogous to that between outer zone 214 and inner zone 210. Thus, in some embodiments, by analogy, any feature described herein a relationship between inner 210 and outer 214 zones may also be provided for outer 214 and OZS additional 218 zones. Such features include but are not limited to features related to heater spacing (e.g. shorter average spacing between neighboring heaters in inner zone 214 than in outer zone 210), heater density (e.g. higher density in inner zone 214 than in outer zone 210), dimensions of inner and/or outer zone perimeters 204, 208 (e.g. related to aspect ratio, or related to a ratio between respective areas of outer and inner zones or of areas enclosed by perimeters 204, 208 thereof), average distance to a nearest heater, dispersion and/or distribution of heaters within inner and/or outer zone, heater distribution along inner and/or outer zone perimeter(s) 204, 208, or any other feature (e.g. including but not limited to feature(s) related to heater location).

As was noted above for the case of a perimeter 208 of outer zone 214, in different embodiments the perimeter 202 of OZS additional zone 218 may be defined by locations of the heater (i.e. to form some a ring-shaped cluster where adjacent locations have a significantly lower heater density).

In the example of FIG. 16A, production wells 224 are arranged through each of inner 210, outer 214, and OZS additional zone 218, and are respectively labeled in FIG. 16A as inner zone 224I, outer zone 224O and additional zone 224A production wells. In the example of FIG. 16A, the density of production wells is greatest in the most inner zone (i.e. inner zone 210), is the least in the most outer zone (i.e. additional zone 218) and has an intermediate value in the 'mediating' zone (i.e. outer zone 214). In particular, a ratio between an inner zone production well density and that of outer zone 210 is three; a ratio between an outer zone production well density and that of additional zone 214 is also three.

In the particular example of FIG. 16A, perimeters 208, 202 of outer 214 and OZS-additional 218 zones are like shaped. As illustrated in FIGS. 16B-16E, this is not a limitation.

Figure 16D:
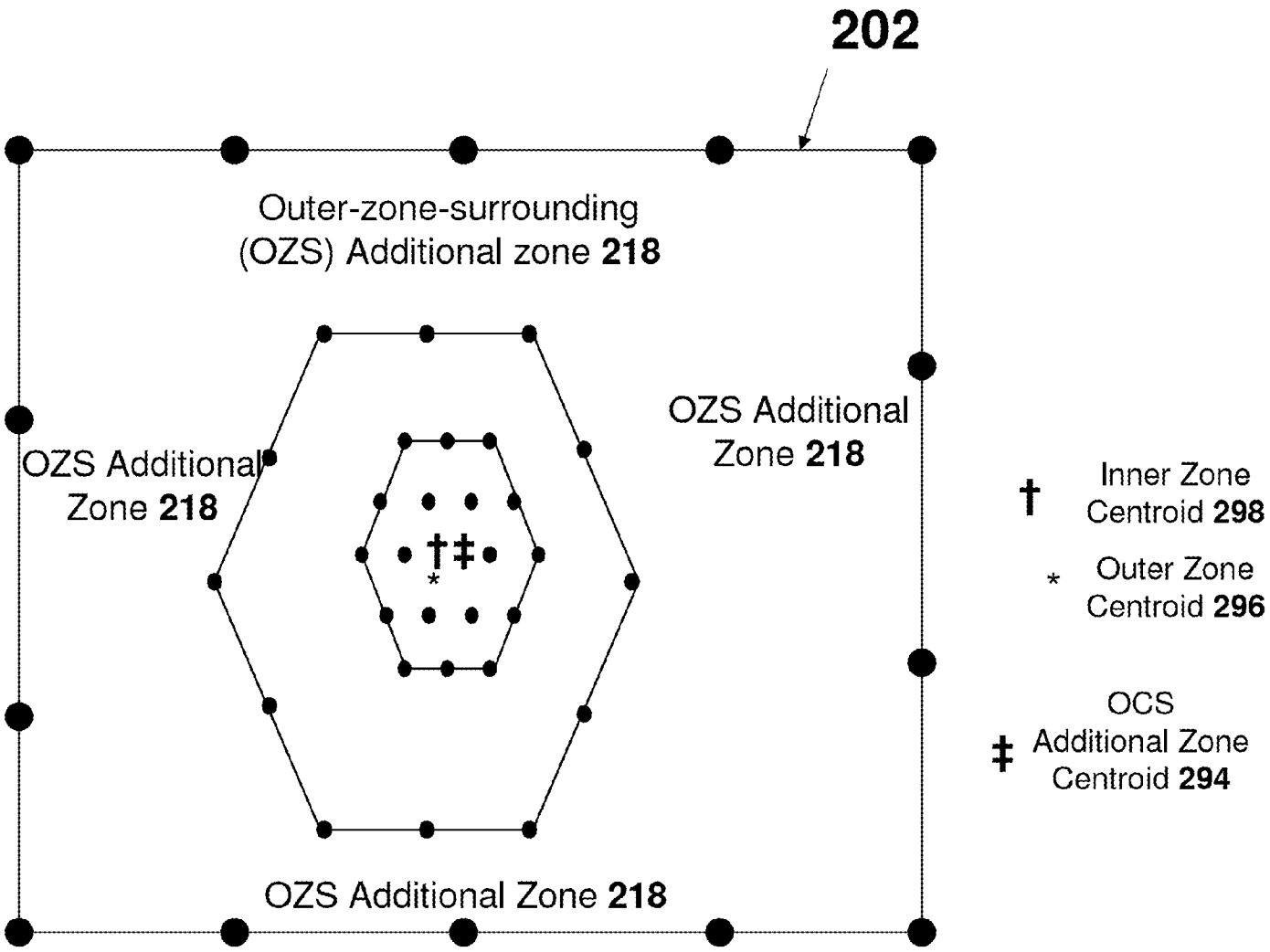
Figure 16E:
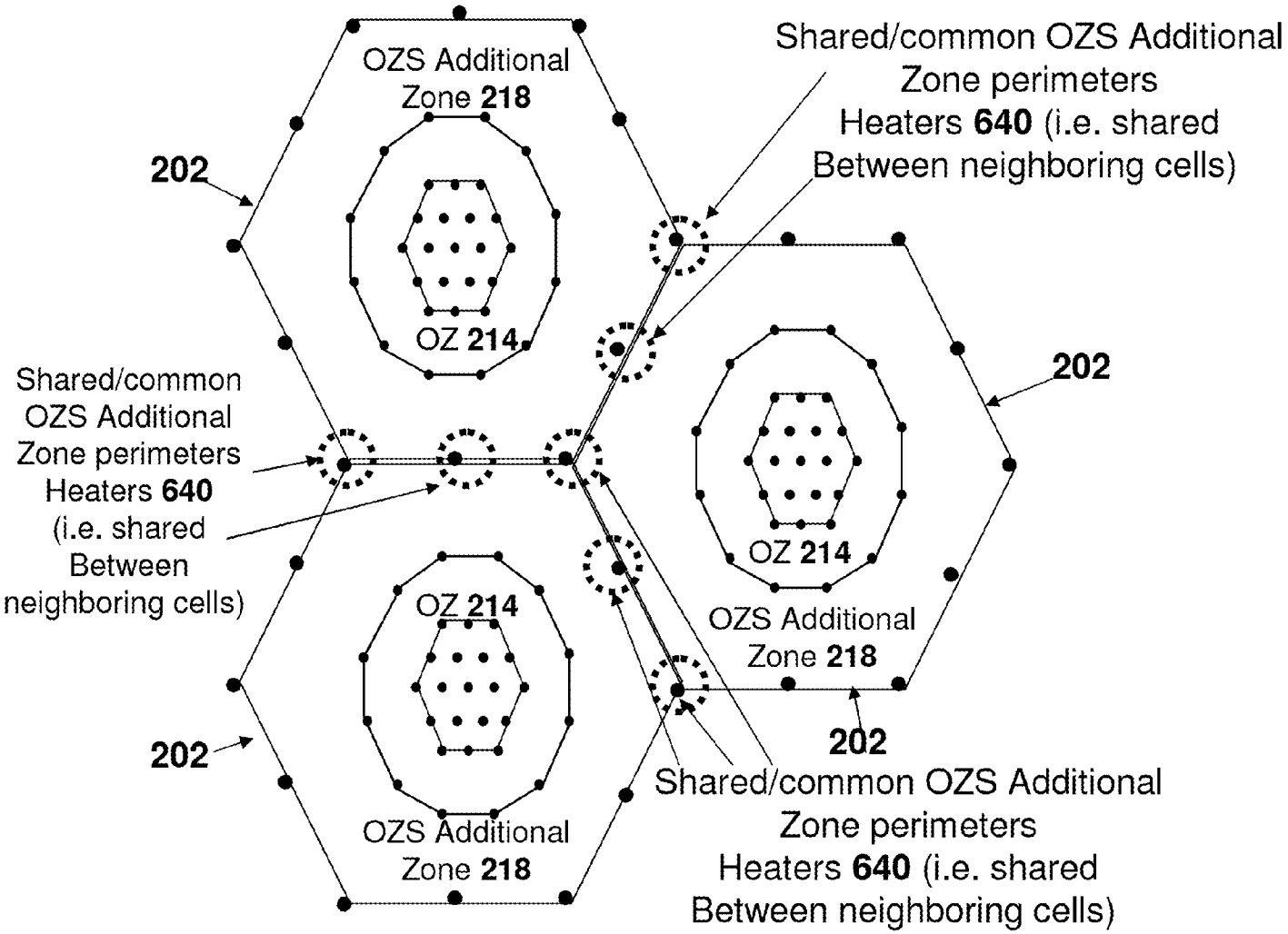

It is noted that the heater and production well pattern of FIG. 16E is the three-level analogy to that of FIG. 2D.

Even though perimeters 208, 204 of outer 214 and inner 210 zones are not required to be like-shaped but they may share certain shape-properties—for example, an aspect ratio (see, for example FIGS. 10A-10B) or any other shape-related parameter discussed herein.

FIG. 16D illustrates an example where centroids 298, 296, 294 of inner 210, outer 214, and OCS additional 218 zones do not share a single common location.

FIG. 16E illustrates a plurality of three-level heater cells. Analogous to the case of two-level heaters cells discussed with reference to FIGS. 15A-15F, any feature(s) relating to sharing of heaters between outermost perimeters neighboring cells, or a relationship to neighboring cells (e.g. area or size relationship), or a proximity relation (i.e. 'closeness') or filling a 'cell-filled' area, or any other relationship described with reference to two-level heater cells may also be provided, by analogy, for three-level heaters.

Figure 16F:
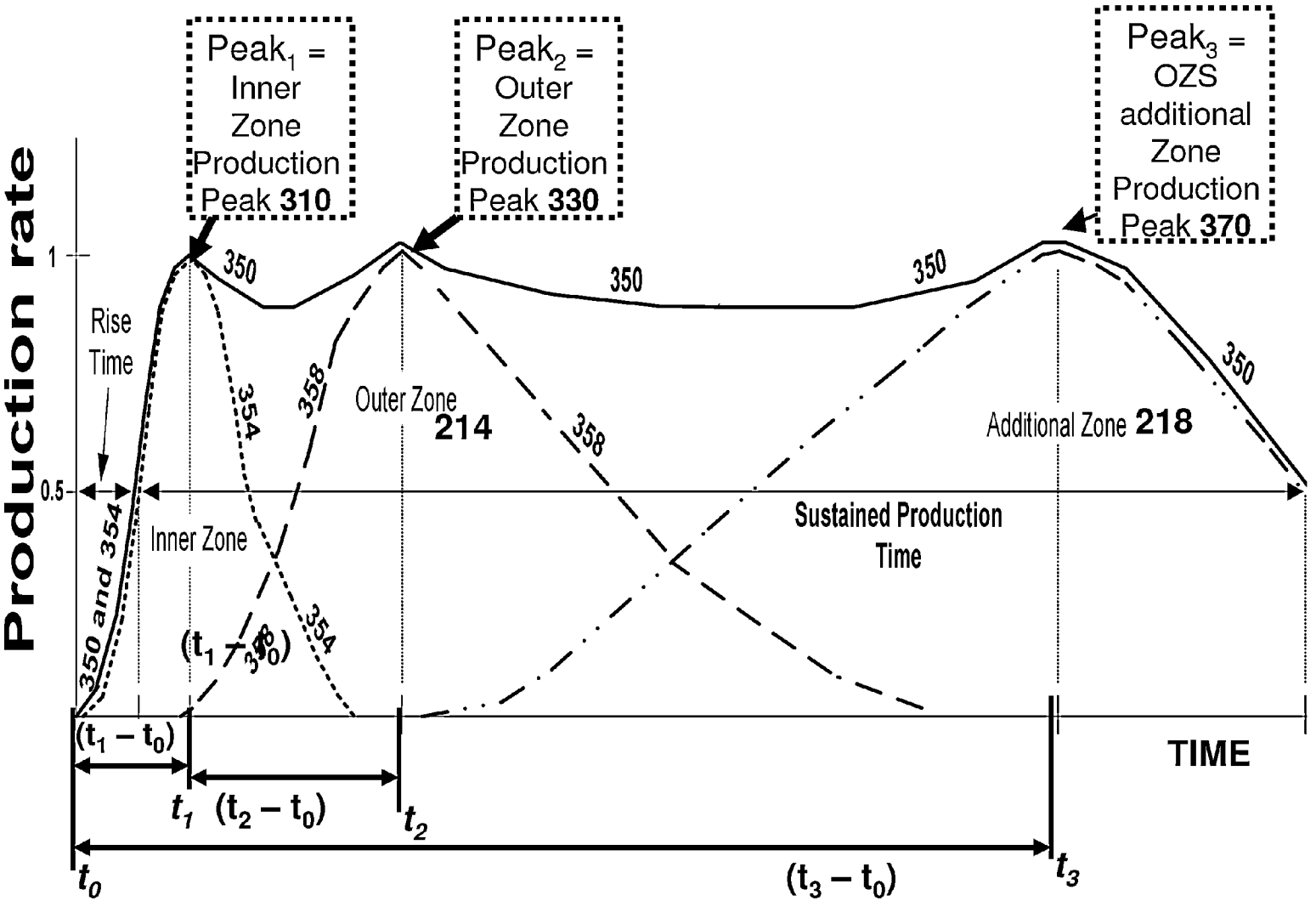
FIG. 16F describes illustrative production functions for a two-level heater cell.

FIG. 16F refers to a production rate in a three-level-heater cell (i.e. N nested zones where N is a positive integer equal to three) in one illustrative example. FIG. 16F is a generalization of the example of FIG. 12A. In the example of FIG. 16F, there are three zones. In the example of FIG. 16F, a rate of production of the hydrocarbon fluids is characterized by a sequence of N zone-specific production peaks $\{Peak_1, \ldots Peak_N\}$, where N=3, the $i^{th}$ peak $Peak_i$ representing a time of a production peak in the $i^{th}$ zone $Zone_i$, wherein for each i between 1 and N N=3), a time ratio between a time required to ramp up to the $(i+1)^{th}$) peak $Peak_{i+1}$ and $i^{th}$ peak $Peak_i$ is substantially equal to a reciprocal of a heater density ratio between a heater density zone area ratio between a heater special density of the $(i+1)^{th}$ zone $Zone_{i+1}$ and that of the $i^{th}$ zone Zone It is appreciated that in other example, N may have any other value—for example, two or four or five.

Figure 38:
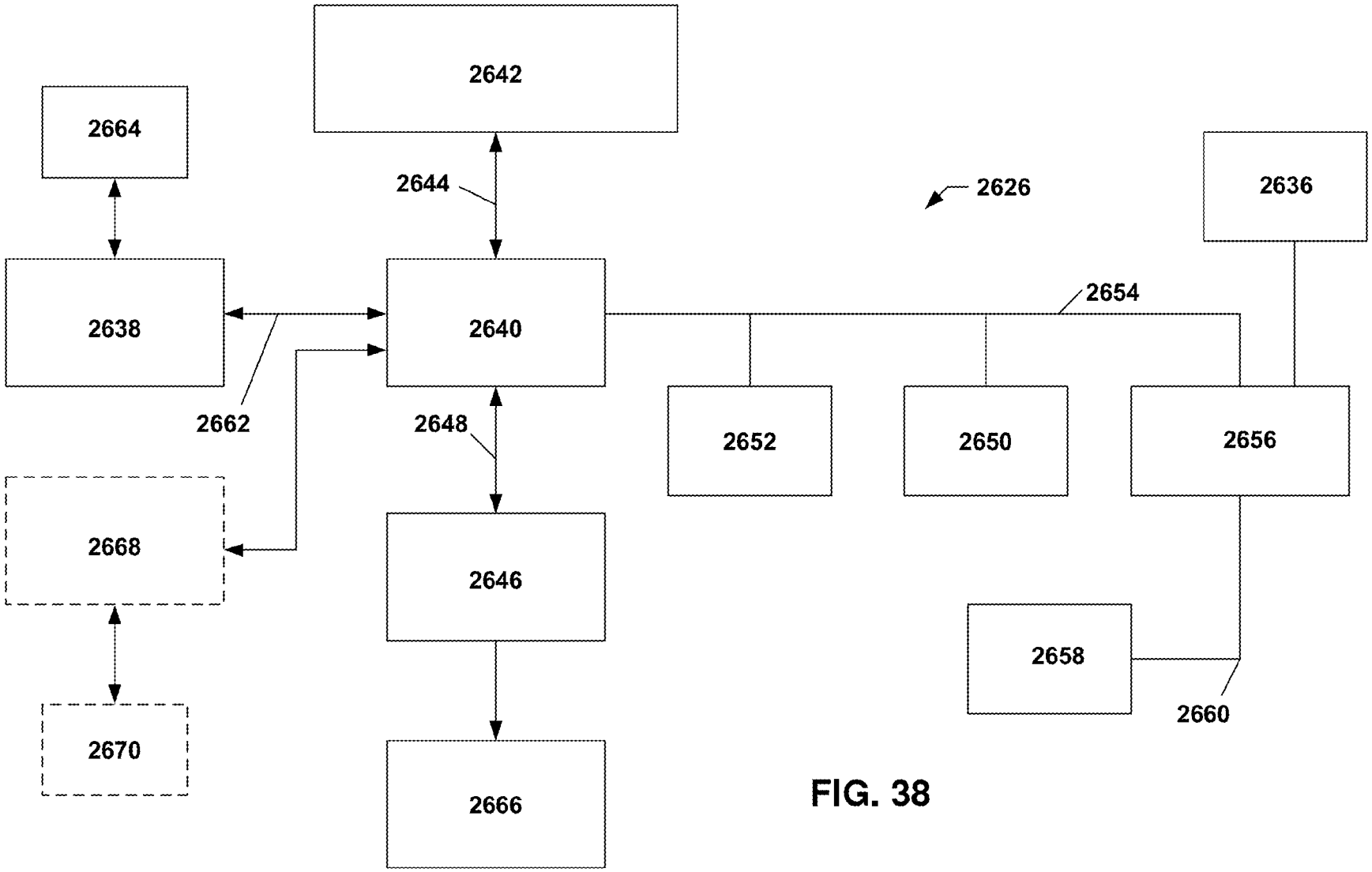
FIGS. 38-40 illustrate control apparatus and methods.

In some embodiments, desired characteristics of a production profile for an oil and gas project are a fast rise time to a peak production rate followed by a sustained period of production at approximately the peak rate. The fast rise time allows for an early return on the initial capital investment, and the sustained production allows for efficient, long-term use of the existing infrastructure. This preferred production profile is an inherent property of the nested heater pattern where the product of the heater density and area of each successive nested zone is held constant or $A_i*\rho_i$=constant, where Ai is the area and $\rho_i$ is the heater density of each successive nested zone i. The production from a three-layer nested hexagonal pattern is illustrated in FIG. 38. The production from the inner zone IZ has a fast rise time due to the high heater density of the inner zone. Because the heater density in the outer zone is reduced by a factor $A_{OZ}/A_{IZ}$, the production of the outer zone OZ is also delayed in time by an amount $A_{OZ}/A_{IZ}$ relative to the IZ production peak while the cumulative production from the outer zone is increased by a factor $A_{OZ}/A_{IZ}$ relative to the inner zone cumulative production. Therefore, as the production from an inner zone begins to decline, the production from an outer zone increases, resulting in a total production rate which is relatively constant throughout the sustained production time.

Although this has been described for the nested hexagonal pattern, it is generally true for any shape of nested heater pattern that satisfies the equation $A_i*\rho_i$=constant for each successive nested zone.

In contrast to the heater and/or production well patterns illustrated in FIGS. 2-15 which are generally two-level patterns, FIGS. 16A-16E relate to three-level patterns. In the inner-most zone (i.e. inner zone 210) heaters are arranged at the shortest spacing and/or greatest density. Each successive zone more outer zone is has a greater area than the previous more inner zone, and is characterized by a larger heater spacing and/or lesser heater density and/or less production well density.

Thus, if a heater cell or an area of the subsurface formation is divided into a N nested zones, FIGS. 2-15 relates to the specific case of N=2. In this particular case, within each heater cell, only one 'neighboring zone pair' NZP is defined, i.e. {inner zone 210, outer zone 214} where the first zone of the ordered pair is the more inner zone, and the second zone of the ordered pair is the outer zone.

For the three-level cells of FIGS. 16A-16E, N=3 and there are N−1 (i.e. two) neighboring zone pairs: {inner zone 210, outer zone 214} and {outer zone 214, OZS additional zone 218}. Because inner zone 210 and OZS additional zone 218 are clearly not neighbors (i.e. because they are separated by the intervening outer zone 214), there is no neighboring zone pair NZP that includes both inner zone 210 and OZS additional zone 218.

Figure 17A:
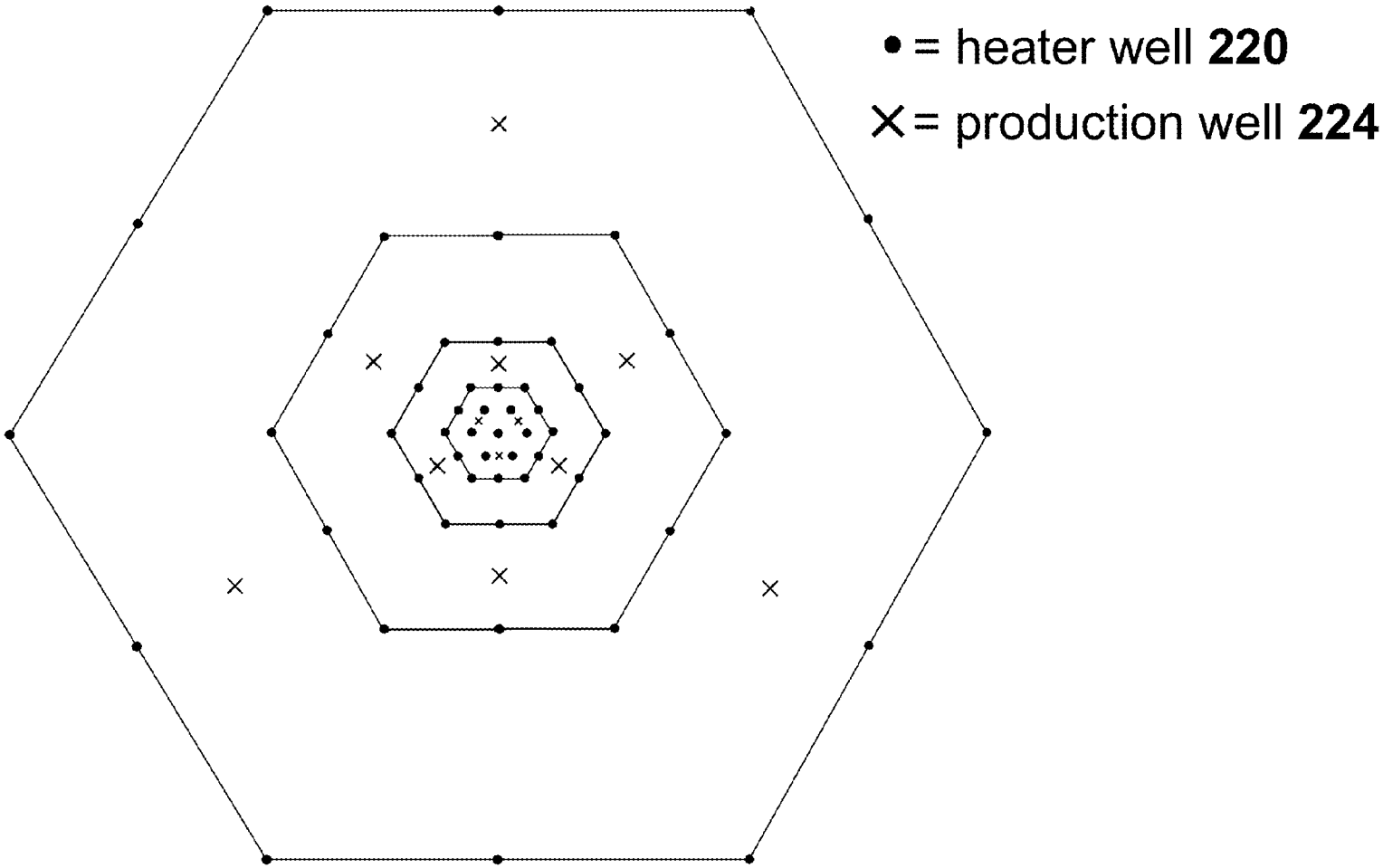
Figure 17B:
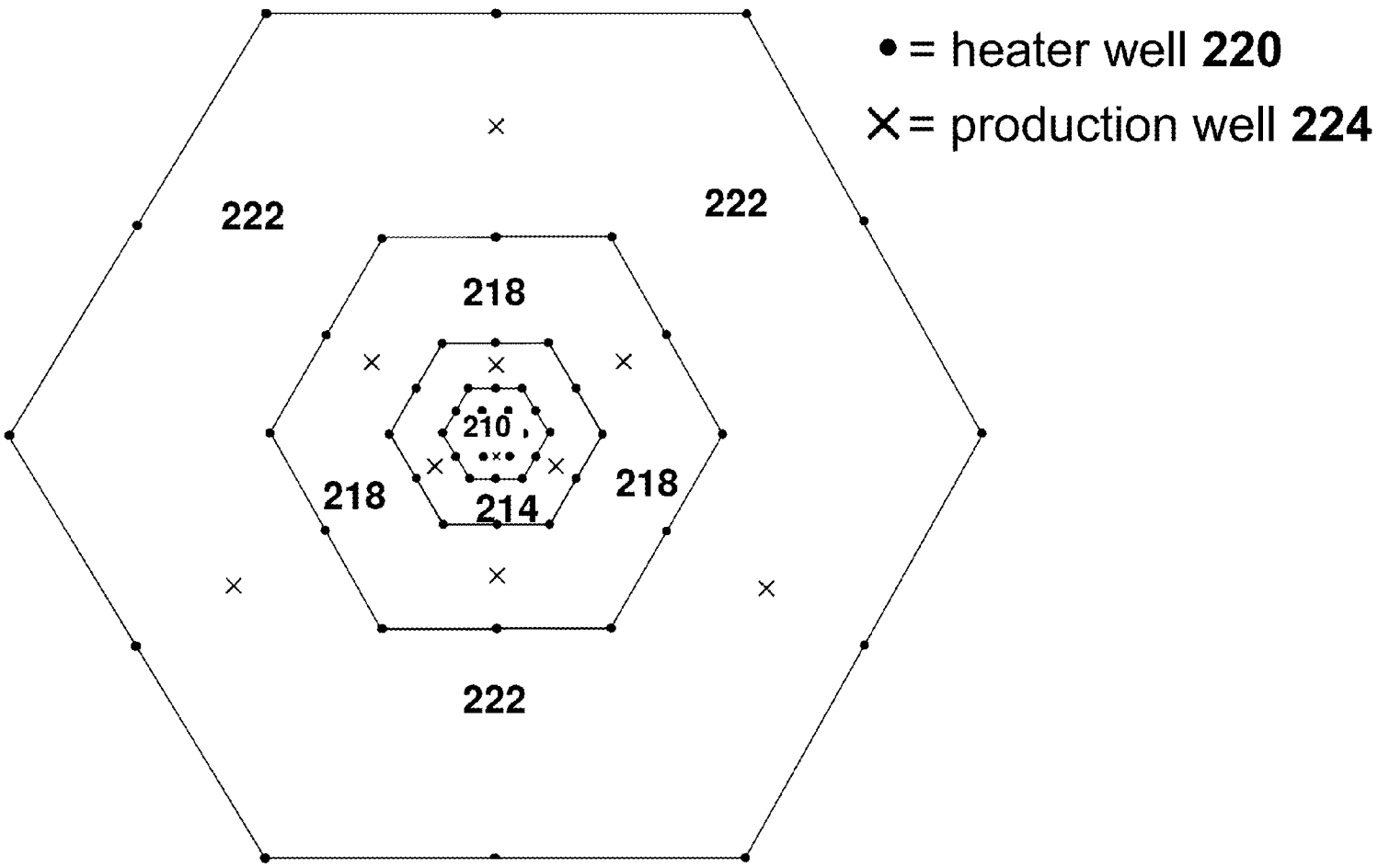

For the four-level cell of FIGS. 17A-17B, N=4 and there are N−1 (i.e. three) neighboring zone pairs NZP: {inner zone 210, outer zone 214}, {outer zone 214, OZS additional zone 218} and {OZS additional zone 218, fourth-zone 222}.

Embodiments described in FIGS. 2-17 relate to a system for in-situ production of hydrocarbon fluids from a subsurface hydrocarbon-containing formation, the system comprising: a heater cell divided into N nested zones (N≥2) each zone having a respective centroid (e.g. outer zone centroid 296 or inner zone centroid 298) and a respective substantially-convex polygon-shaped perimeter (e.g. inner zone perimeter 204, outer zone perimeter 208, or OZS additional zone perimeter 202) such that heaters 220 are located at every vertex thereof.

At least one production well is respectively located in each of the N zones.

For each neighboring zone pair NZP of the N−1 neighboring zone pairs defined by the N nested zones, an area ratio between respective areas enclosed by perimeters of the more outer zone and the more inner zone of the zone pair NZP is at most seven or at most six or at most five and/or at least three or at least 3.5 and/or between two and seven (e.g. at least two or at least three and/or at most seven or at most six or at most five).

In some embodiments, for each neighboring zone pair NZP of the N−1 neighboring zone pairs, heaters of each zone are respectively distributed around each zone centroid (e.g. 296, 298) such that a heater spatial density of the more inner zone of the zone pair NZP significantly exceeds that of the more outer zone of the zone pair NZP and/or is at least about twice that of the more outer zone of the zone pair NZP and/or is at least twice that of (e.g. about twice that of) the more outer zone of the zone pair NZP.

Alternatively or additionally, for each neighboring zone pair NZP of the N−1 neighboring zone pairs, heaters of each zone are respectively distributed around each zone centroid (e.g. 296, 298) such that a heater spatial density of the more inner zone significantly exceeds that of the more outer zone and/or is at least twice (e.g. about three times that of) that of the more outer zone of the zone pair NZP.

Alternatively or additionally, for each neighboring zone pair NZP of the N−1 neighboring zone pairs, an average distance to a nearest heater within the more outer zone significantly exceeds that (e.g. at least twice that of or at least about twice that of and/or at most three times of or at most about three times that of) of the less outer zone and/or an average distance to a nearest heater on the perimeter of the more outer zone perimeter is equal to at most about twice that of the less outer zone.

In some embodiments, there are production wells in the innermost zone 210. In some embodiments, there are production wells in one or more zones located outside of (i.e. more outer than) the innermost zone 210—in zone 214 and/or in zone 218 and/or zone 222. This feature may also be correct for 'three level' heater patterns.

Figure 18A:
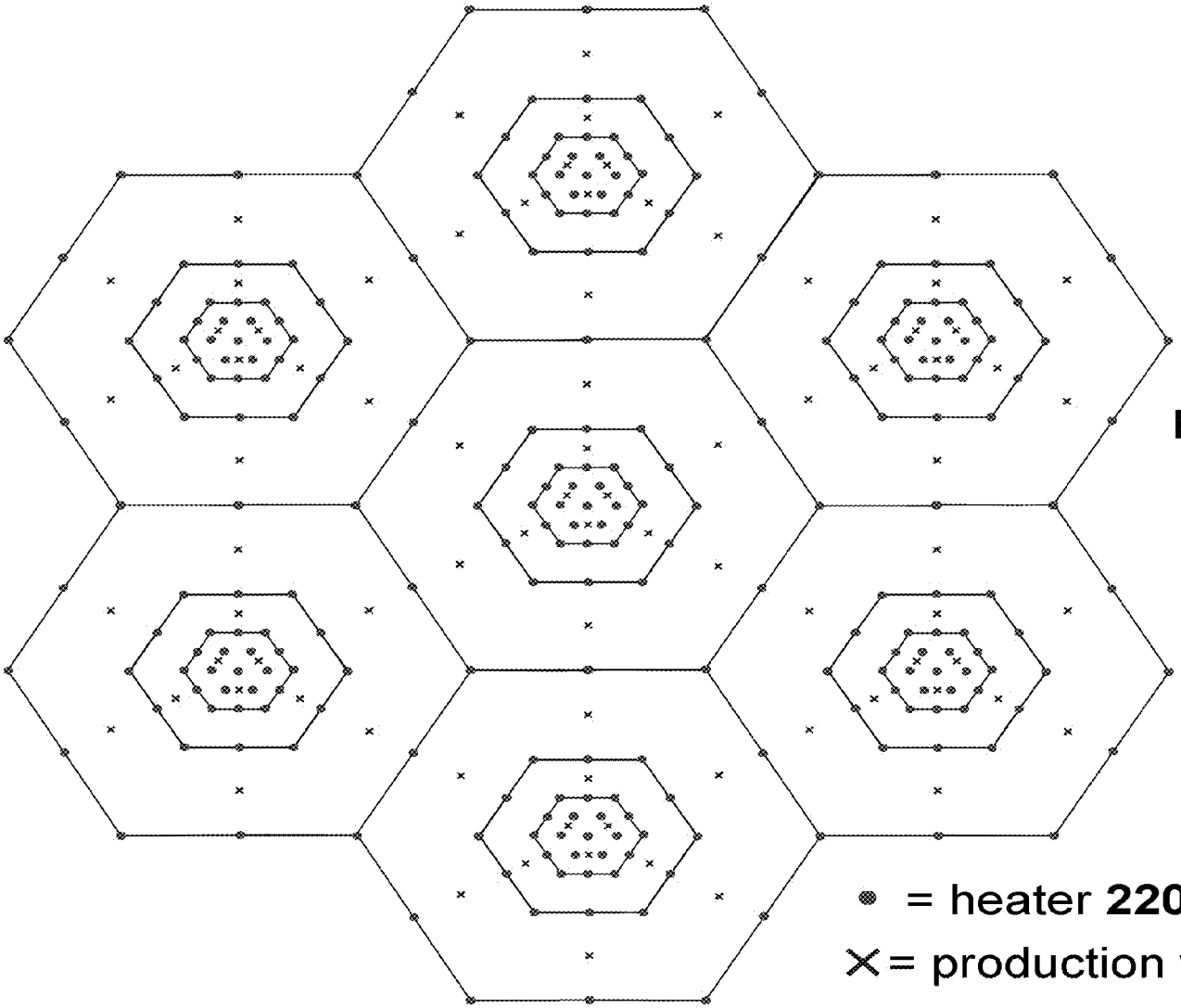
Figure 18B:
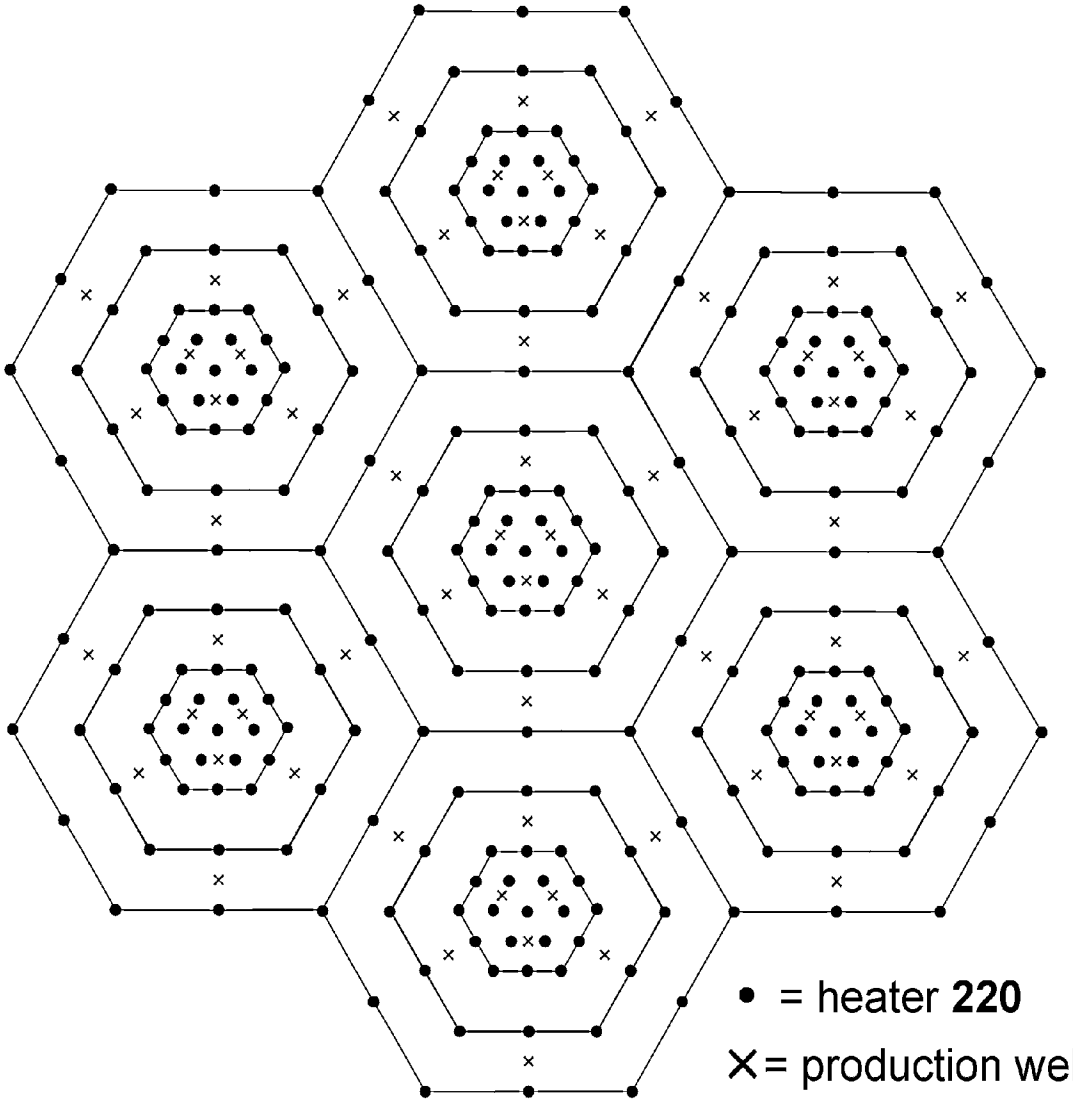
Figure 18C:
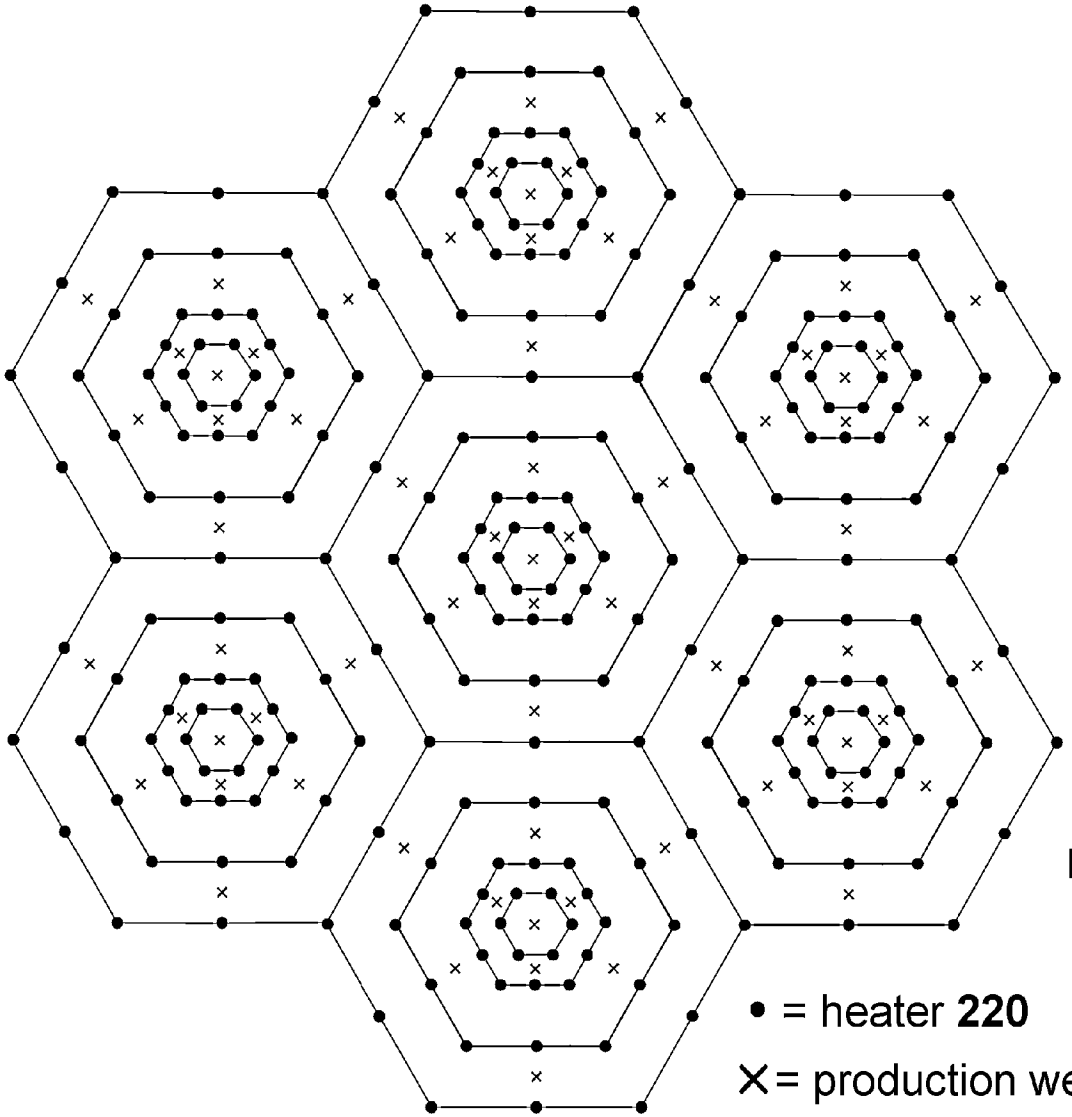

FIGS. 18A-18B relate to two-dimensional arrays of three-level heater cells. In the examples of FIGS. 18A-18B, each cell is identical, though is appreciated that this is not a limitation. As noted above, different cells may have different shapes and/or heater patterns but still provide one or more common features—e.g. related to heater density and/or spacing.

Figure 19:
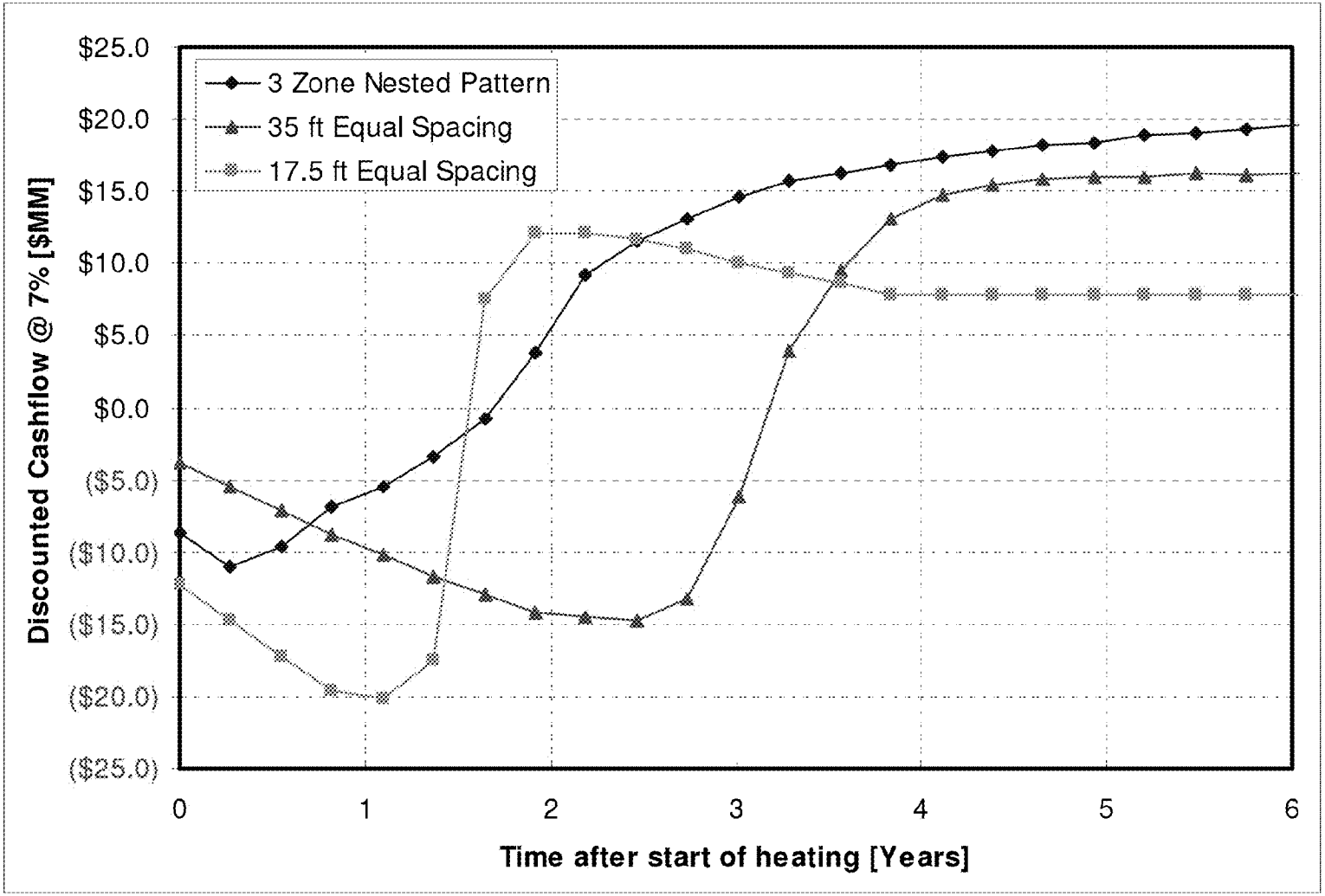
FIG. 19 shows the discounted cash flow for the commercial development of the nested production unit and the evenly spaced production units in accordance with another simplified example FIGS. 20A and 20B respectively illustrate an electrical heater and a molten salt heater.

FIG. 19 relates to a numerical simulation of hydrocarbon fluid production. FIG. 19 shows the discounted cash flow for the commercial development of a nested production unit and the evenly spaced production units. The cost for a single well is taken to be $250,000, the cost of electricity $50/MWh, and the price of oil $80/bbl. The discount rate is 7%. As seen in FIG. 19, the accelerated production from the nested unit results in a greater NPV and a lower cashflow exposure when compared to both the 17.5 ft and the 35 ft evenly spaced unit. Also, the nested production unit results in a smaller maximum cash flow risk-exposure and returns to profitability substantially earlier than the 35 ft evenly spaced unit even though the initial capital investment for the 35 ft spaced unit is lower.

Embodiments of the present invention relate to patterns of 'heaters.' The heaters used may be electrical heaters, such as conductor-in-conduit or mineral-insulated heaters; downhole gas combustors; or heaters heated by high temperature heat transfer fluids such as superheated steam, oils, $CO_2$, or molten salts or others. Because the outer zones 214 of heaters may be energized for a substantially longer time than the inner zone of heaters, for example, four times or eight times longer (see FIG. 13A), a heater with high reliability and long life is preferred for the outer 214 or OZS additional 218 zones. Molten salt heaters have very long lifetimes because they operate at nearly constant temperature without hot spots, and in many chemical plant and refinery applications, molten salt heaters have been operated for decades without shutdown. In addition, molten salt heaters may have very high energy efficiency, approaching 80%, and over the lifetime of the reservoir most of the thermal energy will be supplied to the oil shale from the heaters in the zones with the longest spacing.

Figure 20A:
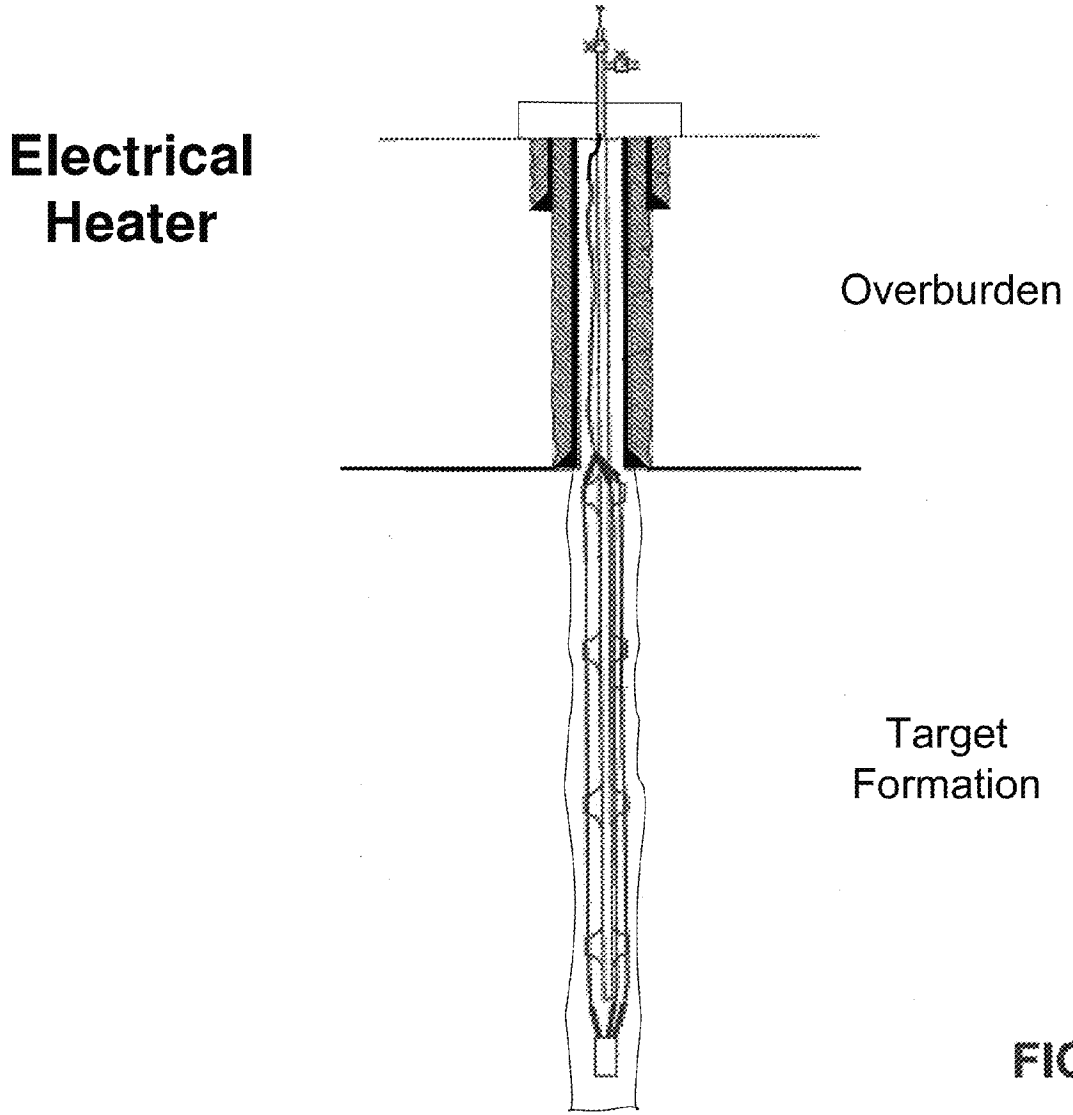
Figure 20B:
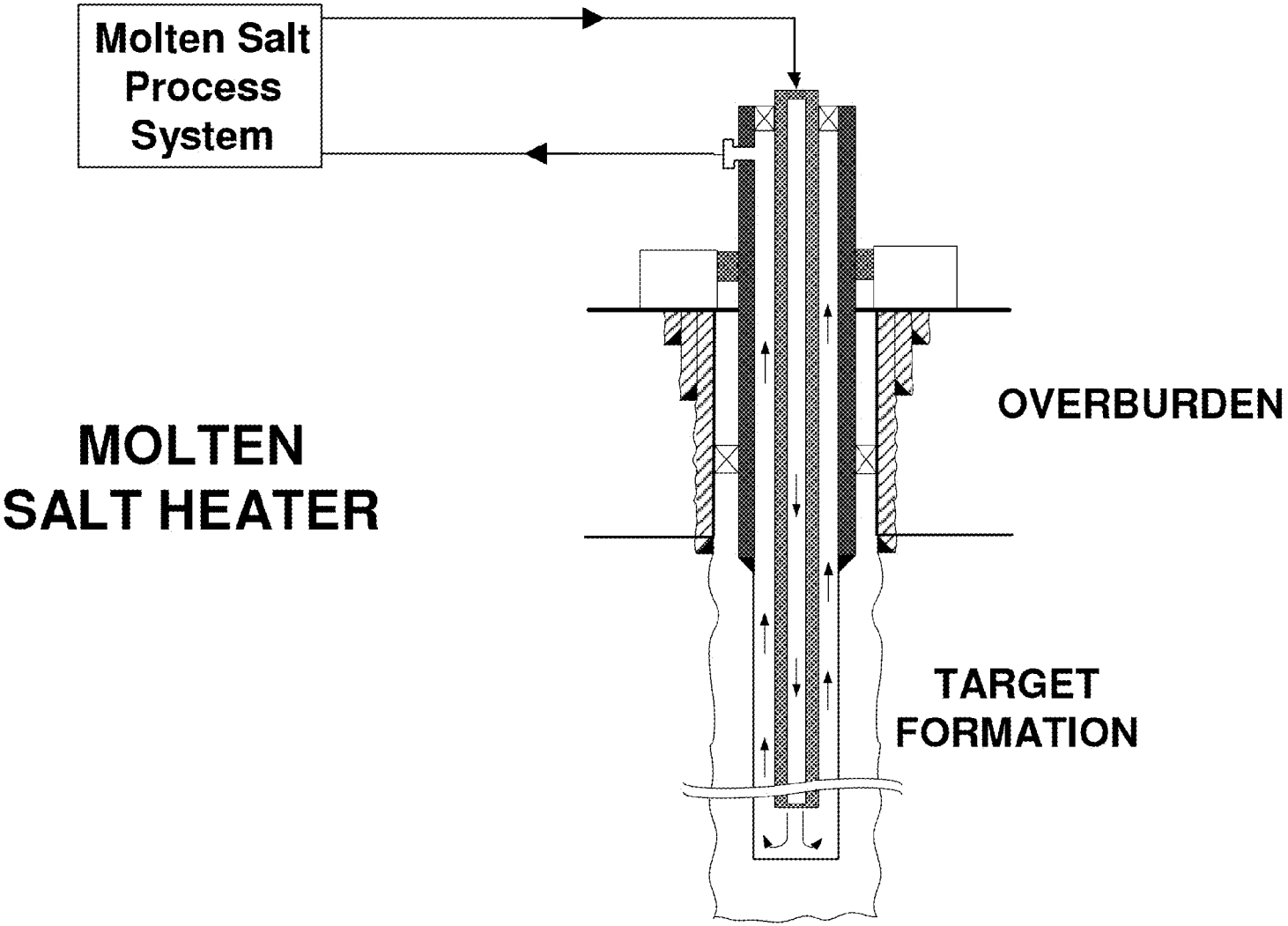
Figure 20D:
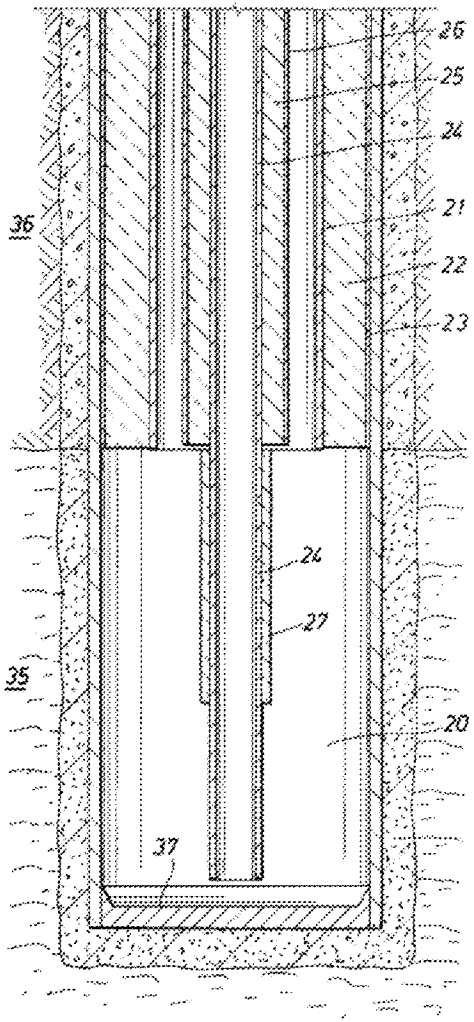
Figure 20C:
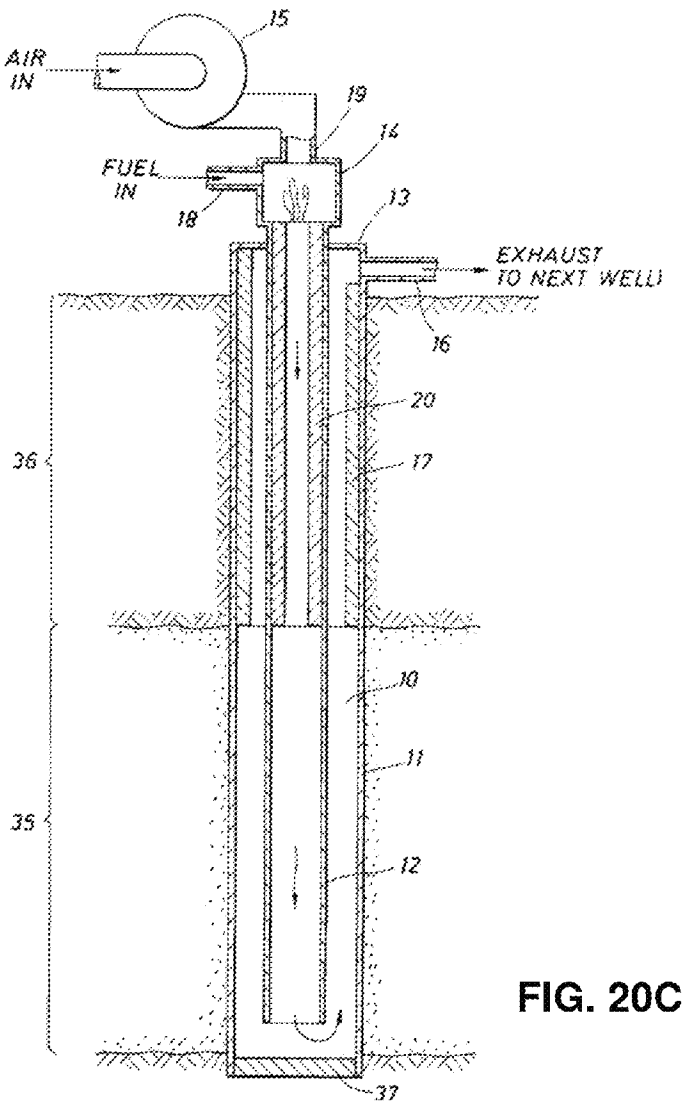

FIG. 20A is an image of an exemplary electrical heater. FIG. 20B is an image of an exemplary molten salt heater. FIG. 20C is an image of an exemplary downhole combustion heater; FIG. 20D is a cross section of the downhole portion of the heater for the heater of FIG. 20C. For an additional discussion of types of heaters and various features thereof, the skilled artisan is referred to U.S. Pat. No. 7,165,615, U.S. Pat. No. 6,079,499, U.S. Pat. No. 6,056,057 and US patent publication 2009/0200031, which are all incorporated herein by reference in their entireties. In some embodiments, molten salt is continuously flowed through the heater. For example, hot molten salt (e.g. heated by a gas furnace) may be continuously forced through the molten salt heater to replace the thermal energy lost by the molten salt within the heater to the formation.

Figure 20E:
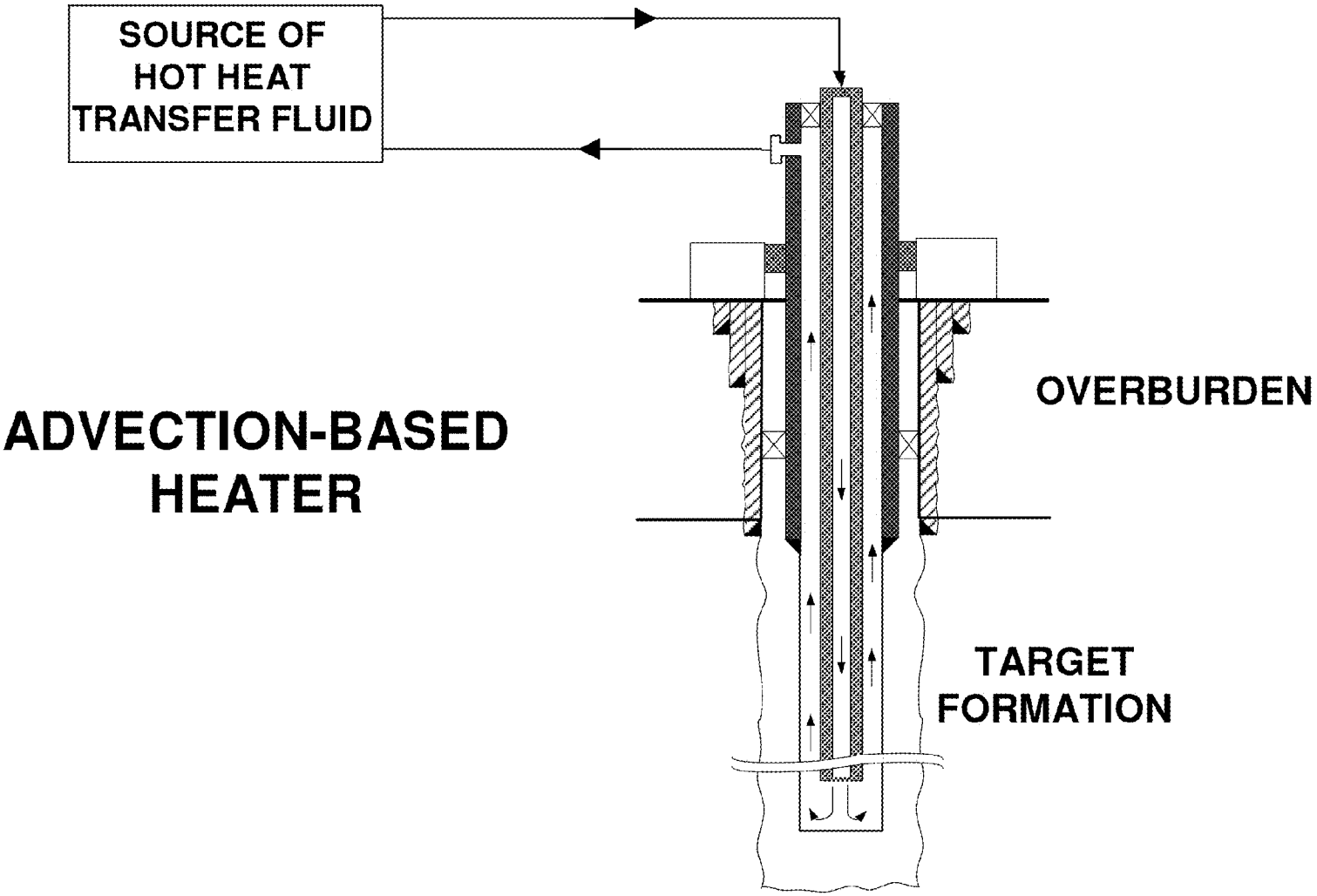

A schematic of an advection-based heater is illustrated in FIG. 20E. Although the source of hot heat transfer fluid is illustrated in the figures as above the surface, this is not a requirement-alternatively or additionally, it is possible to heat the heat transfer fluid at one or more subsurface location(s).

As illustrated in FIGS. 21A-21H, in some embodiments, the inner zone 210 of heaters 226 with shortest spacing may be primarily or entirely electrical heaters, while in outer zone 214 the heaters because 228 may be primarily molten salt heaters. There may be a number of reasons for providing this feature—for example, the inner zone heaters 226 may operate for a significantly shorter period time than heaters 228 in the outer zone (see, for example, FIG. 13A). As such, it may be advantageous to save capital costs by using a heater pattern where inner zone heaters are primarily electrical. In contrast, the outer zone heaters may operate for a significantly longer period of time, so that the extra efficiency of molten salt heaters may justify the extra capital cost required for their installation.

In yet another example, it may be desirable to start a project with electrical heaters for the inner pattern because of the simplicity of field installation. As later surrounding zones are drilled with longer spacings, the heaters may be molten salt heaters.

The skilled artisan will appreciate that the feature whereby mostly electrical heaters are located in regions having a higher heater density and/or lower heater spacing. is not a limitation. In alternate embodiments, some or most or all inner zone heaters 226 may be molten salt heaters.

In some embodiments, because there are many fewer heaters wells in the outer zone, the construction of the heater well may be more robust even though it is more expensive. For example, since these heater wells may operate for longer periods of time, it may be desirable to use thicker well casings with more allowance for metal corrosion.

In different embodiments, at least a majority and/or a least two-thirds of inner-zone heaters 226 are electrical heaters while at least a majority and/or a least two-thirds of outer-zone heaters 228 are molten salt heaters.

Various non-limiting heater patterns are illustrated in FIGS. 21A-21H. As will be explained below in greater detail, in regions of greater heater density and/or where the average heater spacing is shorter, heaters may be primarily electrical heaters, while in regions of lesser heater density and/or where the average heater spacing is longer, heaters may be primarily molten salt heaters.

All of FIGS. 21A-21H relate to system for in-situ production of hydrocarbon fluids from a subsurface hydrocarbon-containing formation, where the system comprises: heaters arranged in a target portion of the formation, the target portion being divided into nested inner 210 and outer 214 zones heaters so that inner zone 226 and outer zone heaters 228 are respectively distributed around inner 298 and outer 296 zone centroids, a majority of the heaters in the inner zone 210 being electrical 242 heaters and a majority of the heaters in the outer zone 214 being molten 244 salt heaters.

The examples of FIGS. 21A-21D relate to two-level heaters cells, while the examples of FIGS. 21E-21H relate to three-level heater cells. Although all of the three-level heater cells illustrated in FIGS. 21E-21H are hexagonally-shaped heater cells, it is appreciated that other shapes are possible, and that this is not a limitation.

One salient feature of molten salt heaters is that they are more efficient than electrical heaters. Although the exact efficiencies may vary, one reasonable benchmark of molten salt heater efficiency is about 80%, in contrast to an efficiency of about 45% for electrical heaters.

Figure 21A:
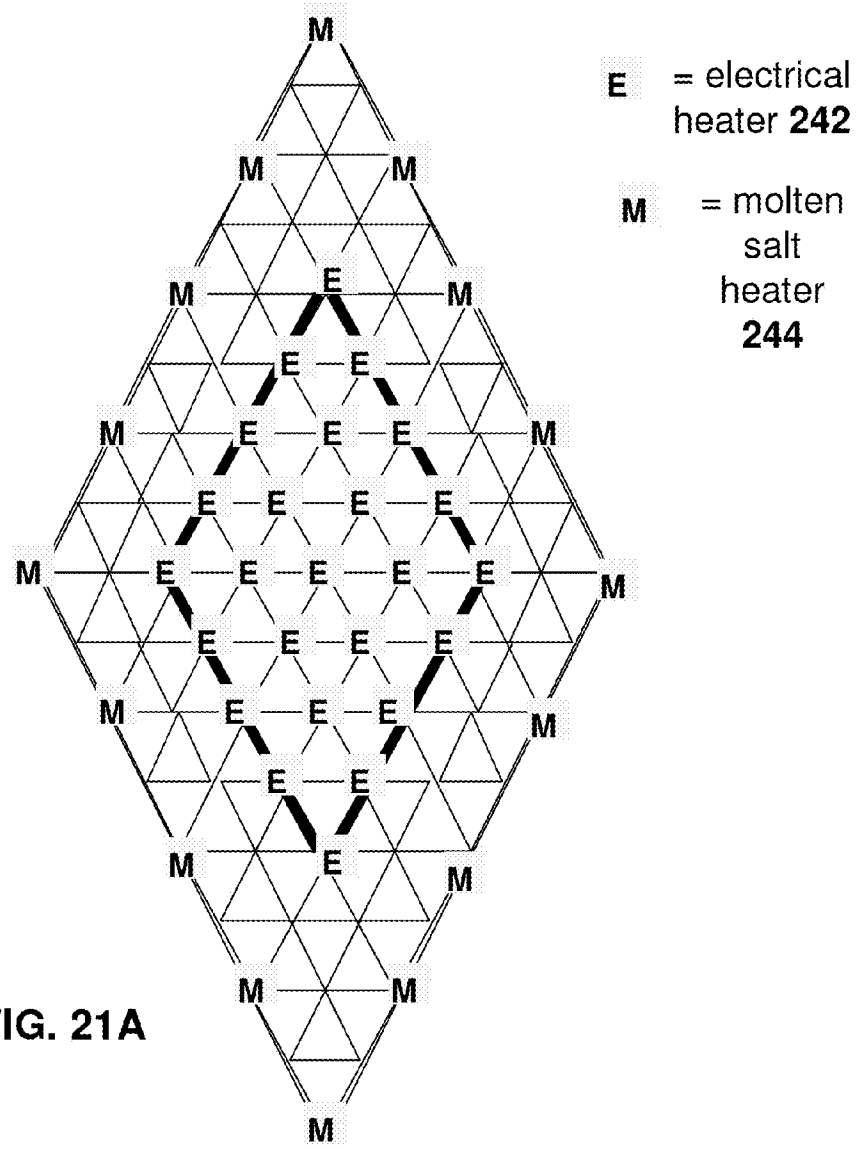
Figure 21B:
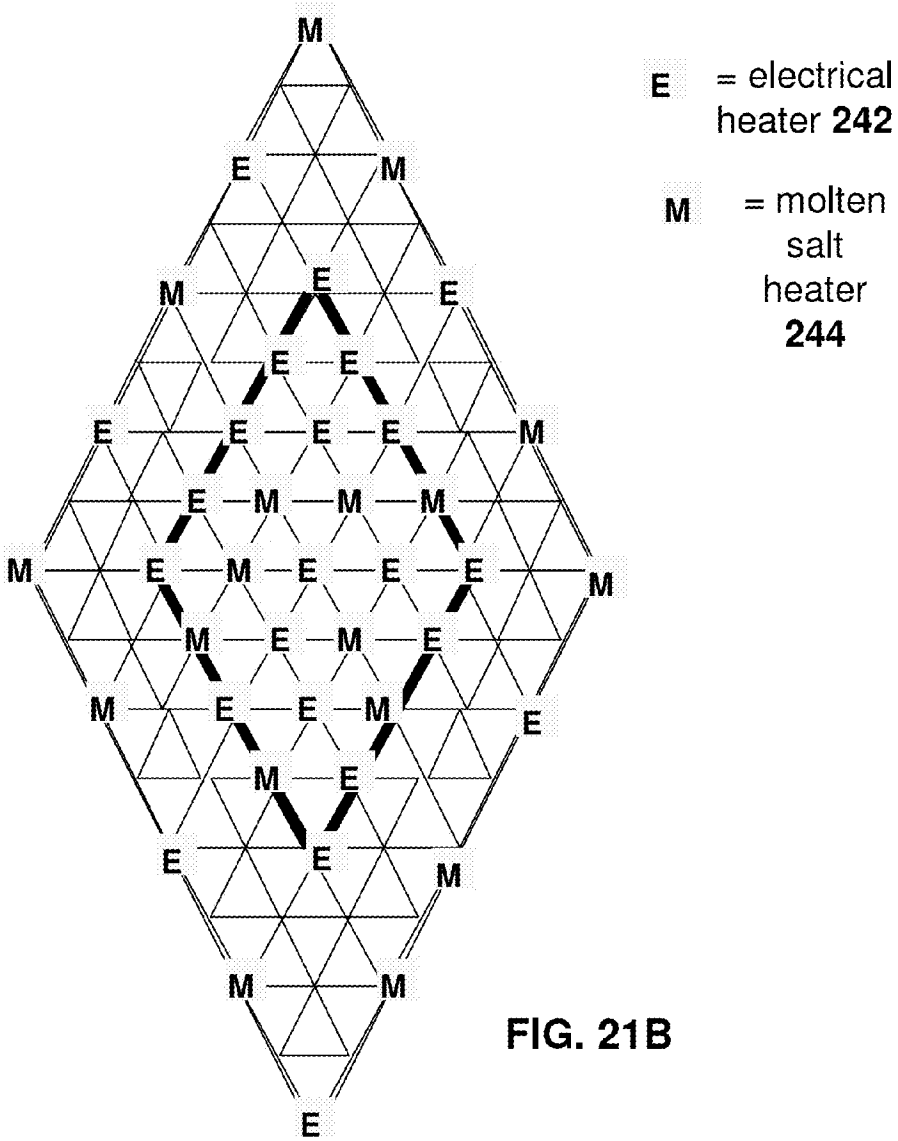
Figure 21C:
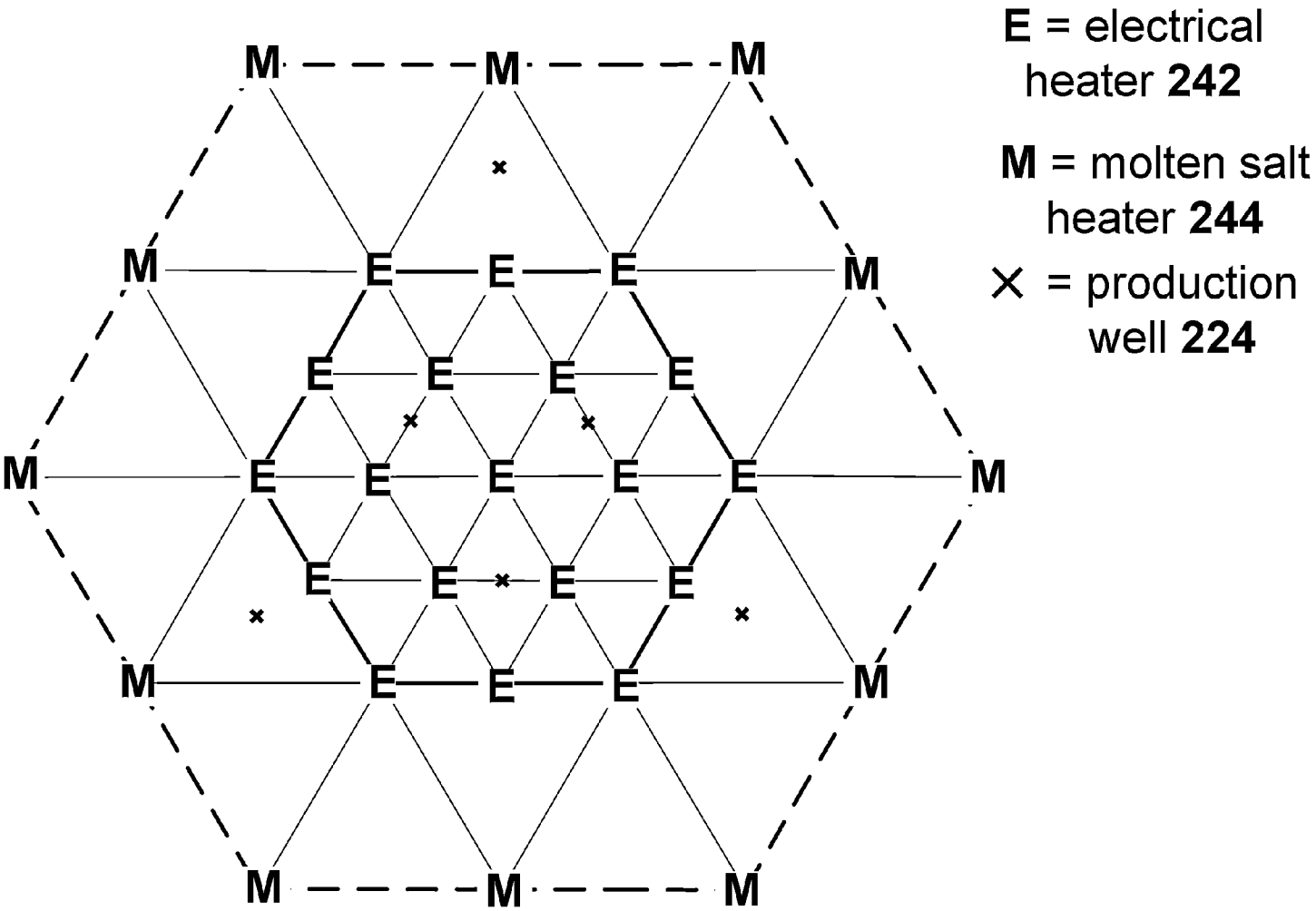
Figure 21D:
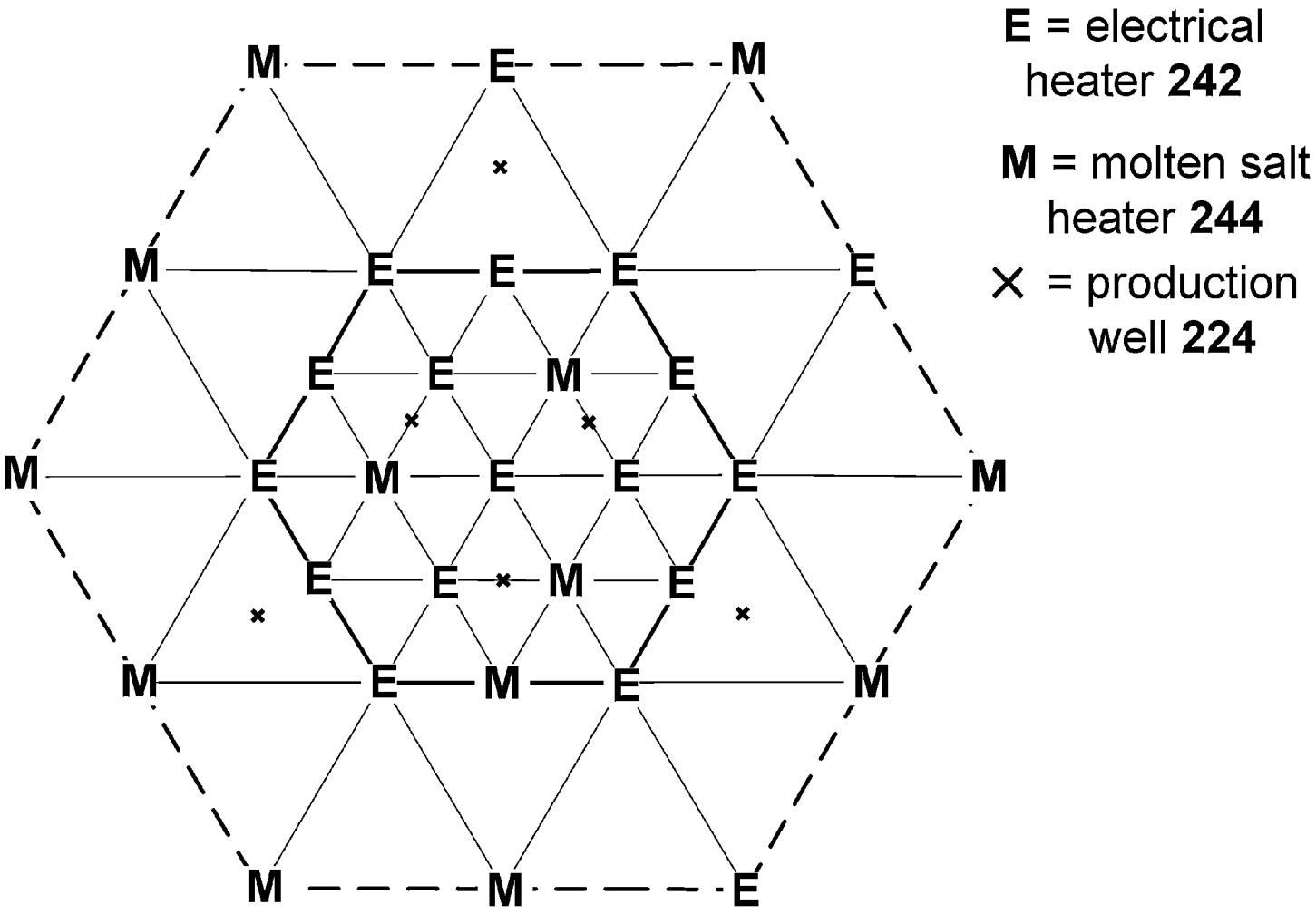
Figure 21F:
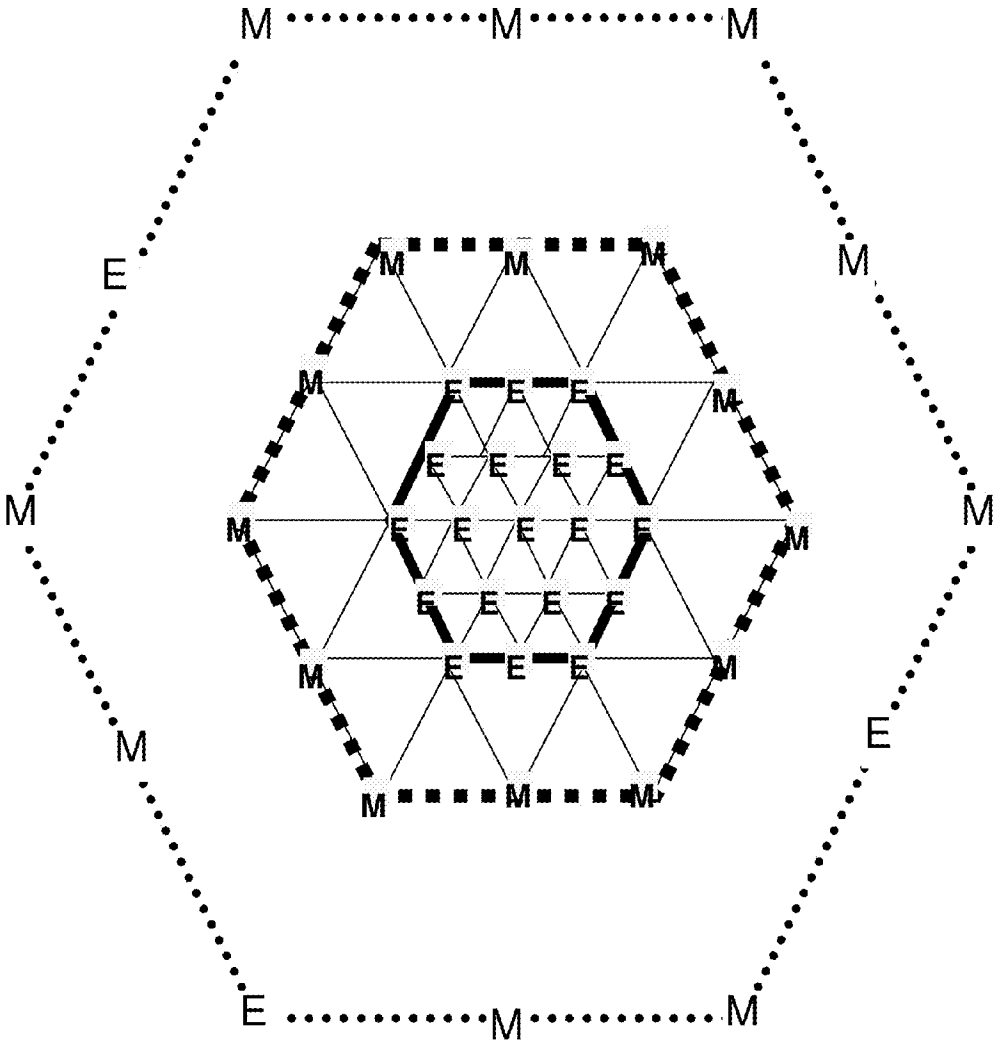
Figure 21G:
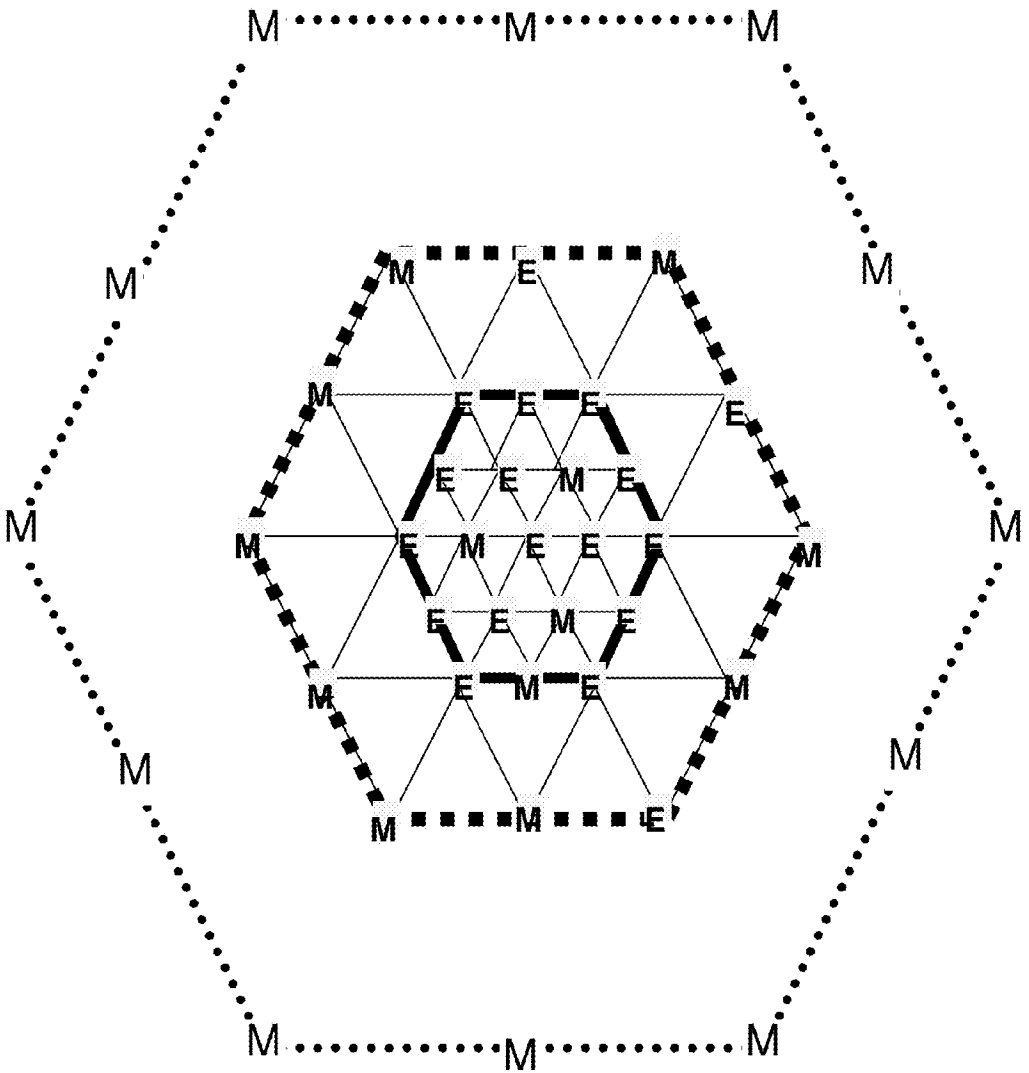
Figure 21I:
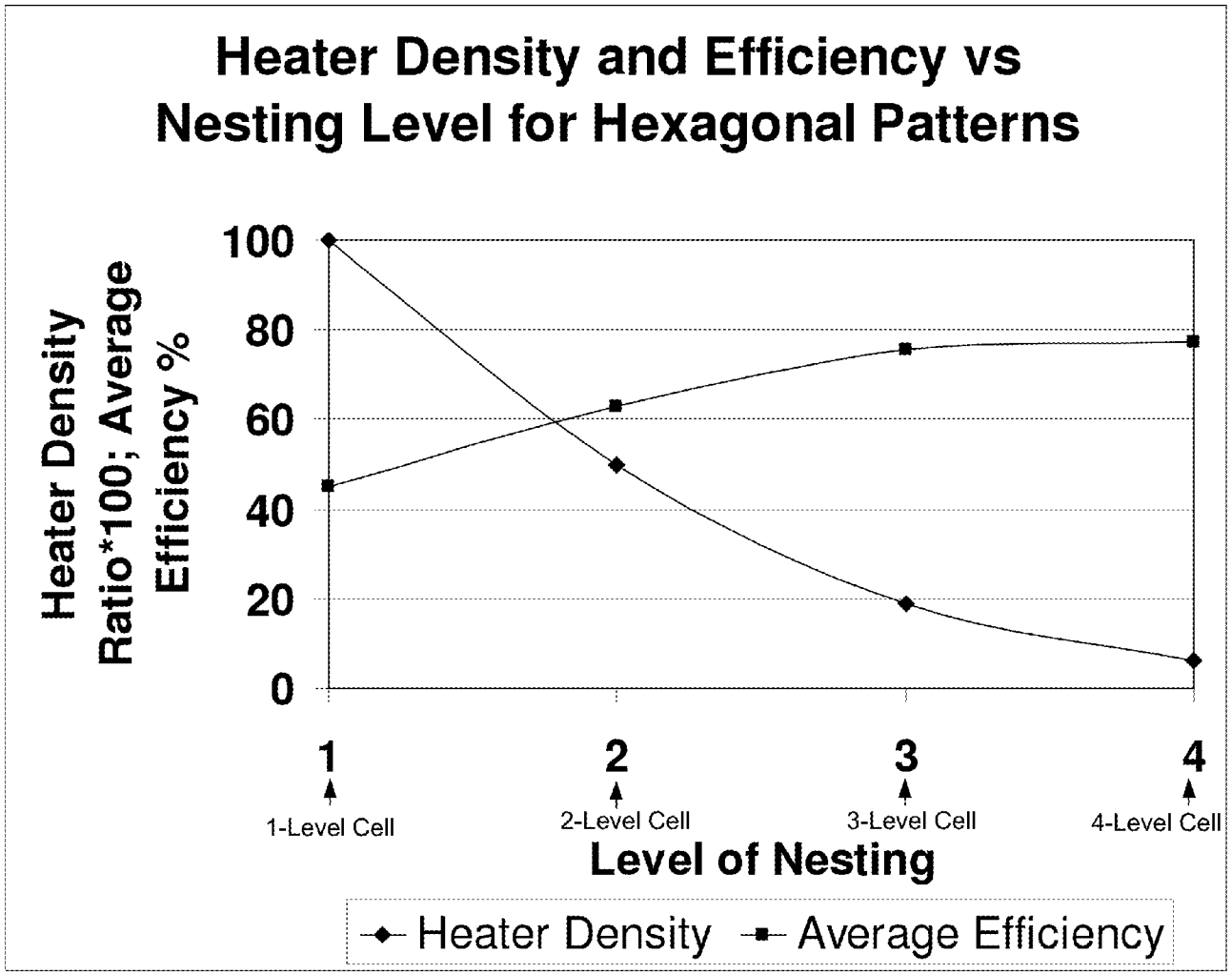
FIG. 21I illustrates, normalized heater density and average heater efficiency for one-level, two-level, three-level and four-level heater cells.

FIG. 21I illustrates, normalized heater density and average heater efficiency (i.e. averaged over the entire cell) as a function of the level of nesting for the specific case of where all zones are hexagonally-shaped and share a common centroid. When the level of nesting is equal to '1' this means that all heaters of the cell are uniformly arranged on a regular triangular grid within a region defined by a regular hexagon. When the level of nesting is equal to '1' this means that heaters of the cell are arranged as illustrated in FIG. 2D.

When the level of nesting is equal to '2' this means that heaters of the cell are arranged as illustrated in FIG. 2D. When the level of nesting is equal to '3' this means that heaters of the cell are arranged as illustrated in FIG. 16A. When the level of nesting is equal to '4' this means that heaters of the cell are arranged as illustrated in FIG. 17. FIG. 21I assumes that all heaters in the innermost zone are electrical heaters having an efficiency of exactly 45% while all other heaters (i.e. outside of the innermost zone) are molten salt heaters having an efficiency of exactly 89%.

The 'normalized heater density' is 100 times the actual heater density divided by what would be the heater density if all heaters within the cell were uniformly arranged at the closest heater spacing—that within the innermost zone 210. For the case of a one-level cell, by definition this is equal to exactly 100. For the case of a two-level cell, this is about 50%—i.e. the number of heaters belonging to a two-level hexagon is about one-half the number of heaters that would be within the same hexagon assuming all heaters are uniformly arranged one a triangular grid at the heater spacing of the innermost zone 210. For the case of a three-level cell, the normalized heater density is about 20, and for the case of a four-level cell, the normalized heater density is less than 10.

The average efficiency per heater throughout the cell (see FIG. 21I) monotonically increases as a function of the number of levels in the cell. In particular, when the cell has only a single level, all heaters are electrical heaters and the efficiency per heater is exactly 45% (i.e. according to the assumptions of FIG. 21I). As the cell has more levels, the fraction of heaters within the heater cell that are molten salt heaters increases, approaching 80%. It is noted however that the difference in heater efficiency between three-level and four-level heater cells is only a few percent. Thus, the major gains in efficiency achieved by using multiple cell levels are obtained when moving from a one-level to a two-level cell (i.e. from 45% efficiency to slightly above 60% efficiency), and when moving from a two-level to a three-level cell (i.e. from 45% slightly above 60% efficiency to slightly above 75% efficiency).

It is noted that FIG. 21I only refers to a single surrounded interior cell in a uniform pattern of heater cells where all heater cells are identical, and the pattern is infinite in the x-y plane—i.e, no edge effects were considered.

Some embodiments relate to 'neighboring heaters' or 'average spacing between neighboring heaters.' Reference is made to FIGS. 22A-B. In FIG. 22A, heaters are arranged according to the same heater pattern as in FIGS. 2A-2D, and heaters are labeled as follows: seven of the outer perimeters heaters are labeled 220A-220G, and nine of the inner zone heaters are labeled as 220H-220P. FIG. 22B illustrates a portion of the heater pattern of FIG. 22A.

It is clear from FIG. 22A that some heaters may be said to 'neighbor each other' (for example, heaters 220C and 220D are 'neighbors,' heaters 220C and 220J are 'neighbors,' heaters 220J and 220K are 'neighbors') while for other heaters, this is not true. Heaters 220C and 220L of the 'heater pair' (220C,220L) are clearly not 'neighbors.' This is because 'heater-connecting-line segment' Seg_Connect (220C,220L) connecting heaters (i.e. connecting the centroids of their respective cross sections) of the pair (220C, 220L), having a length $2\sqrt{3}s$, crosses at least one shorter 'heater-connecting-line segment,' as illustrated in FIG. 22B. In particular, 'heater-connecting-line segment' Seg_Connect (220C,220L) crosses (i) Seg_Connect(220D,220K) having a length of $\sqrt{3}s$ and (ii) Seg_Connect(220D,220J) having a length of 2s.

Figure 23A:
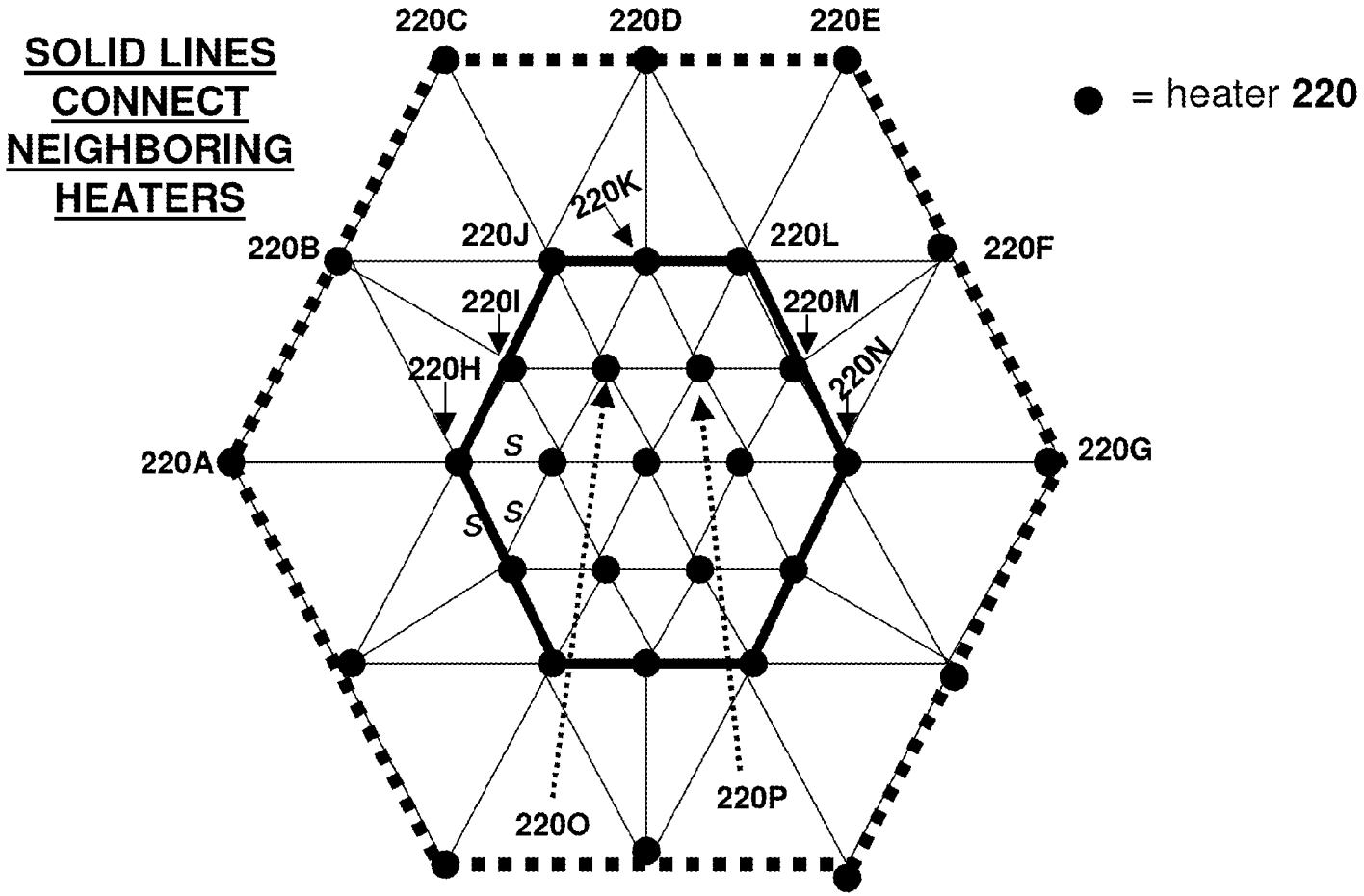

FIG. 22C illustrate the same heaters as in FIG. 22B—line segments of 'neighboring heater pairs' are illustrated. In the example of FIG. 22C, the neighboring heater pairs are as follows: {Heater 220C, Heater 220D}; {Heater 220D, Heater 220E}; {Heater 220E, Heater 220L}; {Heater 220K, Heater 220L}; {Heater 220J, Heater 220K}; {Heater 220C, Heater 220J}; {Heater 220D, Heater 220J}; {Heater 220D, Heater 220K}; {Heater 220D, Heater 220L}, FIG. 23A illustrates the same heater pattern as that of FIGS. 2A-2D and FIG. 22A. In FIG. 22C, lines between neighboring heaters are illustrated. Within the outer zone 214, the average line length, or the average 'heater spacing' is around 1.95s, or slightly less than 2s. Within the inner zone 210, the average line length, or the average 'heater spacing' is exactly s.

Figure 23B:
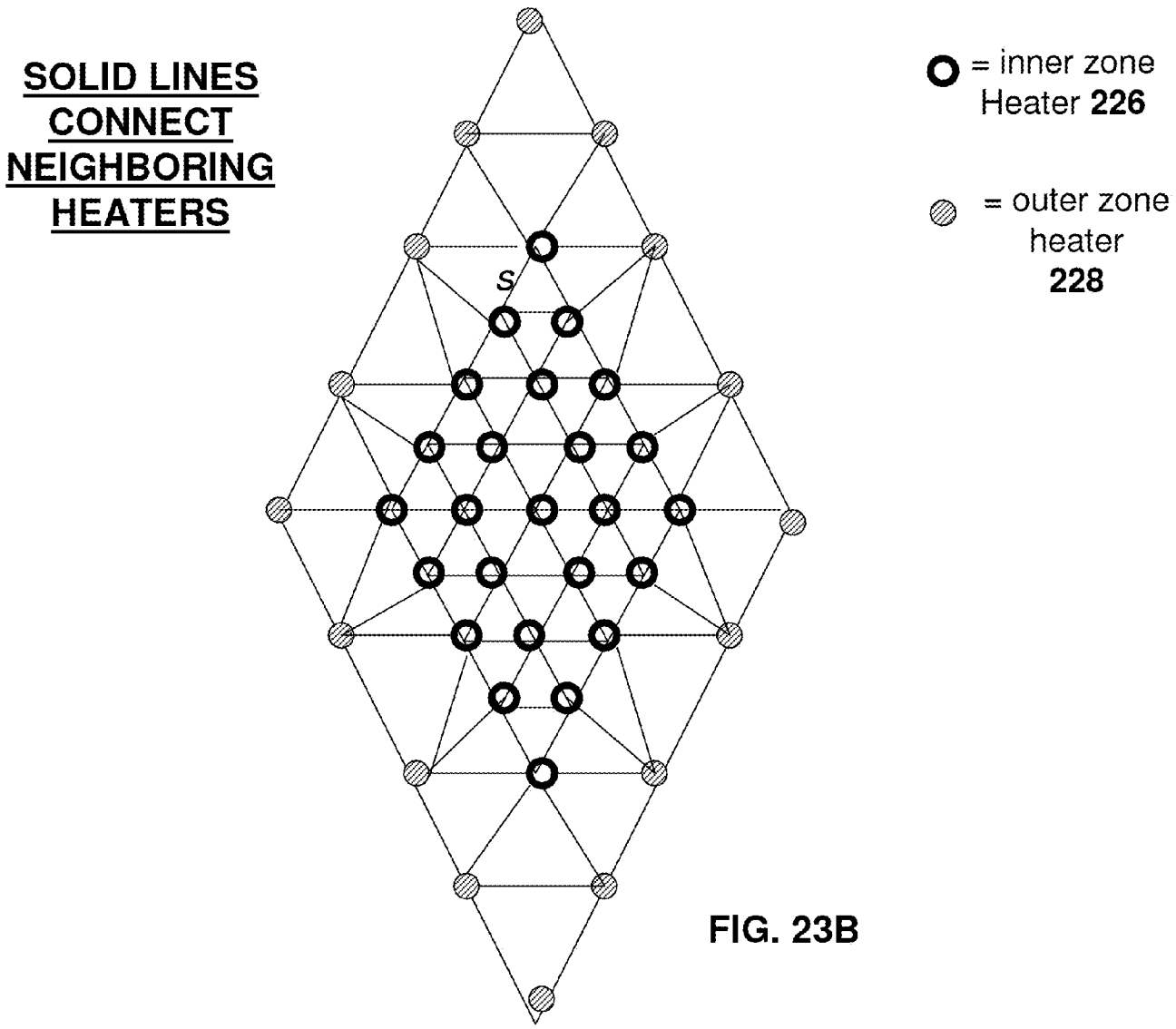

FIG. 23B illustrates 'connecting line segments' between neighboring heaters for the same heater pattern as that of FIG. 4A. Within the inner zone 210 of the example of FIG. 23B, the average line length, corresponding to the average heater spacing, is exactly s.

Two heaters $\text{Heater}_A$, $\text{Heater}_B$ are 'neighboring heaters' if the connecting line segment between them (i.e. between their respective centroids) does not intersect a connecting line segment between two other heaters $\text{Heater}_C$, $\text{Heater}_D$ in the subsurface formation. A 'heater-connecting-line-segment between neighboring heaters' is 'resident within' a region of the subsurface formation (i.e. a two-dimensional cross-section thereof) if a majority of the length of the 'heater-connecting-line-segment' is located within the region of the subsurface formation.

Figure 23C:
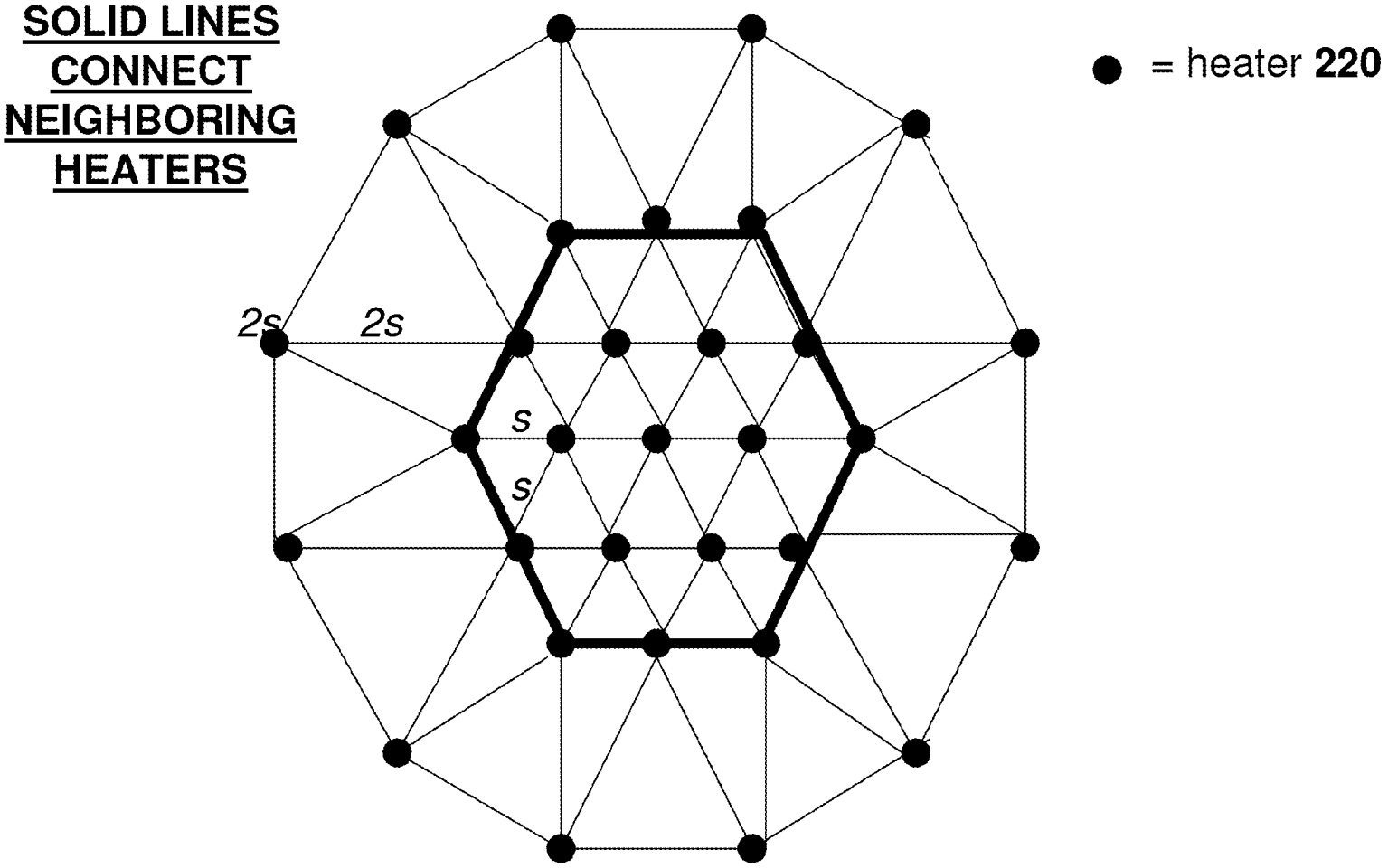
Figure 23D:
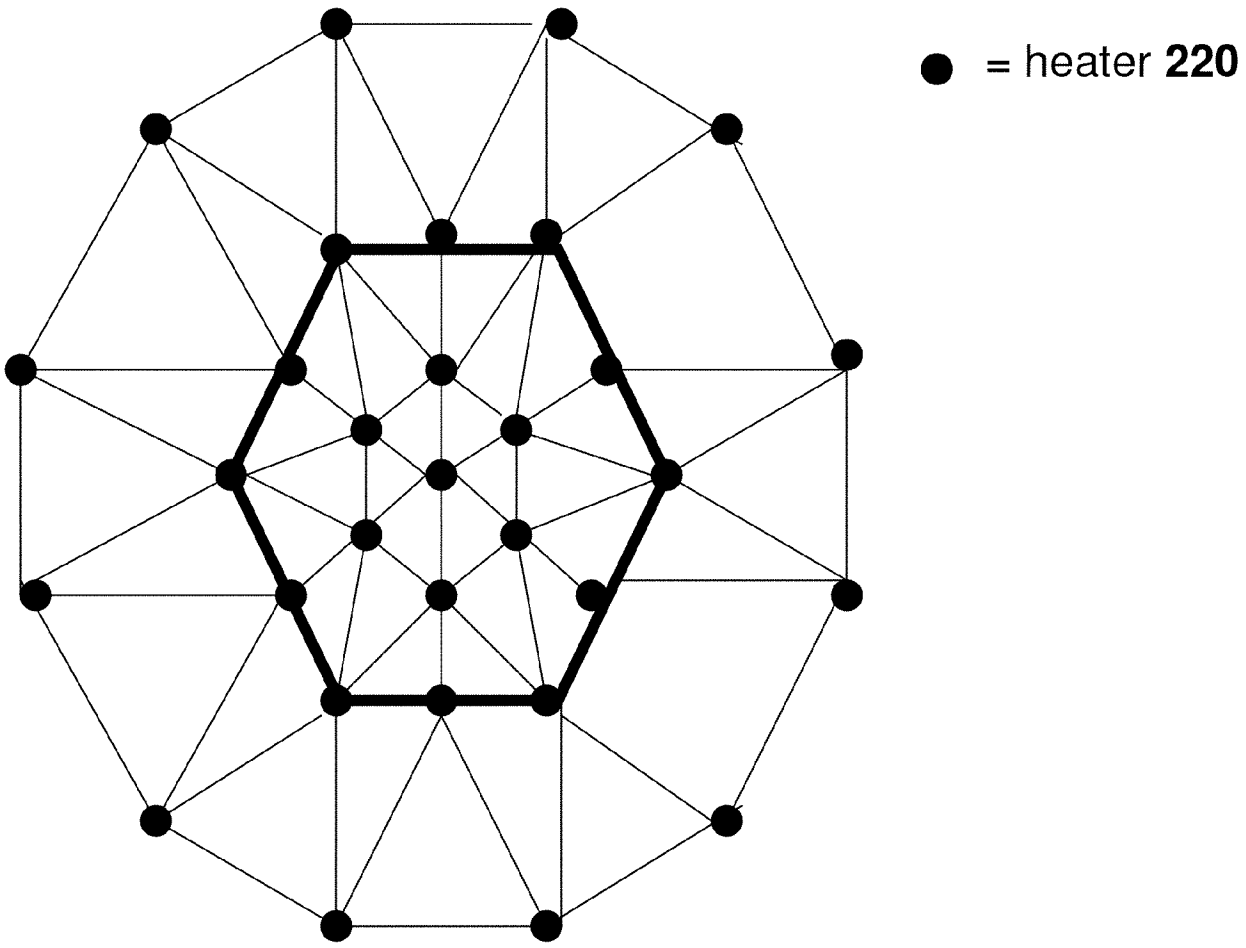

FIGS. 23C-23D respectively illustrate 'connecting lines' between neighboring heaters for the same heater pattern as those of FIGS. 5A-5B.

For the present disclosure, an 'average spacing between neighboring heaters' and an 'average heater spacing' are used synonymously.

For heater patterns that employ both electrical heaters and molten-salt heaters (see for example, FIGS. 21A-21H), three types of 'neighboring heater pairs' may be observed—(i) all-electrical heater pairs (i.e. both heaters of the neighboring heater pair are electrical heaters); (ii) all-molten salt heater pairs (i.e. both heaters of the neighboring heater pair are molten salt heaters); and (iii) electrical-molten salt heater pairs (i.e. one of the neighboring heater pair is an electrical heater; the other heater of the neighboring heater pair is a molten salt heater).

It is that noted the heater pattern of FIG. 21C is identical to that of FIG. 23A—as such, the line segments describing the neighboring heater pairs for the example of FIG. 21C are illustrated in FIG. 23A.

For the example of FIG. 21C, it is clear that the spacing between electrical heaters is significantly less than that between molten salt heaters. In particular, it is noted that (i) for each heater pair of the set of all-electrical neighboring heater pairs, the length of the neighboring heater line segment connecting heaters of the pair is always s; (ii) for each heater pair of the set of all-molten salt neighboring heater pairs, the length of the neighboring heater line segment connecting heaters of the pair is always 2s; (iii) for some of the electrical-molten salt heater pairs the length of the neighboring heater line segment connecting heaters of the pair is 2s while for others of the electrical-molten salt heater pairs the length of the neighboring heater line segment connecting heaters of the pair is $\sqrt{3}$s. Averaged over all of the electrical-molten salt heater pairs, the average connecting line segment length is about 1.9 s.

Two heaters are 'neighboring molten salt heaters' if (i) they are neighboring heaters and (ii) they are both molten salt heaters.

Two heaters are 'neighboring electrical heaters' if (i) they are neighboring heaters and (ii) they are both electrical heaters.

The non-limiting examples of FIGS. 21A-21H provide the following features:

(i) a system for in-situ production of hydrocarbon fluids from a subsurface hydrocarbon-containing formation, wherein both molten salt heaters and electrical heaters arranged within a target portion of the sub-surface formation;

(ii) the average separation distance average separation distance between neighboring molten salt heaters significantly exceeds (e.g. about twice that of) the average separation distance between neighboring electrical heaters;

(iii) the average separation distance average separation distance between neighboring molten salt heaters significantly exceeds (e.g. about twice that of) the average separation distance between neighboring electrical heaters;

(iv) the average heater separation distance for electrical: molten-salt neighboring heater pairs significantly exceeds (e.g. equal to about twice that of) the average separation distance for all-electrical neighboring heater pairs.

(v) an average heater separation distance for all-molten-salt neighboring heater pairs is substantially equal to the average separation distance for electrical:molten-salt neighboring heater pairs neighboring heater pairs.

It is noted that in all examples of FIGS. 21A-21H, heaters are arranged in inner and outer zones. However, this is not a limitation, and unless specified otherwise, any feature related to molten salt and electrical heaters may be provide in a context other than context of nested zones.

Reference is now made to FIG. 24A. As noted above (see, for example, FIGS. 14A-14H), in some embodiments it is advantageous to reduce power to one or more inner zone heaters at a time when the outer zone heaters continue to operate at or near full power. This may occur, for example, at a particular time when most hydrocarbon fluids have been produced in the inner zone 210 but when only a minority of hydrocarbon fluids have been produced in outer zone 214.

Alternatively or additionally, in some embodiments it is possible (e.g. at the aforementioned 'particular time') to increase a ratio between an average power of outer zone heaters and an average power of inner zone heaters—for example, in response to a detected or predicted decrease in hydrocarbon fluid production in the inner zone 210 and/or in response to a detected or predicted increase in hydrocarbon fluid production in the outer zone 214.

As noted with reference to FIGS. 21A-21H, in some embodiments, a majority of the inner zone heaters are electrical heaters while a majority of the outer zone heaters are molten salt heaters. As such, the molten salt heaters may, on average, operate to a longer period of time (e.g. at least twice as long as) electrical heaters within a region of the subsurface formation (e.g. within one or more heater cells).

Thus, in some embodiments where molten salt and electrical heaters simultaneously operate, it is possible to operate the molten salt heaters longer (e.g. significantly longer—e.g. at least twice as long as), on average, than electrical heaters. Alternatively, or additionally, it is possible to operate heaters so that molten salt and electrical heaters respond differently to a decline in production in one portion of the hydrocarbon-containing subsurface formation—e.g. a portion of the subsurface formation where a majority of the heaters are electrical heaters. In some embodiments, it is possible to respond to this decline in production by increasing a ratio between an average power level of molten salt heaters and that of electrical heaters—e.g. by reducing a power level of the electrical heaters.

The present inventors are now disclosing that this is a general concept and does not require shorter spacing between heaters and/or greater concentration of heaters in a first zone relative to a second zone (e.g. annular-shaped second zone around a first zone) and does not require inner 210 and outer 214 zones. In general for any generic heater pattern and/or any geometry, within a region of the subsurface formation where both molten salt and electrical heaters operate, (i) electrical heaters may operate, an average for a shorter amount of time relative to the molten salt heaters while (ii) molten salt heaters operate, on average for a longer period of time.

Figure 24B:
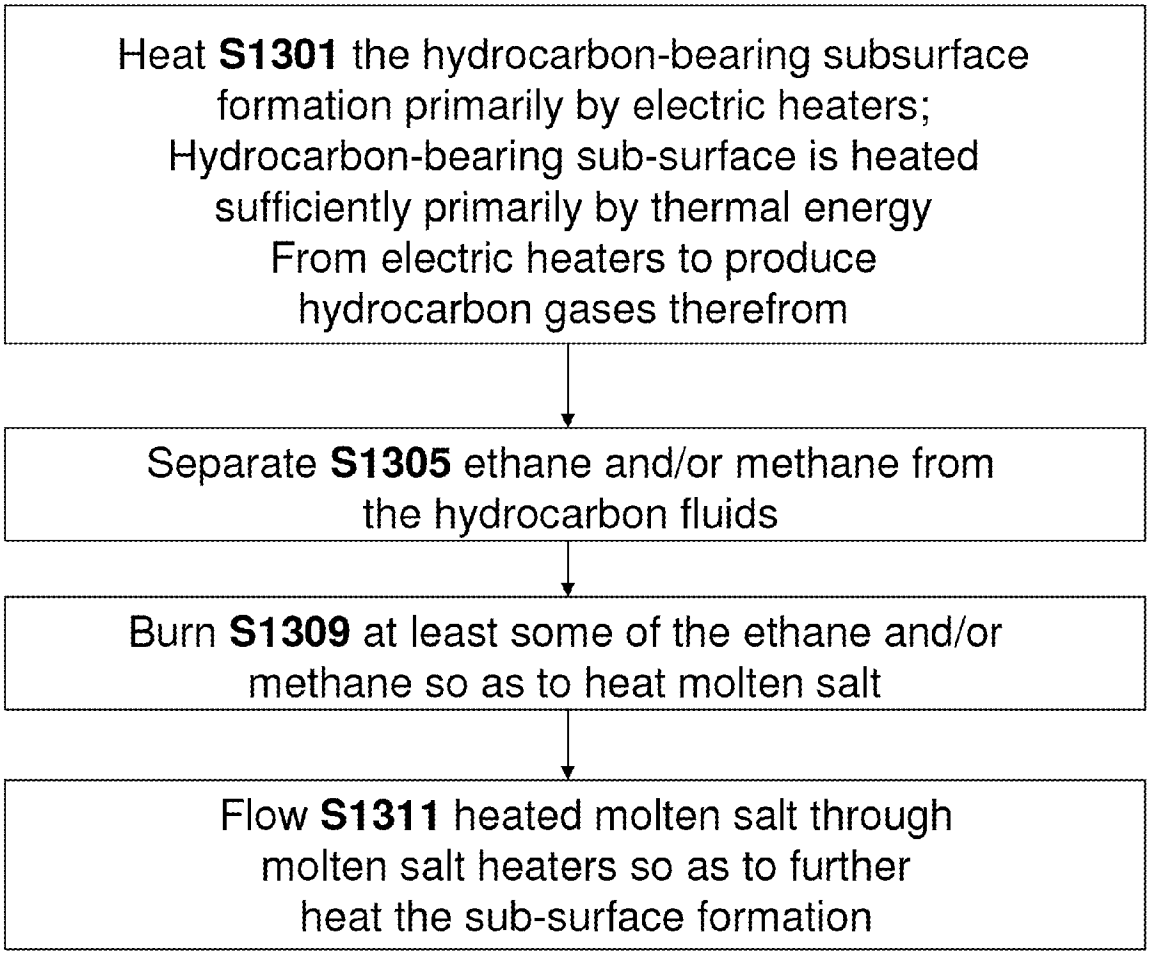

In the example of FIG. 24B, it is possible during an earlier stage of production to produce hydrocarbon fluids including hydrocarbon gases primarily by thermal energy from electric heaters, and at a later stage to produce hydrocarbon fluids by thermal energy from molten salt heaters. Hydrocarbon gases from the first stage of production may be combusted to heat molten salt (e.g. in a furnace) during the later stage. Optionally, in some embodiments, ethane and/or methane is separated from other hydrocarbon gases, and combusted.

Embodiments of the present invention relate to inner perimeter heaters 232, outer perimeter heaters 236 and 'OZS additional zone perimeter heaters.' As discussed earlier, in some embodiments, the locations of the heaters determine the locations of the perimeters 204, 208 (and by analogy 202) of inner 210, outer 214 or OZS additional 218 zones. In this case, inner perimeter heaters 232, outer perimeter heaters 236, and OSC-additional-zone perimeter heaters respectively are located on perimeters 204, 208, 202.

Alternatively, these perimeters 204, 208, 202 may be determined by a predetermined shape—e.g. a rectangle or regular hexagon or any other shape. For the latter case, there is no requirement for the inner perimeter heaters 232 to be located exactly on inner zone perimeter 204—it is sufficient for the heater to be located near inner perimeter—e.g. in a 'near-inner-perimeter' location within inner zone 210 or within outer zone 214. By analogy, the same feature is true for outer zone perimeter 208 or OZS-additional zone perimeter 202.

Figure 25B:
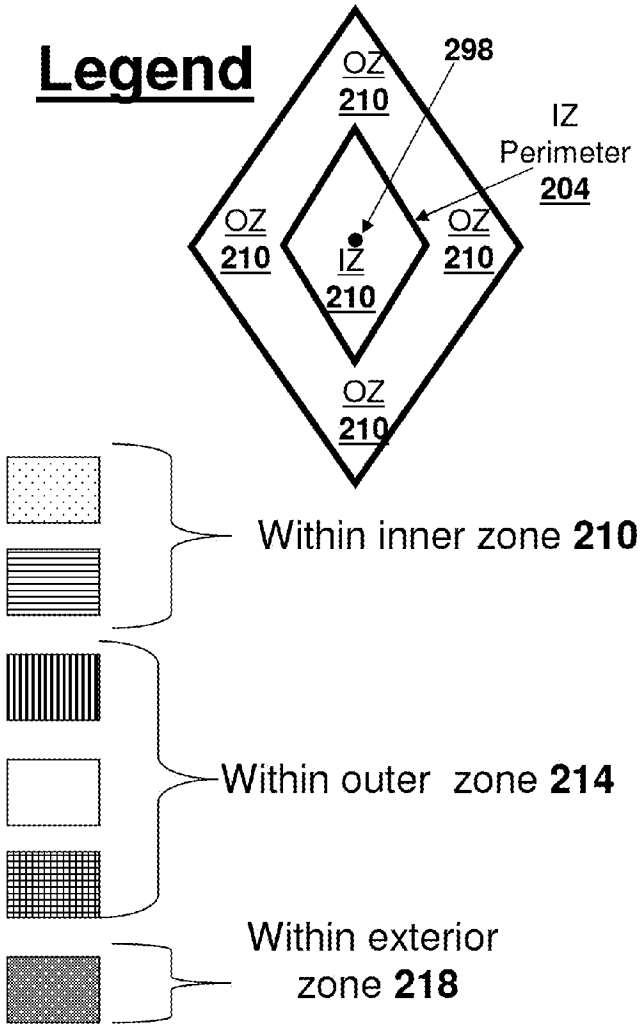
Figure 25B:
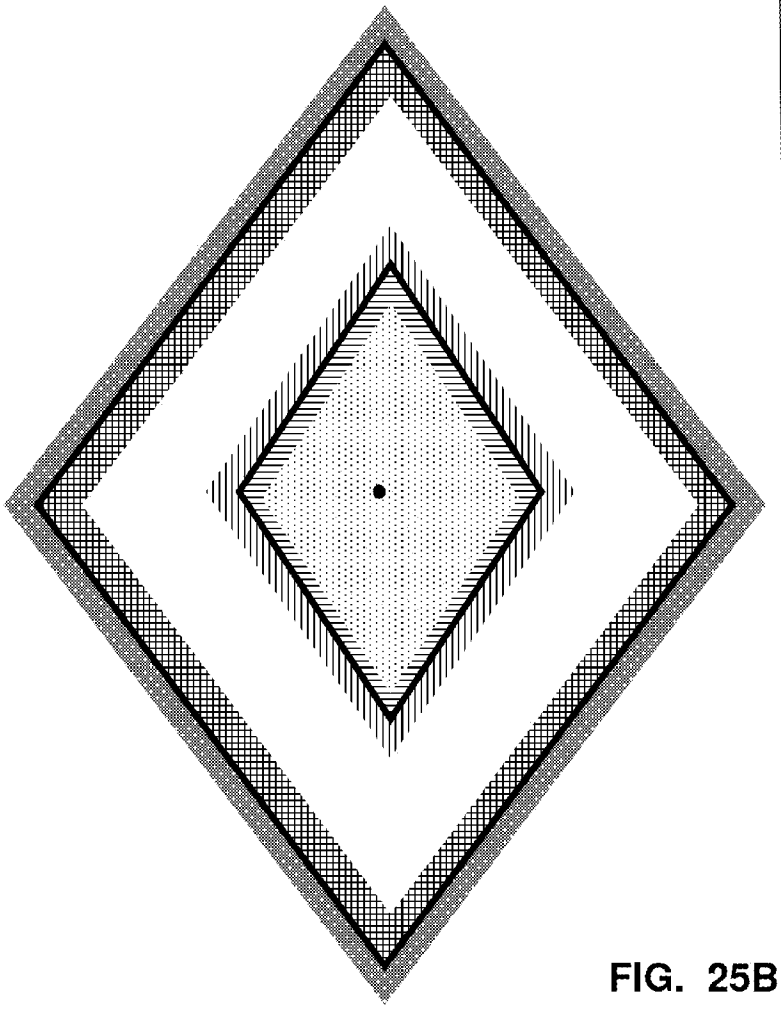

This is illustrated in FIGS. 25A-25B which illustrate: (i) locations in the interior 610 of the inner zone 210; (ii) locations 614 in inner zone 210 that are 'substantially on' inner zone perimeter 204; (iii) locations 618 in outer zone 214 that are 'substantially on' inner zone perimeter 204; (iv) locations 622 in the interior of the 'interior' of outer zone 214 (i.e. away from both inner zone and outer zone perimeters 204, 208); (iv) locations 626 in outer zone 214 that are 'substantially on' outer zone perimeter 208; (v) locations 626 outside of outer zone 214 that are 'substantially on' outer zone perimeter 208.

For each candidate location 614 in inner zone 210 that is 'substantially on' inner zone perimeter 204, a ratio between (i) a distance from the candidate location 614 to a nearest location on inner zone perimeter 204 and (ii) a distance from the candidate location 614 to a centroid of inner zone 210 (i.e. the area enclosed by inner zone perimeter 204) is at most 0.25 or at most 0.2 or at most 0.15 or at most 0.05.

For each candidate location 618 in outer zone 214 that is 'substantially on' inner zone perimeter 204, a ratio between a (i) distance from the candidate location 618 to a nearest location on inner zone perimeter 204 and (ii) a distance from the candidate location 618 to a nearest location on outer zone perimeter 208 is at most 0.25 or at most 0.2 or at most 0.15 or at most 0.05.

For each candidate location 626 in outer zone 214 that is substantially on outer zone perimeter 208, a ratio between (i) a distance from the candidate location 626*a* nearest location on outer zone perimeter 208 and (ii) a distance from the candidate location 626 to a nearest location on inner zone perimeter 204 is at most 0.25 or at most 0.2 or at most 0.15 or at most 0.05.

For each candidate location 630 outside of outer zone perimeter 208 that is substantially on outer zone perimeter 208, a ratio between (i) a distance from the candidate location 630*a* nearest location on outer zone perimeter 208 and (ii) a distance from the candidate location 630 to a centroid 298 of the area enclosed by outer zone perimeter 208 is at most 1.25 or at most 1.15 or at most 1.05.

Figure 26A:
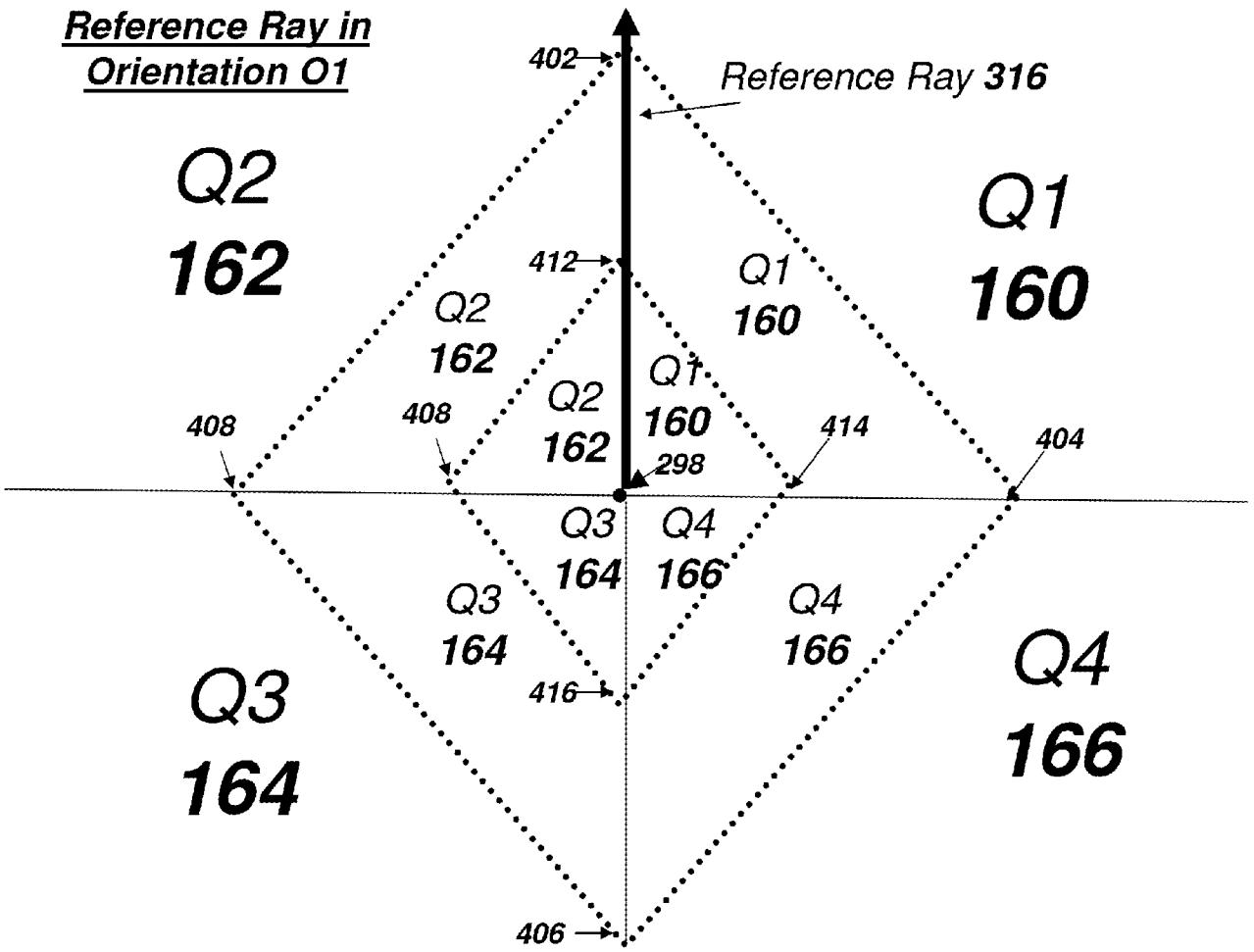
Figure 26B:
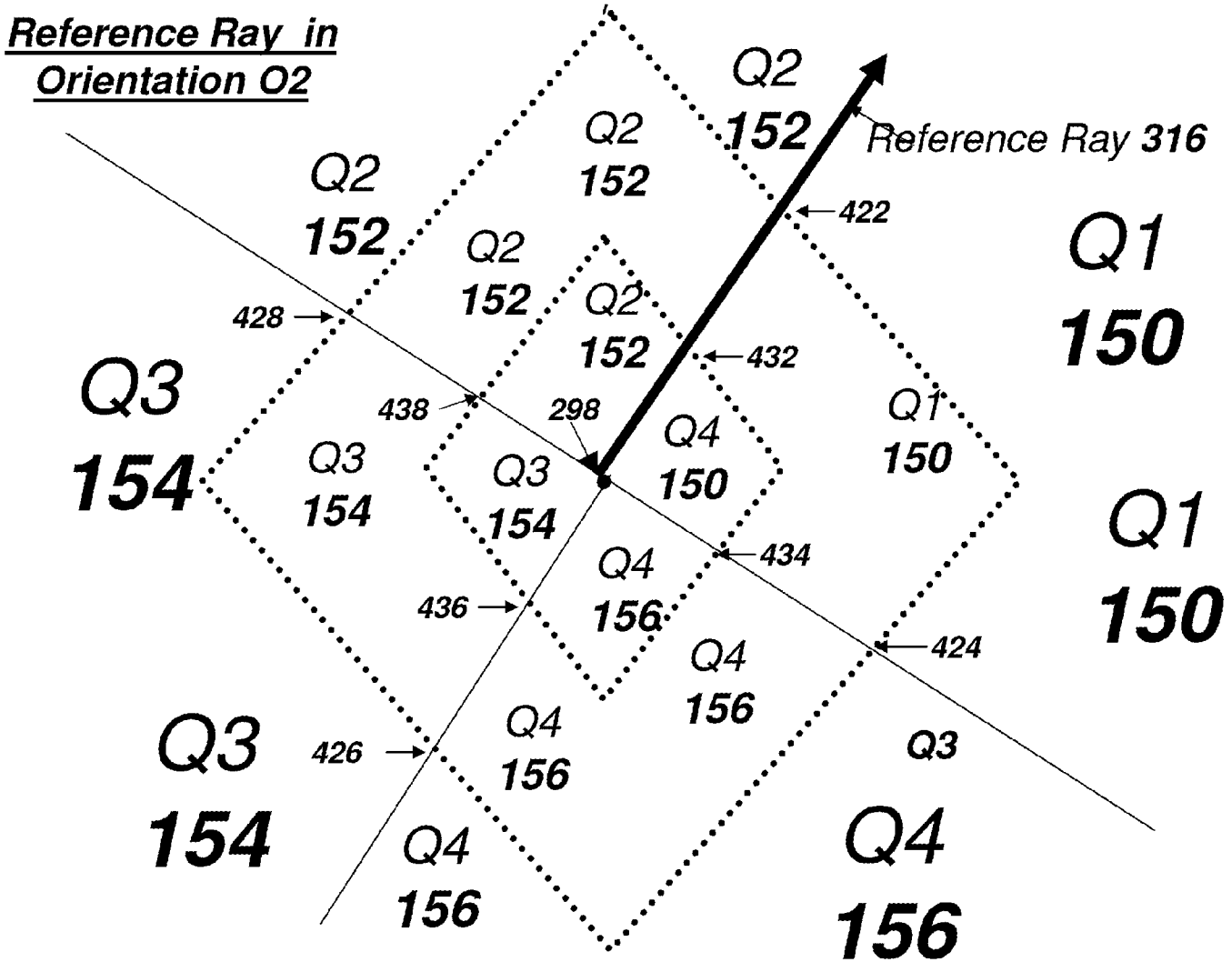

Reference is now made to FIG. 26A-26B. As noted above, when heaters 'are distributed' around perimeter 208 of outer zone 214, this means that heaters (i.e. which are located on or near outer zone perimeter 208) are present on every 90 degree sector of outer zone perimeter 208.

This is illustrated in FIGS. 26A-26B. In FIG. 26A, it is possible to divide the cross-area of the subsurface formation into four 'quadrants' corresponding to four 90 degree sectors (i.e. since the quotient of 360 degrees and four is 90 degrees) relative to any arbitrary 'reference ray 316' starting at centroid of outer zone 214. FIGS. 26A-26B illustrate respective orientations of reference ray 316.

After the orientation of reference ray 316 relative to the heater pattern is fixed, it is possible to define the cross section of the subsurface formation, relative to ray 316, into four quadrants Q1 160, Q2 162, Q3 164, and Q4 166. Dividing the subsurface formation into four quadrants also divides outer perimeter 208 into four portions—in FIG. 26A, these four portions are defined as (i) the portion of outer zone perimeter 208 located in Q1 160 between points 402 and 404; (ii) the portion of outer zone perimeter 208 located in Q2 162 between points 402 and 408; (iii) the portion of outer zone perimeter 208 located in Q3 164 between points 406 and 408; (iv) the portion of outer zone perimeter 208 located in Q4 166 between points 406 and 404. Thus, in FIG. 26A, these four portions are determined by four points on outer zone perimeter 208, namely points 402, 404, 406 and 408. In FIG. 26B associated with a different orientation of reference ray 316, these four portions are determined by points 422, 424, 426 and 428, all lying on outer zone perimeter 208.

For the present disclosure, when heaters are 'present' on every 90 degree sector of outer zone perimeter 208, then irrespective of an orientation of a reference line 316 relative to which four quadrants are defined (i.e. for any arbitrary reference line orientation), there is at least one outer perimeter heater 236 within each of the four quadrants. This concept can be generalized to 72 degree sectors (i.e. to divide the subsurface cross section into five equal portions rather than four quadrants), 60 degrees sectors (i.e. six equal portions or 'sextants') and 45 degree sectors (i.e. eight equal portions or 'octants').

Reference is now made to FIGS. 27-28.

Embodiments of the present invention relate to features of 'distances between heaters' or 'distances between a heater and a location,' where 'distance' and 'displacement' may be used interchangeably. As noted above, unless indicated otherwise, any 'distance' or 'displacement' refers to a distance or displacement constrained within a two-dimensional cross section for which a heater pattern is defined—for example, including but not limited to any heater pattern illustrated in FIGS. 2-11 and 15-16.

In particular, embodiments of the present invention relate to apparatus and methods whereby (i) due to the relatively 'high' heater density and to the distribution of inner zone heaters 226 throughout inner zone 210, a significant fraction of inner zone 210 is 'very close' to a nearest heater; (ii) due to the relatively 'low' heater density and to feature whereby most outer zone heaters 228 are arranged at or near outer perimeter 208, a significantly smaller fraction of outer zone 214 is 'very close' to a nearest heater. As such, the rate of production increases in the inner zone 210 significantly faster than in the outer zone 214.

Figure 27A:
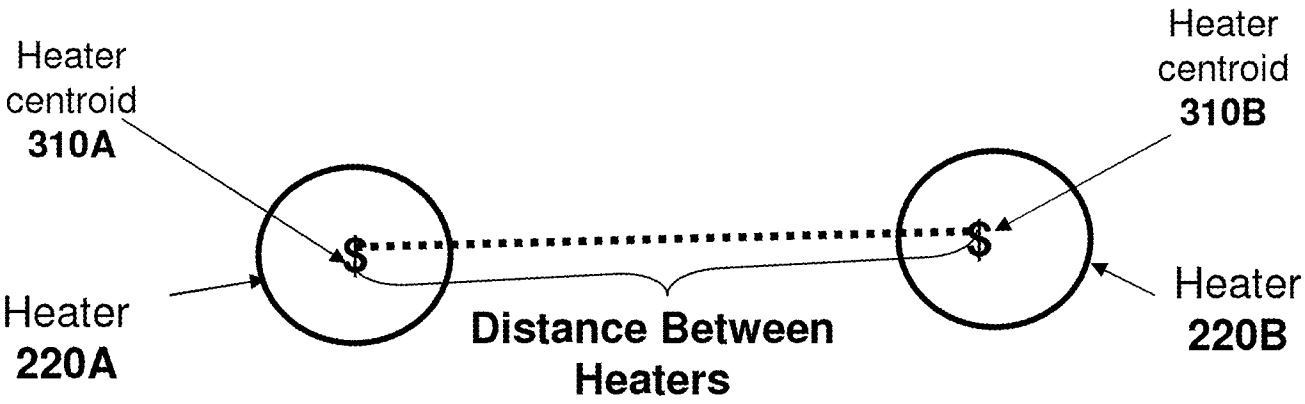
Figure 27B:
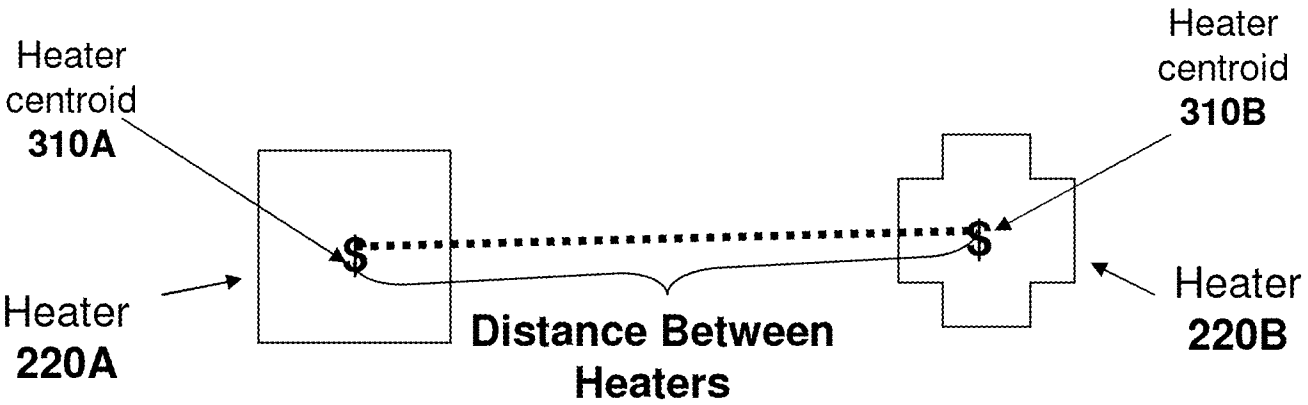

Referring to FIGS. 27-28, it is noted that a 'distance between heaters' refers to the distance between respective heater centroids. Unless indicated otherwise, a 'heater centroid' 310 is a centroid of the heater cross-section co-planar the two-dimensional cross-section of the subsurface where any heater pattern feature is defined. As evidenced by FIGS. 27A-27B, heater cross-section is not required to be circular. As evidenced by FIGS. 27A-27B, the 'distance between heaters 220,' which is the distance between their respective centroids 310, is not necessarily between the locations on the heater surface.

Figure 28A:
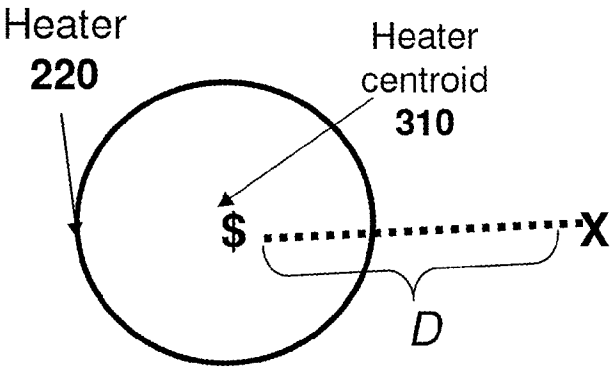
Figure 28B:
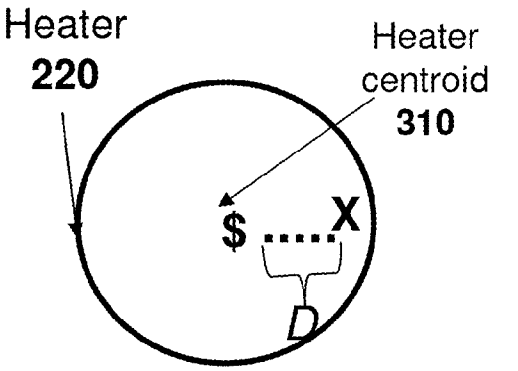
Figure 28C:
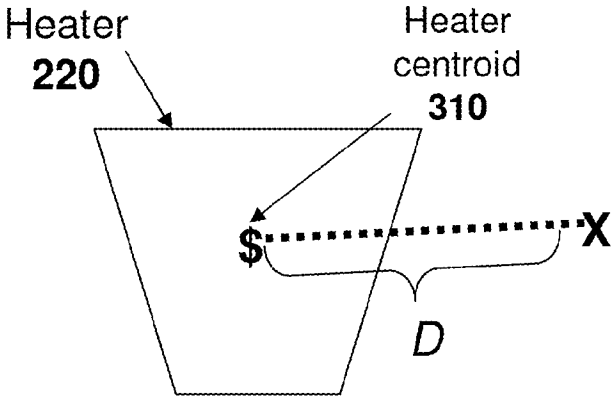
Figure 28D:
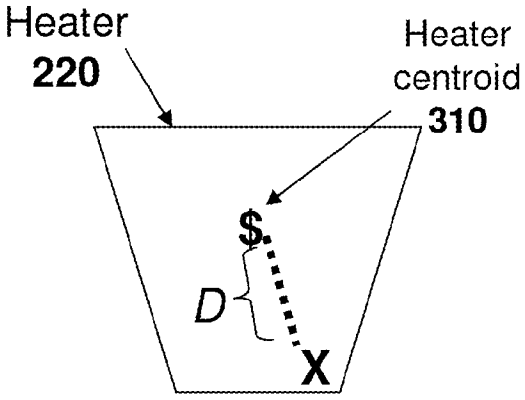

Some embodiments refer to a 'distance' or 'displacement' between a location (indicated in FIGS. 28A-28D by an 'X') within the subsurface formation and one of the heaters. Unless indicated otherwise, this 'distance' or 'displacement' is: (i) the distance D within the plane defined by the two-dimensional cross-section of the subsurface where any heater pattern feature is defined; (ii) the distance D between the location 'X' and the heater centroid 310. In the examples of FIGS. 28A and 28B, the distance between a location 'X' and heater 220, is defined by the distance between heater centroid 310 and location 'X,' even for situations where the location 'X' is within heater 220 but displaced from heater centroid 310.

Figure 29A:
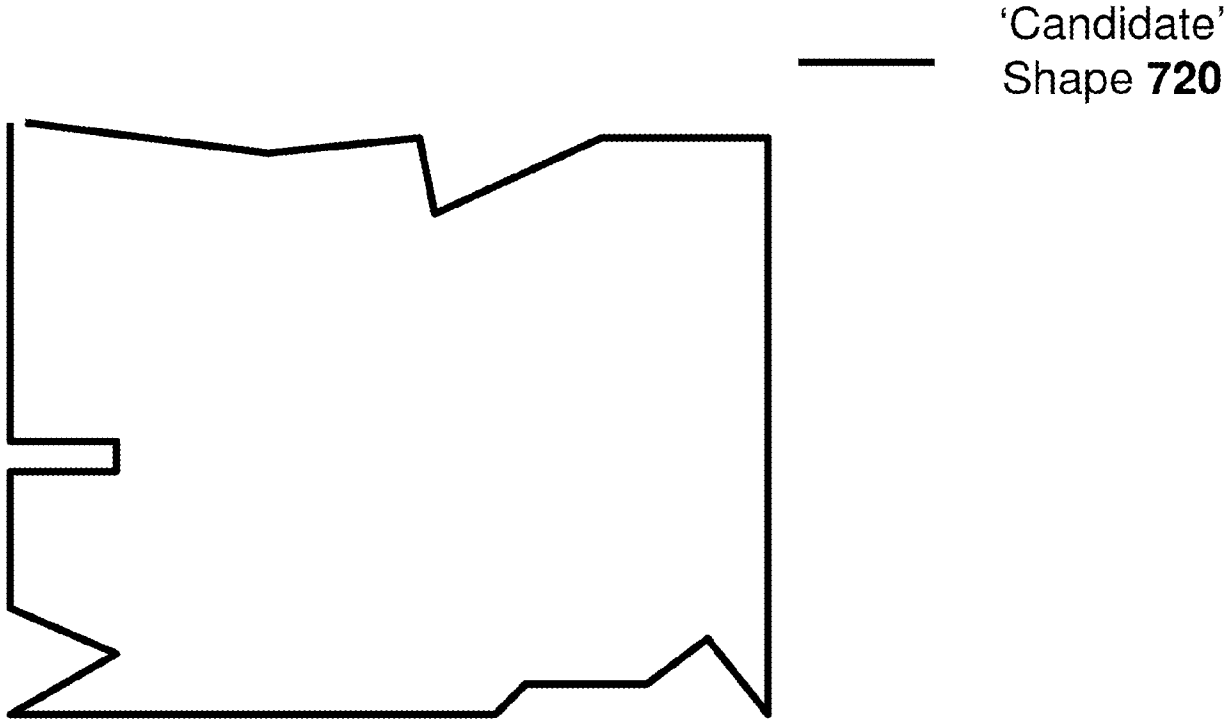
FIGS. 29A-29C illustrate a candidate shape and convex shapes.
Figure 29B:
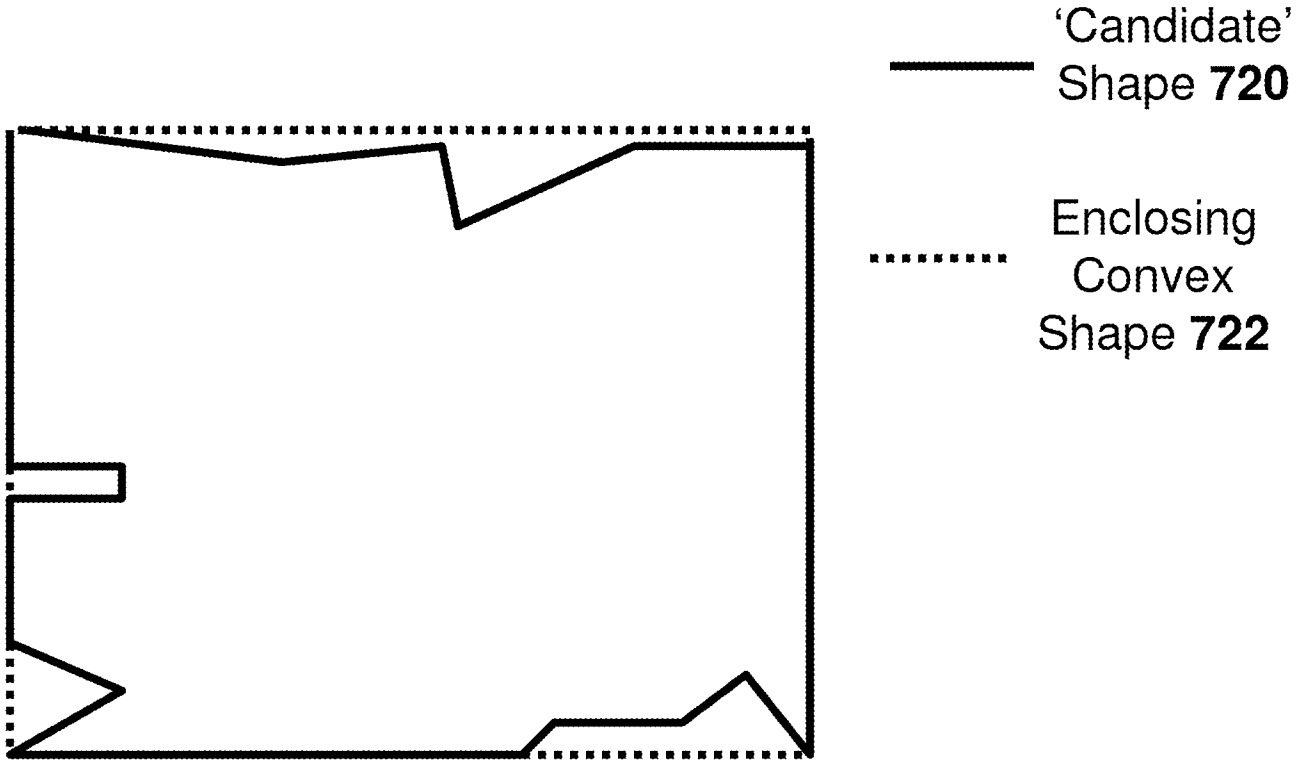
Figure 29C:
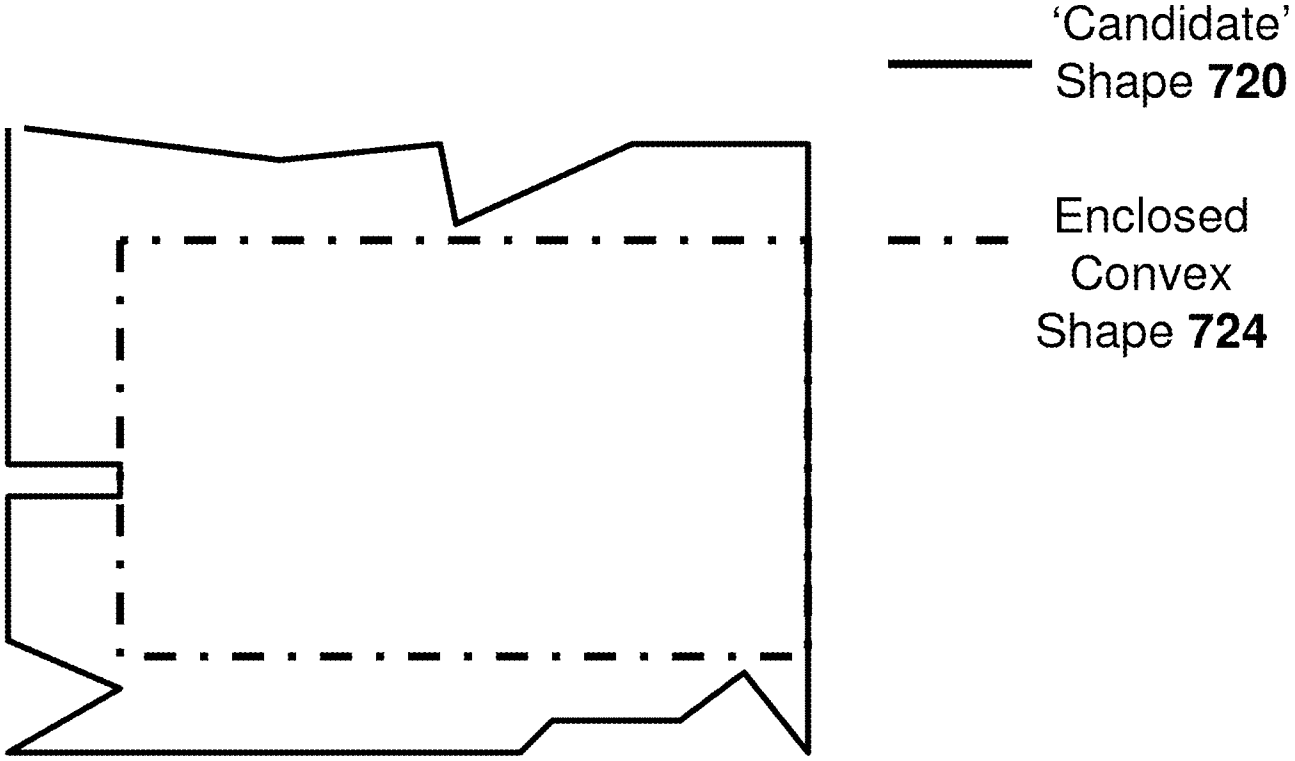

FIGS. 29A-29C illustrate the concept of a substantially convex shape. If a candidate shape 720 is convex it is, by definition, also substantially convex. If candidate shape 720 is not convex, it is possible to determine if candidate shape 720 is substantially convex according to one of two theoretical convex shapes: (i) a minimum-area enclosing convex shape 722—i.e. the smallest (i.e. of minimum area) convex shape which completely encloses the candidate shape 720; (ii) a maximum-area enclosed convex shape 724—i.e. the 'largest' (i.e. of maximum area) convex shape which is completely within candidate shape 720

It is possible to define a first area ratio as a ratio between (i) an area enclosed by minimal-area enclosing convex shape 722 and (ii) an area enclosed by candidate shape 720. It is possible to define a second area ratio as a ratio between (i) an area enclosed by candidate shape 720 and (ii) an area enclosed by maximum-area enclosed convex shape 724.

For the present disclosure, a candidate shape 720 is 'substantially convex' if one or both of these area ratios is at most a 'threshold value.' Unless specified otherwise, this threshold value is at most 1.3. In some embodiments, this threshold value may be at most 1.2 or at most 1.15 or at most 1.1 or at most 1.05.

If one or both of these area ratios is at most a value X, 'convex shape tolerance value' of the candidate shape 720 is said to be X. Thus, as noted in the previous paragraphs, in different embodiments, the 'convex shape tolerance value' is at most 1.2 or at most 1.15 or at most 1.1 or at most 1.05.

As noted above, for the present disclosure, 'spatial heater density' is defined according to the principles of reservoir engineering. For example, the heater FIG. 2A, nineteen heaters are inner zone heaters 226 located on the inner zone perimeter 204 or within inner zone 210, while twelve heaters are outer zone heaters 228 located on outer zone perimeter 208 or within outer zone 214.

Figure 30:
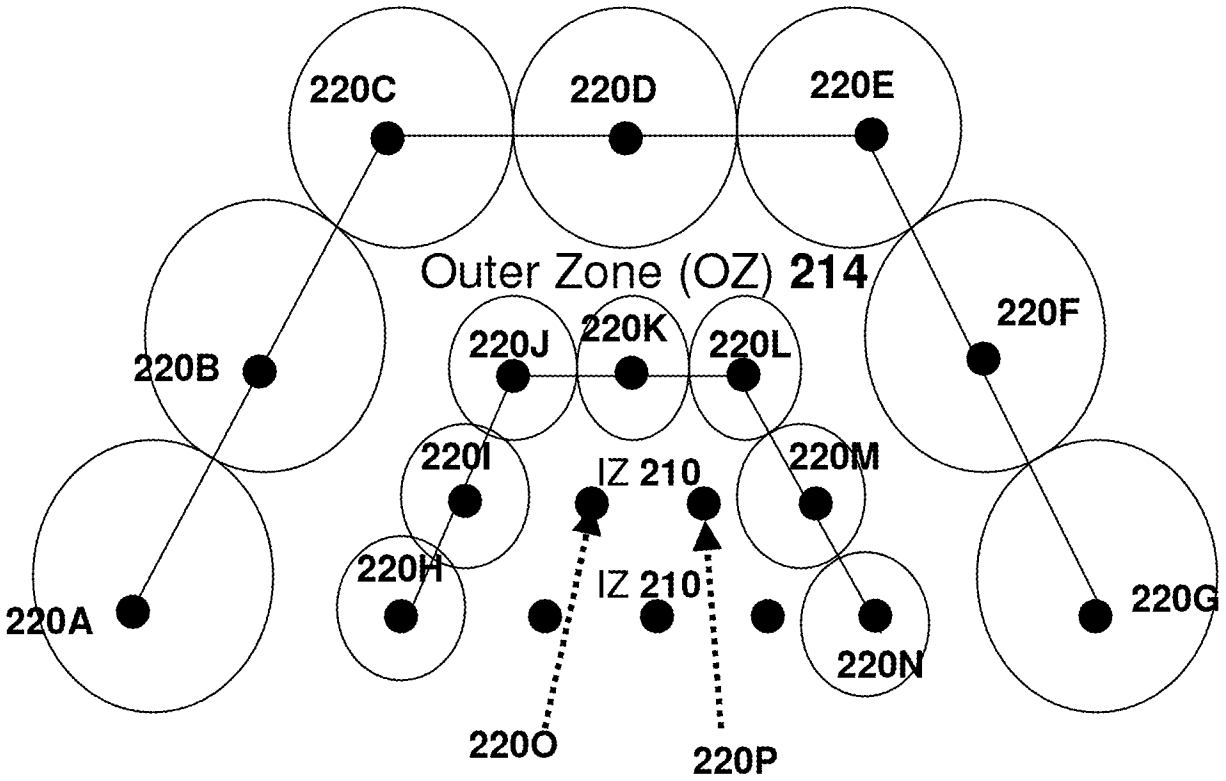

FIG. 30 illustrates a portion of the heater scheme of FIG. 2A, where heaters are labeled as in FIG. 22C. For density purposes, it is possible to draw an 'immediate-neighboring-region circle' around each heater centroid (i.e. serving as a heater 'locator point' within a cross-section of the subsurface formation in which the heater (well) pattern is defined) having a circle radius equal to one-half of a distance to a nearest neighboring heater.

In the example of FIG. 30, the radius of immediate-neighboring-region circles around heaters 220A, 220C and 220G, 220E and 220G (i.e. all located on vertices of outer hexagon 208) equals a, the radius of immediate-neighboring-region circles around heaters 220B, 220D and 220F (i.e. all located halfway between adjacent vertices of outer hexagon 208) is $$\frac{\sqrt{3}}{2}a,$$

and the radius of immediate-neighboring-region circles around inner zone heaters 220H-220P is $$\frac{a}{2}.$$

For the heater pattern scheme of FIG. 2A, 'outer-hexagon-vertex' heaters (see, for example, the outer zone heaters labeled as 220A, 220C, 220E and 220G in FIG. 30) are outer zone heaters are located on vertices of outer hexagon 208, 'outer-hexagon-mid-side' heaters (see, for example, the outer zone heaters labeled as 220B, 220D and 220F in FIG. 30) are outer zone heaters located midway between adjacent vertices of outer hexagon 208, 'inner-hexagon-vertex' heaters (see, for example, the inner zone heaters labeled as 220H, 220J, 220L and 220N in FIG. 30) are inner zone heaters are located on vertices of inner hexagon 204, and 'inner-hexagon-mid-side' heaters (see, for example, the outer zone heaters labeled as 220I, 220K and 220M in FIG. 30) are inner zone heaters located midway between adjacent vertices of inner hexagon 204.

Exactly one-third of the area enclosed by respective immediate-neighboring-region circles centered at 'outer-hexagon-vertex' heaters is within outer zone 214. Thus, it may be said that one-third of each of these heaters 'belong' to outer zone 214, and two-thirds of each of these heaters 'belong' to the region outside of outer zone 214 (i.e. not enclosed by outer zone perimeter 208).

Exactly one-half of the area enclosed by respective immediate-neighboring-region circles centered at 'outer-hexagon-mid-side' heaters is within outer zone 214. Thus, it may be said that one-half of each of these heaters 'belong' to outer zone 214, and one-half of each of these heaters 'belong' to the region outside of outer zone 214 (i.e. not enclosed by outer zone perimeter 208).

Exactly one-third of the area enclosed by respective immediate-neighboring-region circles centered at 'inner-hexagon-vertex' heaters is within inner zone 214. Thus, it may be said that one-third of each of these heaters 'belong' to inner zone 210, and two-thirds of each of these heaters 'belong' to outer zone 214.

Exactly one-half of the area enclosed by respective immediate-neighboring-region circles centered at 'inner-hexagon-mid-side' heaters is within inner zone 210, and exactly one-half of the area is within outer zone 214. Thus, it may be said that one-half of each of these heaters 'belong' to outer zone 214, and one-half of each of these heaters 'belong' to inner zone 210 (i.e. not enclosed by outer zone perimeter 208).

For the heater pattern of FIG. 2A, for the purposes of computing heater spatial density, the total number of heaters 'belonging to' inner zone 210 include: (i) seven 'internally-located' heaters 226 located within inner zone 210 and not on the perimeter of inner hexagon 204 (i.e. including heaters 220O and 220P); (ii) one-half of each of the six inner zone heaters 226 located midway between adjacent vertices of the inner hexagon 204 (i.e. including heaters 220I, 220K and 220M) for a total of three heaters; and (iii) one-third of each of the six inner zone heaters 226 located at vertices of the inner hexagon 204 (i.e. including heaters 220H, 220J, 220L and 220N) for a total of two heaters. Thus, a total of 7+3+2=12 heaters belong to inner zone 210 for the purposes of computing heater spatial density.

For the heater pattern of FIG. 2A, for the purposes of computing heater spatial density, the total number of heaters 'belonging to' outer zone 214 include: (i) one-half of each of the six inner zone heaters 226 located midway between adjacent vertices of the inner hexagon 204 (i.e. including heaters 220I, 220K and 220M) for a total of three heaters; (ii) two-thirds of each of the six inner zone heaters 226 located at vertices of the inner hexagon 204 (i.e. including heaters 220H, 220J, 220L and 220N) for a total of four heaters; (iii) one-half of each of the six outer zone heaters 228 located midway between adjacent vertices of the outer hexagon 208 (i.e. including heaters 220B, 220D and 220F) for a total of three heaters; and (iv) one-third of each of the six outer zone heaters 228 located at vertices of the outer hexagon 208 (i.e. including heaters 220A, 220C, 220E and 220G) for a total of two heaters. Thus, it may be said that a total of 3+4+3+2=12 heaters belong to outer zone 214 for the purposes of computing heater spatial density.

In the example of FIG. 2A, 12 heaters belong to inner zone 210 and 12 heaters belong to outer zone 214. Because the area of outer zone 214 is three times that of inner zone 210, because the number of heaters belonging to inner 210 and outer 214 zones is the same, the heater spatial density within inner zone 210 may be said to be three times that of outer zone 214.

In general, to compute a 'heater spatial density' of any given region (i.e. cross section of the subsurface), one (i) determines, for each heater in the formation within or relatively close to the given region, a nearest neighboring heater distance; (ii) for each heater, determines a 'immediate-neighboring-region circle' around each heater centroid (i.e. having a radius equal to one half of the distance to a nearest neighboring heater), (iii) computes, for each heater in the formation, a fraction of the immediate-neighboring-region circle located within the given region to determine the fraction (i.e. between 0 and 1) of the heater belonging to the given region; (iv) determines the total number of heaters belonging to the given region and (v) divides this number by the area of the given region.

In the example of FIG. 4A, exactly 16 heaters belong to inner zone 210 and exactly 16 heaters 'belong to' outer zone 214. Thus, in the example of FIG. 4A, a ratio between (i) a heater spatial density in inner zone 210; and (ii) a heater spatial density in outer zone 214, is exactly three.

In different embodiments, a spatial density ratio between a heater spatial density in inner zone 210 and that of outer zone 214 is at least 1.5, or at least 2, or at least 2.5 and/or at most 10 or at most 7.5 or at most 5 or at most 4.

Figure 31:
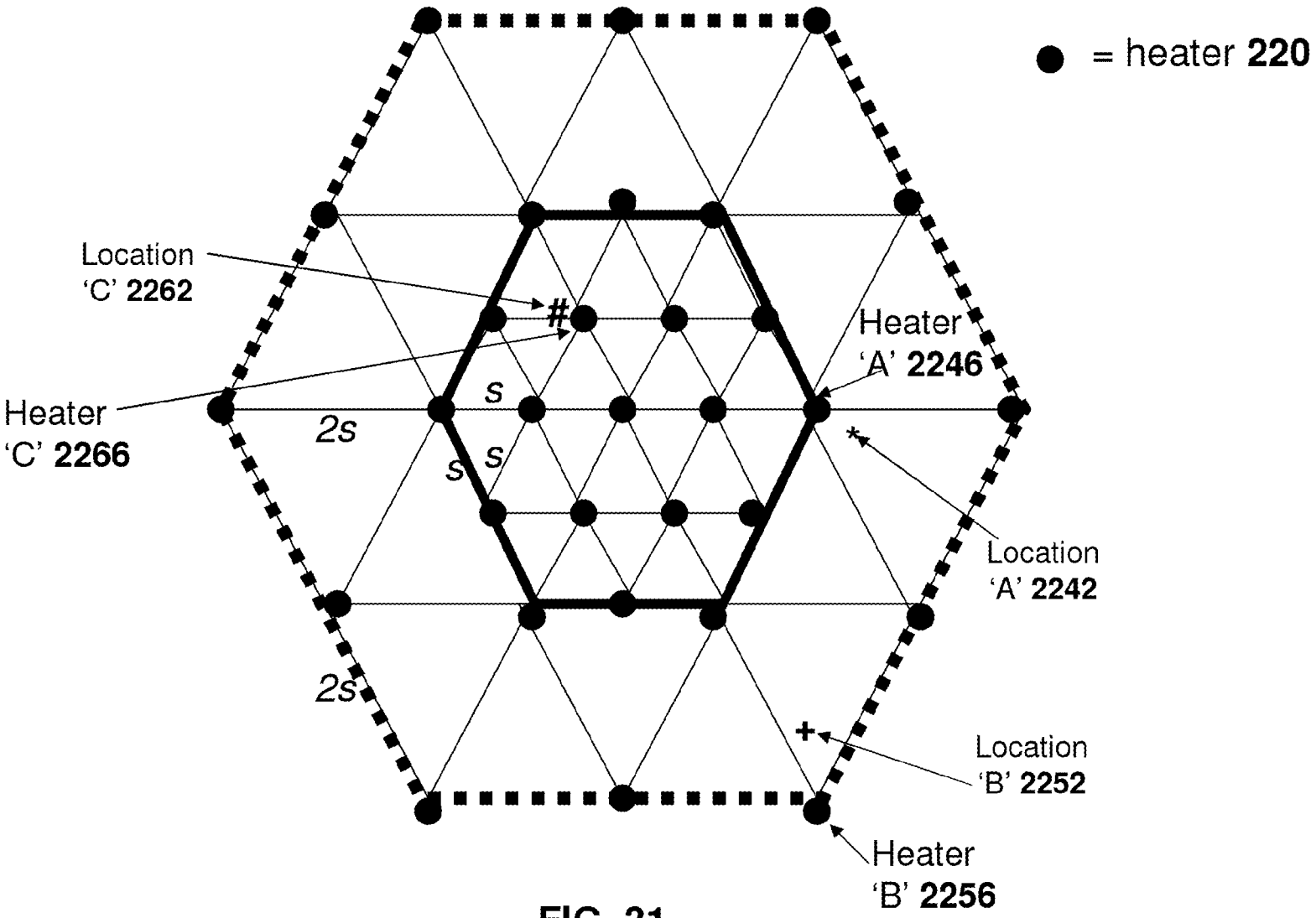

Some embodiments relate to a 'nearest heater' to a location in the subsurface formation. In the example of FIG. 31, location A 2242 (marked with a star) is closer to heater 'A' 2246 than to any other heater. Therefore, a 'distance to a nearest heater at location A' is the distance between location 'A' 2242 and heater 'A' 2246. In the example of FIG. 31, location B2252 (marked with a cross) is closer to heater 'B' 256 than to any other heater. Therefore, a 'distance to a nearest heater at location B' is the distance between location B 2252 and heater B2256. In the example of FIG. 31, location C2262 (marked with a number symbol) is closer to heater 'C' 2266 than to any other heater. Therefore, a 'distance to a nearest heater at location C' is the distance between location C 2262 and heater C 2266.

Figure 32:
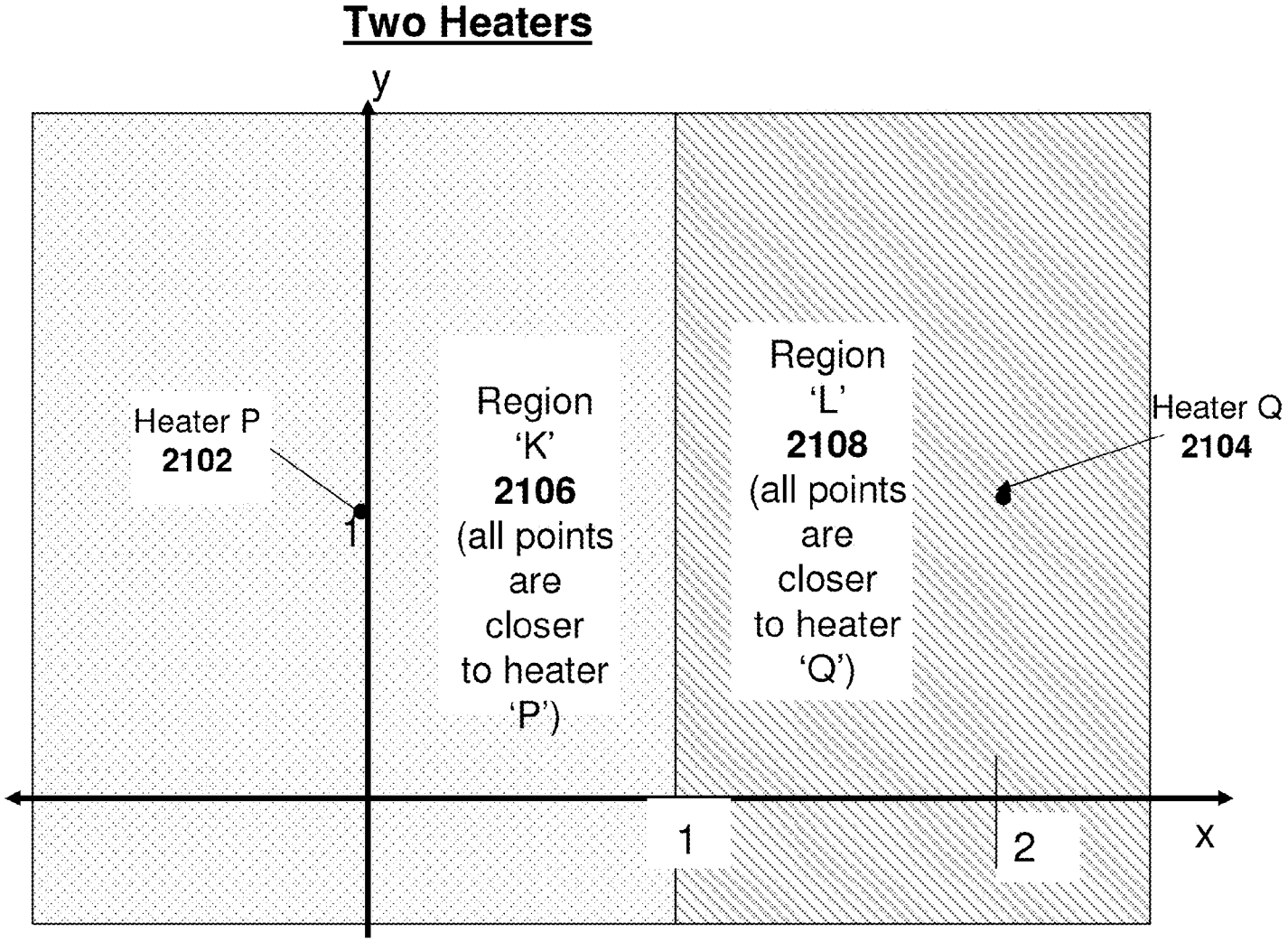

In the example of FIG. 32, exactly two heaters are arranged so that 'Heater P' 2102 is located at point (0,1) and 'Heater Q' 2104 is located at point (2,1). As such, all locations within region 'K' 2106 are closer to heater 'P' 2102 than to heater 'Q' 2104, and locations within region 'L' 2108 are closer to heater 'Q' 2104 than to heater 'P' 2102. Locations on the boundary between regions 'K' 2106 and 'L' 2108 are equidistant to the heaters.

Some embodiments relate to the 'average distance' within an area of the subsurface formation or on a curve within the surface formation (e.g. a closed curve such as a zone perimeter 204 or 208 or 202) to a nearest heater. Each location within the area of curve LOC∈AREA or LOC∈CURVE is associated with a distance to a nearest heater (or heater well)—this is the distance within the cross-section of the subsurface formation for which a heater pattern is defined to a heater centroid within the cross-section (see FIGS. 27-28). The heater which is the 'nearest heater' to the location LOC∈AREA or LOC∈CURVE within the area or on the curve is not required to be located in the 'area' AREA or curve.

Strictly speaking, an area or curve of the subsurface of formation is a locus of points. Each given point of the locus is associated with a respective distance value describing a distance to a heater closest to the given point. By averaging these values over all points in the area or on the curve it is possible to compute an average distance, within the area or on the curve, to a nearest heater.

FIGS. 33-36 illustrate some relatively simple examples.

Figure 33A:
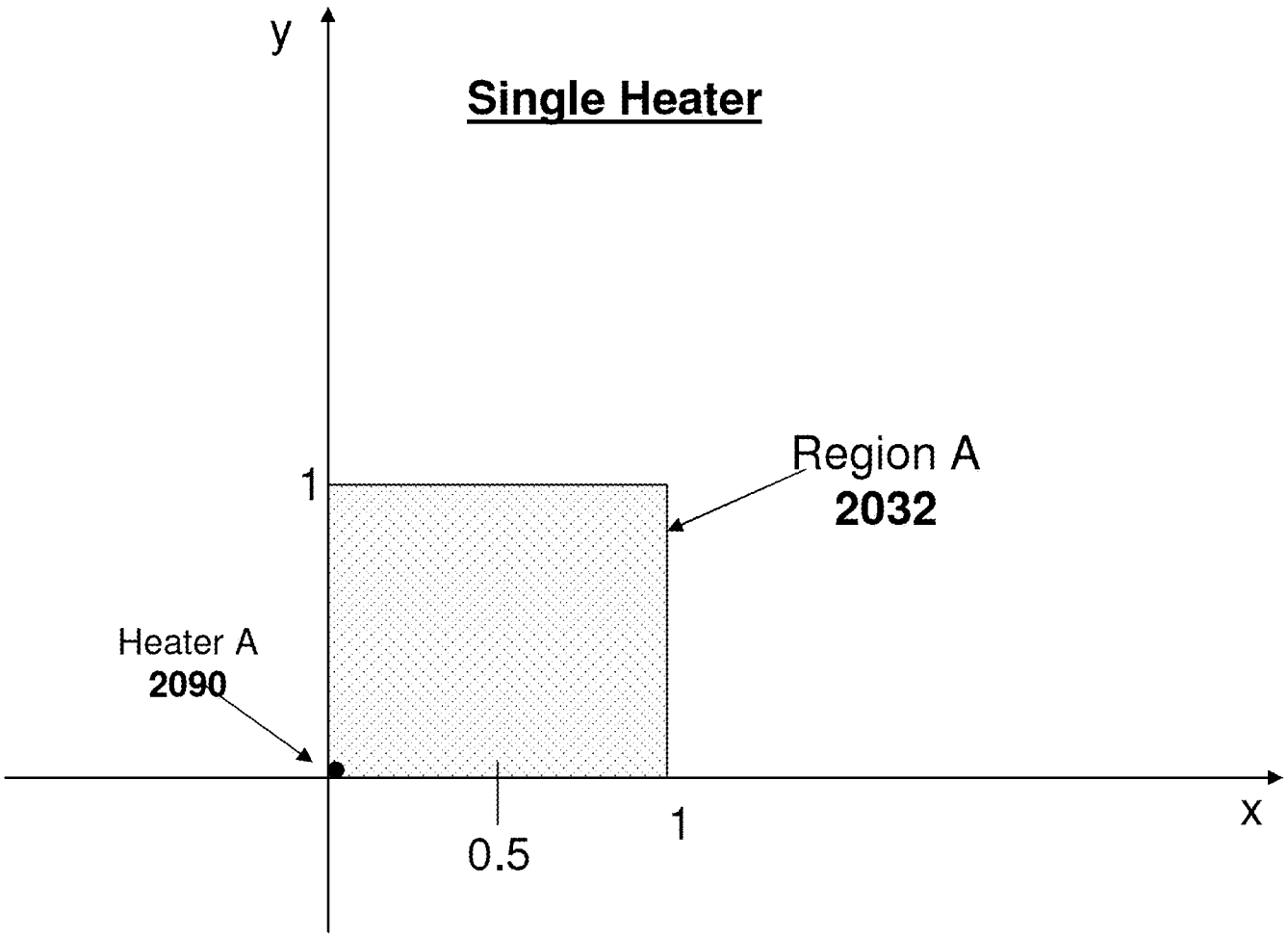

FIG. 33A illustrates a (i) single heater A 2090 situated at the origin, and (ii) Region A 2032 which is bounded by the lines x=0, x=1, y=0, y=1. In the example of FIG. 33A, for any point $(x_0,y_0)$ within Region A 2032, a distance to a nearest heater is the same as the distance to the origin, i.e. $\sqrt{(x_0)^2+(y_0)^2}$. In order to determine the average distance within Region A to a nearest heater, it is possible to compute the integral:

$$\frac{\int_{Region_A} \sqrt{(x_0)^2+(y_0)^2}\, dx dy}{|\text{Area_of_Region_A}|} = \quad \text{(EQN 2)}$$

-continued $$\frac{\int_{y=0}^{1}\int_{x=0}^{1}\sqrt{(x_0)^2+(y_0)^2}\,dx\,dy}{\int_{y=0}^{1}\int_{x=0}^{1}dx\,dy}=\frac{1}{6}\ln\left(1+\sqrt{2}\right)+\frac{\sqrt{2}}{3}-\frac{1}{12}\operatorname{arctanh}\left(\frac{\sqrt{2}}{2}\right)-\frac{1}{4}\left(\sqrt{2}-1\right)\approx 0.765$$

The 'average distance to a nearest heater' within Region A (i.e. in this case, a distance to heater A 2090 situated at the original) may be approximated by a distance between (i) a centroid of Region A 2032—i.e. the point (½,½); and (ii) heater A 2090. This distance is equal to approximately 0.71.

EQN. 2 is valid for a particular region illustrated in FIG. 33A. For any arbitrary REGION of the subsurface, an entirety of which is nearer to HEATER_H than to any other heater, the average distance to a nearest heater or AVG_NHD (NHD is an abbreviation for 'nearest heater distance') is given by:

$$\text{AVG_NHD(REGION)} = \frac{\int_{REGION} DIST(LOC, \text{HEATER_H})\,dLOC}{|\text{Area_of_REGION}|} \quad \text{(EQN 3)}$$

where LOC is a location within REGION, dLOC is the size (i.e. area or volume) of an infinitesimal portion of the subsurface formation at location LOC within REGION, and DIST(LOC,HEATER_H) is a distance between HEATER_H and location LOC.

Figure 33B:
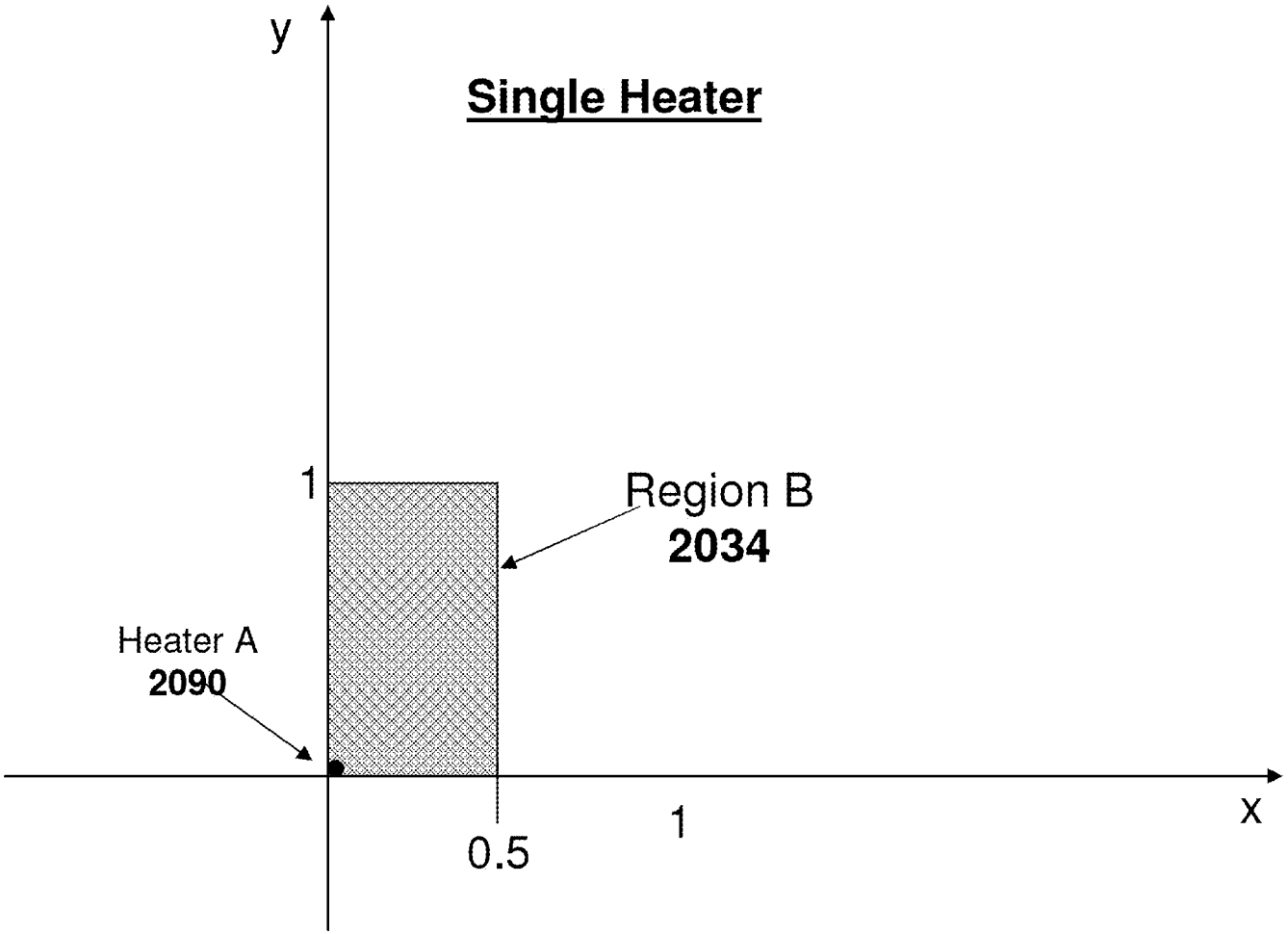

In the example of FIG. 33 only a single heater is present—i.e. Heater A 2090 situated at the origin. Region B 2032 of FIG. 33B is bounded by the lines x=0, x=0.5, y=0, y=1. For the example of FIG. 18B, EQN 2 yields AVG_NHD((Region B)=0.59. This may be approximated by a distance between a centroid of Region B and Heater A 2090, or 0.56.

EQN. 3 assumes that only a single heater is present in the subsurface formation. EQN. 3 may be generalized for a subsurface in which a heaters $\{H_1, H_2, \ldots H_i \ldots H_N\}$ (i.e. for any positive integer N) are arranged at respective locations $\{LOC(H_1), LOC(H_1), \ldots LOC(H_i), LOC(H_N).\}$. In this situation, any location LOC within the subsurface formation is associated with a respective nearest heater $H_{NEAREST}$ (LOC) that is selected from $\{H_1, H_2, \ldots H_i \ldots H_N\}$. In the example of FIG. 32, for all locations within Region K 2106, a nearest heater $H_{NEAREST}$ (LOC) is Heater P 2102 situated at (0,1). In the example of FIG. 6, for all locations within Region L 2108, a nearest heater $H_{NEAREST}$ (LOC) is Heater Q 2104 situated at (2,1).

For location LOC within the subsurface formation, a nearest heater distance NHD(LOC) is defined as DIST (LOC, $H_{NEAREST}$(LOC))—a distance between the location LOC and its associated nearest heater $H_{NEAREST}$ (LOC). Thus, EQN. 3 may be generalized as:

$$\text{AVG_NHD(REGION)} = \frac{\int_{REGION} NHD(LOC)\,dLOC}{|\text{Area_of_REGION}|}. \quad \text{(EQN. 4)}$$

For the example of FIG. 20, four heaters are arranged in the subsurface formation—Heater A 90 situated at the origin, Heater B 2092 situated at (0,2), Heater C 2094 situated at (2,2) and Heater D 2096 situated at (2,0). In this example, it is desired to compute the average heater distance within Region C 2036 defined by all locations enclosed by the four lines x=0, x=2, y=0, y=2. Region C 36 may be divided into four sub-regions A1-A4 2080, 2082, 2084, 2086. For any location $LOC_A$/in sub-region A1 2080, a nearest heater $H_{NEAREST}(LOC_{A1})$ is Heater B 2092. For any location $LOC_{A3}$ in sub-region A3 2084, a nearest heater $H_{NEAREST}$ ($LOC_{A3}$) is Heater A 90. For any location $LOC_{A2}$ in sub-region A2 2082, a nearest heater $H_{NEAREST}$ ($LOC_{A2}$) is Heater C 2094. For any location $LOC_{A4}$ in sub-region A4 2060, a nearest heater $H_{NEAREST}$ ($LOC_{A4}$) is Heater D 2096.

Figure 34:
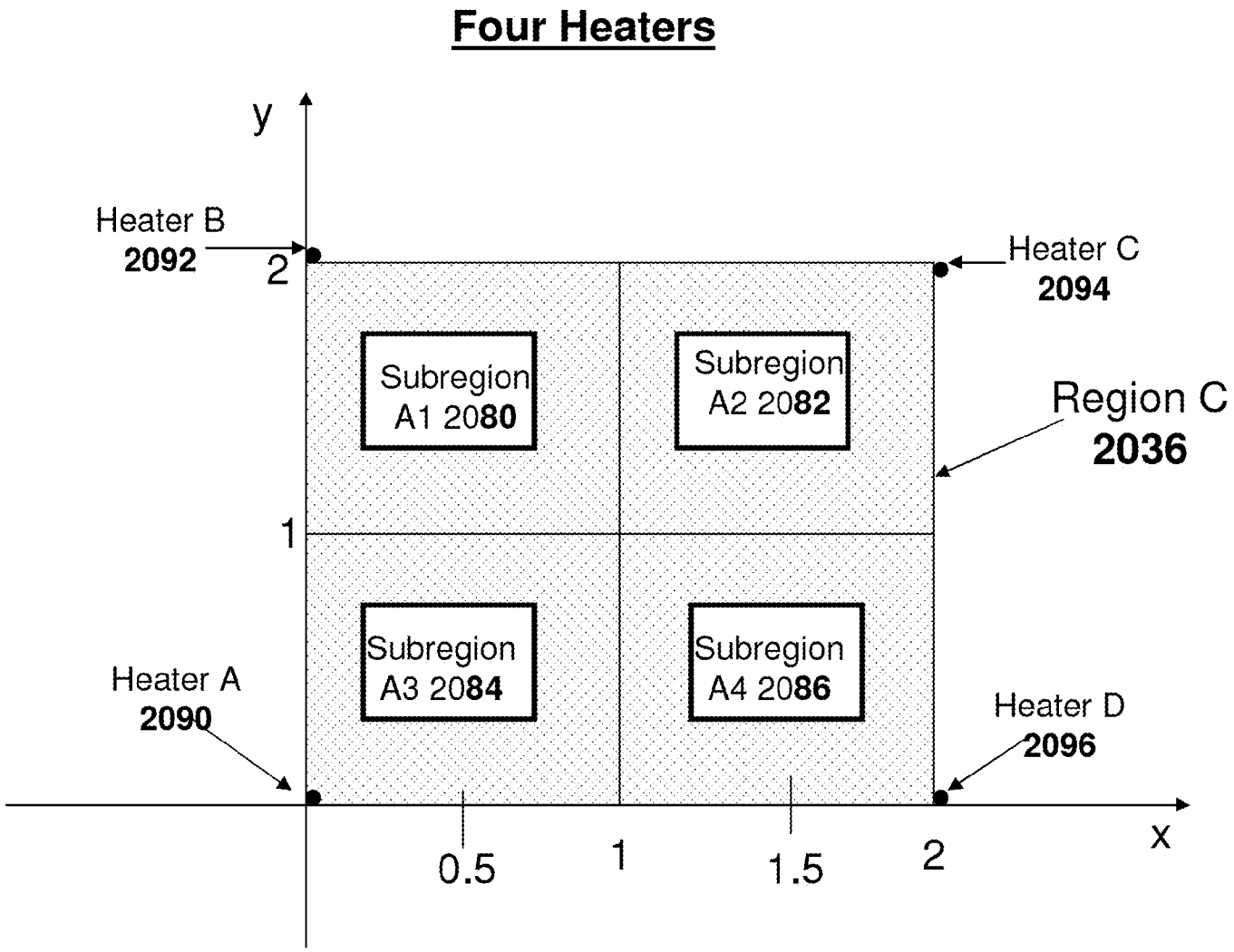

By symmetry, it is clear that the average distance to a nearest heater within Region C 2036 AVG_NHD(REGION C) of FIG. 34 is identical to the average distance to a nearest heater within Region A 2032 AVG_NHD(REGION A) of FIG. 33A, or 0.765.

Figure 35A:
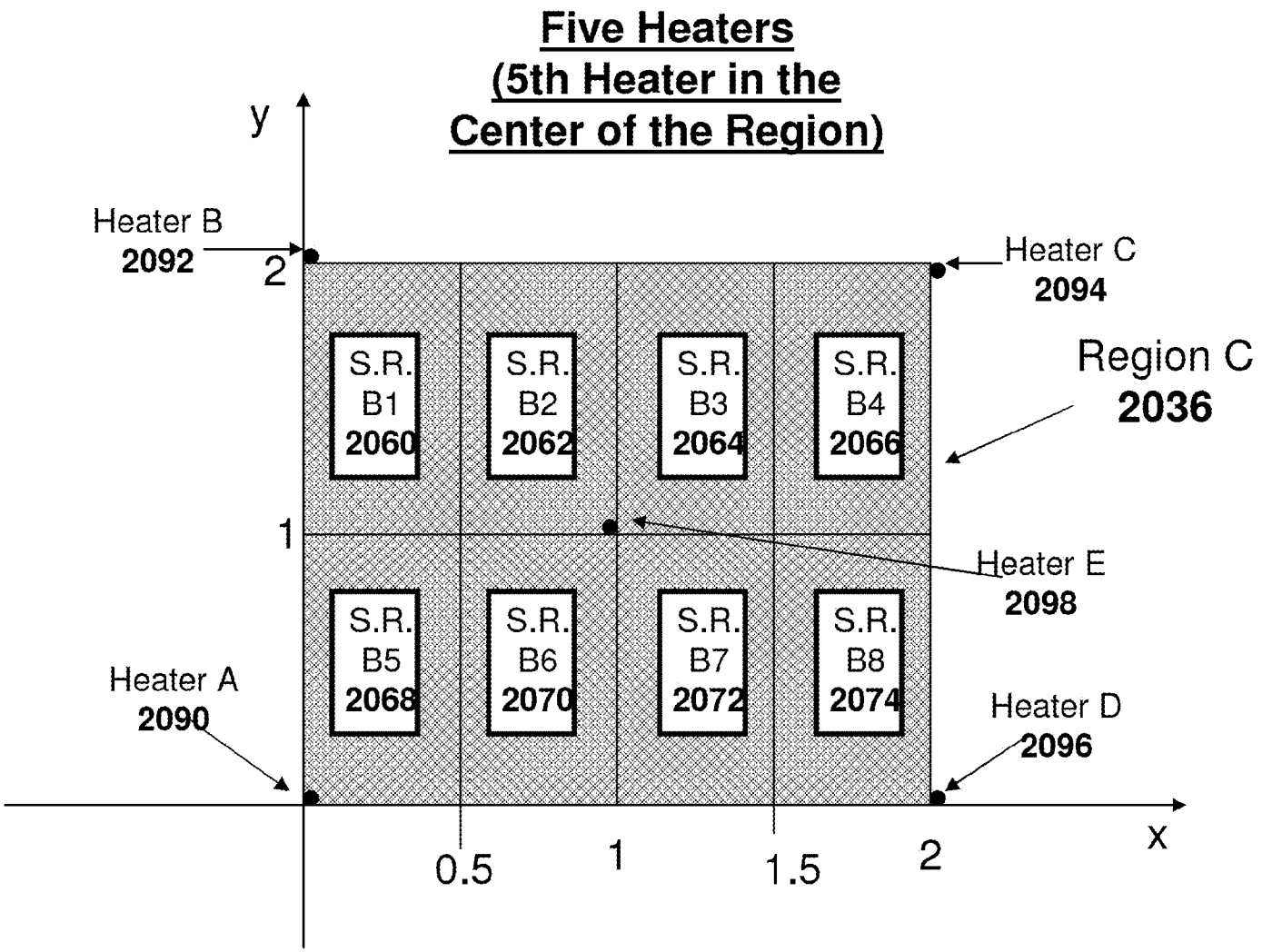

For the example of FIG. 35A, five heaters are arranged in the subsurface formation—Heater A 2090 situated at the origin, Heater B 2092 situated at (0,2), Heater C 2094 situated at (2,2), Heater D 2096 situated at (2,0) and Heater E 2098 situated at (1,1). In this example, it is desired to compute the average heater distance within Region C 2036 defined by all locations enclosed by the four lines x=0, x=2, y=0, y=2. Region C 2036 may be divided into eight sub-regions B1-B8 2060, 2062, 2064, 2066, 2068, 2072, 2074. For any location $LOC_{B1}$ in sub-region B1 2060, a 'nearest heater' $H_{NEAREST}$ ($LOC_{B1}$) is Heater B 2092. For any location $LOC_{B2}$ in sub-region B2 2062, a 'nearest heater' $H_{NEAREST}$ ($LOC_{B2}$) is Heater E 2098. For any location $LOC_{B3}$ in sub-region B3 2064, a 'nearest heater' $H_{NEAREST}$ ($LOC_{B3}$) is Heater E 2098. For any location $LOC_{B4}$ in sub-region B4 2066, a 'nearest heater' $H_{NEAREST}$ ($LOC_{B4}$) is Heater C 2094.

For any location $LOC_{B5}$ in sub-region B5 2068, a nearest heater $H_{NEAREST}$ ($LOC_{B5}$) is Heater A 2090. For any location $LOC_{B6}$ in sub-region B6 70, a nearest heater $H_{NEAREST}$ ($LOC_{B6}$) is Heater E 2098. For any location $LOC_{B7}$ in sub-region B7 2072, a nearest heater $H_{NEAREST}$ ($LOC_{B7}$) is Heater E 2098. For any location $LOC_{B8}$ in sub-region B8 2074, a nearest heater $H_{NEAREST}$ ($LOC_{B8}$) is Heater D 2096.

By symmetry, it is clear that the average distance to a nearest heater within Region C 2036 AVG_NHD(REGION C) of FIG. 35A is identical to the average distance to a nearest heater within Region B 2034 AVG_NHD(REGION B) of FIG. 33B, or 0.59.

In the example of FIG. 35A, there are four corner heaters and a fifth more central heater E 2098 situated exactly in the center of the square-shaped region. In the example of FIG. 35B, there are also four corner heaters—however, the fifth more central heater E' 98' is situated on the center of one of the square sides rather than in the center of the square. The heater density for both the example of 35A and of 35B is identical. However, the 'average distance to a nearest heater' in the example of FIG. 35B is about 0.68, or about 15% greater than that of the example of FIG. 35A. This is due to the less uniform distribution of heaters within Region C 2038 in the example of FIG. 35B.

The aforementioned examples relate to the average distance to a nearest heater within an area of the sub-formation formation. It is also possible to compute the 'average distance to a nearest heater' for any set of points—for example, along a line, or along a curve, or along the perimeter of a polygon.

Figure 36:
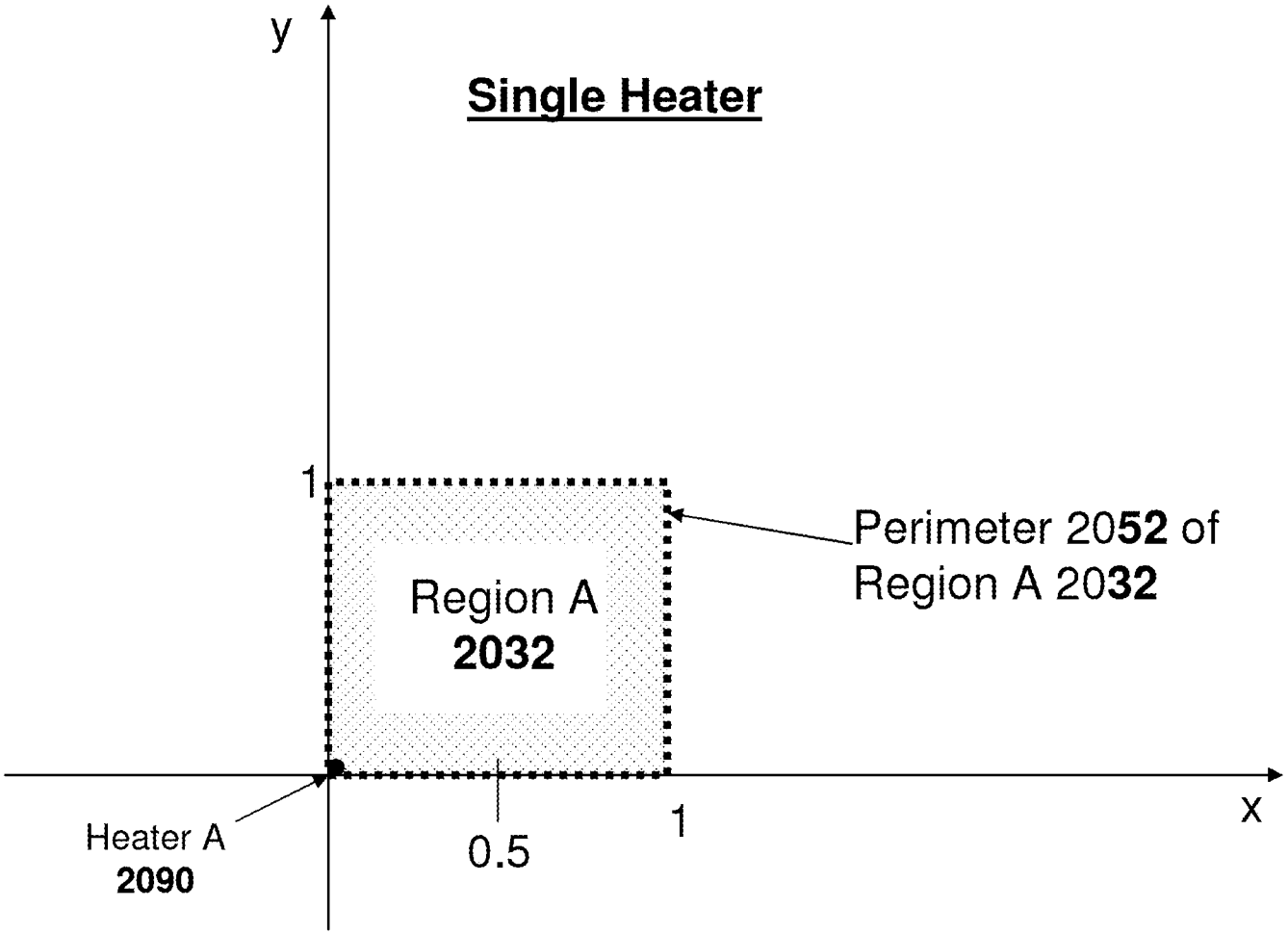

In the example of FIG. 36 (i.e. in this example, exactly one heater is situated in the subsurface formation), the 'average distance to a nearest heater' along the perimeter 2052 of region A 2032 is given by:

$$\frac{\int_0^1 y\,dy + \int_{x=0}^1 \sqrt{(x)^2+1}\,dx + \int_{y=0}^1 \sqrt{(y)^2+1}\,dy + \int_0^1 x\,dx}{4} = \frac{\int_{x=0}^1 \sqrt{(x)^2+1}\,dx + \int_0^1 x\,dx}{2} \approx 1.15 \quad \text{(EQN. 5)}$$

In general, for a curve (e.g. a closed curve) C, the average distance to a nearest heater $$\text{AVG_NHD(ALONG_CURVE_C)} = \frac{\int_{CURVE_C} NHD(LOC)\,dLOC}{|\text{Length_of_Curve_C1}|} \quad \text{(EQN. 6)}$$

where location LOC is a location on Curve C. One example of a Curve is inner zone or outer zone perimeters 204, 208.

Figure 37A:
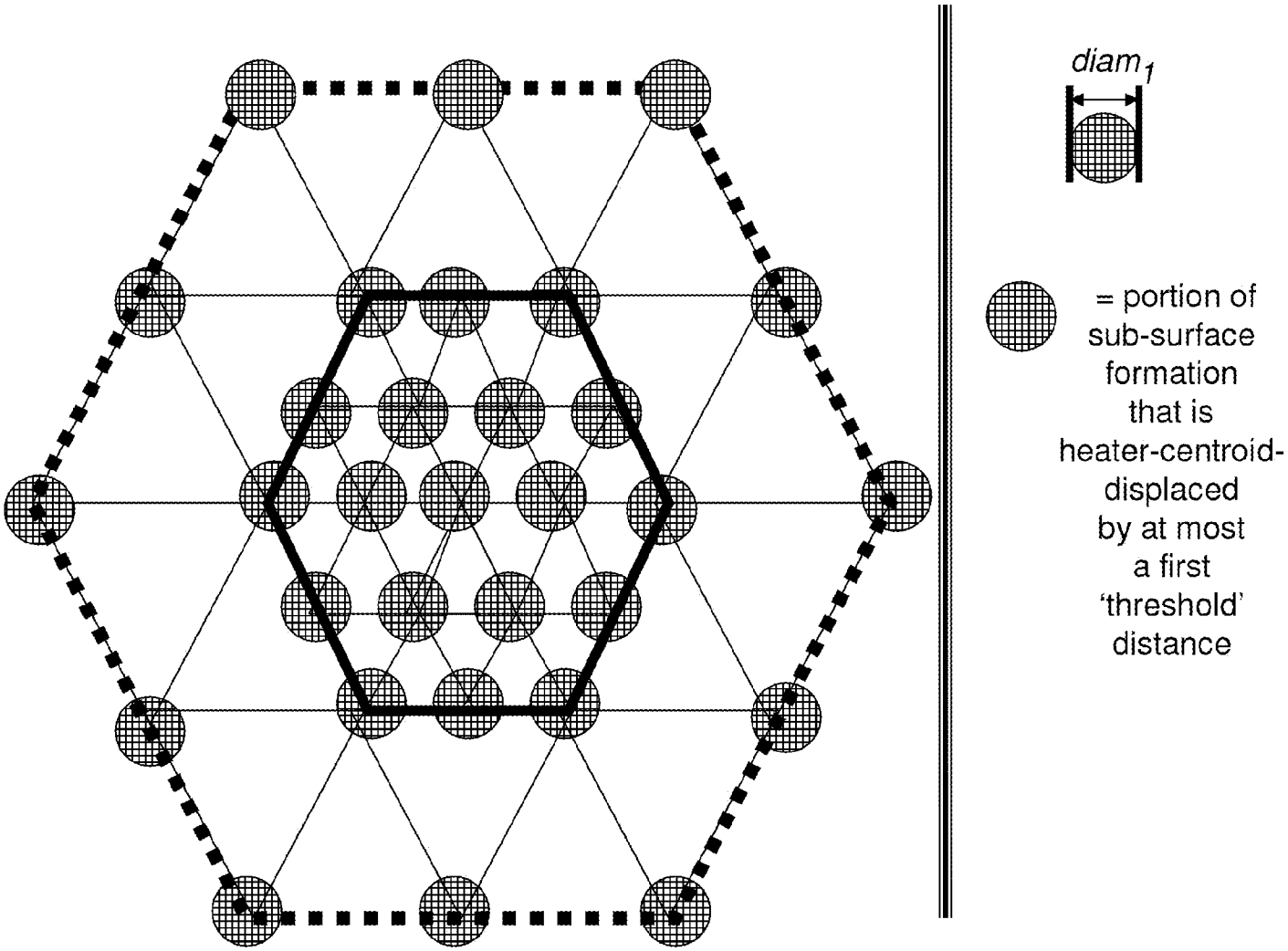

FIG. 37A illustrates fractions of inner 210 and outer 214 zones (and perimeters 204, 208 thereof) that are heater-displaced or heater-centroid-displaced by at most a first threshold distance; $diam_1/2$. $Diam_1$ is the diameter of a circle centered around each heater centroid 310. Shaded locations in FIG. 15A are those portions of inner and outer zones which are displaced from a centroid 310 of one or more of the heaters 210 by less than a distance $Diam_1$. In the example of FIG. 15, each shaded circle has an area that is around 3-5% of the area of inner zone 210.

Because a significant number of heaters are located throughout inner zone 210, the fraction of inner zone 210 that is shaded is significant—e.g. at least 30% or at least 40% or at least 50% or at least 60% or at least 70% of the area of inner zone 210. Because a significant number of heaters are located around an entirety of inner perimeter 204, the fraction of inner perimeter 204 that is shaded is significant—e.g. at least 30% or at least 40% or at least 50% or at least 60% or at least 70% of the length of inner perimeter 204. In contrast, due to the much lower heater density in outer zone 210, a much smaller fraction of outer zone 210 is shaded.

Figure 37B:
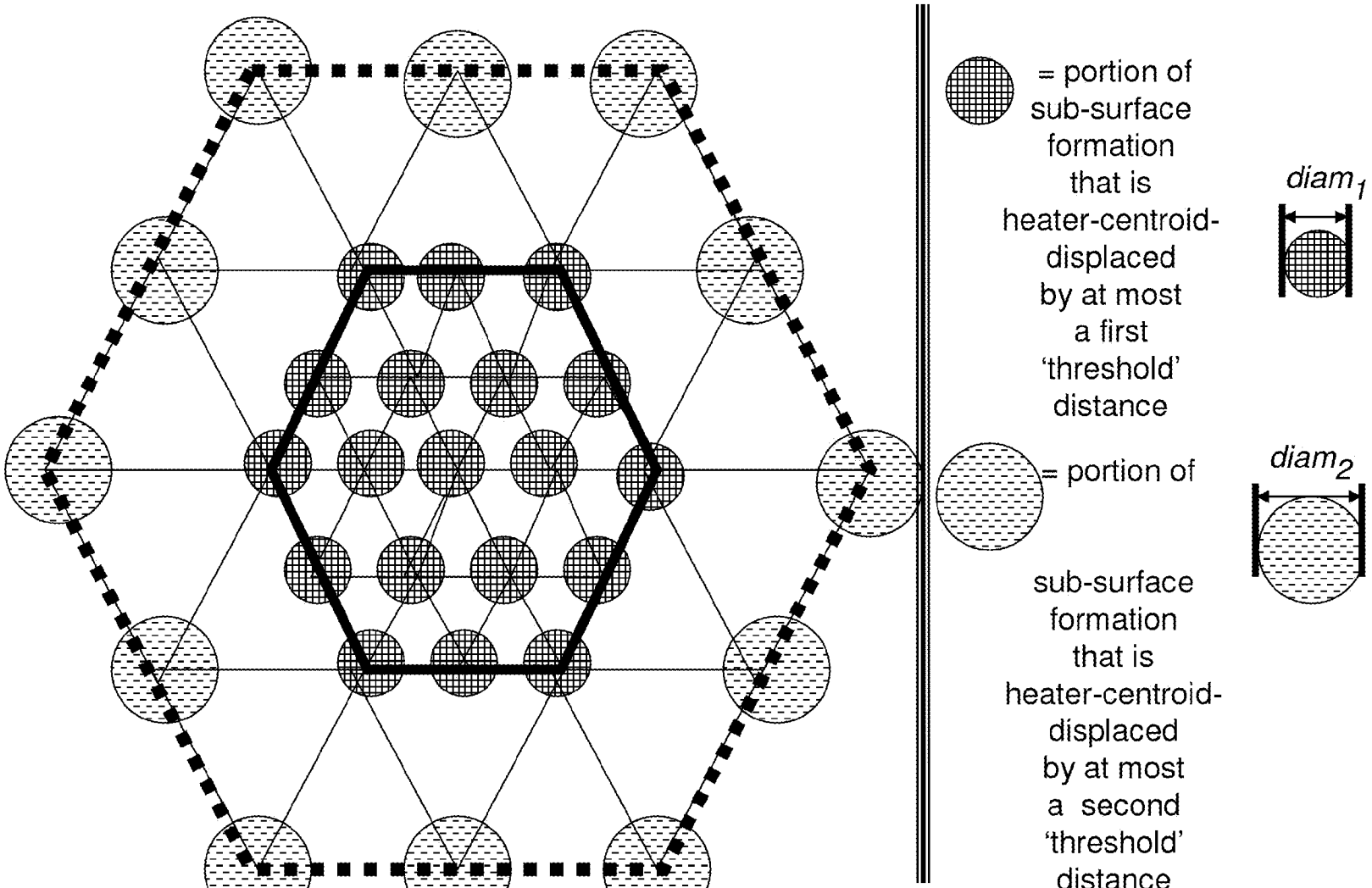

In the example of FIG. 37B, it is shown that when the threshold distance is increased from a first to a second threshold distance, the portion of the outer perimeter 208 that is heater-displaced or 'heater-centroid-displaced' by at most the second threshold distance is significant—e.g. at least 30% or at least 40% or at least 50% or at least 60% or at least 70% of the length of outer perimeter 208.

In one example, the area of the circle defining locations (e.g. see the shaded circles of FIG. 37A) within the subsurface formation (i.e. in the plane in which a heater pattern is defined) is exactly 5% of the area of inner zone 210. In this case, the radius of inner zone 210 equals $$\sqrt{\frac{0.05}{\pi}}$$

or about 12.6% (or about one-eighth) of the square root of the area of inner zone 210, where the square root of the area of inner zone 210 has dimensions of length.

Embodiments of the present invention relate to apparatus and methods whereby, for a cross-section of the subsurface formation, and for a threshold length or threshold distance that is equal to one-eighth of the area of inner zone 204, (i) a significant fraction of inner zone 210 is covered by the shaded circles having a radius equal to the threshold distance and an area equal to about 5% of the area of inner zone 204; (ii) only a significantly smaller fraction of outer zone 214 is covered by the shaded circles having a radius equal to the same threshold distance, due to the much lower heater density. In some embodiments, a significant fraction of the length of inner perimeter 204 is covered by shaded circles. In some embodiments, for a second threshold distance equal to twice the aforementioned 'threshold distance' (e.g. equal to one quarter of the square root of the area of inner zone 210), a 'significant fraction' of the length of outer perimeter 208 is covered by shaded circles.

In one example, it is possible to set a threshold distance or threshold length to one-eighth of the area of inner zone 204 so that a magnitude of an area enclosed by a circle whose radius is the 'threshold distance' is equal to 5% of that of the inner zone 204.

According to this threshold distance, for the heater patterns illustrated in FIG. 5A, (i) more than 50% (for example, about 60%) of inner zone 210 is heater-displaced or 'heater-centroid-displaced by less than this threshold distance, and (ii) a much smaller fraction, i.e. about 15-20% of outer zone 214 is displaced by less than this threshold distance. For the example of FIG. 3A, according to this threshold distance, (i) well over two-thirds of inner zone 210 is heater-displaced or heater-centroid displaced by less than this threshold distance; and (ii) a much smaller fraction, about a third, of outer zone 210 is heater-displaced by less than this threshold distance.

In both examples, a ratio between (i) a fraction of inner zone 210 that is heater-displaced or heater-centroid displaced by at most the threshold distance; and (ii) a fraction of outer zone 214 that is heater-displaced or heater-centroid displaced by at most the threshold distance is at least 1.2 or at least 1.25 or at least 1.3 or at least 1.4 or at least 1.5 or at least 1.6 or at least 1.8 or at least 1.9.

In the example of FIG. 37A, about 60% of a length of inner perimeter 204 is heater-displaced or heater-centroid-displaced by at most this threshold distance and about 60% of a length of outer perimeter 208 is heater-displaced or heater-centroid-displaced by at most twice this threshold distance. In some embodiments, over 75% of a length of inner perimeter 204 is heater-displaced or heater-centroid-displaced by at most this threshold distance and over 75% of a length of outer perimeter 208 is heater-displaced or heater-centroid-displaced by at most twice this threshold distance.

Embodiments of the present invention refer to 'control apparatus.' Control apparatus may include any combination of analog or digital circuitry (e.g. current or voltage or electrical power regulator(s) or electronic timing circuitry) and/or computer-executable code and/or mechanical apparatus (e.g. flow regulator(s) or pressure regulator(s) or valve(s) or temperature regulator(s)) or any monitoring devices (e.g. for measuring temperature or pressure) and/or other apparatus.

Control apparatus may regulate any combination of one or more operating parameters including but not limited to an amount of electrical power delivered to an electrical heater, or a flow rate or temperature of a heat transfer fluid (e.g. molten salt or carbon dioxide or synthetic oil) delivered to a subsurface heater, or a flow rate of hydrocarbon formation fluids within a production well.

The skilled artisan will appreciate that control apparatus may include one or more component(s) or element(s) not explicitly listed herein. Furthermore, the skilled artisan will appreciate that one portion or combination of element(s) of "control apparatus" which regulates one element of the hydrocarbon fluid system may electronically communicate with any portion of combination of element(s)—e.g. wired or wireless computer network or in any other manner known to those skilled in the art. Control apparatus may include an element, or combination of element(s), or portions thereof, illustrated, for example, in FIG. 38 or in any other figure.

FIG. 38 illustrates a schematic of an embodiment used to control an in situ conversion process (ICP) in formation 678. Barrier well 518, monitor well 2616, production well 2512, and/or heater well 520 may be placed in formation 2678. Barrier well 2518 may be used to control water conditions within formation 2678. Monitoring well 2616 may be used to monitor subsurface conditions in the formation, such as, but not limited to, pressure, temperature, product quality, or fracture progression. Production well 2512 may be used to produce formation fluids (e.g., oil, gas, and water) from the formation. Heater well 2520 may be used to provide heat to the formation. Formation conditions such as, but not limited to, pressure, temperature, fracture progression (monitored, for instance, by acoustical sensor data), and fluid quality (e.g., product quality or water quality) may be monitored through one or more of wells 2512, 2518, 2520, and 2616.

Surface data such as, but not limited to, pump status (e.g., pump on or off), fluid flow rate, surface pressure/temperature, and/or heater power may be monitored by instruments placed at each well or certain wells. Similarly, subsurface data such as, but not limited to, pressure, temperature, fluid quality, and acoustical sensor data may be monitored by instruments placed at each well or certain wells. Surface data 2680 from barrier well 2518 may include pump status, flow rate, and surface pressure/temperature. Surface data 2682 from production well 2512 may include pump status, flow rate, and surface pressure/temperature. Subsurface data 2684 from barrier well 2518 may include pressure, temperature, water quality, and acoustical sensor data. Subsurface data 2686 from monitoring well 2616 may include pressure, temperature, product quality, and acoustical sensor data. Subsurface data 2688 from production well 2512 may include pressure, temperature, product quality, and acoustical sensor data. Subsurface data 2690 from heater well 2520 may include pressure, temperature, and acoustical sensor data.

Surface data 2680 and 2682 and subsurface data 2684, 2686, 2688, and 2690 may be monitored as analog data 2692 from one or more measuring instruments. Analog data 2692 may be converted to digital data 2694 in analog-to-digital converter 2696. Digital data 694 may be provided to computational system 2626. Alternatively, one or more measuring instruments may provide digital data to computational system 2626. Computational system 2626 may include a distributed central processing unit (CPU). Computational system 2626 may process digital data 694 to interpret analog data 2692. Output from computational system 2626 may be provided to remote display 2698, data storage 2700, display 2666, or to treatment facility 516. Treatment facility 2516 may include, for example, a hydrotreating plant, a liquid processing plant, or a gas processing plant. Computational system 2626 may provide digital output 2702 to digital-to-analog converter 2704. Digital-to-analog converter 2704 may convert digital output 2702 to analog output 2706.

Analog output 2706 may include instructions to control one or more conditions of formation 2678. Analog output 2706 may include instructions to control the ICP within formation 2678. Analog output 2706 may include instructions to adjust one or more parameters of the ICP. The one or more parameters may include, but are not limited to, pressure, temperature, product composition, and product quality. Analog output 2706 may include instructions for control of pump status 2708 or flow rate 2710 at barrier well 2518. Analog output 2706 may include instructions for control of pump status 2712 or flow rate 2714 at production well 2512. Analog output 2706 may also include instructions for control of heater power 2716 at heater well 2520. Analog output 2706 may include instructions to vary one or more conditions such as pump status, flow rate, or heater power. Analog output 2706 may also include instructions to turn on and/or off pumps, heaters, or monitoring instruments located at each well.

Remote input data 2718 may also be provided to computational system 2626 to control conditions within formation 2678. Remote input data 2718 may include data used to adjust conditions of formation 2678. Remote input data 2718 may include data such as, but not limited to, electricity cost, gas or oil prices, pipeline tariffs, data from simulations, plant emissions, or refinery availability. Remote input data 2718 may be used by computational system 2626 to adjust digital output 2702 to a desired value. In some embodiments, treatment facility data 2720 may be provided to computational system 2626.

An in situ conversion process (ICP) may be monitored using a feedback control process, feedforward control process, or other type of control process. Conditions within a formation may be monitored and used within the feedback control process. A formation being treated using an in situ conversion process may undergo changes in mechanical properties due to the conversion of solids and viscous liquids to vapors, fracture propagation (e.g., to overburden, underburden, water tables, etc.), increases in permeability or porosity and decreases in density, moisture evaporation, and/or thermal instability of matrix minerals (leading to dehydration and decarbonation reactions and shifts in stable mineral assemblages).

Remote monitoring techniques that will sense these changes in reservoir properties may include, but are not limited to, 4D (4 dimension) time lapse seismic monitoring, 3D/3C (3 dimension/3 component) seismic passive acoustic monitoring of fracturing, time lapse 3D seismic passive acoustic monitoring of fracturing, electrical resistivity, thermal mapping, surface or downhole tilt meters, surveying permanent surface monuments, chemical sniffing or laser sensors for surface gas abundance, and gravimetrics. More direct subsurface-based monitoring techniques may include high temperature downhole instrumentation (such as thermocouples and other temperature sensing mechanisms, pressure sensors such as hydrophones, stress sensors, or instrumentation in the producer well to detect gas flows on a finely incremental basis). In certain embodiments, a "base" seismic monitoring may be conducted, and then subsequent seismic results can be compared to determine changes.

U.S. Pat. No. 6,456,566 issued to Aronstam; U.S. Pat. No. 5,418,335 issued to Winbow; and U.S. Pat. No. 4,879,696 issued to Kostelnicek et al. and U.S. Statutory Invention Registration H1561 to Thompson describe seismic sources for use in active acoustic monitoring of subsurface geophysical phenomena. A time-lapse profile may be generated to monitor temporal and areal changes in a hydrocarbon containing formation. In some embodiments, active acoustic monitoring may be used to obtain baseline geological information before treatment of a formation. During treatment of a formation, active and/or passive acoustic monitoring may be used to monitor changes within the formation.

Simulation methods on a computer system may be used to model an in situ process for treating a formation. Simulations may determine and/or predict operating conditions (e.g., pressure, temperature, etc.), products that may be produced from the formation at given operating conditions, and/or product characteristics (e.g., API gravity, aromatic to paraffin ratio, etc.) for the process. In certain embodiments, a computer simulation may be used to model fluid mechanics (including mass transfer and heat transfer) and kinetics within the formation to determine characteristics of products produced during heating of the formation. A formation may be modeled using commercially available simulation programs such as STARS, THERM, FLUENT, or CFX. In addition, combinations of simulation programs may be used to more accurately determine or predict characteristics of the in situ process. Results of the simulations may be used to determine operating conditions within the formation prior to actual treatment of the formation. Results of the simulations may also be used to adjust operating conditions during treatment of the formation based on a change in a property of the formation and/or a change in a desired property of a product produced from the formation.

Figure 39:
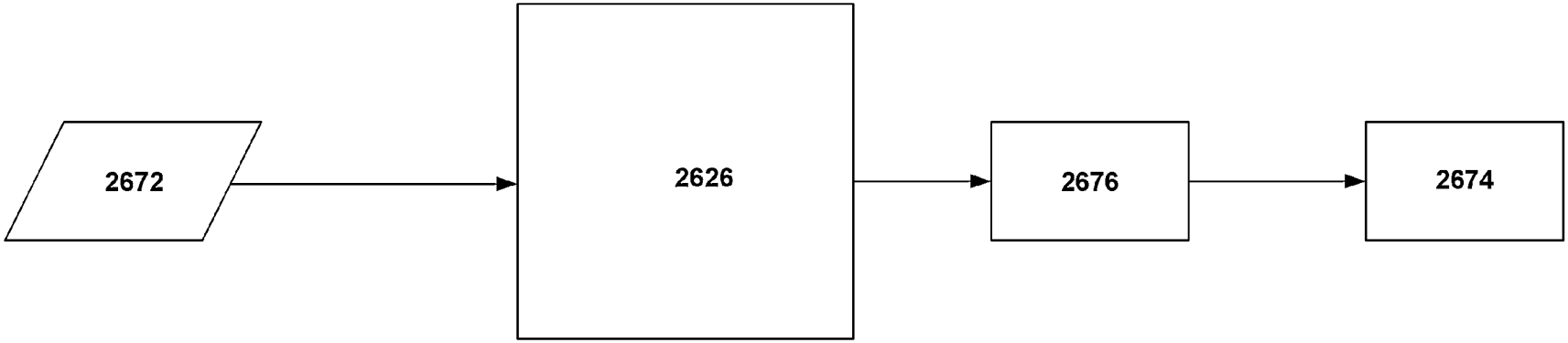
Figure 40:
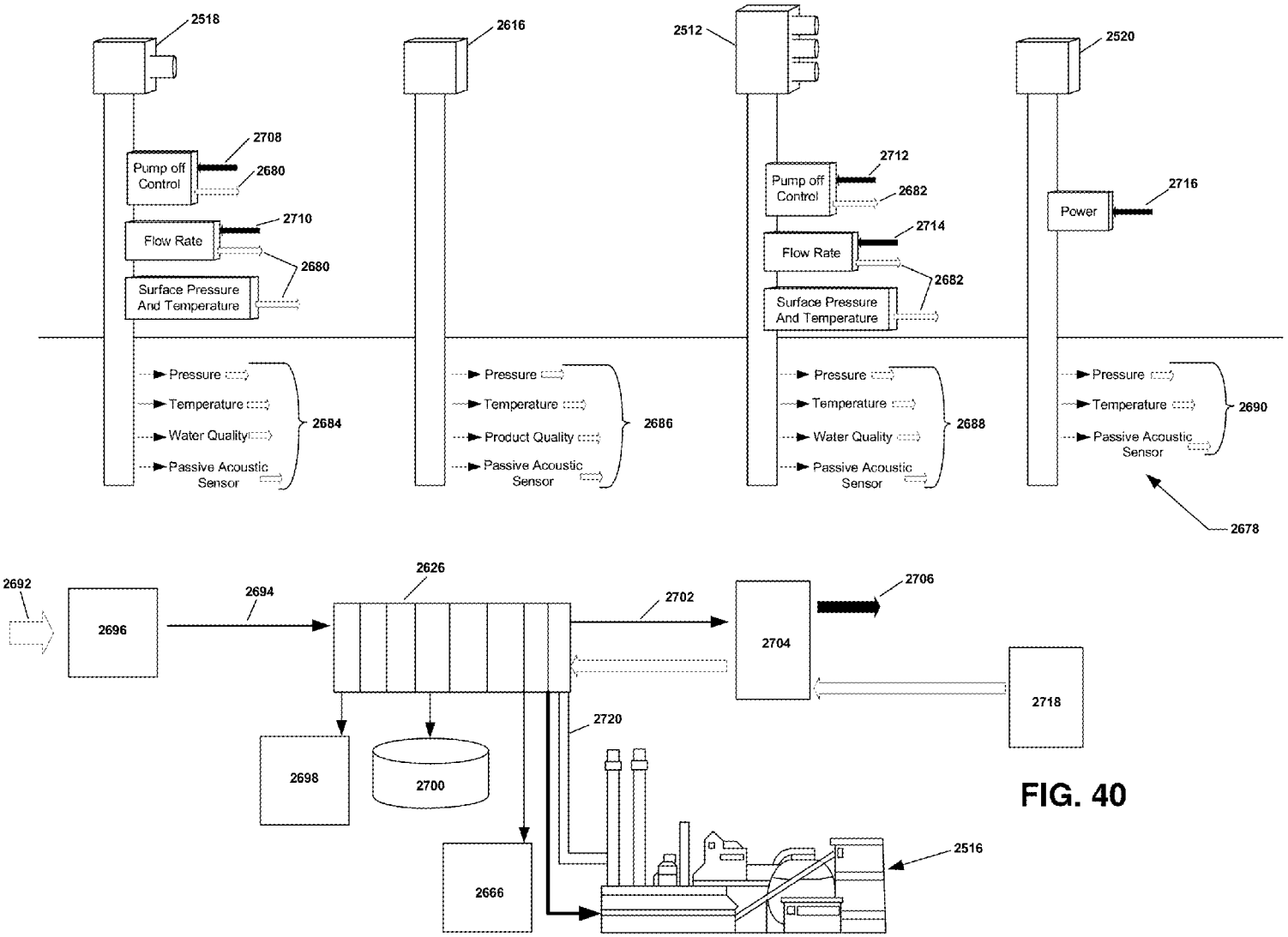

FIGS. 39 and 40 illustrates an embodiment of method 2722 for modeling an in situ process for treating a hydrocarbon containing formation using a computer system. Method 2722 may include providing at least one property 2724 of the formation to the computer system. Properties of the formation may include, but are not limited to, porosity, permeability, saturation, thermal conductivity, volumetric heat capacity, compressibility, composition, and number and types of phases in the formation. Properties may also include chemical components, chemical reactions, and kinetic parameters. At least one operating condition 2726 of the process may also be provided to the computer system. For instance, operating conditions may include, but are not limited to, pressure, temperature, heating rate, heat input rate, process time, weight percentage of gases, production characteristics (e.g., flow rates, locations, compositions), and peripheral water recovery or injection. In addition, operating conditions may include characteristics of the well pattern such as producer well location, producer well orientation, ratio of producer wells to heater wells, heater well spacing, type of heater well pattern, heater well orientation, and distance between an overburden and horizontal heater wells.

Method 2722 may include assessing at least one process characteristic 2728 of the in situ process using simulation method 2730 on the computer system. At least one process characteristic may be assessed as a function of time from at least one property of the formation and at least one operating condition. Process characteristics may include, but are not limited to, properties of a produced fluid such as API gravity, olefin content, carbon number distribution, ethene to ethane ratio, atomic carbon to hydrogen ratio, and ratio of non-condensable hydrocarbons to condensable hydrocarbons (gas/oil ratio). Process characteristics may include, but are not limited to, a pressure and temperature in the formation, total mass recovery from the formation, and/or production rate of fluid produced from the formation.

In some embodiments, simulation method 2730 may include a numerical simulation method used/performed on the computer system. The numerical simulation method may employ finite difference methods to solve fluid mechanics, heat transfer, and chemical reaction equations as a function of time. A finite difference method may use a body-fitted grid system with unstructured grids to model a formation. An unstructured grid employs a wide variety of shapes to model a formation geometry, in contrast to a structured grid. A body-fitted finite difference simulation method may calculate fluid flow and heat transfer in a formation. Heat transfer mechanisms may include conduction, convection, and radiation. The body-fitted finite difference simulation method may also be used to treat chemical reactions in the formation. Simulations with a finite difference simulation method may employ closed value thermal conduction equations to calculate heat transfer and temperature distributions in the formation. A finite difference simulation method may determine values for heat injection rate data.

In an embodiment, a body-fitted finite difference simulation method may be well suited for simulating systems that include sharp interfaces in physical properties or conditions. A body-fitted finite difference simulation method may be more accurate, in certain circumstances, than space-fitted methods due to the use of finer, unstructured grids in body-fitted methods. For instance, it may be advantageous to use a body-fitted finite difference simulation method to calculate heat transfer in a heater well and in the region near or close to a heater well. The temperature profile in and near a heater well may be relatively sharp. A region near a heater well may be referred to as a "near wellbore region." The size or radius of a near wellbore region may depend on the type of formation. A general criteria for determining or estimating the radius of a "near wellbore region" may be a distance at which heat transfer by the mechanism of convection contributes significantly to overall heat transfer. Heat transfer in the near wellbore region is typically limited to contributions from conductive and/or radiative heat transfer. Convective heat transfer tends to contribute significantly to overall heat transfer at locations where fluids flow within the formation (i.e., convective heat transfer is significant where the flow of mass contributes to heat transfer).

Some embodiments relate to patterns of heaters and/or production wells and/or injection wells. Some embodiments relate to methods of hydrocarbon fluid production and/or methods of heating a subsurface formation. Unless specified otherwise, any feature or combination of feature(s) relating to heater and/or production well locations or patterns may be provided in combination with any method disclosed herein even if not explicitly specified herein. Furthermore, a number of methods are disclosed within the present disclosure, each providing its own set of respective features. Unless specified otherwise, in some embodiments, any feature(s) of any one method may be combined with feature(s) of any other method, even if not explicitly specified herein.

Furthermore, any 'control apparatus' may be programmed to carry out any method or combination thereof disclosed herein.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

All references cited herein are incorporated by reference in their entirety. Citation of a reference does not constitute an admission that the reference is prior art.

The articles "a" and "an" are used herein to refer to one or to more than one. (i.e., to at least one) of the grammatical object of the article. By way of example, "an element" means one element or more than one element.

The term "including" is used herein to mean, and is used interchangeably with, the phrase "including but not limited" to.

The term "or" is used herein to mean, and is used interchangeably with, the term "and/or," unless context clearly indicates otherwise.

The term "such as" is used herein to mean, and is used interchangeably, with the phrase "such as but not limited to".

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art.

What is claimed is:

1. A system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters of the outer and inner zones is between two and seven, heaters being located at all polygon vertices of inner and outer zone perimeters, inner zone and outer zone heaters being respectively distributed around inner and outer zone centroids such that an average heater spacing in outer zone significantly exceeds that of inner zone, each heater cell further comprising inner-zone production well(s) and outer-zone production well(s) respectively located in the inner and outer zones.

2. The system of claim 1 wherein at least some production wells of the outer zone are disposed on an equilateral triangle.

3. The system of claim 1 wherein a number of production wells in the outer zone exceeds that of the inner zone.

4. The system of claim 1 wherein a spacing ratio between an average heater spacing of the outer zone and that of the inner zone is about equal to a square root of the area ratio between respective areas enclosed by the inner zone and outer zone perimeters.

5. The system of claim 1 wherein an average heater spacing in the outer zone is about twice that of the inner zone.

6. The system of claim 5 wherein the inner and outer zones are like-shaped.

7. The system of claim 1 wherein at least 20% of inner zone heaters are interior-of-inner-zone heaters located within the inner zone and away from a perimeter of the inner zone.

8. The system of claim 1 wherein a centroid of the more inner zone is located in a central portion of the region enclosed by a perimeter of the more outer zone.

9. The system of claim 1 wherein the ratio between areas enclosed by the outer and inner perimeters is at most 5.

10. The system of claim 1 further comprising control apparatus configured to regulate heater operation times so that, on average, heaters in outer zone operate above a one-half maximum power level for at least twice as long as the heaters in inner zone.

11. The system of claim 1 wherein an aspect ratio of the inner zone is at most 2.

12. A system for in-situ production of hydrocarbon fluids from a subsurface hydrocarbon-containing formation, the system comprising:

a heater cell divided into nested inner and outer zones such that an enclosed area ratio between respective areas enclosed by substantially-convex polygon-shaped perimeters of the outer and inner zones is between two and seven, heaters being located at all polygon vertices of inner and outer zone perimeters, inner zone and outer zone heaters being respectively distributed around inner and outer zone centroids such that an average heater spacing in outer zone significantly exceeds that of inner zone, a majority of the heaters in the inner zone being electric heaters and a majority of the heaters in the outer zone being non-electric heaters or combustion-based heaters or advection-based heaters.

13. The system of claim 12 at least two-thirds of the heaters in the inner zone are electrical heaters and at least two-thirds of the heaters in the outer zone are non-electric heaters or combustion-based heaters or advection-based heaters.

14. The system of claim 12 wherein a spacing ratio between an average heater spacing of the outer zone and that of the inner zone is about equal to a square root of the area ratio between respective areas enclosed by the inner zone and outer zone perimeters.

15. The system of claim 14 wherein an average heater spacing in the outer zone is about twice that of the inner zone.

16. The system of claim 12 wherein the inner and outer zones are like-shaped.

17. A system for in-situ production of hydrocarbon fluids from a subsurface hydrocarbon-containing formation, the system comprising:

a heater cell divided into nested, inner, outer and outer-zone-surrounding (OZS) additional zones by respective polygon-shaped zone perimeters, heaters being located at all polygon vertices of inner, outer and OZS additional zone perimeters, the inner and outer zones defining a first zone pair, the outer and OZS additional zones defining a second zone pair, inner zone heaters, outer zone heaters and OZS additional zone heaters being respectively distributed around inner zone, outer zone and OZS additional zone centroids, wherein for each of the zone pairs:

i. an enclosed area ratio between respective areas enclosed by perimeters of the more outer zone and the more inner zone is between two and seven; and ii. a heater spacing of the more outer zone significantly exceeds that of the more inner zone.

18. The system of claim 17 wherein production well(s) are respectively located in each of the inner zone, the outer zone and the OZS additional zone.

19. The system of claim 17 wherein for each of the zone pairs:

spacing ratio between an average heater spacing of the more outer zone and that of the more inner zone is about equal to a square root of the area ratio between respective areas enclosed by the more inner zone and more outer zone perimeters.

* * * * *